US007377623B2

(12) United States Patent
Silverbrook et al.

(10) Patent No.: US 7,377,623 B2
(45) Date of Patent: May 27, 2008

(54) PRINTHEAD HEATERS WITH A NANOCRYSTALLINE COMPOSITE STRUCTURE

(75) Inventors: Kia Silverbrook, Balmain (AU); Gregory John McAvoy, Dublin (IE); Angus John North, Balmain (AU)

(73) Assignee: Silverbrook Research Pty Ltd, Balmain, New South Wales (AU)

( * ) Notice: Subject to any disclaimer, the term of this patent is extended or adjusted under 35 U.S.C. 154(b) by 375 days.

(21) Appl. No.: 11/097,213

(22) Filed: Apr. 4, 2005

(65) Prior Publication Data

US 2006/0221134 A1 Oct. 5, 2006

(51) Int. Cl.
*B41J 2/05* (2006.01)
*B41J 2/04* (2006.01)

(52) U.S. Cl. ..... 347/56; 347/54

(58) Field of Classification Search ..... 347/61–62
See application file for complete search history.

(56) References Cited

U.S. PATENT DOCUMENTS 4,990,939 A * 2/1991 Sekiya et al. ..... 347/62
5,132,711 A * 7/1992 Shinada et al. ..... 347/6
6,003,977 A * 12/1999 Weber et al. ..... 347/63
6,336,713 B1 * 1/2002 Regan et al. ..... 347/62
6,482,574 B1 * 11/2002 Ramaswami et al. ..... 430/320
6,598,960 B1 7/2003 Cabal et al.
6,818,959 B2 11/2004 Montelius et al.
7,070,262 B2 * 7/2006 Yamamoto et al. ..... 347/63
2004/0001121 A1 1/2004 Kameda et al.
2004/0090495 A1 5/2004 Delametter et al.

OTHER PUBLICATIONS

Zbigniew Suszynski, Miroslaw Malinski, and Leszek Bychto, "Thermal Parameters Measurment Method of Electronics Materials", Sep. 1998, IEEE Transactions on components, packaging, and manufacturing technology-Part A, vol. 21, No. 3, pp. 425-426.*
"Silicon Carbide", Nov. 2, 2002, [online] Retrieved from Internet URL: www.accuratus.com/silicar.html, pp. 1-2.*

* cited by examiner

*Primary Examiner*—Matthew Luu
*Assistant Examiner*—Lisa M Solomon

(57) ABSTRACT

A thermal inkjet printhead with bubble forming heater elements formed from a material with a nanocrystalline composite structure.

Nanocrystalline composite films can be superhard and can facilitate removal of the SiC and Ta anti-cavitation wear coatings. Improved oxidation resistance can also be achieved with some nanocrystalline composites, facilitating removal of the $Si_3N_4$ oxidation prevention coating. By removing or reducing the protective coatings, the heater element requires much less energy to form a bubble in the ink. A further benefit is improved crack resistance, which can extend the lifetime of uncoated heaters.

16 Claims, 72 Drawing Sheets

PRINTHEAD HEATERS WITH A NANOCRYSTALLINE COMPOSITE STRUCTURE

FIELD OF THE INVENTION

The present invention relates to inkjet printers and in particular, inkjet printheads that generate vapor bubbles to eject droplets of ink.

CO-PENDING APPLICATIONS

The following applications have been filed by the Applicant simultaneously with the present application:

| | | | | | |
|---|---|---|---|---|---|
| 11/097308 | 11/097309 | 7246876 | 11/097299 | 11/097310 | 11/097212 |

The disclosures of these co-pending applications are incorporated herein by reference.

CROSS REFERENCES TO RELATED APPLICATIONS

The following patents or patent applications filed by the applicant or assignee of the present invention are hereby incorporated by cross-reference.

| | | | | | |
|---|---|---|---|---|---|
| 6750901 | 6476863 | 6788336 | 11/003786 | 11/003616 | 11/003418 |
| 11/003334 | 11/003600 | 11/003404 | 11/003419 | 11/003700 | 11/003601 |
| 11/003618 | 7229148 | 11/003337 | 11/003698 | 11/003420 | 6984017 |
| 11/003699 | 11/071473 | 11/003463 | 11/003701 | 11/003683 | 11/003614 |
| 11/003702 | 11/003684 | 7246875 | 11/003617 | 6623101 | 6406129 |
| 6505916 | 6457809 | 6550895 | 6457812 | 7152962 | 6428133 |
| 7204941 | 10/815624 | 10/815628 | 10/913375 | 10/913373 | 10/913374 |
| 10/913372 | 7138391 | 7153956 | 10/913380 | 10/913379 | 10/913376 |
| 7122076 | 7148345 | 10/407212 | 7156508 | 7159972 | 7083271 |
| 7165834 | 7080894 | 7201469 | 7090336 | 7156489 | 10/760233 |
| 10/760246 | 7083257 | 10/760243 | 10/760201 | 7219980 | 10/760253 |
| 10/760255 | 10/760209 | 7118192 | 10/760194 | 10/760238 | 7077505 |
| 7198354 | 7077504 | 10/760189 | 7198355 | 10/760232 | 10/760231 |
| 7152959 | 7213906 | 7178901 | 7222938 | 7108353 | 7104629 |
| 7246886 | 7128400 | 7108355 | 6991322 | 10/729790 | 7118197 |
| 10/728970 | 10/728784 | 10/728783 | 7077493 | 6962402 | 10/728803 |
| 7147308 | 10/728779 | 7118198 | 7168790 | 7172270 | 7229155 |
| 6830318 | 7195342 | 7175261 | 10/773183 | 7108356 | 7118202 |
| 10/773186 | 7134744 | 10/773185 | 7134743 | 7182439 | 7210768 |
| 10/773187 | 7134745 | 7156484 | 7118201 | 7111926 | 10/773184 |
| 7018021 | 11/060751 | 11/060805 | 09/575197 | 7079712 | 6825945 |
| 09/575165 | 6813039 | 6987506 | 7038797 | 6980318 | 6816274 |
| 7102772 | 09/575186 | 6681045 | 6728000 | 7173722 | 7088459 |
| 09/575181 | 7068382 | 7062651 | 6789194 | 6789191 | 6644642 |
| 6502614 | 6622999 | 6669385 | 6549935 | 6987573 | 6727996 |
| 6591884 | 6439706 | 6760119 | 09/575198 | 6290349 | 6428155 |
| 6785016 | 6870966 | 6822639 | 6737591 | 7055739 | 7233320 |
| 6830196 | 6832717 | 6957768 | 7170499 | 7106888 | 7123239 |
| 10/727181 | 10/727162 | 10/727163 | 10/727245 | 7121639 | 7165824 |
| 7152942 | 10/727157 | 7181572 | 7096137 | 10/727257 | 10/727238 |
| 7188282 | 10/727159 | 10/727180 | 10/727179 | 10/727192 | 10/727274 |
| 10/727164 | 10/727161 | 10/727198 | 10/727158 | 10/754536 | 10/754938 |
| 10/727227 | 10/727160 | 10/934720 | 10/296522 | 6795215 | 7070098 |
| 7154638 | 6805419 | 6859289 | 6977751 | 6398332 | 6394573 |
| 6622923 | 6747760 | 6921144 | 10/884881 | 7092112 | 7192106 |
| 10/854521 | 10/854522 | 10/854488 | 10/854487 | 10/854503 | 10/854504 |
| 10/854509 | 7188928 | 7093989 | 10/854497 | 10/854495 | 10/854498 |
| 10/854511 | 10/854512 | 10/854525 | 10/854526 | 10/854516 | 10/854508 |
| 10/854507 | 10/854515 | 10/854506 | 10/854505 | 10/854493 | 10/854494 |
| 10/854489 | 10/854490 | 10/854492 | 10/854491 | 10/854528 | 10/854523 |
| 10/854527 | 10/854524 | 10/854520 | 10/854514 | 10/854519 | 10/854513 |
| 10/854499 | 10/854501 | 10/854500 | 7243193 | 10/854518 | 10/854517 |
| 10/934628 | 10/760254 | 10/760210 | 10/760202 | 7201468 | 10/760198 |
| 10/760249 | 7234802 | 10/760196 | 10/760247 | 7156511 | 10/760264 |

-continued

| | | | | | |
|---|---|---|---|---|---|
| 10/760244 | 7097291 | 10/760222 | 10/760248 | 7083273 | 10/760192 |
| 10/760203 | 10/760204 | 10/760205 | 10/760206 | 10/760267 | 10/760270 |
| 7198352 | 10/760271 | 10/760275 | 7201470 | 7121655 | 10/760184 |
| 7232208 | 10/760186 | 10/760261 | 7083272 | 11/014764 | 11/014763 |
| 11/014748 | 11/014747 | 11/014761 | 11/014760 | 11/014757 | 11/014714 |
| 7249822 | 11/014762 | 11/014724 | 11/014723 | 11/014756 | 11/014736 |
| 11/014759 | 11/014758 | 11/014725 | 11/014739 | 11/014738 | 11/014737 |
| 11/014726 | 11/014745 | 11/014712 | 11/014715 | 11/014751 | 11/014735 |
| 11/014734 | 11/014719 | 11/014750 | 11/014749 | 7249833 | 11/014769 |
| 11/014729 | 11/014743 | 11/014733 | 11/014754 | 11/014755 | 11/014765 |
| 11/014766 | 11/014740 | 11/014720 | 11/014753 | 11/014752 | 11/014744 |
| 11/014741 | 11/014768 | 11/014767 | 11/014718 | 11/014717 | 11/014716 |
| 11/014732 | 11/014742 | | | | |

BACKGROUND TO THE INVENTION

The present invention involves the ejection of ink drops by way of forming gas or vapor bubbles in a bubble forming liquid. This principle is generally described in U.S. Pat. No. 3,747,120 to Stemme.

There are various known types of thermal ink jet (bubble-jet) printhead devices. Two typical devices of this type, one made by Hewlett Packard and the other by Canon, have ink ejection nozzles and chambers for storing ink adjacent the nozzles. Each chamber is covered by a so-called nozzle plate, which is a separately fabricated item and which is mechanically secured to the walls of the chamber. In certain prior art devices, the top plate is made of Kapton™ which is a Dupont trade name for a polyimide film, which has been laser-drilled to form the nozzles. These devices also include heater elements in thermal contact with ink that is disposed adjacent the nozzles, for heating the ink thereby forming gas bubbles in the ink. The gas bubbles generate pressures in the ink causing ink drops to be ejected through the nozzles.

Before printing, the chambers need to be primed with ink. During operation, the chambers may deprime. If the chamber is not primed the nozzle will not eject ink. Thus it is useful to detect the presence or absence of ink in the chambers. However, the microscopic scale of the chambers and nozzles makes the incorporation of sensors difficult and adds extra complexity to the fabrication process.

The resistive heaters operate in an extremely harsh environment. They must heat and cool in rapid succession to form bubbles in the ejectable liquid, usually a water soluble ink. These conditions are highly conducive to the oxidation and corrosion of the heater material. Dissolved oxygen in the ink can attack the heater surface and oxidise the heater material. In extreme circumstances, the heaters 'burn out' whereby complete oxidation of parts of the heater breaks the heating circuit.

The heater can also be eroded by 'cavitation' caused by the severe hydraulic forces associated with the surface tension of a collapsing bubble.

To protect against the effects of oxidation, corrosion and cavitation on the heater material, inkjet manufacturers use stacked protective layers, typically made from $Si_3N_4$, SiC and Ta. In certain prior art devices, the protective layers are relatively thick. U.S. Pat. No. 6,786,575 to Anderson et al (assigned to Lexmark) for example, has 0.7 μm of protective layers for a ~0.1 μm thick heater.

To form a vapor bubble in the bubble forming liquid, the surface of the protective layers in contact with the bubble forming liquid must be heated to the superheat limit of the liquid (~300° C. for water). This requires that the heater and the entire thickness of its protective layers be heated to 300°

C. If the protective layers are much thicker than the heater, they will absorb a lot more heat. If this heat cannot be dissipated between successive firings of the nozzle, the ink in the nozzles will boil continuously and the nozzles will stop ejecting. Consequently, the heat absorbed by the protective layers limits the density of the nozzles on the printhead and the nozzle firing rate. This in turn has an impact on the print resolution, the printhead size, the print speed and the manufacturing costs.

Attempts to increase nozzle density and firing rate are hindered by limitations on thermal conduction out of the printhead integrated circuit (chip), which is currently the primary cooling mechanism of printheads on the market. Existing printheads on the market require a large heat sink to dissipate heat absorbed from the printhead IC.

Inkjet printheads can also suffer from nozzle clogging from dried ink. During periods of inactivity, evaporation of the volatile component of the bubble forming liquid will occur at the liquid-air interface in the nozzle. This will decrease the concentration of the volatile component in the liquid near the heater and increase the viscosity of the liquid in the chamber. The decrease in concentration of the volatile component will result in the production of less vapor in the bubble, so the bubble impulse (pressure integrated over area and time) will be reduced: this will decrease the momentum of ink forced through the nozzle and the likelihood of drop break-off. The increase in viscosity will also decrease the momentum of ink forced through the nozzle and increase the critical wavelength for the Rayleigh Taylor instability governing drop break-off, decreasing the likelihood of drop break-off. If the nozzle is left idle for too long, the nozzle is unable to eject the liquid in the chamber. Hence each nozzle has a maximum time that it can remain unfired before evaporation will clog the nozzle.

OBJECT OF THE INVENTION

The present invention aims to overcome or ameliorate some of the problems of the prior art, or at least provide a useful alternative.

SUMMARY OF THE INVENTION

According to a first aspect, the present invention provides an inkjet printhead comprising:

a plurality of nozzles;

a bubble forming chamber corresponding to each of the nozzles respectively, the bubble forming chambers adapted to contain ejectable liquid; and, a heater element disposed in each of the bubble forming chambers respectively, the heater element configured for heating some of the ejectable liquid above its boiling point to form a gas bubble that causes the ejection of a drop of the ejectable liquid from the nozzle; wherein, the heater element is formed from a material with a nanocrystalline composite structure.

Nanocrystalline composite films are made from two or more phases, where at least one of the phases is nanocrystalline. The other phases may be nanocrystalline or amorphous. They can be designed to be superhard (>40 GPa) and the hardness of the film significantly exceeds the hardness of constituent phases in isolation. The advantage of nanocrystalline composite films in their application to inkjet heaters is their superhardness can facilitate removal of the SiC and Ta anti-cavitation wear coatings, since the heater itself can be made significantly harder and therefore more cavitation resistant than either of those coatings. Improved oxidation resistance can also be achieved with some nanocrystalline composites, facilitating removal of the $Si_3N_4$ oxidation prevention coating. By removing or reducing the protective coatings, the heater element requires much less energy to form a bubble in the ink. A further benefit is improved crack resistance, which can extend the lifetime of uncoated heaters.

Preferably, the nanocrystalline composite has one or more nanocrystalline phases embedded in an amorphous phase.

In some preferred embodiments, at least one of the nanocrystalline phases is a transition metal nitride, a transition metal silicide, a transition metal boride or a transition metal carbide. In some embodiments, the amorphous phase is non-metallic. The amorphous phase may be a nitride, a carbide, carbon or an oxide. Optionally, the nitride is:

silicon nitride;

boron nitride; or, aluminium nitride;

the carbide is:

silicon carbide;

the oxide is;

silicon oxide;

aluminium oxide; or, chromium oxide.

Optionally, the transition metal is one of Ti, Ta, W, Ni, Zr, Cr, Hf, V, Nb, or Mo.

In a particularly preferred embodiment, the heater element is formed from TiAlSiN.

In a first aspect there is provided a fluid sensor for detecting fluid in a device having a fluid chamber, the sensor comprising:

a MEMS sensing element formed of conductive material having a resistance that is a function of temperature, the MEMS sensing element having electrical contacts for connection to an electrical power source for heating the sensing element with an electrical signal; and control circuitry for measuring the current passing through the sensing element during heating of the sensing element; such that, the control circuitry is configured to determine the temperature of the sensing element from the known applied voltage, the measured current and the known relationship between the current, resistance and temperature.

Optionally the MEMS sensing element is a beam structure that is suspended in the flow path of the fluid.

Optionally the device is an inkjet printhead and the fluid chamber is an ink chamber with an ink inlet and an ejection nozzle, such that the beam structure extends into the chamber for immersion in ink when the printhead is primed.

Optionally the beam structure is a heater element for raising the temperature of part of the ink above its boiling point to form a vapor bubble that causes a drop of ink to be ejected through the nozzle.

Optionally the bubble generated by the heater subsequently collapses to a bubble collapse point, and the heater element is shaped in a topologically open or closed loop such that the bubble collapse point is spaced from the heater element.

Optionally each heater element requires an actuation energy of less than 500 nanojoules (nJ) to heat that heater element sufficiently to form said bubble causing the ejection of said drop.

Optionally each heater element requires an actuation energy of less than 200 nJ to heat that heater element sufficiently to form said bubble causing the ejection of said drop.

Optionally each heater element requires an actuation energy of less than 80 nJ to heat that heater element sufficiently to form said bubble causing the ejection of said drop.

In a second aspect there is provided an inkjet printhead comprising:

a plurality of nozzles;

a bubble forming chamber corresponding to each of the nozzles respectively, the bubble forming chambers adapted to contain ejectable liquid; and, a heater element disposed in each of the bubble forming chambers respectively, the heater element configured for thermal contact with the ejectable liquid; such that, heating the heater element to a temperature above the boiling point of the ejectable liquid forms a gas bubble that causes the ejection of a drop of the ejectable liquid from the nozzle; wherein, the heater element has a protective surface coating that is less than 0.1 μm thick; and, is able to eject more than one billion drops.

Optionally the heater element has no protective surface coating.

Optionally the heater element forms a self passivating surface oxide layer.

Optionally the heater element has a surface area between 80 $\mu m^2$ and 120 $\mu m^2$.

Optionally the heater element thickness is between 0.8 μm to 1.2 μm.

Optionally each heater element requires an actuation energy of less than 500 nanojoules (nJ) to heat that heater element sufficiently to form said bubble causing the ejection of said drop.

Optionally the actuation energy is less than 200 nJ.

Optionally the actuation energy is less than 80 nJ.

In a third aspect the present invention provides an inkjet printhead for printing onto a media substrate, the printhead comprising:

a plurality of nozzles;

a bubble forming chamber corresponding to each of the nozzles respectively, the bubble forming chambers adapted to contain ejectable liquid;

a heater element positioned in each of the bubble forming chambers respectively for heating the ejectable liquid to form a gas bubble that causes the ejection of a drop of the ejectable liquid from the nozzle; and, a print engine controller for controlling the operation of the heater elements; wherein during use, the print engine controller heats the ejectable liquid with the heater element to lower its viscosity prior to a print job; and during printing, the print engine controller ensures that the time interval between successive actuations of each of the heater elements is less than the decap time.

Optionally the print engine controller is programmed such that any drops of the ejectable liquid ejected solely to ensure that the time interval between successive actuations is less than the decap time, do not print onto the media substrate being printed.

Optionally the media substrate is a series of separate pages that are fed passed the nozzles wherein, the drops of the ejectable liquid ejected solely to ensure that the time interval between successive actuations is less than the predetermined time, are ejected into gaps between successive pages as they are fed passed the nozzles.

Optionally the heater element is configured for receiving an energizing pulse to form the bubble, the energizing pulse having duration less than 1.5 μs.

Optionally the bubble formed by the heater element subsequently collapses to a bubble collapse point, and the heater element is shaped in a topologically open or closed loop such that the bubble collapse point is spaced from the heater element.

Optionally each of the heater elements has an actuation energy that is less than the maximum amount of thermal energy that can be removed by the drop, being the energy required to heat a volume of the ejectable liquid equivalent to the drop volume from the temperature at which the liquid enters the printhead to the heterogeneous boiling point of the ejectable liquid.

Optionally each heater element requires an actuation energy of less than 500 nanojoules (nJ) to heat that heater element sufficiently to form said bubble causing the ejection of said drop.

Optionally each heater element requires an actuation energy of less than 200 nJ to heat that heater element sufficiently to form said bubble causing the ejection of said drop.

In a fourth aspect the present invention provides an inkjet printhead comprising:

a plurality of nozzles;

a bubble forming chamber corresponding to each of the nozzles respectively, the bubble forming chambers adapted to contain ejectable liquid; and, a heater element disposed in each of the bubble forming chambers respectively, the heater element configured for heating some of the ejectable liquid above its boiling point to form a gas bubble that causes the ejection of a drop of the ejectable liquid from the nozzle; wherein, the heater element is formed from a transition metal nitride with an additive whose oxidation is thermodynamically favored above all other elements in the transition metal nitride, such that the heater element is self passivating.

Optionally the additive is aluminium.

Optionally the additive is chromium.

Optionally the self passivating transition metal nitride is TiAlN.

Optionally the inkjet printhead further comprising control circuitry for driving the heater elements with a driver voltage of approximately 3.3 Volts, wherein the self passivating transition metal nitride has a resistivity between 1.5 μOhm·m to 8 μOhm·m.

Optionally the inkjet printhead further comprising control circuitry for driving the heater elements with a driver voltage of approximately 5 Volts, wherein the self passivating transition metal nitride has a resistivity between 1.5 μOhm·m to 30 μOhm·m.

Optionally the inkjet printhead further comprising control circuitry for driving the heater elements with a driver voltage of approximately 12 Volts, wherein the self passivating transition metal nitride has a resistivity between 6 μOhm·m to 150 μOhm·m.

Optionally each heater element requires an actuation energy of less than 500 nanojoules (nJ) to heat that heater element sufficiently to form said bubble causing the ejection of said drop.

In a fifth aspect the present invention provides an inkjet printhead comprising:

a plurality of nozzles;

a bubble forming chamber corresponding to each of the nozzles respectively, the bubble forming chambers adapted to contain ejectable liquid; and, a generally planar heater element disposed in each of the bubble forming chambers respectively, the heater element being bonded on one side to the chamber so that the other side faces into the chamber, and configured for receiving an energizing pulse to heat some of the ejectable liquid above its boiling point to form a gas bubble on the side facing into the chamber, whereby the gas bubble causes the ejection of a drop of the ejectable liquid from the nozzle; and, the chamber having a dielectric layer proximate the side of the heater element bonded to the chamber; wherein, the dielectric layer has a thermal product less than 1495 $Jm^{-2}K^{-1}s^{-1/2}$, the thermal product being $(\rho Ck)^{1/2}$, where ρ is the density of the layer, C is specific heat of the layer and k is thermal conductivity of the layer.

Optionally the dielectric layer is less than 1 μm from the side of the heater element bonded to the chamber.

Optionally the dielectric layer is bonded directly to the side of the heater element.

Optionally the dielectric layer is deposited with CVD.

Optionally the dielectric layer is spun on.

Optionally the dielectric layer is a form of SiOC or SiOCH.

Optionally each heater element requires an actuation energy of less than 500 nanojoules (nJ) to heat that heater element sufficiently to form said bubble causing the ejection of said drop.

Optionally each heater element requires an actuation energy of less than 200 nJ to heat that heater element sufficiently to form said bubble causing the ejection of said drop.

In a sixth aspect the present invention provides an inkjet printhead comprising:

a plurality of nozzles;

a bubble forming chamber corresponding to each of the nozzles respectively, the bubble forming chambers adapted to contain ejectable liquid; and, a heater element disposed in each of the bubble forming chambers respectively, the heater element configured for heating some of the ejectable liquid above its boiling point to form a gas bubble that causes the ejection of a drop of the ejectable liquid from the nozzle; wherein, the heater element is formed from a material with a nanocrystalline composite structure.

Optionally the nanocrystalline composite has one or more nanocrystalline phases embedded in an amorphous phase.

Optionally at least one of the nanocrystalline phases is a transition metal nitride, a transition metal silicide, a transition metal boride or a transition metal carbide.

Optionally the amorphous phase is non-metallic.

Optionally the amorphous phase is a nitride, a carbide, carbon or an oxide.

Optionally the nitride is:

silicon nitride;

boron nitride; or, aluminium nitride;

the carbide is:

silicon carbide; and, the oxide is;

silicon oxide;

aluminium oxide; or, chromium oxide.

Optionally the transition metal is one of Ti, Ta, W, Ni, Zr, Cr, Hf, V, Nb, or Mo.

Optionally the heater element is formed from TiAlSiN.

In a seventh aspect the present invention provides an inkjet printhead comprising:

a plurality of nozzles;

a bubble forming chamber corresponding to each of the nozzles respectively, the bubble forming chambers adapted to contain ejectable liquid; and, a heater element disposed in each of the bubble forming chambers respectively, the heater element configured for receiving an energizing pulse for heating some of the ejectable liquid above its boiling point to form a gas bubble that causes the ejection of a drop of the ejectable liquid from the nozzle; wherein during use, the energizing pulse has a duration less than 1.5 microseconds (μs) and the energy required to generate the drop is less than the capacity of the drop to remove energy from the printhead.

Optionally the energizing pulse has a duration less than 1.0 μs.

Optionally the voltage applied to the heater element during the energizing pulse is between 5V and 12V.

Optionally each heater element requires an actuation energy of less than 500 nanojoules (nJ) to heat that heater element sufficiently to form said bubble causing the ejection of said drop.

Optionally the actuation energy is less than 200 nJ.

Optionally the actuation energy is less than 80 nJ.

Optionally the bubble formed by the heater element subsequently collapses to a bubble collapse point, and the heater element is shaped in a topologically open or closed loop such that the bubble collapse point is spaced from the heater element.

Optionally the heater element is generally planar and suspended in the bubble forming chamber such that the bubble forms on opposing sides of the heater element.

In an eighth aspect the present invention provides an inkjet printhead comprising:

a plurality of nozzles;

a bubble forming chamber corresponding to each of the nozzles respectively, the bubble forming chambers adapted to contain ejectable liquid; and, a generally planar heater element disposed in each of the bubble forming chambers respectively, the generally planar heater element having a heat generating portion for heating part of the ejectable liquid above its boiling point to form a gas bubble that causes the ejection of a drop of the ejectable liquid from the nozzle; wherein, the planar surface area of the heater element is less than 300 $\mu m^2$.

Optionally the heater element is configured such that the energy required to generate the drop is less than the capacity of the drop to remove energy from the printhead.

Optionally the planar surface area is less than 225 $\mu m^2$.

Optionally the planar surface area is less than 150 $\mu m^2$.

Optionally the drop is less than 5 pico-litres(pl).

Optionally the drop is between 1 pl and 2 pl.

Optionally each heater element requires an actuation energy of less than 500 nanojoules (nJ) to heat that heater element sufficiently to form said bubble causing the ejection of said drop.

Optionally each heater element requires an actuation energy of less than 200 nJ to heat that heater element sufficiently to form said bubble causing the ejection of said drop.

In a ninth aspect the present invention provides an inkjet printhead comprising:

a plurality of nozzles;

a bubble forming chamber corresponding to each of the nozzles respectively, the bubble forming chambers adapted to contain ejectable liquid; and, a heater element disposed in each of the bubble forming chambers respectively, for heating part of the ejectable liquid above its boiling point to form a gas bubble that causes the ejection of a drop of the ejectable liquid from the nozzle; wherein, the heater element is separated from the nozzle by less than 5 μm at their closest points;

the nozzle length is less than 5 μm; and the ejectable liquid has a viscosity less than 5 cP.

Optionally the heater is separated from the nozzle by less than 3 μm at their closest points.

Optionally the nozzle length is less than 3 μm.

Optionally the ejectable liquid has a viscosity less than 3 cP.

Optionally the heater element configured such that the energy required to generate the drop is less than the capacity of the drop to remove energy from the printhead.

Optionally the drop is less than 5 pico-litres(pl) and the energy required to generate the drop is less than 500 nJ.

Optionally the drop is between 1 pl and 2 pl and the energy required to generate the drop is less than 220 nJ.

Optionally the drop is less than 1 pl and the energy required to generate the drop is less than 80 nJ.

In a further aspect there is provided an inkjet printhead further comprising a MEMS fluid sensor for detecting the presence or otherwise of the ejectable liquid in the chamber, the MEMS fluid sensor having a MEMS sensing element formed of conductive material having a resistance that is a function of temperature, the MEMS sensing element having electrical contacts for connection to an electrical power source for heating the sensing element with an electrical signal; and control circuitry for measuring the current passing through the sensing element during heating of the sensing element; such that, the control circuitry is configured to determine the temperature of the sensing element from the known applied voltage, the measured current and the known relationship between the current, resistance and temperature.

Optionally the heater element has a protective surface coating that is less than 0.1 μm thick.

In a further aspect there is provided an inkjet printhead further comprising a print engine controller to control the ejection of drops from each of the nozzles such that it actuates any one of the heaters to eject a keep-wet drop if the interval between successive actuations of that heater reaches a predetermined maximum; wherein during use, the density of dots on the media substrate from the keep-wet drops, is less than 1:250 and not clustered so as to produce any artifacts visible to the eye.

Optionally the heater element is formed from a self passivating transition metal nitride.

Optionally the heater element is bonded on one side to the chamber so that the gas bubble forms on the other side which faces into the chamber, and the chamber has a dielectric layer proximate the side of the heater element bonded to the chamber; wherein the dielectric layer has a thermal product less than 1495 $Jm^{-2}K^{-1}s^{-1/2}$, the thermal product being $(\rho Ck)^{1/2}$, where ρ is the density of the layer, C is specific heat of the layer and k is thermal conductivity of the layer.

Optionally the heater element is formed from a material with a nanocrystalline composite structure.

Optionally the heater element configured for receiving an energizing pulse to form the gas bubble that causes the ejection of a drop of the ejectable liquid from the nozzle; wherein during use, the energizing pulse has a duration less than 1.5 micro-seconds (μs) and the energy required to generate the drop is less than the capacity of the drop to remove energy from the printhead.

Optionally the planar surface area of the heater element is less than 300 $\mu m^2$.

Optionally the heater element is separated from the nozzle by less than 5 μm at their closest points;

the nozzle length is less than 5 μm; and the ejectable liquid has a viscosity less than 5 cP.

Terminology

As will be understood by those skilled in the art, the ejection of a drop of the ejectable liquid as described herein, is caused by the generation of a vapor bubble in a bubble forming liquid, which, in embodiments, is the same body of liquid as the ejectable liquid. The generated bubble causes an increase in pressure in ejectable liquid, which forces the drop through the relevant nozzle. The bubble is generated by Joule heating of a heater element which is in thermal contact with the ink. The electrical pulse applied to the heater is of brief duration, typically less than 2 microseconds. Due to stored heat in the liquid, the bubble expands for a few microseconds after the heater pulse is turned off. As the vapor cools, it recondenses, resulting in bubble collapse. The bubble collapses to a point determined by the dynamic interplay of inertia and surface tension of the ink. In this specification, such a point is referred to as the "point of collapse" of the bubble.

Throughout this specification, 'self passivation' refers to the incorporation of an additive whose oxidation is thermodynamically favored above the other elements in the heater. The additive forms a surface oxide layer with a low diffusion coefficient for oxygen so as to provide a barrier to further oxidation. Accordingly, a 'self passivating' material has the ability to form such a surface oxide layer. The self passivating component need not be aluminium: any other additive whose oxidation is thermodynamically favored over the other components will form an oxide on the heater surface provided this oxide has a low oxygen diffusion rate (comparable to aluminium oxide), the additive will be a suitable alternative to aluminium.

Throughout the specification, references to 'self cooled' or 'self cooling' nozzles will be understood to be nozzles in which the energy required to eject a drop of the ejectable liquid is less than the maximum amount of thermal energy that can be removed by the drop, being the energy required to heat a volume of the ejectable fluid equivalent to the drop volume from the temperature at which the fluid enters the printhead to the heterogeneous boiling point of the ejectable fluid.

Throughout this specification, the 'nozzle length' refers to the distance, in the direction of droplet travel, of the sidewall defining a nozzle aperture, from the interior of the chamber to the external edge of the nozzle plate, or nozzle rim projecting from the nozzle plate. This dimension of the nozzle aperture influences the viscous drag on the ink drop as it is ejected from the chamber.

The printhead according to the invention comprises a plurality of nozzles, as well as a chamber and one or more heater elements corresponding to each nozzle. Each portion of the printhead pertaining to a single nozzle, its chamber and its one or more elements, is referred to herein as a "unit cell".

In this specification, where reference is made to parts being in thermal contact with each other, this means that they are positioned relative to each other such that, when one of the parts is heated, it is capable of heating the other part, even though the parts, themselves, might not be in physical contact with each other.

Also, the term "ink" is used to signify any ejectable liquid, and is not limited to conventional inks containing colored dyes. Examples of non-colored inks include fixatives, infrared absorber inks, functionalized chemicals, adhesives, biological fluids, water and other solvents, and so on. The ink or ejectable liquid also need not necessarily be a strictly a liquid, and may contain a suspension of solid particles or be solid at room temperature and liquid at the ejection temperature.

BRIEF DESCRIPTION OF THE DRAWINGS

Preferred embodiments of the invention will now be described, by way of example only, with reference to the accompanying drawings. The drawings are described as follows.

DETAILED DESCRIPTION

Figure 1:
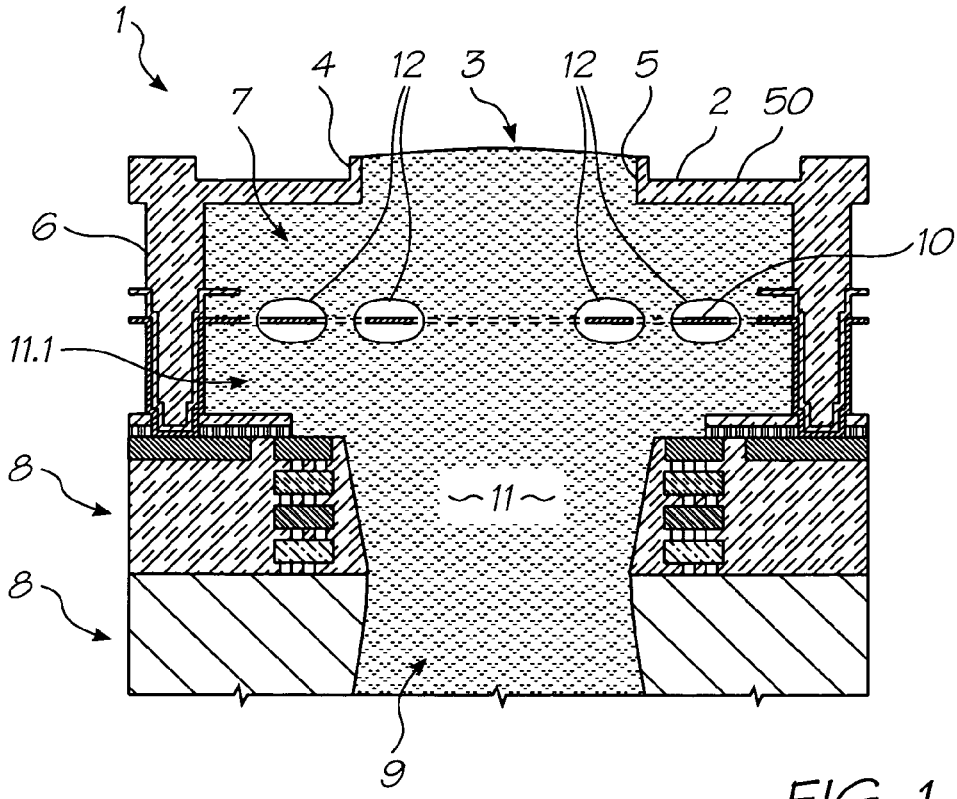
FIG. 1 is a schematic cross-sectional view through an ink chamber of a unit cell of a printhead with a suspended heater element at a particular stage during its operative cycle.

In the description than follows, corresponding reference numerals, or corresponding prefixes of reference numerals (i.e. the parts of the reference numerals appearing before a point mark) which are used in different figures relate to corresponding parts. Where there are corresponding prefixes and differing suffixes to the reference numerals, these indicate different specific embodiments of corresponding parts.

Overview of the Invention and General Discussion of Operation

With reference to FIGS. 1 to 4, the unit cell 1 of a printhead according to an embodiment of the invention comprises a nozzle plate 2 with nozzles 3 therein, the nozzles having nozzle rims 4, and apertures 5 extending through the nozzle plate. The nozzle plate 2 is plasma etched from a silicon nitride structure which is deposited, by way of chemical vapor deposition (CVD), over a sacrificial material which is subsequently etched.

The printhead also includes, with respect to each nozzle 3, side walls 6 on which the nozzle plate is supported, a chamber 7 defined by the walls and the nozzle plate 2, a multi-layer substrate 8 and an inlet passage 9 extending through the multi-layer substrate to the far side (not shown) of the substrate. A looped, elongate heater element 10 is suspended within the chamber 7, so that the element is in the form of a suspended beam. The printhead as shown is a microelectromechanical system (MEMS) structure, which is formed by a lithographic process which is described in more detail below.

When the printhead is in use, ink 11 from a reservoir (not shown) enters the chamber 7 via the inlet passage 9, so that the chamber fills to the level as shown in FIG. 1. Thereafter, the heater element 10 is heated for somewhat less than 1 microsecond (μs), so that the heating is in the form of a thermal pulse. It will be appreciated that the heater element 10 is in thermal contact with the ink 11 in the chamber 7 so that when the element is heated, this causes the generation of vapor bubbles 12 in the ink. Accordingly, the ink 11 constitutes a bubble forming liquid. FIG. 1 shows the formation of a bubble 12 approximately 1 μs after generation of the thermal pulse, that is, when the bubble has just nucleated on the heater elements 10. It will be appreciated that, as the heat is applied in the form of a pulse, all the energy necessary to generate the bubble 12 is to be supplied within that short time.

Figure 33:
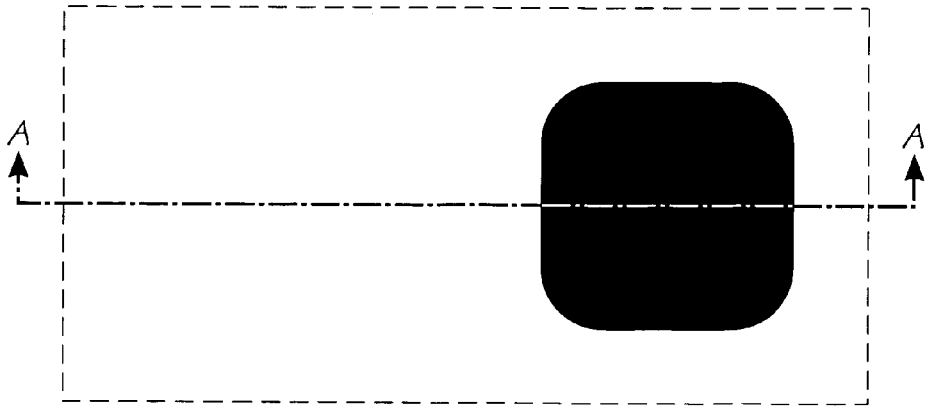
Figure 34:
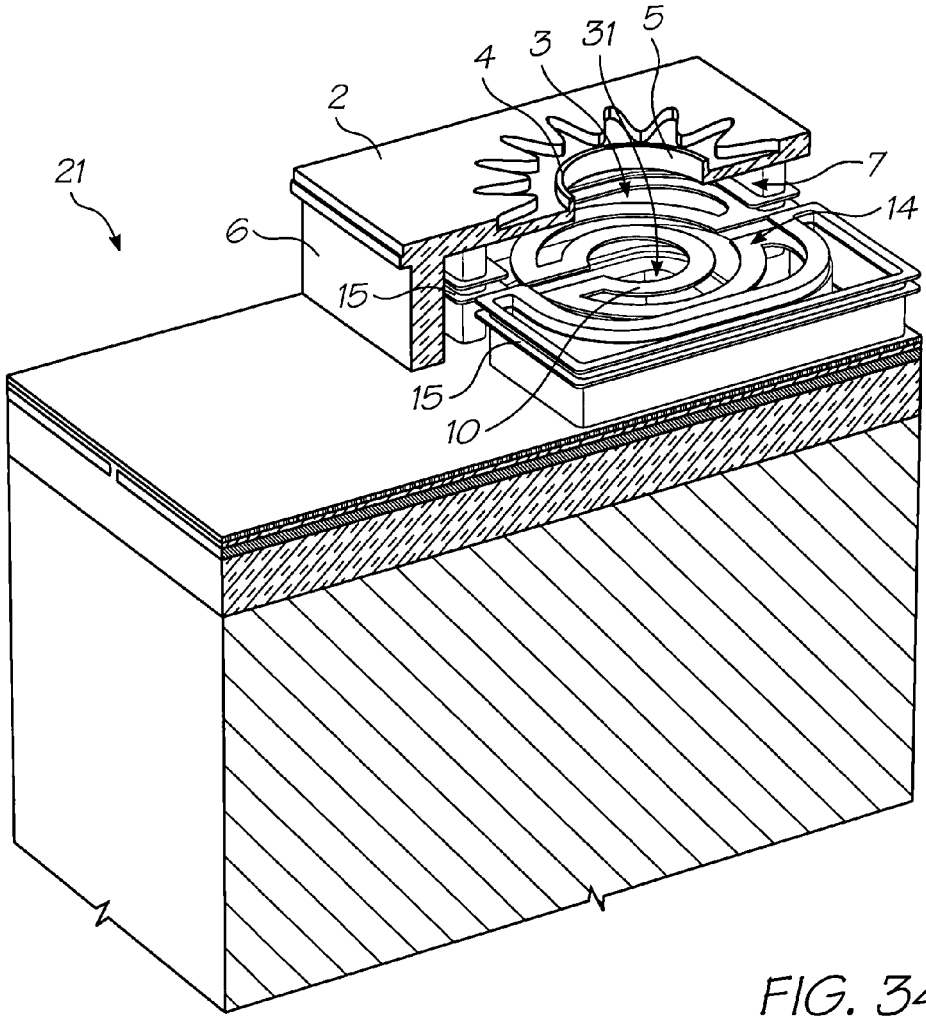

Turning briefly to FIG. 34, there is shown a mask 13 for forming a heater 14 (as shown in FIG. 33) of the printhead (which heater includes the element 10 referred to above), during a lithographic process, as described in more detail below. As the mask 13 is used to form the heater 14, the shapes of several of its parts correspond to the shape of the element 10. The mask 13 therefore provides a useful reference by which to identify various parts of the heater 14. The heater 14 has electrodes 15 corresponding to the parts designated 15.34 of the mask 13 and a heater element 10 corresponding to the parts designated 10.34 of the mask. In operation, voltage is applied across the electrodes 15 to cause current to flow through the element 10. The electrodes 15 are much thicker than the element 10 so that most of the electrical resistance is provided by the element. Thus, nearly all of the power consumed in operating the heater 14 is dissipated via the element 10, in creating the thermal pulse referred to above.

When the element 10 is heated as described above, the bubble 12 forms along the length of the element, this bubble appearing, in the cross-sectional view of FIG. 1, as four bubble portions, one for each of the element portions shown in cross section.

The bubble 12, once generated, causes an increase in pressure within the chamber 7, which in turn causes the ejection of a drop 16 of the ink 11 through the nozzle 3. The rim 4 assists in directing the drop 16 as it is ejected, so as to minimize the chance of drop misdirection.

The reason that there is only one nozzle 3 and chamber 7 per inlet passage 9 is so that the pressure wave generated within the chamber, on heating of the element 10 and forming of a bubble 12, does not affect adjacent chambers and their corresponding nozzles.

The advantages of the heater element 10 being suspended rather than embedded in any solid material, are discussed below. However, there are also advantages to bonding the heater element to the internal surfaces of the chamber. These are discussed below with reference to FIGS. 6 to 9.

Figure 2:
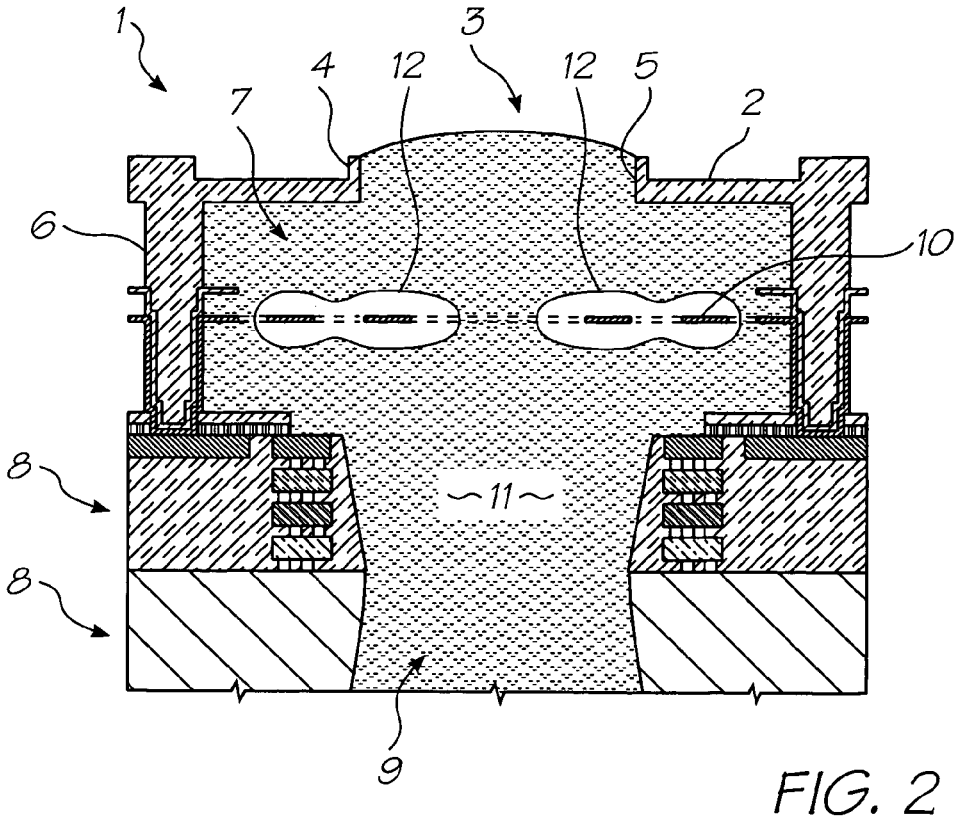
FIG. 2 is a schematic cross-sectional view through the ink chamber FIG. 1, at another stage of operation.
Figure 3:
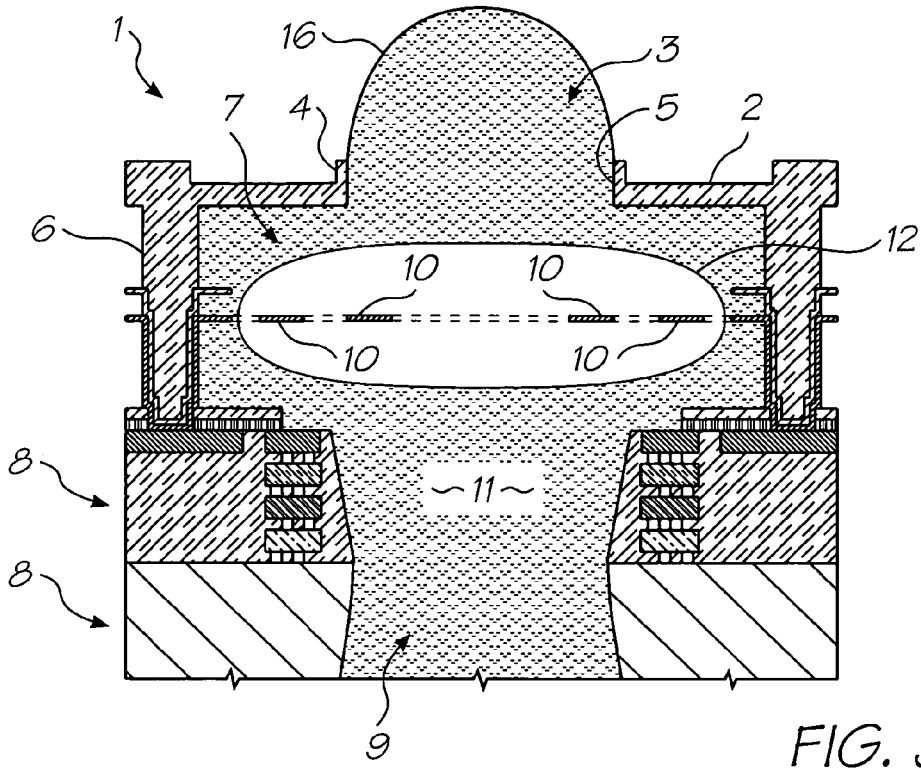
FIG. 3 is a schematic cross-sectional view through the ink chamber FIG. 1, at yet another stage of operation.

FIGS. 2 and 3 show the unit cell 1 at two successive later stages of operation of the printhead. It can be seen that the bubble 12 generates further, and hence grows, with the resultant advancement of ink 11 through the nozzle 3. The shape of the bubble 12 as it grows, as shown in FIG. 3, is determined by a combination of the inertial dynamics and the surface tension of the ink 11. The surface tension tends to minimize the surface area of the bubble 12 so that, by the time a certain amount of liquid has evaporated, the bubble is essentially disk-shaped.

The increase in pressure within the chamber 7 not only pushes ink 11 out through the nozzle 3, but also pushes some ink back through the inlet passage 9. However, the inlet passage 9 is approximately 200 to 300 microns in length, and is only about 16 microns in diameter. Hence there is a substantial inertia and viscous drag limiting back flow. As a result, the predominant effect of the pressure rise in the chamber 7 is to force ink out through the nozzle 3 as an ejected drop 16, rather than back through the inlet passage 9.

Figure 4:
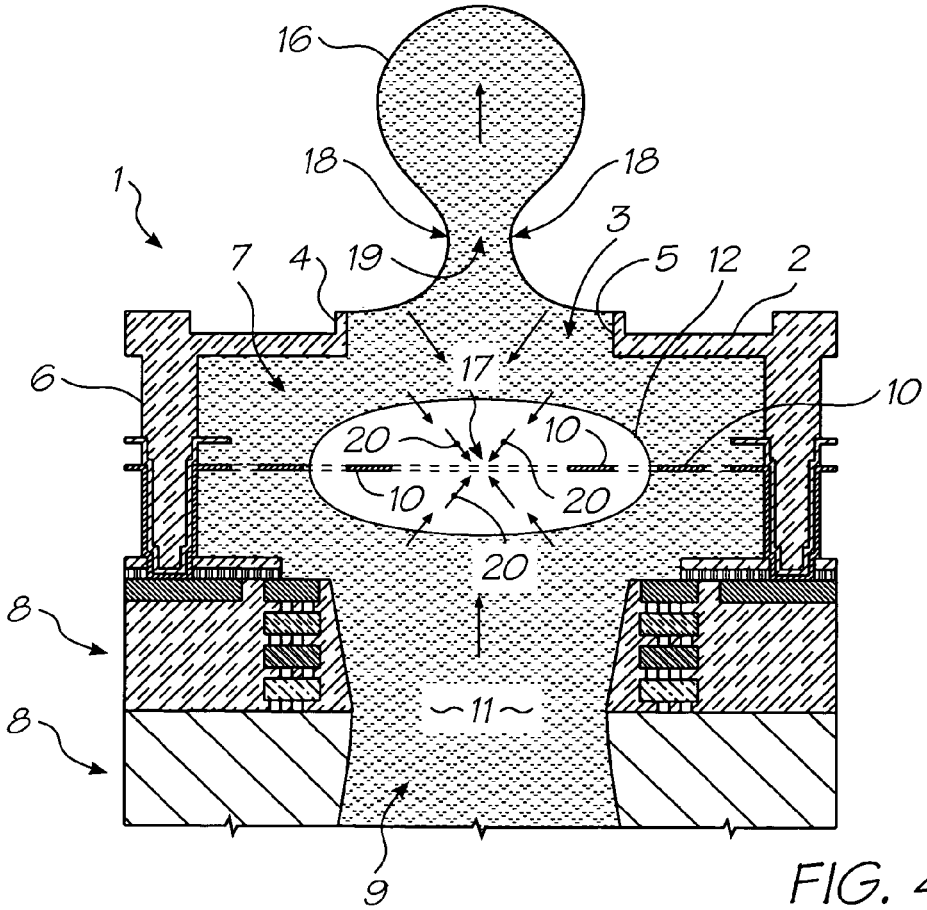
FIG. 4 is a schematic cross-sectional view through the ink chamber FIG. 1, at yet a further stage of operation.

Turning now to FIG. 4, the printhead is shown at a still further successive stage of operation, in which the ink drop 16 that is being ejected is shown during its "necking phase" before the drop breaks off. At this stage, the bubble 12 has already reached its maximum size and has then begun to collapse towards the point of collapse 17, as reflected in more detail in FIG. 5.

The collapsing of the bubble 12 towards the point of collapse 17 causes some ink 11 to be drawn from within the nozzle 3 (from the sides 18 of the drop), and some to be drawn from the inlet passage 9, towards the point of collapse. Most of the ink 11 drawn in this manner is drawn from the nozzle 3, forming an annular neck 19 at the base of the drop 16 prior to its breaking off.

The drop 16 requires a certain amount of momentum to overcome surface tension forces, in order to break off. As ink 11 is drawn from the nozzle 3 by the collapse of the bubble 12, the diameter of the neck 19 reduces thereby reducing the amount of total surface tension holding the drop, so that the momentum of the drop as it is ejected out of the nozzle is sufficient to allow the drop to break off.

When the drop 16 breaks off, cavitation forces are caused as reflected by the arrows 20, as the bubble 12 collapses to the point of collapse 17. It will be noted that there are no solid surfaces in the vicinity of the point of collapse 17 on which the cavitation can have an effect.

Manufacturing Process

Relevant parts of the manufacturing process of a printhead according to embodiments of the invention are now described with reference to FIGS. 10 to 33.

Figure 10:
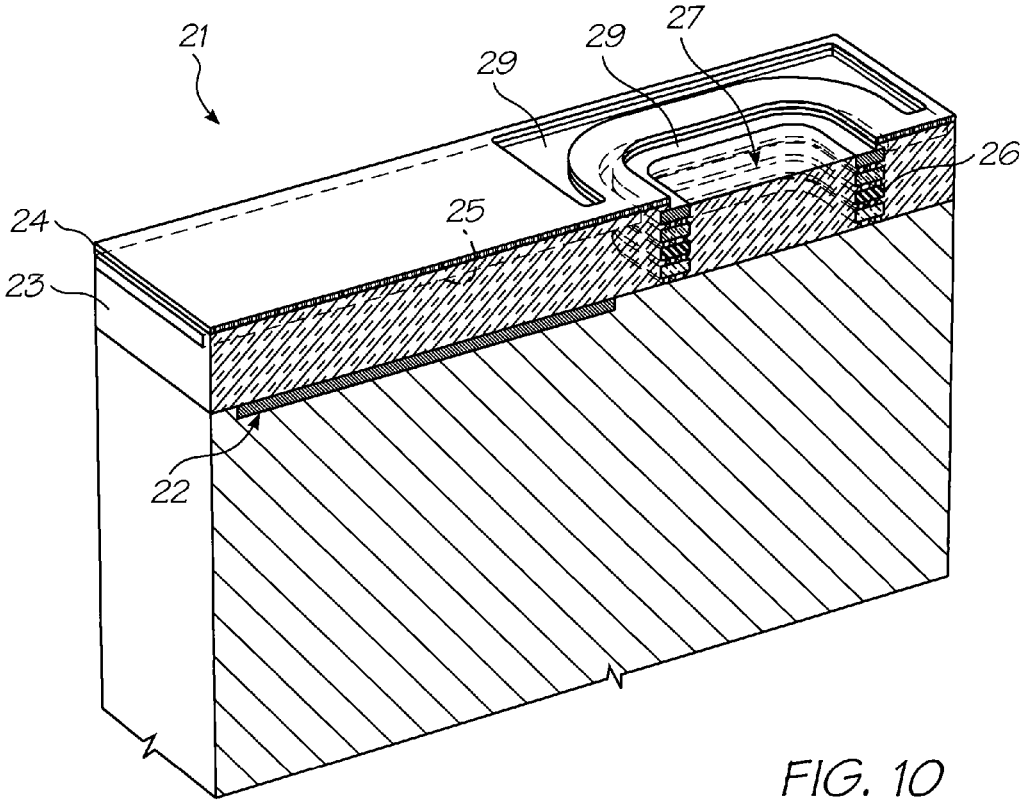
FIGS. 10, 12, 14, 15, 17, 18, 20, 22, 23, 25, 27, 28, 30, 32 and 34 are schematic perspective views (FIG. 34 being partly cut away) of a unit cell of a printhead in accordance with an embodiment of the invention, at various successive stages in the production process of the printhead.
Figure 11:
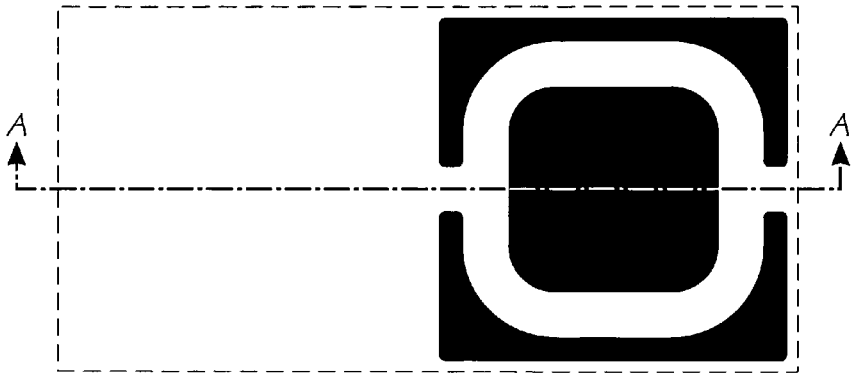
FIGS. 11, 13, 16, 19, 21, 24, 26, 29, 31, 33 and 35 are each schematic plan views of a mask suitable for use in performing the production stage for the printhead, as represented in the respective immediately preceding figures.

Referring to FIG. 10, there is shown a cross-section through a silicon substrate portion 21, being a portion of a Memjet™ printhead, at an intermediate stage in the production process thereof. This figure relates to that portion of the printhead corresponding to a unit cell 1. The description of the manufacturing process that follows will be in relation to a unit cell 1, although it will be appreciated that the process will be applied to a multitude of adjacent unit cells of which the whole printhead is composed.

FIG. 10 represents the next successive step, during the manufacturing process, after the completion of a standard CMOS fabrication process, including the fabrication of CMOS drive transistors (not shown) in the region 22 in the substrate portion 21, and the completion of standard CMOS interconnect layers 23 and passivation layer 24. Wiring indicated by the dashed lines 25 electrically interconnects the transistors and other drive circuitry (also not shown) and the heater element corresponding to the nozzle.

Guard rings 26 are formed in the metallization of the interconnect layers 23 to prevent ink 11 from diffusing from the region, designated 27, where the nozzle of the unit cell 1 will be formed, through the substrate portion 21 to the region containing the wiring 25, and corroding the CMOS circuitry disposed in the region designated 22.

The first stage after the completion of the CMOS fabrication process consists of etching a portion of the passivation layer 24 to form the passivation recesses 29.

Figure 12:
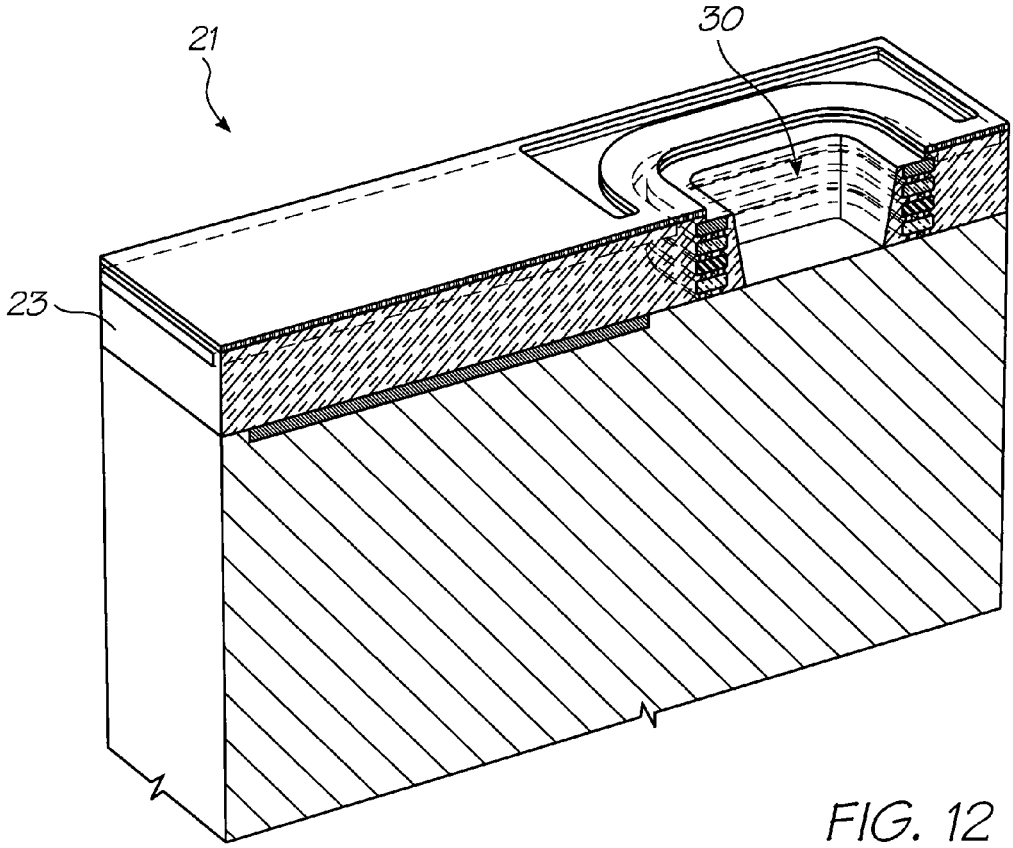
Figure 13:
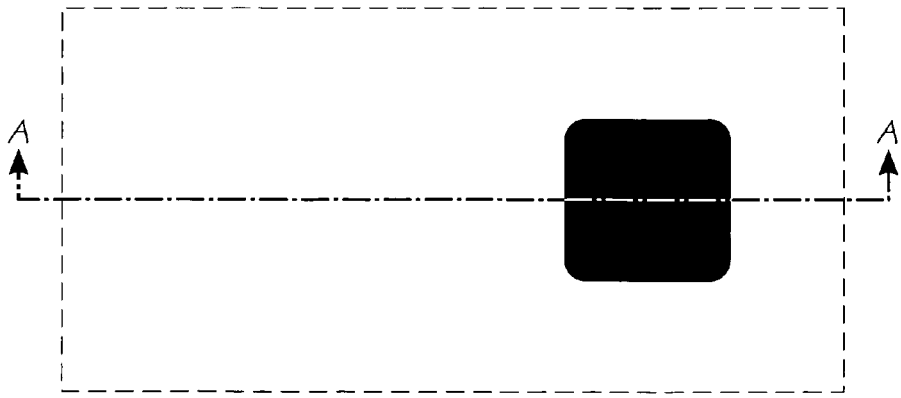

FIG. 12 shows the stage of production after the etching of the interconnect layers 23, to form an opening 30. The opening 30 is to constitute the ink inlet passage to the chamber that will be formed later in the process.

Figure 14:
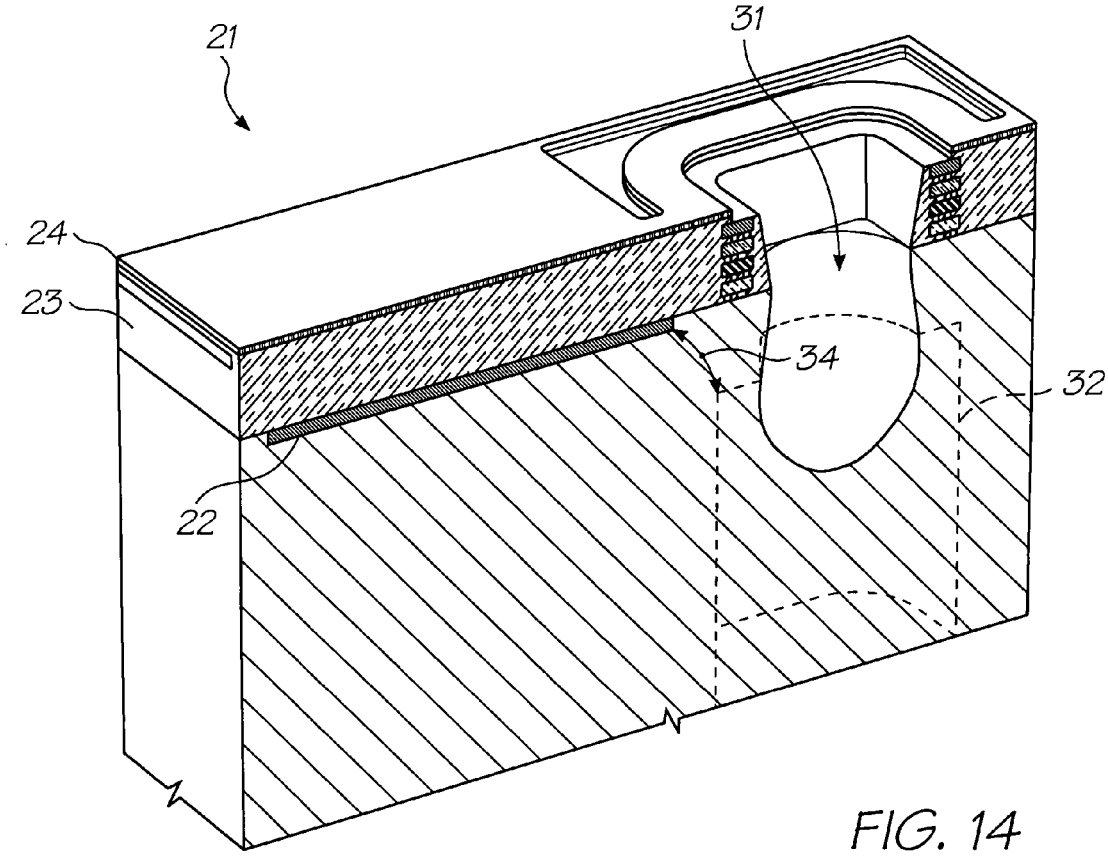

FIG. 14 shows the stage of production after the etching of a hole 31 in the substrate portion 21 at a position where the nozzle 3 is to be formed. Later in the production process, a further hole (indicated by the dashed line 32) will be etched from the other side (not shown) of the substrate portion 21 to join up with the hole 31, to complete the inlet passage to the chamber. Thus, the hole 32 will not have to be etched all the way from the other side of the substrate portion 21 to the level of the interconnect layers 23.

If, instead, the hole 32 were to be etched all the way to the interconnect layers 23, then to avoid the hole 32 being etched so as to destroy the transistors in the region 22, the hole 32 would have to be etched a greater distance away from that region so as to leave a suitable margin (indicated by the arrow 34) for etching inaccuracies. But the etching of the hole 31 from the top of the substrate portion 21, and the resultant shortened depth of the hole 32, means that a lesser margin 34 need be left, and that a substantially higher packing density of nozzles can thus be achieved.

Figure 15:
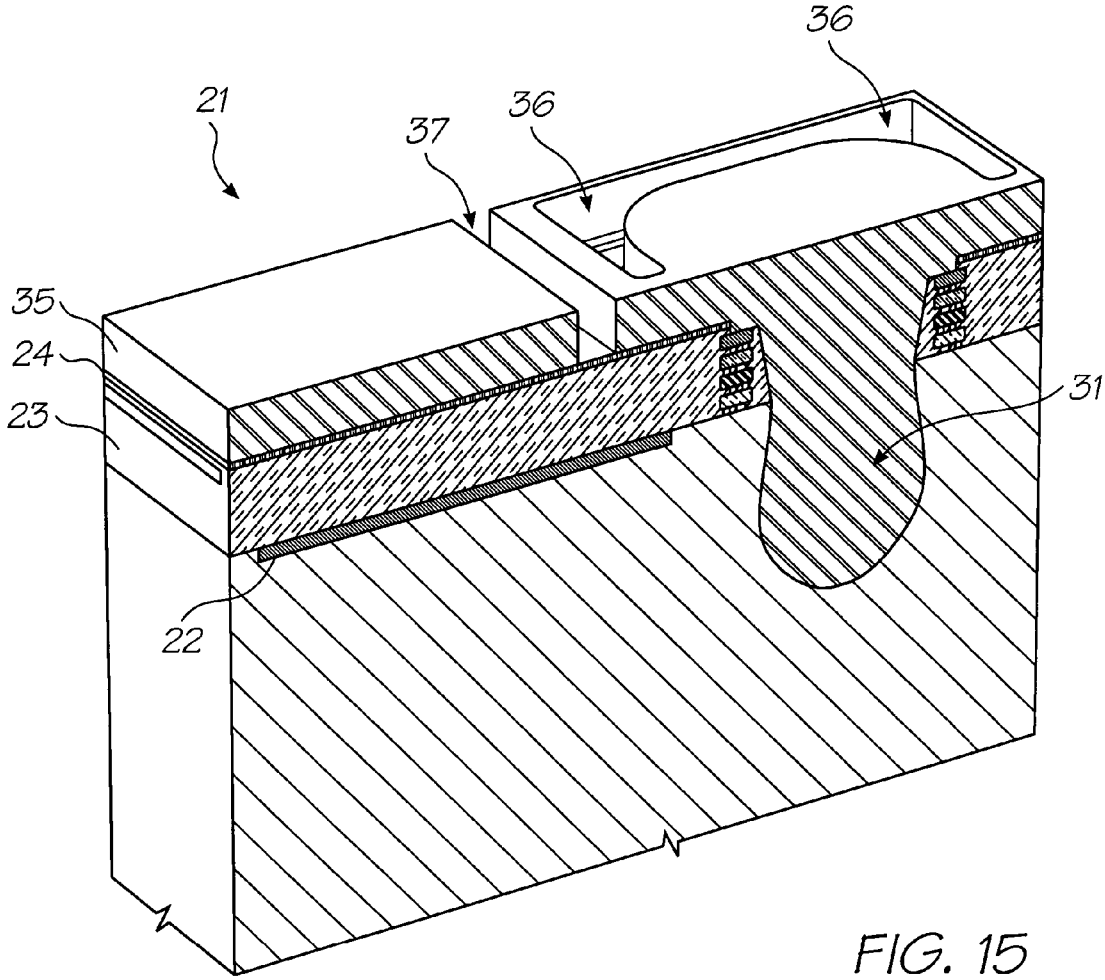
Figure 16:
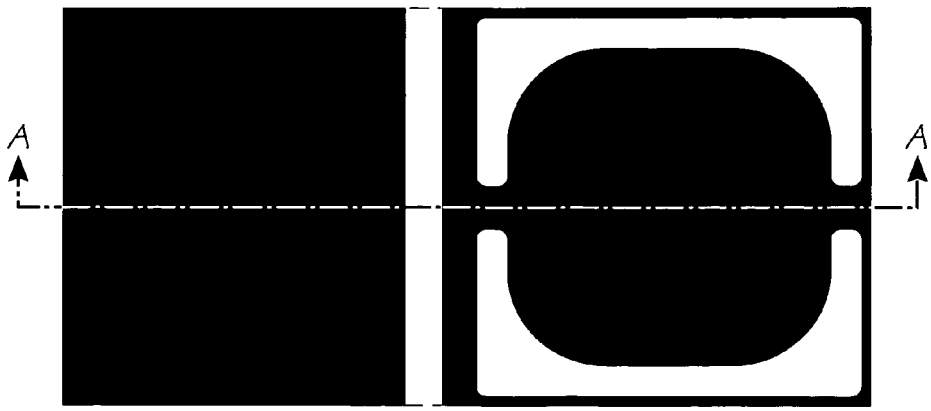
Figure 17:
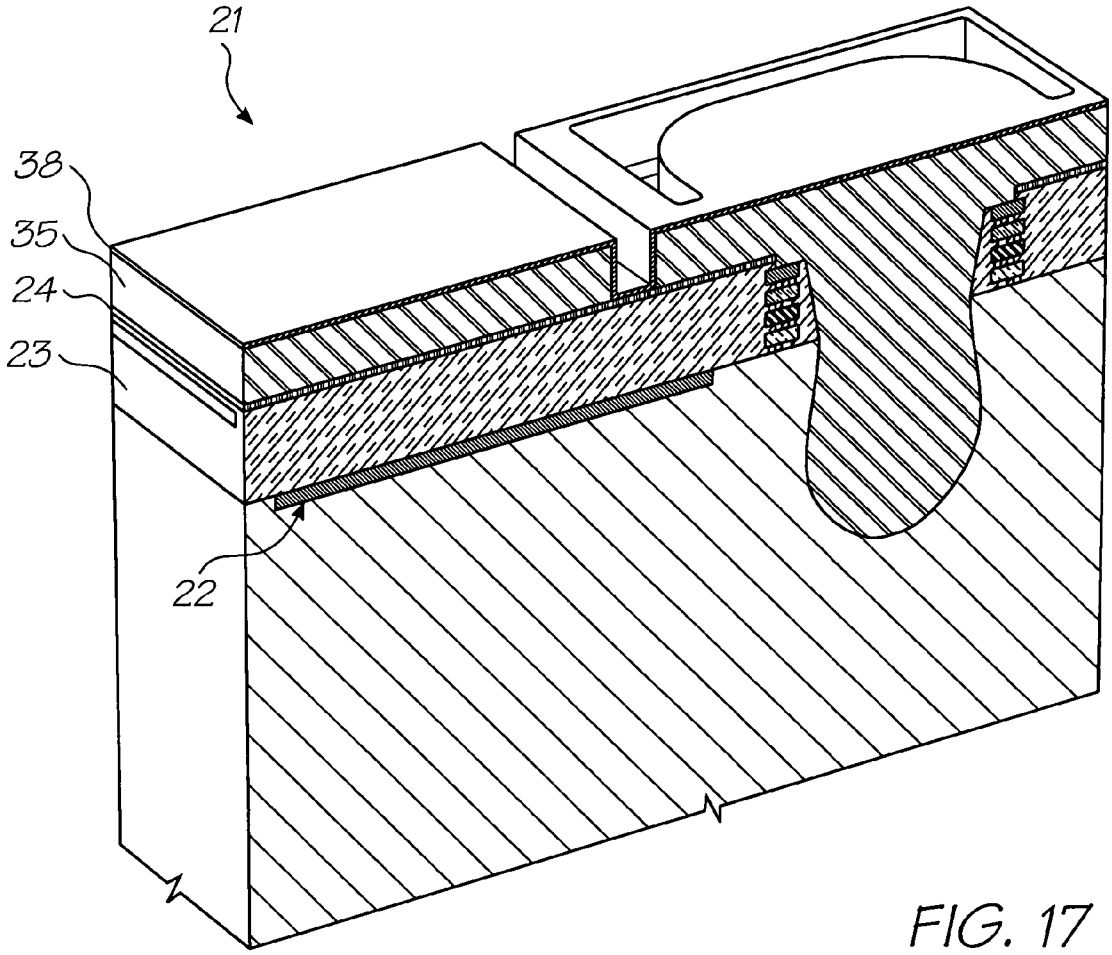

FIG. 15 shows the stage of production after a four micron thick layer 35 of a sacrificial resist has been deposited on the layer 24. This layer 35 fills the hole 31 and now forms part of the structure of the printhead. The resist layer 35 is then exposed with certain patterns (as represented by the mask shown in FIG. 16) to form recesses 36 and a slot 37. This provides for the formation of contacts for the electrodes 15 of the heater element to be formed later in the production process. The slot 37 will provide, later in the process, for the formation of the nozzle walls 6 that will define part of the chamber 7.

Figure 21:
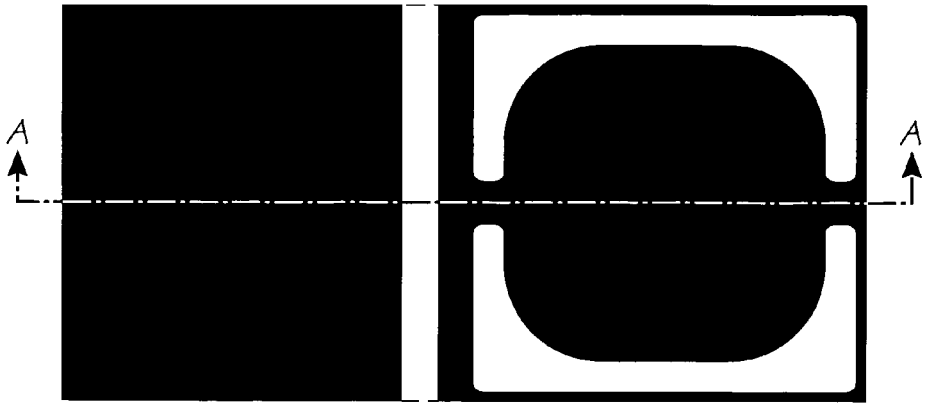

FIG. 21 shows the stage of production after the deposition, on the layer 35, of a 0.5 micron thick layer 38 of heater material, which, in the present embodiment, is of titanium aluminium nitride.

Figure 18:
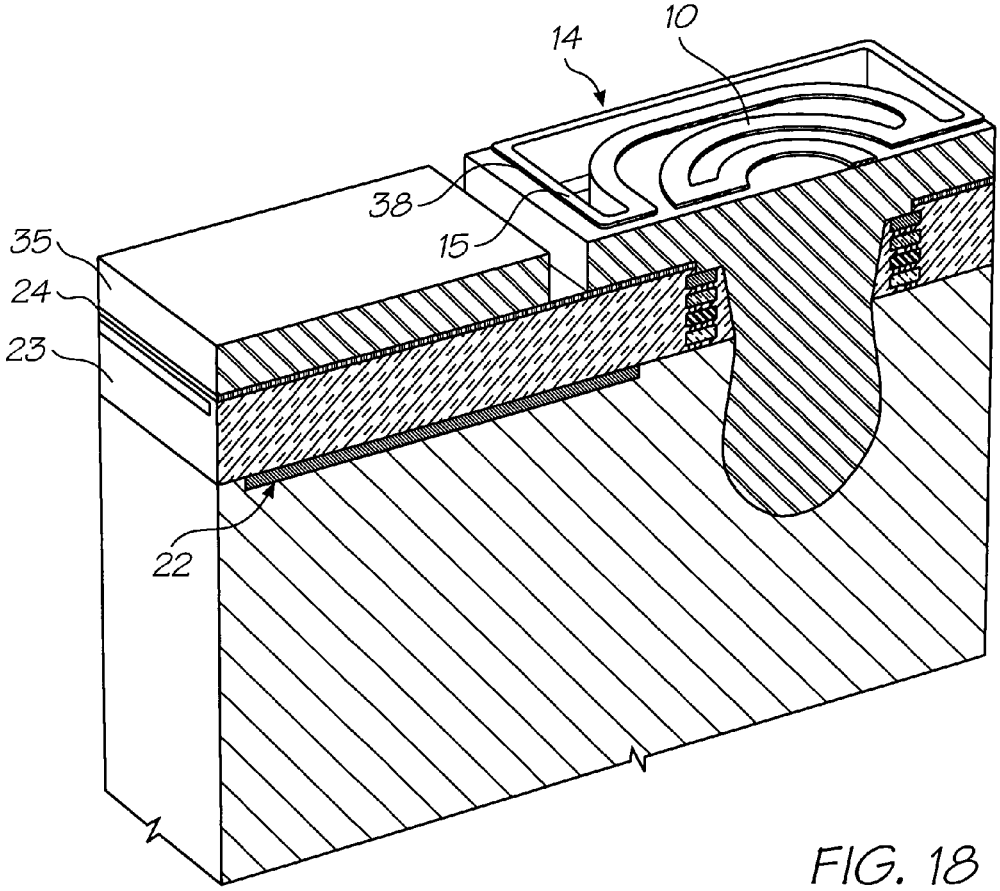
Figure 19:
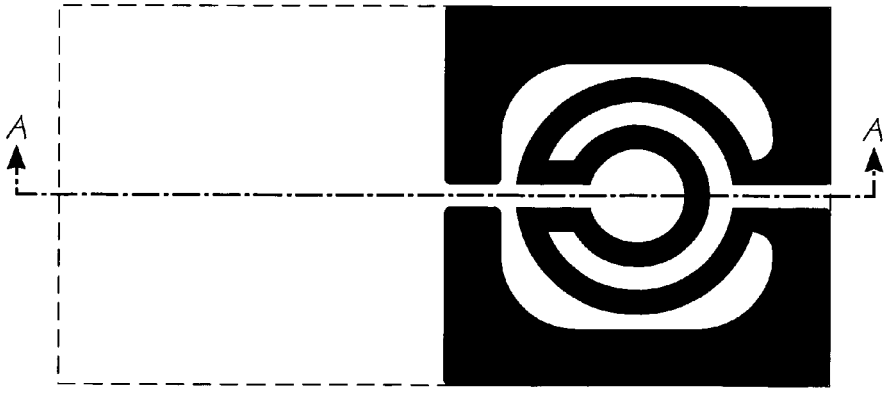

FIG. 18 shows the stage of production after patterning and etching of the heater layer 38 to form the heater 14, including the heater element 10 and electrodes 15.

Figure 20:
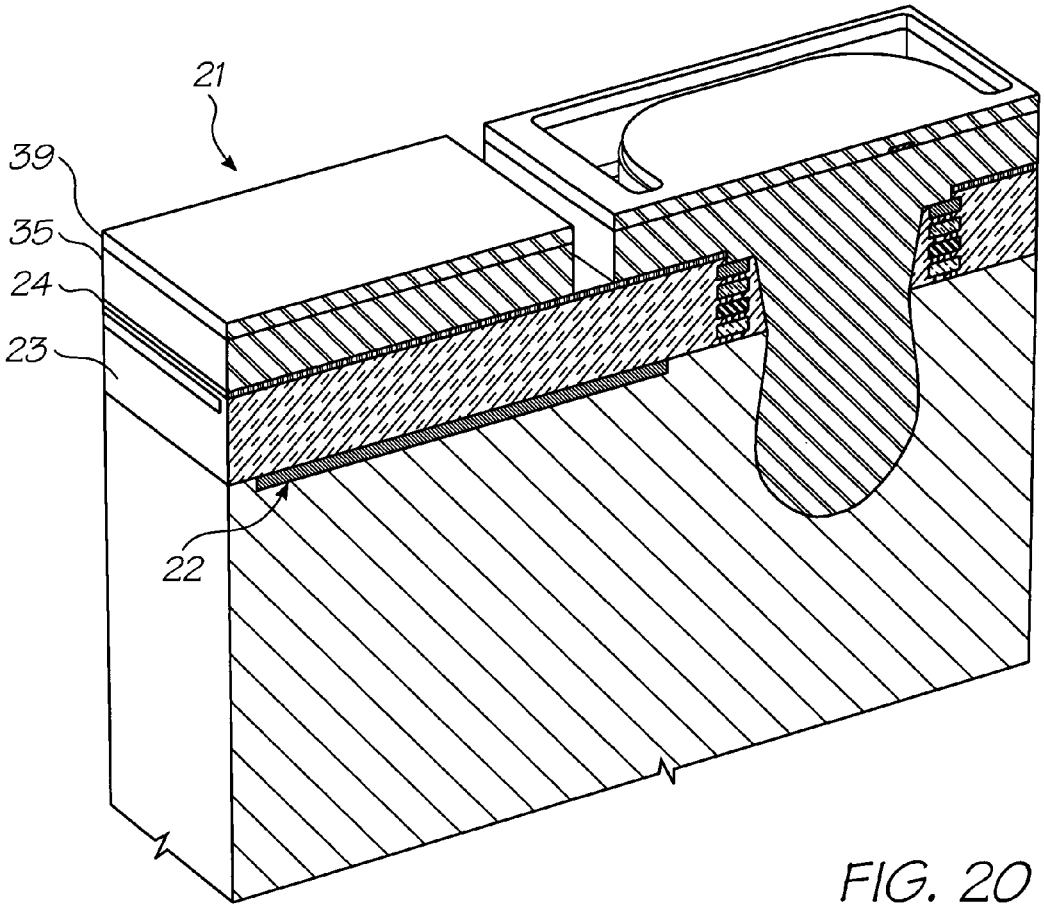

FIG. 20 shows the stage of production after another sacrificial resist layer 39, about 1 micron thick, has been added.

Figure 22:
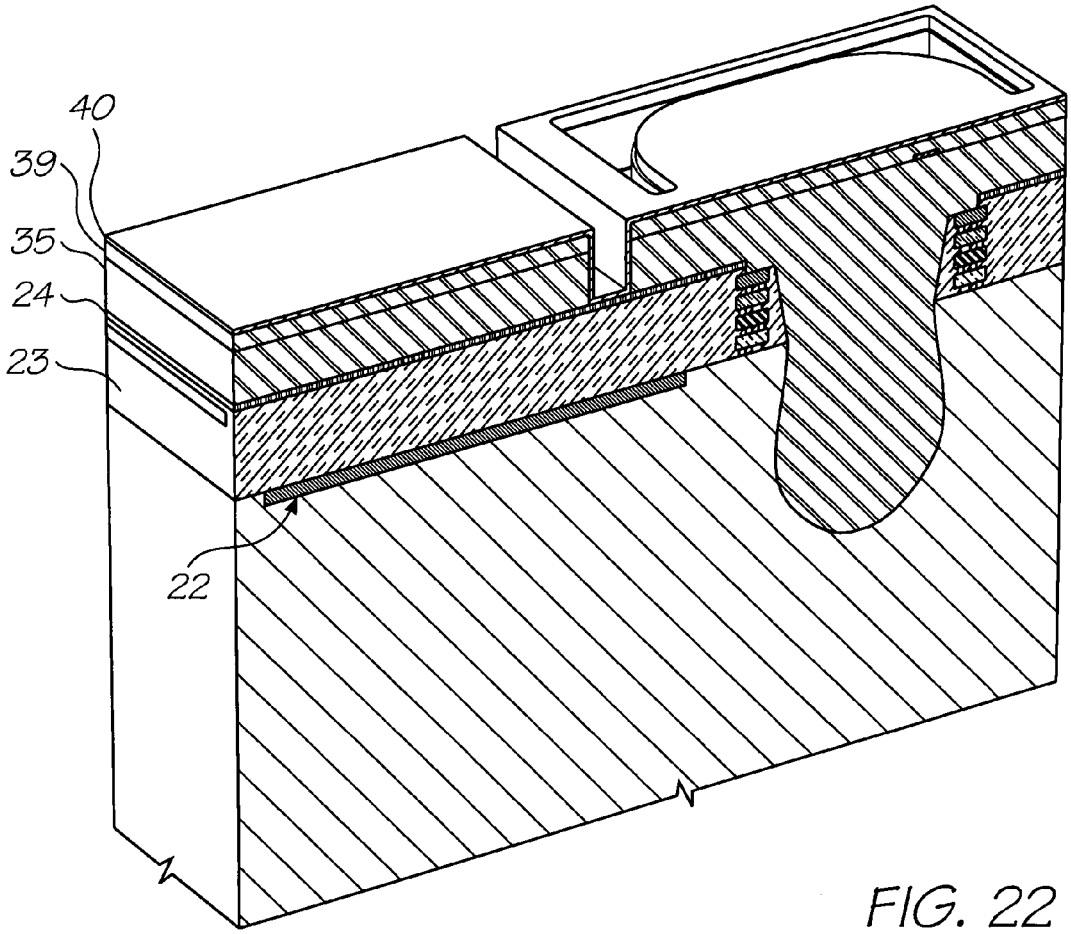

FIG. 22 shows the stage of production after a second layer 40 of heater material has been deposited. In a preferred embodiment, this layer 40, like the first heater layer 38, is of 0.5 micron thick titanium aluminium nitride.

Figure 23:
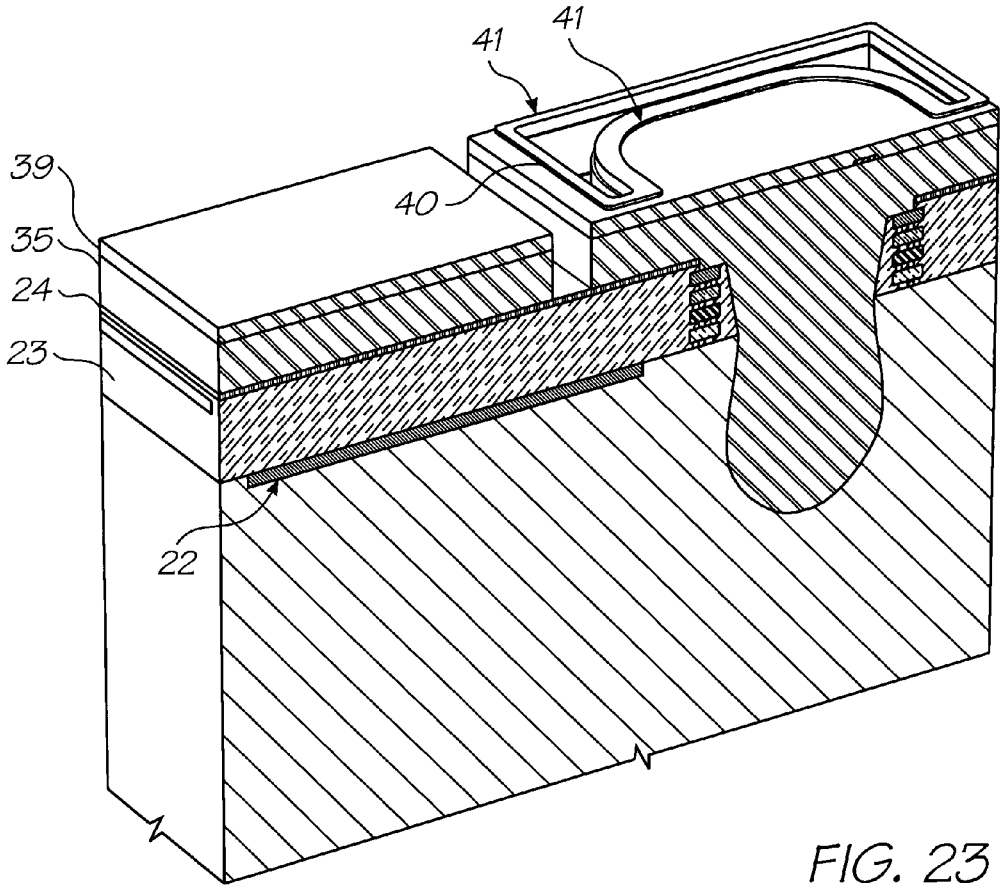
Figure 24:
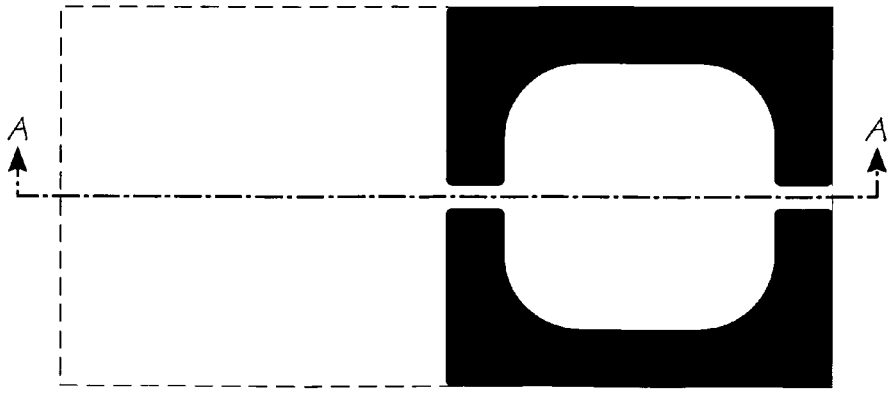

FIG. 23 then shows this second layer 40 of heater material after it has been etched to form the pattern as shown, indicated by reference numeral 41. In this illustration, this patterned layer does not include a heater layer element 10, and in this sense has no heater functionality. However, this layer of heater material does assist in reducing the resistance of the electrodes 15 of the heater 14 so that, in operation, less energy is consumed by the electrodes which allows greater energy consumption by, and therefore greater effectiveness of, the heater elements 10. In the dual heater embodiment illustrated in FIG. 42, the corresponding layer 40 does contain a heater 14.

Figure 25:
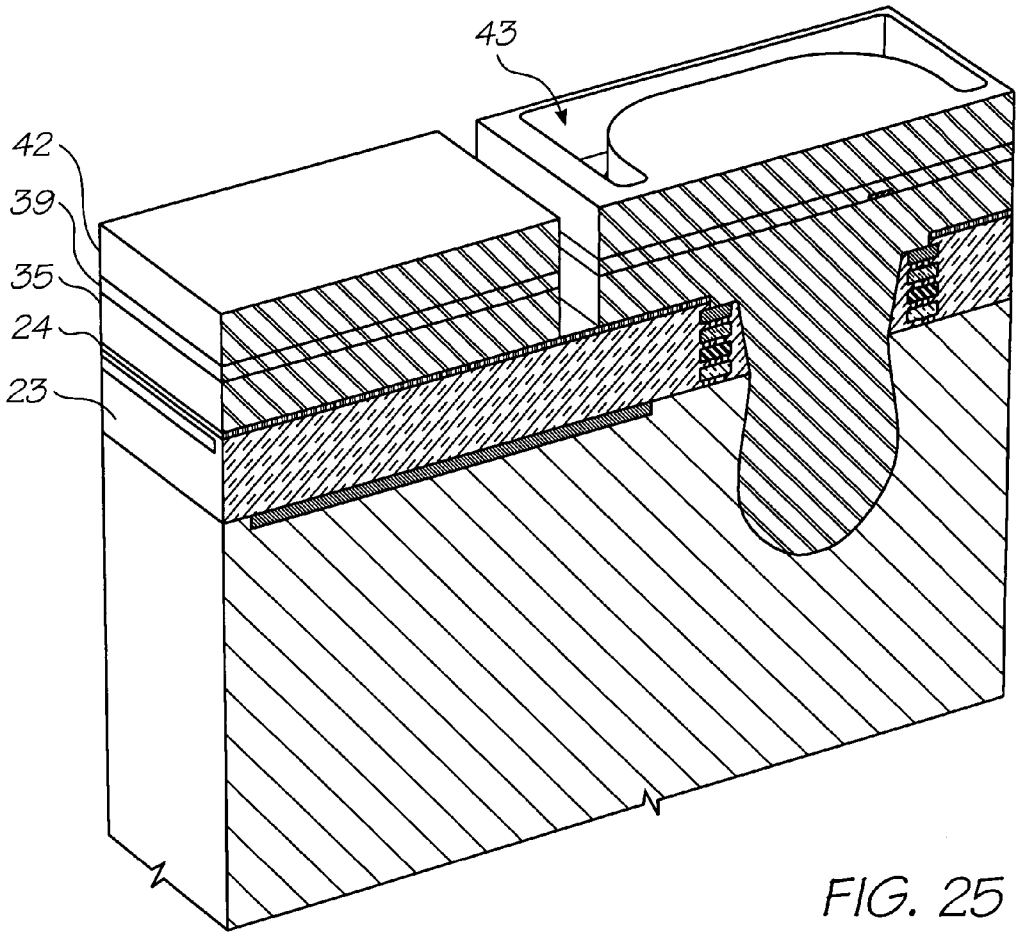
Figure 26:
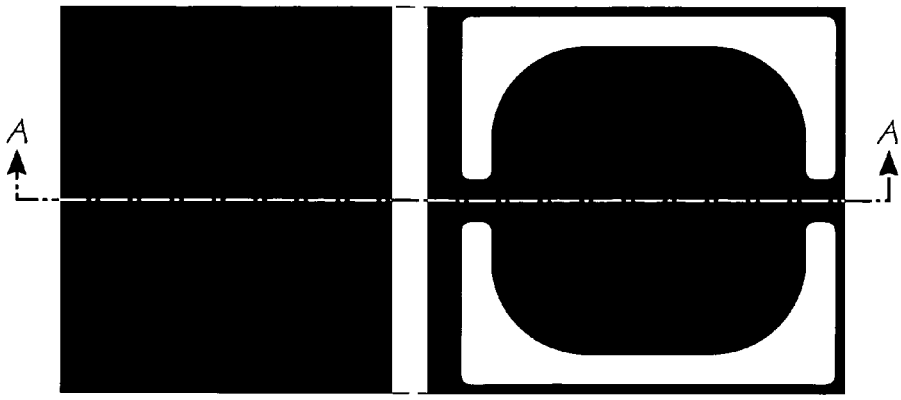

FIG. 25 shows the stage of production after a third layer 42, of sacrificial resist, has been deposited. The uppermost level of this layer will constitute the inner surface of the nozzle plate 2 to be formed later. This is also the inner extent of the ejection aperture 5 of the nozzle. The height of this layer 42 must be sufficient to allow for the formation of a bubble 12 in the region designated 43 during operation of the printhead. However, the height of layer 42 determines the mass of ink that the bubble must move in order to eject a droplet. In light of this, the printhead structure of the present invention is designed such that the heater element is much closer to the ejection aperture than in prior art printheads. The mass of ink moved by the bubble is reduced. The generation of a bubble sufficient for the ejection of the desired droplet will require less energy, thereby improving efficiency.

Figure 27:
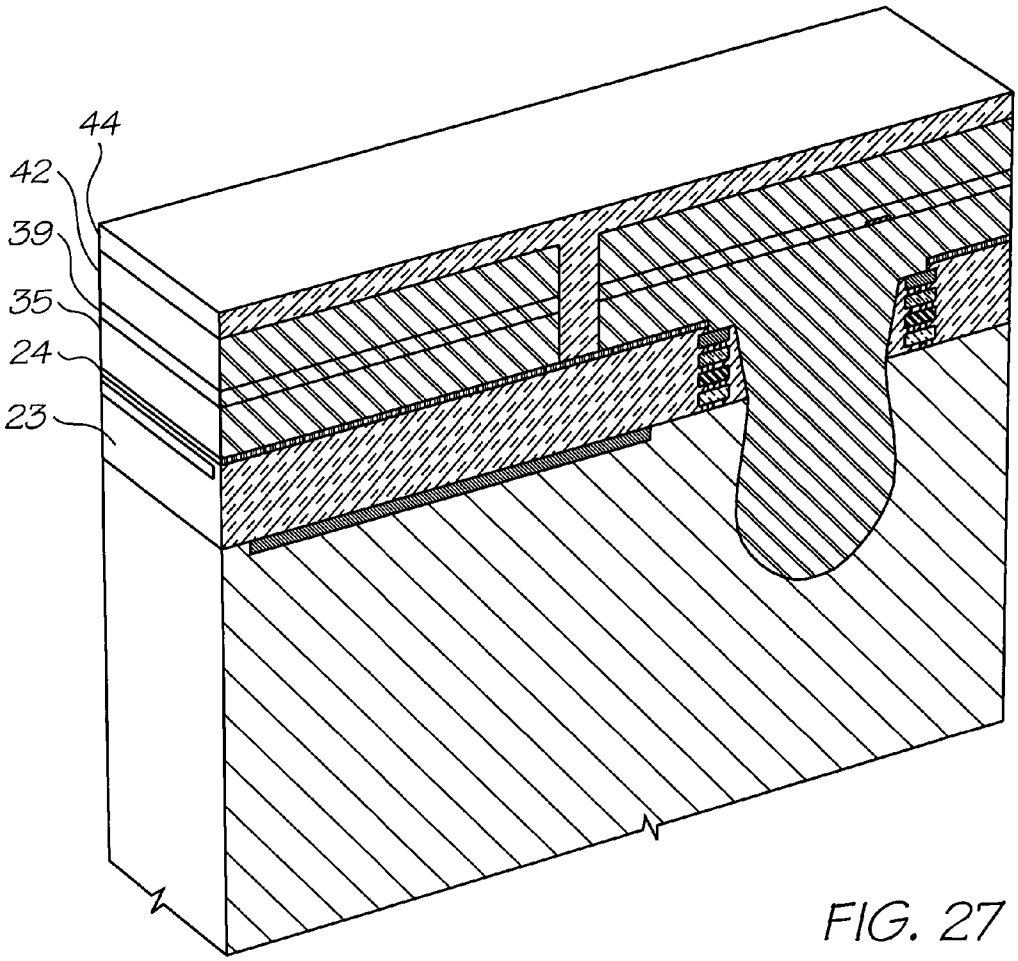

FIG. 27 shows the stage of production after the roof layer 44 has been deposited, that is, the layer which will constitute the nozzle plate 2. Instead of being formed from 100 micron thick polyimide film, the nozzle plate 2 is formed of silicon nitride, just 2 microns thick.

Figure 28:
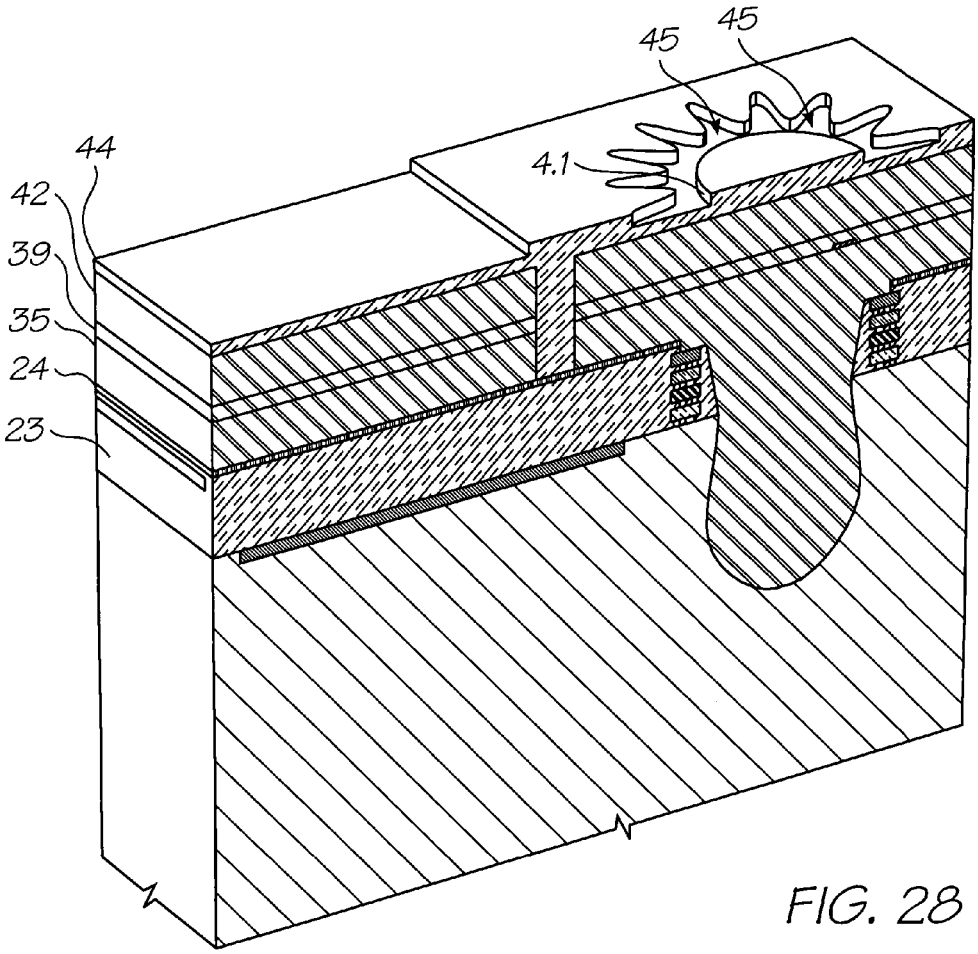
Figure 29:
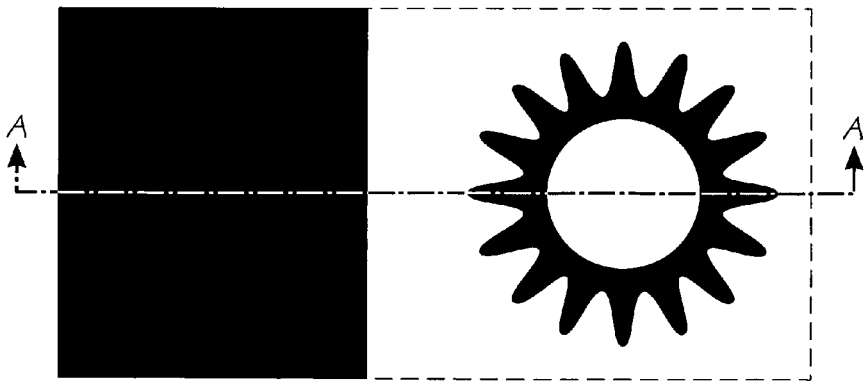

FIG. 28 shows the stage of production after the chemical vapor deposition (CVD) of silicon nitride forming the layer 44, has been partly etched at the position designated 45, so as to form the outside part of the nozzle rim 4, this outside part being designated 4.1

Figure 30:
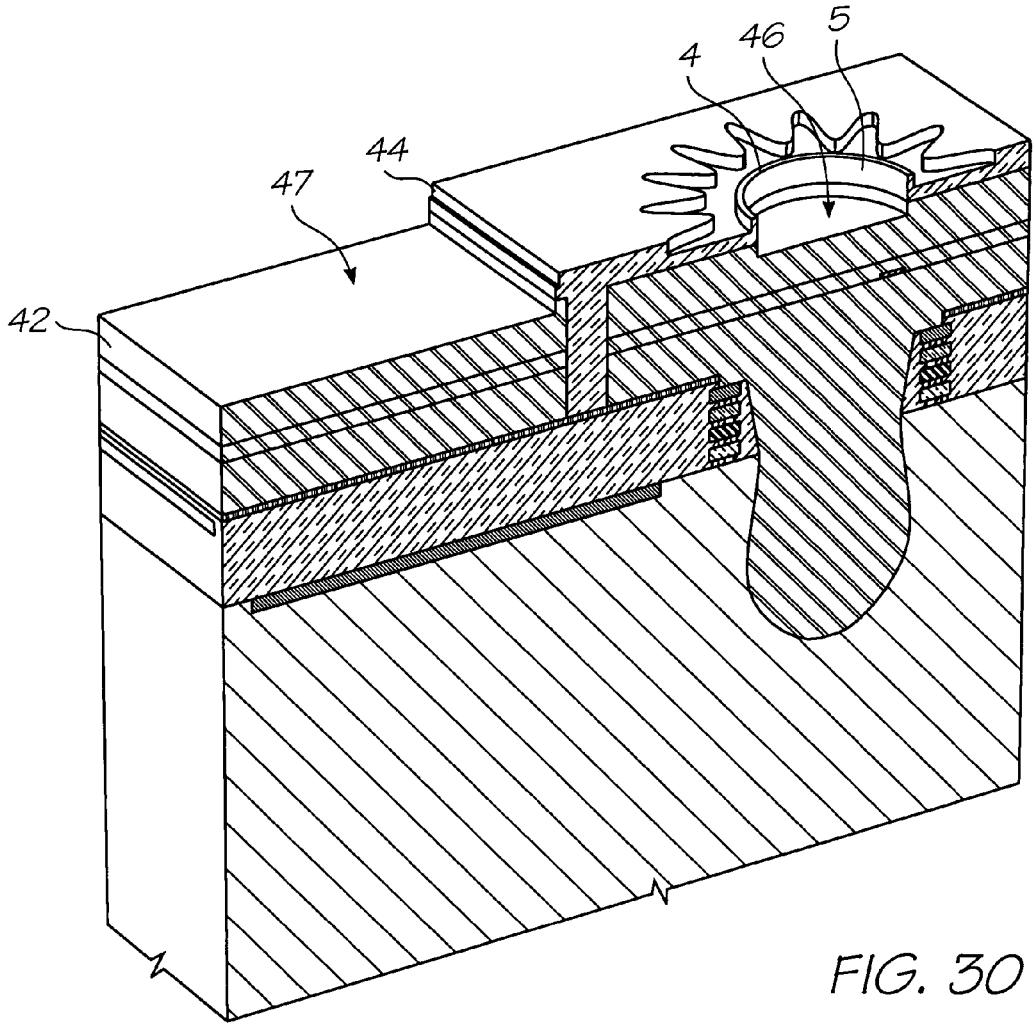
Figure 31:
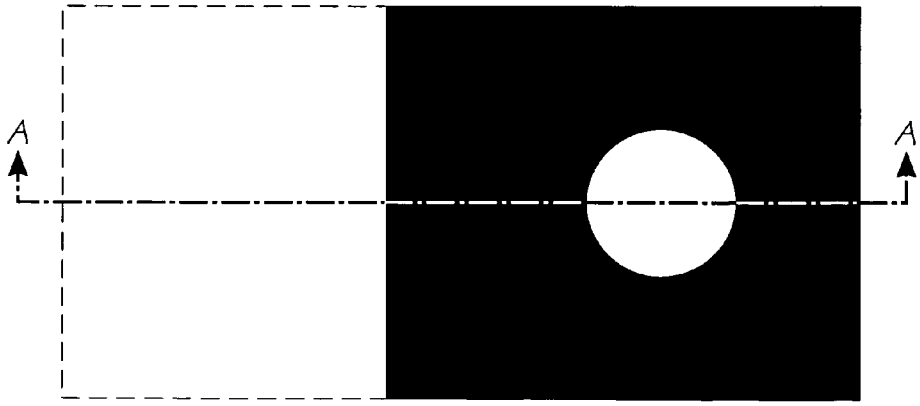

FIG. 30 shows the stage of production after the CVD of silicon nitride has been etched all the way through at 46, to complete the formation of the nozzle rim 4 and to form the ejection aperture 5, and after the CVD silicon nitride has been removed at the position designated 47 where it is not required.

Figure 32:
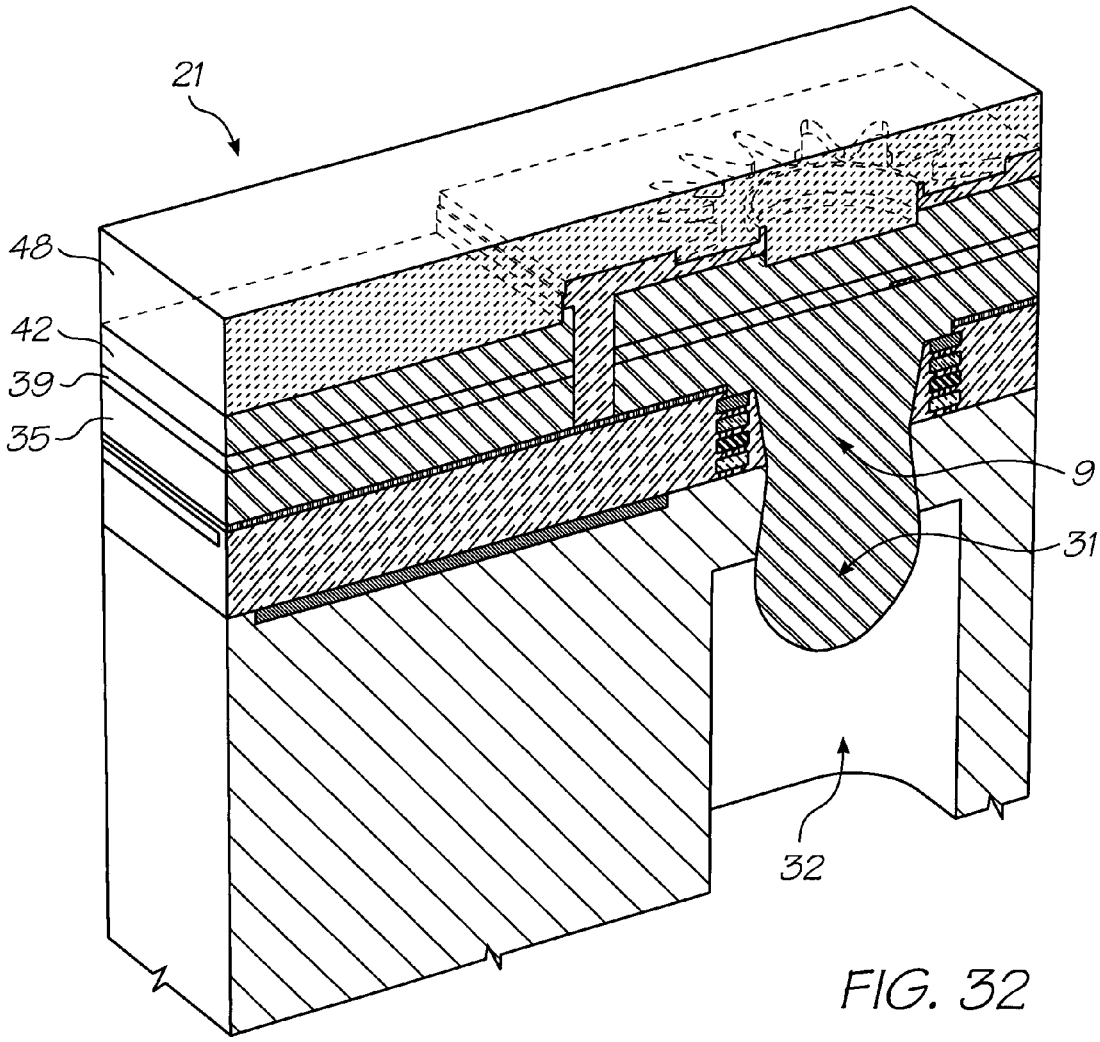

FIG. 32 shows the stage of production after a protective layer 48 of resist has been applied. After this stage, the substrate portion 21 is then ground from its other side (not shown) to reduce the substrate portion from its nominal thickness of about 800 microns to about 200 microns, and then, as foreshadowed above, to etch the hole 32. The hole 32 is etched to a depth such that it meets the hole 31.

Then, the sacrificial resist of each of the resist layers 35, 39, 42 and 48, is removed using oxygen plasma, to form the structure shown in FIG. 34, with walls 6 and nozzle plate 2 which together define the chamber 7 (part of the walls and nozzle plate being shown cut-away). It will be noted that this also serves to remove the resist filling the hole 31 so that this hole, together with the hole 32 (not shown in FIG. 34), define a passage extending from the lower side of the substrate portion 21 to the nozzle 3, this passage serving as the ink inlet passage, generally designated 9, to the chamber 7.

Figure 36:
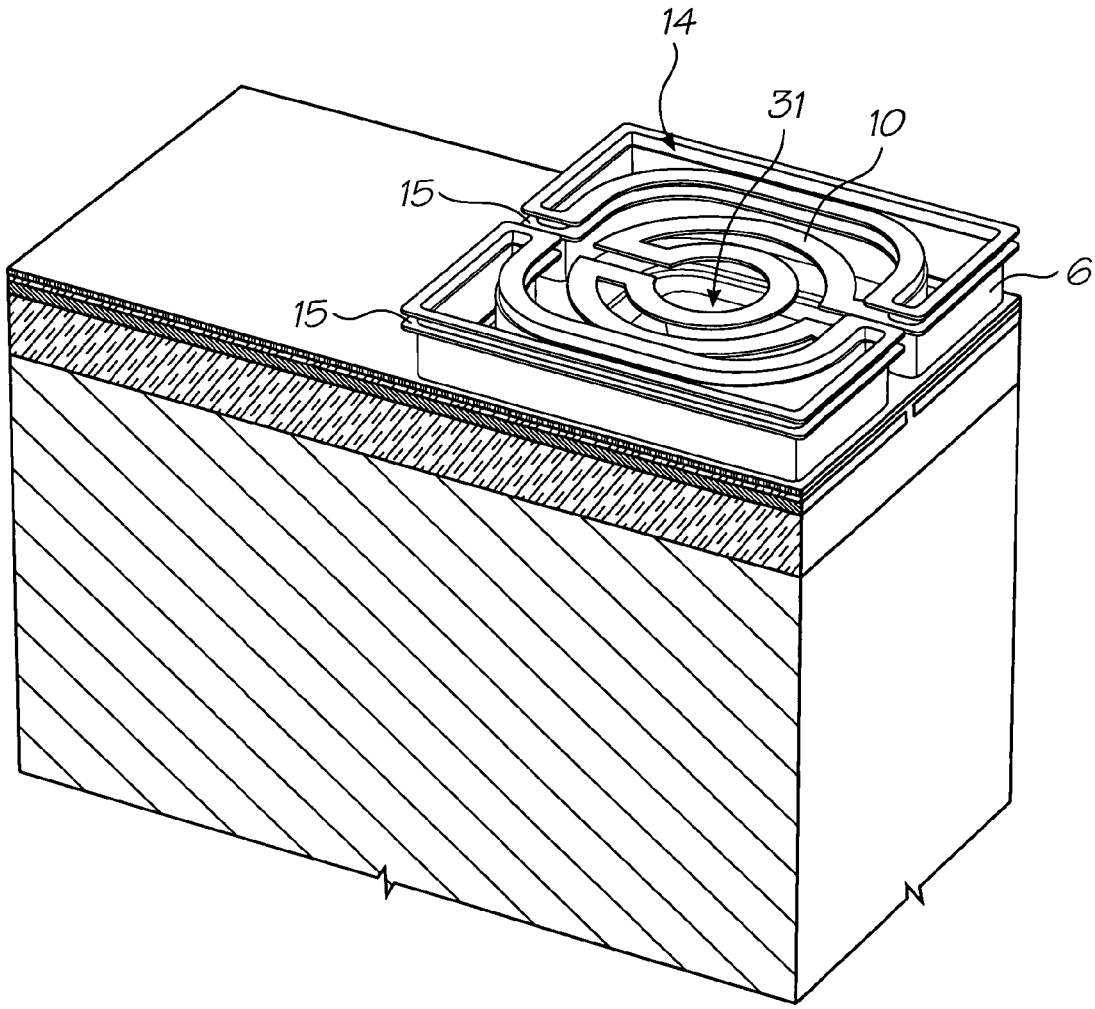
FIG. 36 is a further schematic perspective view of the unit cell of FIG. 34 shown with the nozzle plate omitted.

FIG. 36 shows the printhead with the nozzle guard and chamber walls removed to clearly illustrate the vertically stacked arrangement of the heater elements 10 and the electrodes 15.

While the above production process is used to produce the embodiment of the printhead shown in FIG. 34, further printhead embodiments, having different heater structures, are shown in FIG. 37, FIGS. 39 and 41, and FIGS. 42 and 44.

Bonded Heater Element

In other embodiments, the heater elements are bonded to the internal walls of the chamber. Bonding the heater to solid surfaces within the chamber allows the etching and deposition fabrication process to be simplified. However, heat conduction to the silicon substrate can reduce the efficiency of the nozzle so that it is no longer 'self cooling'. Therefore, in embodiments where the heater is bonded to solid surfaces within the chamber, it is necessary to take steps to thermally isolate the heater from the substrate.

One way of improving the thermal isolation between the heater and the substrate is to find a material with better thermal barrier properties than silicon dioxide, which is the traditionally used thermal barrier layer, described in U.S. Pat. No. 4,513,298. The Applicant has shown that the relevant parameter to consider when selecting the barrier layer, is the thermal product; $(\rho Ck)^{1/2}$. The energy lost into a solid underlayer in contact with the heater is proportional to the thermal product of the underlayer, a relationship which may be derived by considering the length scale for thermal diffusion and the thermal energy absorbed over that length scale. Given that proportionality, it can be seen that a thermal barrier layer with reduced density and thermal conductivity will absorb less energy from the heater. This aspect of the invention focuses on the use of materials with reduced density and thermal conductivity as thermal barrier layers inserted underneath the heater layer, replacing the traditional silicon dioxide layer. In particular, this aspect of the invention focuses on the use of low-k dielectrics as thermal barriers Low-k dielectrics have recently been used as the inter-metal dielectric of copper damascene integrated circuit technology. When used as an inter-metal dielectric, the reduced density and in some cases porosity of the low-k dielectrics help reduce the dielectric constant of the inter-metal dielectric, the capacitance between metal lines and the RC delay of the integrated circuit. In the copper damascene application, an undesirable consequence of the reduced dielectric density is poor thermal conductivity, which limits heat flow from the chip. In the thermal barrier application, low thermal conductivity is ideal, as it limits the energy absorbed from the heater.

Two examples of low-k dielectrics suitable for application as thermal barriers are Applied Material's Black Diamond™ and Novellus' Coral™, both of which are CVD deposited SiOCH films. These films have lower density than $SiO_2$ (~1340 $kgm^{-3}$ vs ~2200 $kgm^{-3}$) and lower thermal conductivity (~0.4 $Wm^{-1}K^{-1}$ vs ~1.46 $Wm^{-1}K^{-1}$). The thermal products for these materials are thus around 600 $Jm^{-2}K^{-1}s^{-1/2}$, compared to 1495 $Jm^{-2}K^{-1}s^{-1/2}$ for $SiO_2$ i.e. a 60% reduction in thermal product. To calculate the benefit that may be derived by replacing $SiO_2$ underlayers with these materials, models using equation 3 in the Detailed Description can be used to show that ~35% of the energy required to nucleate a bubble is lost by thermal diffusion into the underlayer when $SiO_2$ underlayers are used. The benefit of the replacement is therefore 60% of 35% i.e. a 21% reduction in nucleation energy. This benefit has been confirmed by the Applicant by comparing the energy required to nucleate a bubble on 1. heaters deposited directly onto $SiO_2$ and
2. heaters deposited directly onto Black Diamond™.

The latter required 20% less energy for the onset of bubble nucleation, as determined by viewing the bubble formation stroboscopically in an open pool boiling configuration, using water as a test fluid. The open pool boiling was run for over 1 billion actuations, without any shift in nucleation energy or degradation of the bubble, indicating the underlayer is thermally stable up to the superheat limit of the water i.e. ~300° C. Indeed, such layers can be thermally stable up to 550° C., as described in work related to the use of these films as Cu diffusion barriers (see "Physical and Barrier Properties of Amorphous Silicon-Oxycarbide Deposited by PECVD from Octamethylcycltetrasiloxane", Journal of The Electrochemical Society, 151 (2004) by Chiu-Chih Chiang et. al.).

Further reduction in thermal conductivity, thermal product and the energy required to nucleate a bubble may be provided by introducing porosity into the dielectric, as has been done by Trikon Technologies, Inc. with their ORION™ 2.2 porous SiOCH film, which has a density of ~1040 $kgm^{-3}$ and thermal conductivity of ~0.16 $Wm^{-1}K^{-1}$ (see IST 2000 30043, "Final report on thermal modeling", from the IST project "Ultra Low K Dielectrics For Damascene Copper Interconnect Schemes"). With a thermal product of ~334 $Jm^{-2}K^{-1}s^{-1/2}$, this material would absorb 78% less energy than a $SiO_2$ underlayer, resulting in a 78*35%=27% reduction in the energy required to nucleate a bubble. It is possible however that the introduction of porosity may compromise the moisture resistance of the material, which would compromise the thermal properties, since water has a thermal product of 1579 $Jm^{-2}K^{-1}s^{-1/2}$, close to that of $SiO_2$. A moisture barrier could be introduced between the heater and the thermal barrier, but the heat absorption in this layer would likely degrade overall efficiency: in the preferred embodiment the thermal barrier is directly in contact with the underside of the heater. If it is not in direct contact, the thermal barrier layer is preferably no more than 1 μm away from the heater layer, as it will have little effect otherwise (the length scale for heat diffusion in the ~1 μs time scale of the heating pulse in e.g. $SiO_2$ is ~1 μm).

An alternative for further lowering thermal conductivity without using porosity is to use the spin-on dielectrics, such as Dow Corning's SiLK™, which has a thermal conductivity of 0.18 $Wm^{-1}K^{-1}$. The spin-on films can also be made porous, but as with the CVD films, that may compromise moisture resistance. SiLK has thermal stability up to 450° C. One point of concern regarding the spin-on dielectrics is that they generally have large coefficients of thermal expansion (CTEs). Indeed, it seems that reducing k generally increases the CTE. This is implied in "A Study of Current Multilevel Interconnect Technologies for 90 nm Nodes and Beyond", by Takayuki Ohba, Fujitsu magazine, Volume 38-1, paper 3. SiLK, for example, has a CTE of ~70 $ppm \cdot K^{-1}$. This is likely to be much larger than the CTE of the overlying heater material, so large stresses and delamination are likely to result from heating to the ~300° C. superheat limit of water based ink. SiOCH films, on the other hand, have a reasonably low CTE of ~10 $ppm \cdot K^{-1}$, which in the Applicant's devices, matches the CTE of the TiAlN heater material: no delamination of the heater was observed in the Applicant's open pool testing after 1 billion bubble nucleations. Since the heater materials used in the inkjet application are likely to have CTEs around ~10 $ppm \cdot K^{-1}$, the CVD deposited films are preferred over the spin-on films.

One final point of interest relating to this application relates to the lateral definition of the thermal barrier. In U.S. Pat. No. 5,861,902 the thermal barrier layer is modified after deposition so that a region of low thermal diffusivity exists immediately underneath the heater, while further out a region of high thermal diffusivity exists. The arrangement is designed to resolve two conflicting requirements:

1. that the heater be thermally isolated from the substrate to reduce the energy of ejection and
2. that the printhead chip be cooled by thermal conduction out the rear face of the chip.

Such an arrangement is unnecessary in the Applicant's nozzles, which are designed to be self cooling, in the sense that the only heat removal required by the chip is the heat removed by ejected droplets. Formally, 'self cooled' or 'self cooling' nozzles can be defined to be nozzles in which the energy required to eject a drop of the ejectable liquid is less than the maximum amount of thermal energy that can be removed by the drop, being the energy required to heat a volume of the ejectable fluid equivalent to the drop volume from the temperature at which the fluid enters the printhead to the heterogeneous boiling point of the ejectable fluid. In this case, the steady state temperature of the printhead chip will be less than the heterogenous boiling point of the ejectable fluid, regardless of nozzle density, firing rates or the presence or otherwise of a conductive heatsink. If a nozzle is self cooling, the heat is removed from the front face of the printhead via the ejected droplets, and does not need to be transported to the rear face of the chip. Thus the thermal barrier layer does not need to be patterned to confine it to the region underneath the heaters. This simplifies the processing of the device. In fact, a CVD SiOCH may simply be inserted between the CMOS top layer passivation and the heater layer. This is now discussed below with reference to FIGS. 6 to 9.

Figure 5:
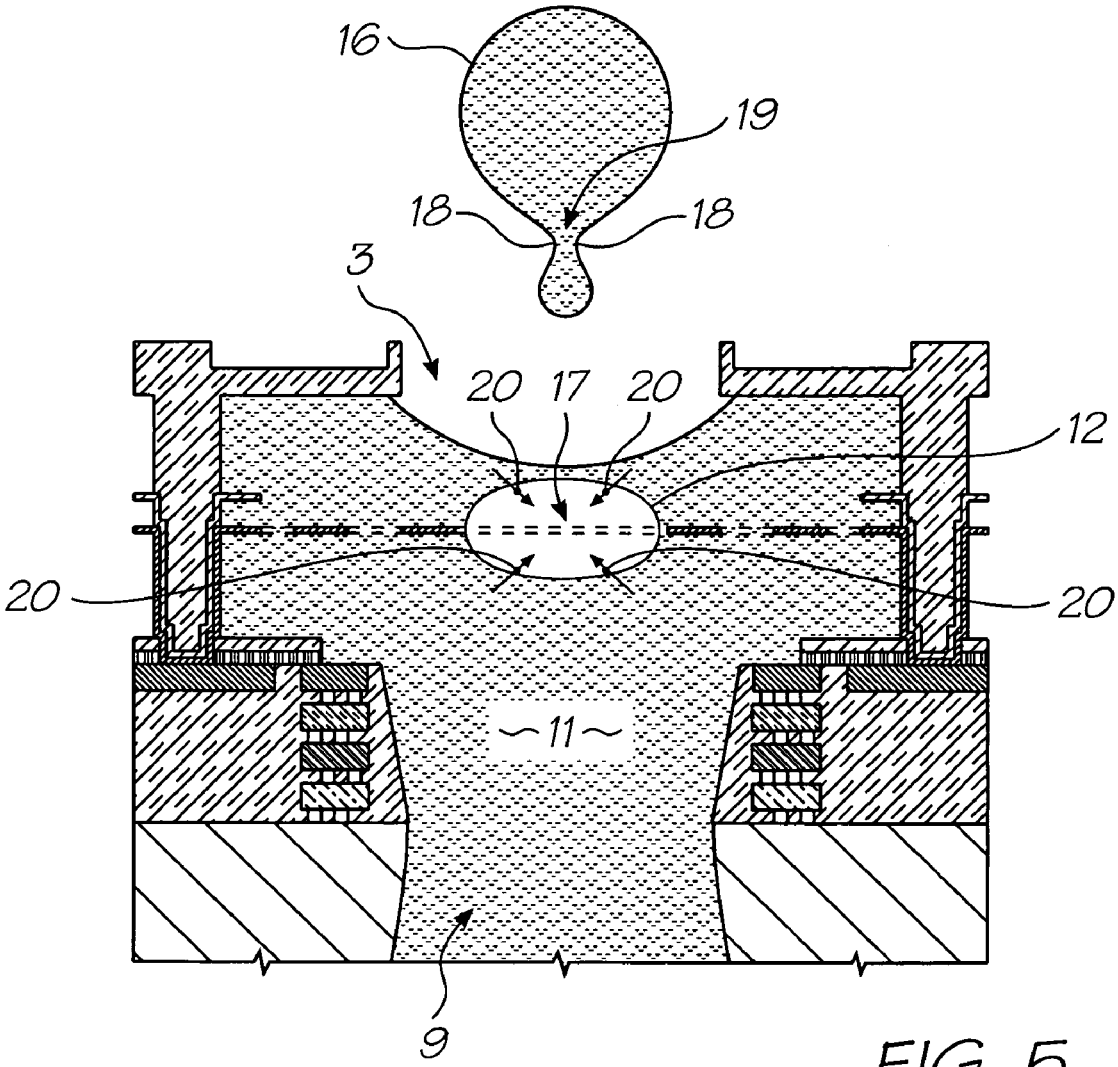
FIG. 5 is a diagrammatic cross-sectional view through a unit cell of a printhead in accordance with an embodiment of the invention showing the collapse of a vapor bubble.
Figure 6:
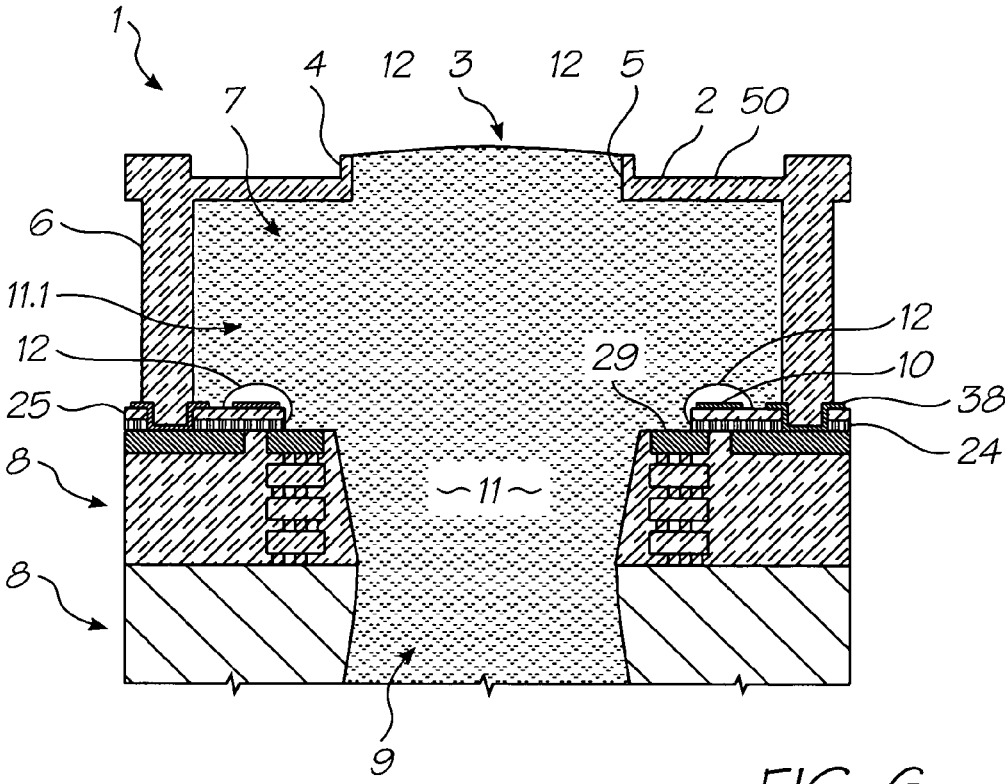
FIG. 6 is a schematic cross-sectional view through an ink chamber of a unit cell of a printhead with a floor bonded heater element, at a particular stage during its operative cycle.
Figure 7:
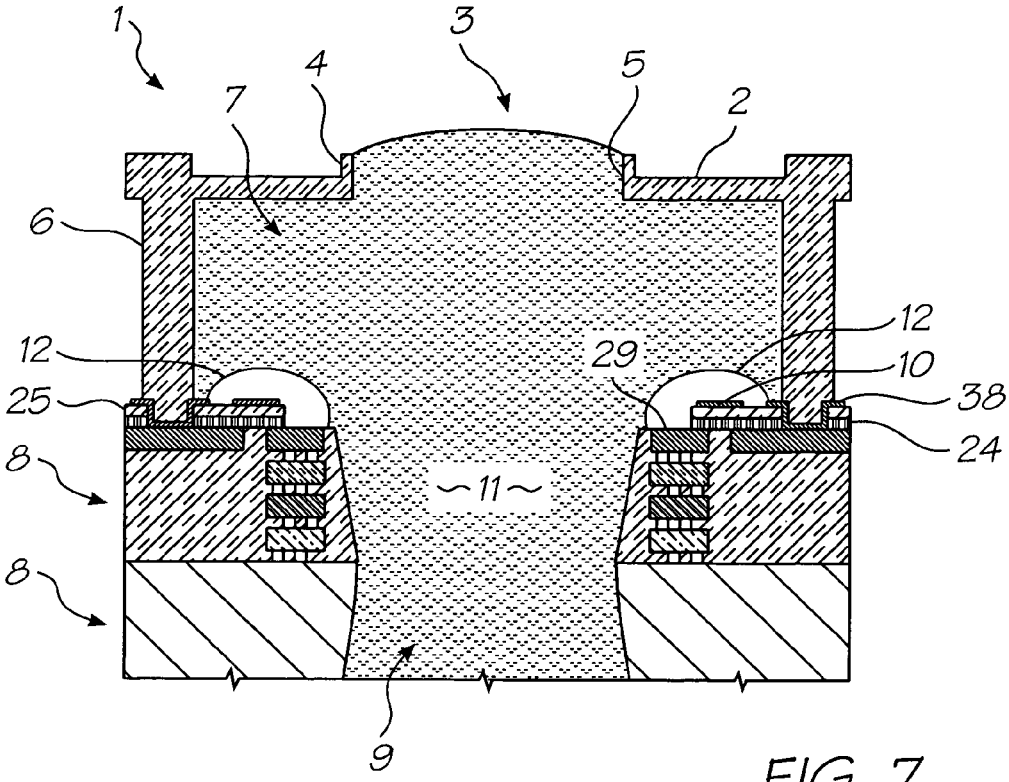
FIG. 7 is a schematic cross-sectional view through the ink chamber of FIG. 6, at another stage of operation.
Figure 8:
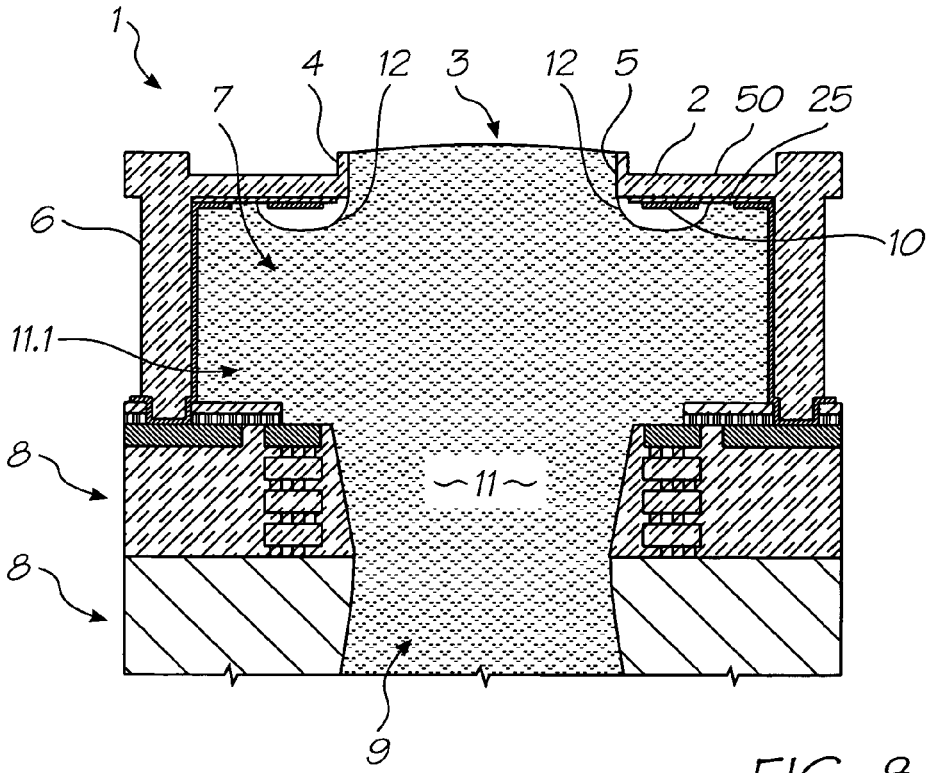
FIG. 8 is a schematic cross-sectional view through an ink chamber of a unit cell of a printhead with a roof bonded heater element, at a particular stage during its operative cycle.
Figure 9:
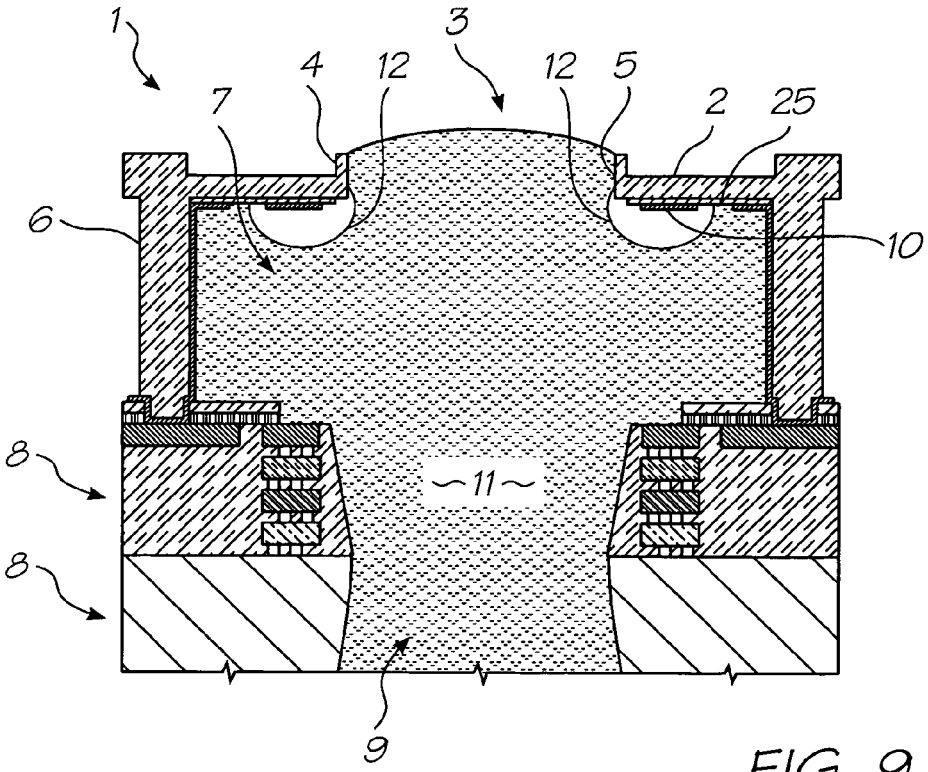
FIG. 9 is a schematic cross-sectional view through the ink chamber of FIG. 8, at another stage of operation.

FIGS. 6 to 9 schematically show two bonded heater embodiments; in FIGS. 6 and 7 the heater 10 is bonded to the floor of the chamber 7, and FIGS. 8 and 9 bond the heater to the roof of the chamber. These figures generally correspond with FIGS. 1 and 2 in that they show bubble 12 nucleation and the early stages of growth. In the interests of brevity, figures corresponding to FIGS. 3 to 5 showing continued growth and drop ejection have been omitted.

Referring firstly to FIGS. 6 and 7, the heater element 10 is bonded to the floor of the ink chamber 7. In this case the heater layer 38 is deposited on the passivation layer 24 after the etching the passivation recesses 29 (best shown in FIG. 10), before etching of the ink inlet holes 30 and 31 and deposition of the sacrificial layer 35 (shown in FIGS. 14 and 15). This re-arrangement of the manufacturing sequence prevents the heater material 38 from being deposited in the holes 30 and 31. In this case the heater layer 38 lies underneath the sacrificial layer 35. This allows the roof layer 50 to be deposited on the sacrificial layer 35, instead of the heater layer 38 as is the case in the suspended heater embodiments. No other sacrificial layers are required if the heater element 10 is bonded to the chamber floor, whereas suspended heater embodiments need the deposition and subsequent etching of the second sacrificial layer 42 above described with reference to FIGS. 25 to 35. To maintain the efficiency of the printhead, a low thermal product layer 25 can be deposited on the passivation layer 24 so that it lies between the heater element 10 and the rest of the substrate 8. The thermal product of a material and its ability to thermally isolate the heater element 10 is discussed above and in greater detail below with reference to equation 3. However, in essence it reduces thermal loss into the passivation layer 24 during the heating pulse.

FIGS. 8 and 9 show the heater element 10 is bonded to the roof of the ink chamber 7. In terms of the suspended heater fabrication process described with reference to FIGS. 10 to 44, the heater layer 38 is deposited on top of the sacrificial layer 35, so the manufacturing sequence is unchanged until after the heater layer 38 is patterned and etched. At that point the roof layer 44 is then deposited on top of the etched heater layer 38, without an intervening sacrificial layer. A low thermal product layer 25 can be included in the roof layer 44 so that the heater layer 38 is in contact with the low thermal product layer, thereby reducing thermal loss into the roof 50 during the beating pulse.

Control of Ink Drop Ejection

Referring once again to FIG. 34, the unit cell 1 shown, as mentioned above, is shown with part of the walls 6 and nozzle plate 2 cut-away, which reveals the interior of the chamber 7. The heater 14 is not shown cut away, so that both halves of the heater element 10 can be seen.

In operation, ink 11 passes through the ink inlet passage 9 (see FIG. 32) to fill the chamber 7. Then a voltage is applied across the electrodes 15 to establish a flow of electric current through the heater element 10. This heats the element 10, as described above in relation to FIG. 1, to form a vapor bubble in the ink within the chamber 7.

The various possible structures for the heater 14, some of which are shown in FIGS. 37, 39 and 41, and 42, can result in there being many variations in the ratio of length to width of the heater elements 10. Such variations (even though the surface area of the elements 10 may be the same) may have significant effects on the electrical resistance of the elements, and therefore on the balance between the voltage and current to achieve a certain power of the element.

Modern drive electronic components tend to require lower drive voltages than earlier versions, with lower resistances of drive transistors in their "on" state. Thus, in such drive transistors, for a given transistor area, there is a tendency to higher current capability and lower voltage tolerance in each process generation.

Figure 39:
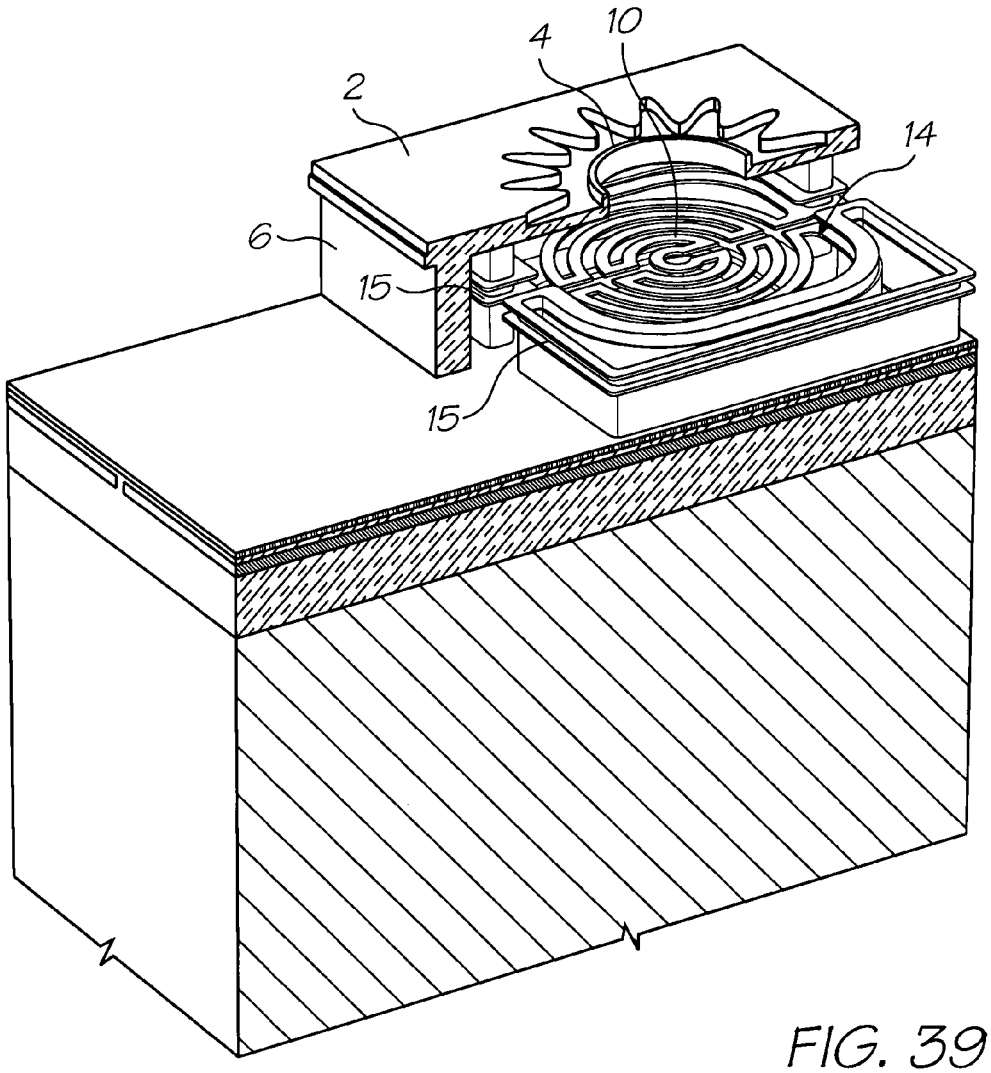
FIG. 39 is a schematic perspective view, partly cut away, of a unit cell of a printhead according to the invention having a further particular embodiment of heater element.
Figure 40:
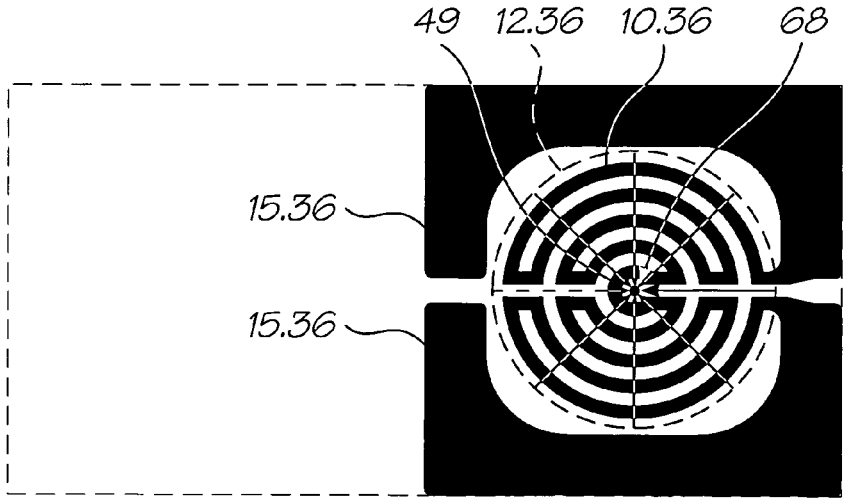
FIG. 40 is a schematic plan view of a mask suitable for use in performing the production stage for the printhead of FIG. 39 for forming the heater element thereof.
Figure 41:
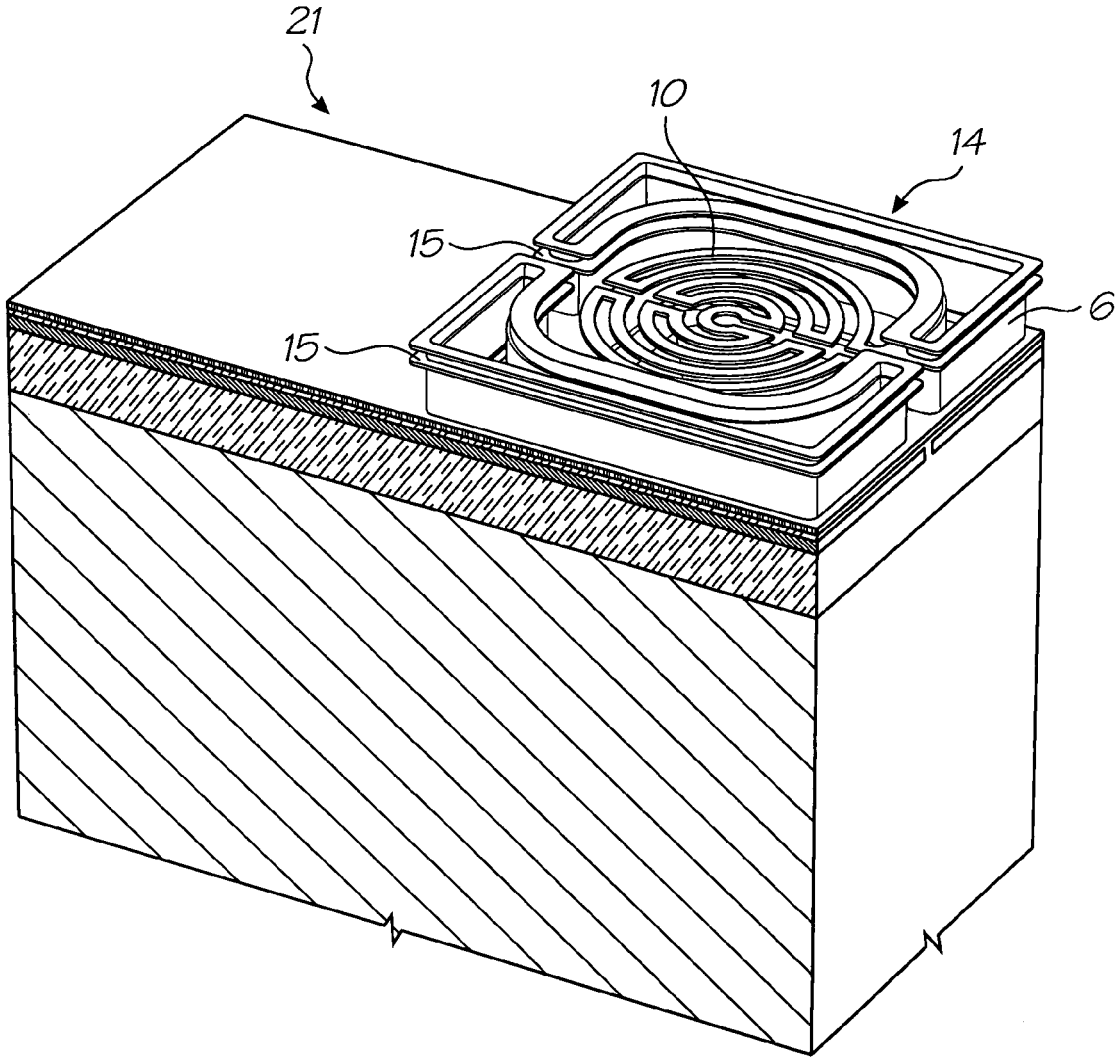
FIG. 41 is a further schematic perspective view of the unit cell of FIG. 39 shown with the nozzle plate omitted.

FIG. 40, referred to above, shows the shape, in plan view, of a mask for forming the heater structure of the embodiment of the printhead shown in FIG. 39. Accordingly, as FIG. 40 represents the shape of the heater element 10 of that embodiment, it is now referred to in discussing that heater element. During operation, current flows vertically into the electrodes 15 (represented by the parts designated 15.36), so that the current flow area of the electrodes is relatively large, which, in turn, results in there being a low electrical resistance. By contrast, the element 10, represented in FIG. 40 by the part designated 10.36, is long and thin, with the width of the element in this embodiment being 1 micron and the thickness being 0.25 microns.

Figure 37:
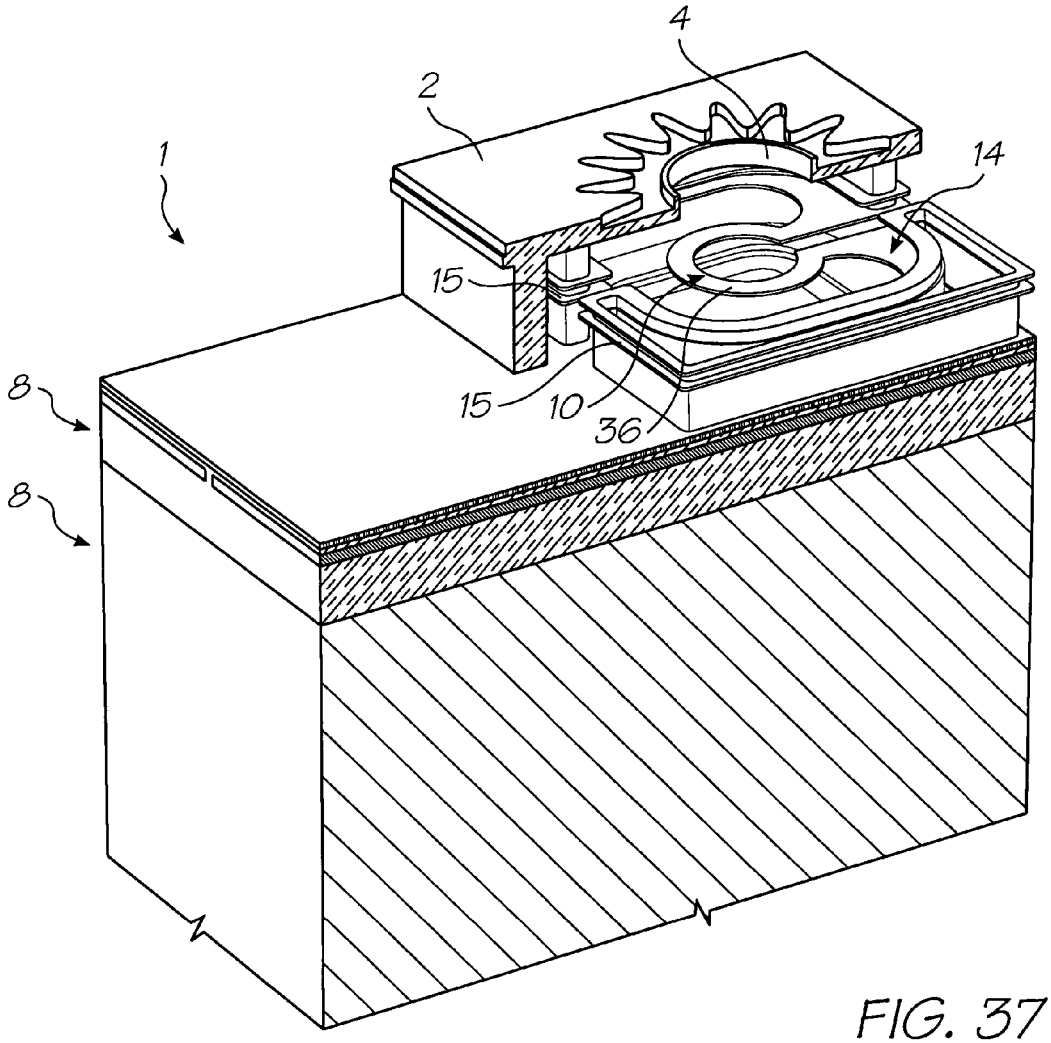
FIG. 37 is a schematic perspective view, partly cut away, of a unit cell of a printhead according to the invention having another particular embodiment of heater element.

It will be noted that the heater 14 shown in FIG. 37 has a significantly smaller element 10 than the element 10 shown in FIG. 39, and has just a single loop 36. Accordingly, the element 10 of FIG. 37 will have a much lower electrical resistance, and will permit a higher current flow, than the element 10 of FIG. 39. It therefore requires a lower drive voltage to deliver a given energy to the heater 14 in a given time.

Figure 42:
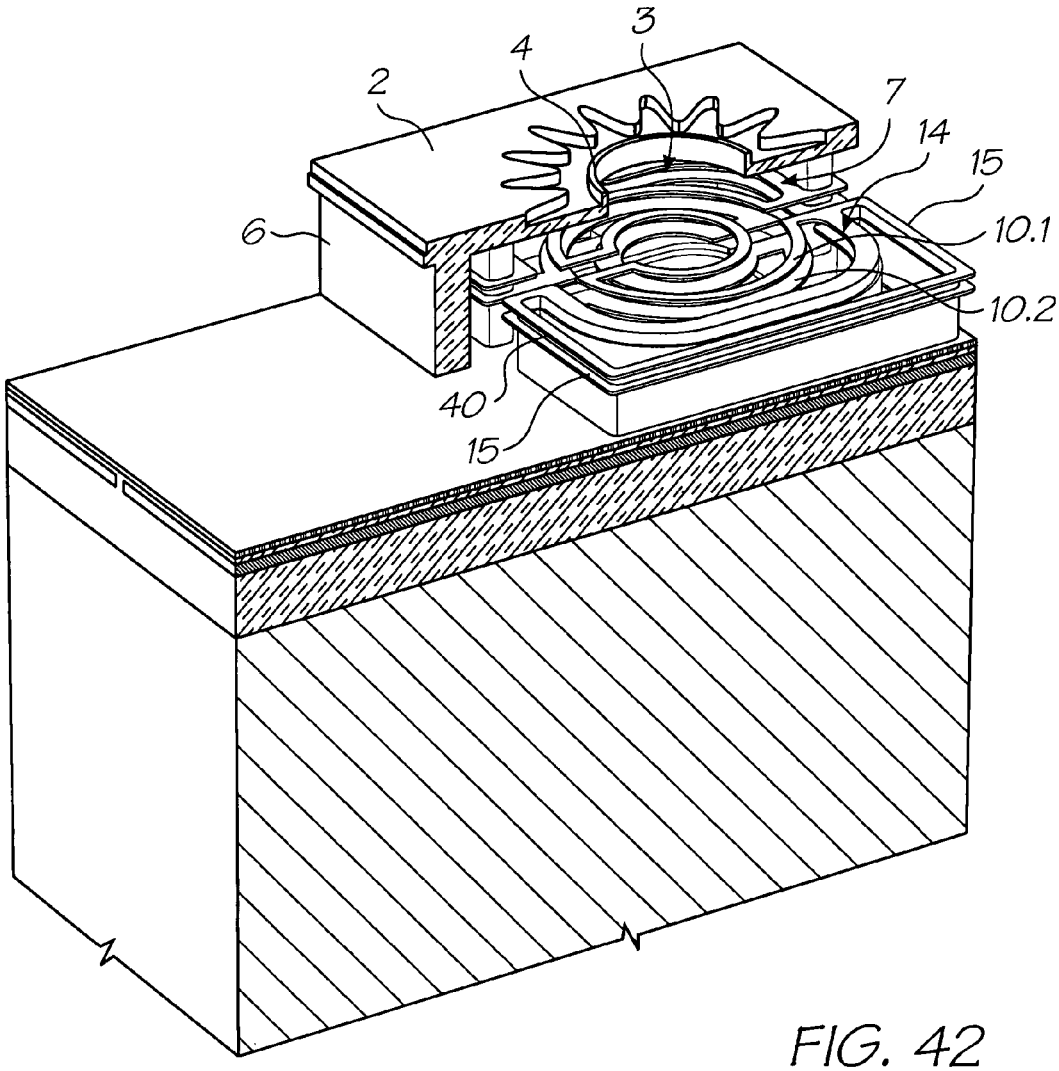
FIG. 42 is a schematic perspective view, partly cut away, of a unit cell of a printhead according to the invention having a further particular embodiment of heater element.
Figure 43:
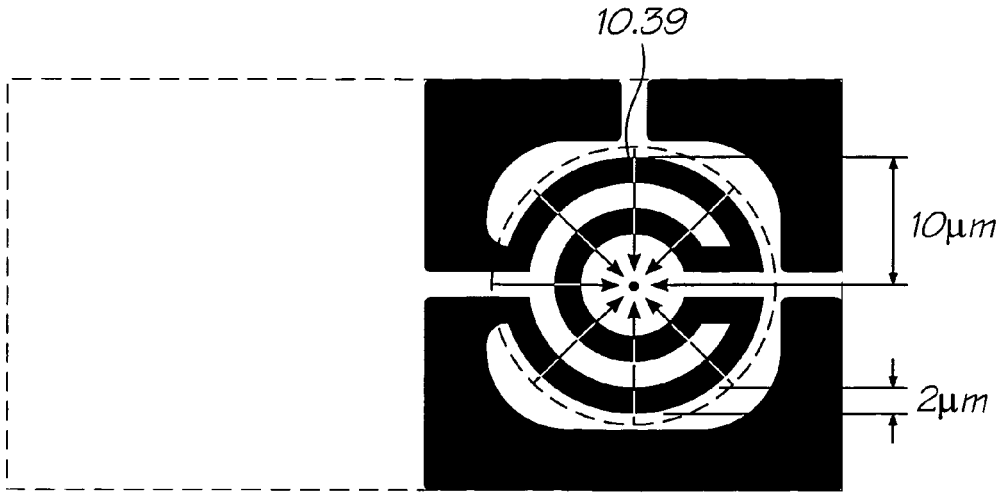
FIG. 43 is a schematic plan view of a mask suitable for use in performing the production stage for the printhead of FIG. 42 for forming the heater element thereof.

In FIG. 42, on the other hand, the embodiment shown includes a heater 14 having two heater elements 10.1 and 10.2 corresponding to the same unit cell 1. One of these elements 10.2 is twice the width as the other element 10.1, with a correspondingly larger surface area. The various paths of the lower element 10.2 are 2 microns in width, while those of the upper element 10.1 are 1 micron in width. Thus the energy applied to ink in the chamber 7 by the lower element 10.2 is twice that applied by the upper element 10.1 at a given drive voltage and pulse duration. This permits a regulating of the size of vapor bubbles and hence of the size of ink drop ejected due to the bubbles.

Assuming that the energy applied to the ink by the upper element 10.1 is X, it will be appreciated that the energy applied by the lower element 10.2 is about 2X, and the energy applied by the two elements together is about 3X. Of course, the energy applied when neither element is operational, is zero. Thus, in effect, two bits of information can be printed with the one nozzle 3.

As the above factors of energy output may not be achieved exactly in practice, some "fine tuning" of the exact sizing of the elements 10.1 and 10.2, or of the drive voltages that are applied to them, may be required.

It will also be noted that the upper element 10.1 is rotated through 180° about a vertical axis relative to the lower element 10.2. This is so that their electrodes 15 are not coincident, allowing independent connection to separate drive circuits.

Features and Advantages of Particular Embodiments

Discussed below, under appropriate headings, are specific features and advantages of embodiments of the invention. The features are described individually to provide a comprehensive understanding of each aspect of the invention.

Efficiency of the Printhead

The printhead of the present invention has a design that configures the nozzle structure for enhanced efficiency: less than 200 nanojoules (nJ) is required to heat the element sufficiently to form a bubble 12 in the ink 11, so as to eject a drop 16 of ink through a nozzle 3. In some of the Applicant's nozzle designs, the energy required to form a bubble in the ink is less than 80 nJ. By comparison, prior art devices generally require over 5 microjoules to heat the element 10 sufficiently to generate a vapor bubble 12 to eject an ink drop 16. Thus, the energy requirements of the present invention are an order of magnitude lower than that of known thermal ink jet systems. This lower energy consumption provides lower operating costs, smaller power supplies, and so on, but also dramatically simplifies printhead cooling, allows higher densities of nozzles 3, and permits printing at higher resolutions.

These advantages of the present invention are especially significant in 'self cooling' printheads where the individual ejected ink drops 16, themselves, constitute the major cooling mechanism of the printhead, as described further below.

Self-cooling of the Printhead

Referring again to FIGS. 1 to 10, this feature of the invention provides that the energy applied to a heater element 10 to form a vapour bubble 12 so as to eject a drop 16 of ink 11 is removed from the printhead by a combination of the heat removed by the ejected drop itself, and the ink that is taken into the printhead from the ink reservoir (not shown). The result of this is that the net "movement" of heat will be outwards from the printhead, to provide for automatic cooling. Under these circumstances, the printhead does not require any other cooling systems.

As the ink drop 16 ejected and the amount of ink 11 drawn into the printhead to replace the ejected drop are constituted by the same type of liquid, and will essentially be of the same mass, it is convenient to express the net movement of energy as, on the one hand, the energy added by the heating of the element 10, and on the other hand, the net removal of heat energy that results from ejecting the ink drop 16 and the intake of the replacement quantity of ink 11. Assuming that the replacement quantity of ink 11 is at ambient temperature, the change in energy due to net movement of the ejected and replacement quantities of ink can conveniently be expressed as the heat that would be required to raise the temperature of the ejected drop 16, if it were at ambient temperature, to the actual temperature of the drop as it is ejected.

It will be appreciated that a determination of whether the above criteria are met depends on what constitutes the ambient temperature. In the present case, the temperature that is taken to be the ambient temperature is the temperature at which ink 11 enters the printhead from the ink storage reservoir (not shown) which is connected, in fluid flow communication, to the inlet passages 9 of the printhead. Typically the ambient temperature will be the room ambient temperature, which is usually roughly 20° C. (Celsius).

However, the ambient temperature may be less, if for example, the room temperature is lower, or if the ink 11 entering the printhead is refrigerated.

In one preferred embodiment, the printhead is designed to achieve complete self-cooling (i.e. where the outgoing heat energy due to the net effect of the ejected and replacement quantities of ink 11 is equal to the heat energy added by the heater element 10).

By way of example, assume that the ink 11 is the bubble forming liquid and is water based, thus having a boiling point of approximately 100° C. If the ambient temperature is 40° C., then there is a maximum of 60° C. from the ambient temperature to the ink boiling temperature: that is the maximum temperature rise that the printhead could undergo. To ensure self cooling in this case, the energy required to produce each drop 16 must be less than the maximum amount of energy that can be taken away. The maximum amount of energy that can be taken away is $$E_{removed}=\rho CV\Delta T \quad \text{(equation 1)},$$

where $\rho=1000\ kg\cdot m^{-3}$ is the density of water, $C=4190\ J\cdot kg^{-1}\cdot C^{-1}$ is the specific heat of water, V is the drop volume and $\Delta T=60°$ C. Assume, by way of example, that a 1.2 pl drop is ejected. In this case $E_{removed}=302$ nJ. In this example, if it took more than 302 nJ to eject each drop, the temperature of a dense array of nozzles would rise with each pulse to the point where the ink inside the nozzles 11 would boil continuously. If, however, it took less than 302 nJ to produce each drop, then regardless of other cooling mechanisms, the steady state ink temperature would settle below the boiling point, at a maximum temperature given by $$T_{steady\ state}=T_{ambient}+E_{ejection}/\rho CV \quad \text{(equation 2)}$$

It is desirable to avoid having ink temperatures within the printhead (other than at time of ink drop 16 ejection) which are very close to the boiling point of the ink 11. Temperatures close to boiling result in elevated evaporation rates, causing the ink in the nozzles 11 to rapidly increase in viscosity and clog the nozzles. Furthermore, ink temperatures above 60° C. can cause dissolved air in water based inks to come out of solution (known as 'outgassing'), forming air bubbles that can block the ink channels, preventing refill of the nozzle chamber 7. Accordingly, a preferred embodiment of the invention is configured such that complete self-cooling, as described above, can be achieved so that the ink 11 (bubble forming liquid) in a particular nozzle chamber 7 has a steady state temperature substantially below the ink boiling point when the heating element 10 is not active. In the case of water based inks, the steady state temperature is ideally less than 60° C., to avoid outgassing of dissolved air.

The main advantage of self cooling is that it allows for a high nozzle density and for a high speed of printhead operation without requiring elaborate cooling methods for preventing undesired boiling in nozzles 3 adjacent to nozzles from which ink drops 16 are being ejected. This can allow as much as a hundred-fold increase in nozzle packing density than would be the case if such a feature, and the temperature criteria mentioned, were not present. Furthermore, if the steady state ink temperature predicted by equation 2 is significantly below boiling (~60° C. for water based inks), the firing frequency of the nozzles will not limited by thermal constraints. The maximum firing rate and the resulting print speed will instead limited by the refill time of the ink chambers.

Note that thermal conduction out of the printhead integrated circuit (see item 81 in FIG. 63) through the back (the surface of the wafer substrate opposite the nozzle plate 50) or through the wire bonds will reduce the temperature of the printhead integrated circuit (IC) further below the steady state temperature determined by equation 2. The degree to which thermal conduction further reduces the printhead IC temperature will depend on the time scale for thermal conduction out of the printhead IC and how that time scale compares with the firing rate. Designs which operate close to the self cooling limit (ink close to boiling) will still show significant frequency dependent temperature and viscosity effects. Thus, as already mentioned, it is preferable to aim for steady state fluid temperatures significantly below boiling i.e. 60° C. in the case of a water based ink.

Areal Density of Nozzles

This feature of the invention relates to the density, by area, of the nozzles 3 on the printhead. With reference to FIG. 1, the nozzle plate 2 has an upper surface 50, and the present aspect of the invention relates to the packing density of nozzles 3 on that surface. More specifically, the areal density of the nozzles 3 on that surface 50 is over 10,000 nozzles/$cm^2$ of surface area.

In one preferred embodiment, the areal density exceeds 20,000 nozzles/$cm^2$ of surface area 50, while in another preferred embodiment, the areal density exceeds 40,000 nozzles/$cm^2$. In some of the Applicant's designs, the areal density is 48 828 nozzles/$cm^2$.

When referring to the areal density, each nozzle 3 is taken to include the drive-circuitry corresponding to the nozzle, which consists, typically, of a drive transistor, a shift register, an enable gate and clock regeneration circuitry (this circuitry not being specifically identified).

Figure 47:
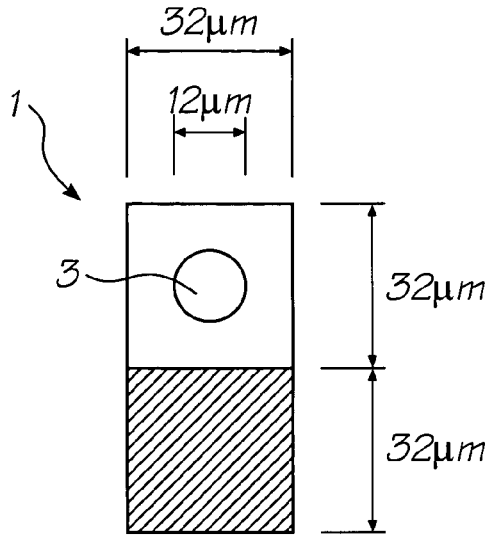
FIG. 47 is a diagrammatic plan view of a unit cell of a printhead according to an embodiment of the invention showing a nozzle.

With reference to FIG. 47 in which a single unit cell 1 is shown, the dimensions of the unit cell are shown as being 32 microns in width by 64 microns in length. The nozzle 3 of the next successive row of nozzles (see FIG. 48) immediately juxtaposes this nozzle, so that, as a result of the dimension of the outer periphery of the printhead chip, there are 48,828 nozzles/$cm^2$. This is about 85 times the nozzle areal density of a typical thermal inkjet printhead, and roughly 400 times the nozzle areal density of a piezoelectric printhead.

The main advantage of a high areal density is low manufacturing cost, as the devices are batch fabricated on silicon wafers of a particular size.

The more nozzles 3 that can be accommodated in a square cm of substrate, the more nozzles can be fabricated in a single batch, which typically consists of one wafer. The cost of manufacturing a CMOS plus MEMS wafer of the type used in the printhead of the present invention is, to some extent, independent of the nature of patterns that are formed on it. Therefore if the patterns are relatively small, a relatively large number of nozzles 3 can be included. This allows more nozzles 3 and more printheads to be manufactured for the same cost than in cases where the nozzles had a lower areal density. The cost is directly proportional to the area taken by the nozzles 3.

Drop Size

Equation 2 ($T_{steady\ state}=T_{ambient}+E_{ejection}/\rho CV$) shows that both the drop volume and ejection energy strongly impact the steady state temperature of the ink in a self-cooling printhead. Doubling the drop size, for example, doubles the amount of heat the drop can take away, but doubling the drop size will generally required more energy, so the steady state ink temperature will not necessarily be lower.

In the present invention, the print head resolution is 1600 dpi and the preferred drop size is between 1 pl and 2 pl. Drops that are 1 pl will produce 1600 dpi images on a page without any white space visible between dots if the drop placement accuracy is very good. Drops that are 2 pl will produce 1600 dpi dots that overlap significantly, loosening the requirement for accuracy and drop trajectory stability (commonly termed "directionality").

Equation 2 can be used to determine the relationship between $\Delta T=T_{steady\ state}-T_{ambient}$ and the energy required to eject drops between 1 pl and 2 pl. For 1 pl drops of water based ink, a 300 nJ ejection energy results in a 71° C. rise from the ambient temperature. For 1.2 pl drops, 300 nJ results in a 60° C. rise and for 2 pl drops, 300 nJ results in a 36° C. rise. Assuming the worst case ambient temperature is 40° C., the steady state ink temperature with 300 nJ, 2 pl drop ejection will be 76° C. The ink will be above the boiling point with 300 nJ, 1 pl drop ejection and the ink will be at the boiling point with 300 nJ, 1.2 pl drop ejection. Given the constraints on drop size and ink temperature, for the present invention 300 nJ is chosen as the upper limit of ejection energy for a viable self-cooling design.

Features of Low Energy Ejection

The embodiments shown achieve self cooling with nozzle designs that eject with much less energy than the prior art. This led to the development of a range of mechanisms and techniques for reducing ejection energy. These are best understood by considering the energy required for bubble formation and each source of energy loss associated with driving the heater. An approximate expression for the energy required for bubble formation is:

$$E\approx\Delta T*A*\{\rho_h C_h t_h+\rho_c C_c t_c+\{(\rho_u C_u k_u)^{1/2}+(\rho_i C_i k_i)^{1/2}\}\tau^{1/2}\}J+FL+SL \quad \text{(equation 3)},$$

where $\Delta T$ is the temperature increase from ambient to the film boiling point (~309° C. for water based inks), A is the planar surface area of the heater, $\rho$ is density, C is specific heat, t is thickness, k is thermal conductivity, $\tau$ is the time taken for the bubble to nucleate and the subscripts h, c, u and i refer to heater, coating, underlayer and ink respectively. The coating is any passivating or protective coating placed between the heater material and the ink, assumed for the sake of simplicity in equation 3 to be a single homogenous layer. The underlayer is the material in thermal contact with the heater, on the opposite side of the heater to the side which forms the bubble that causes ejection. This definition leaves open the possibility of heaters attached to the chamber sidewall or roof and the possibility of a heater suspended at each end which is fully immersed in ink. In the case of a suspended heater the underlayer is ink and its properties are identical to the ink properties. FL is the loss in the driving CMOS FET and SL is loss in non-nucleating resistances in series with the heater. Some second order terms associated with heat leakage from the edge of the heater have been neglected in equation 3.

According to equation 3, there are many practical possibilities for minimizing the energy required for bubble formation:

1. minimize heater area A
2. minimize protective coating thickness $t_c$
3. minimize heater thickness $t_h$
4. minimize $\rho_h C_h$ and $\rho_c C_c$
5. minimize nucleation time $\tau$
6. minimize $(\rho_i C_i k_i)^{1/2}$
7. minimize $(\rho_u C_u k_u)^{1/2}$
8. minimize FET loss FL
9. minimize series loss SL Each of these options is discussed in detail below.

Reduced Heater Area

The heater area A plays a large role in equation 3. Two terms scale directly with area: the energy required to heat the heater to the film boiling point $\Delta TA\rho_h C_h t_h$ and the energy required to heat the coating to the film boiling point $\Delta TA\rho_c C_c t_c$. The energy lost by diffusion into the underlayer $\Delta TA(\rho_u C_u k_u)^{1/2}\tau^{1/2}$ and the energy lost by diffusion into the ink $\Delta TA(\rho_i C_i k_i)^{1/2}\tau^{1/2}$ are even more strongly dependent on area, since $\tau$ depends on A: smaller area implies a smaller volume being heated and smaller volumes will reach the film boiling point more quickly with a given power input. Overall, since the FL and SL terms in equation 3 can largely be eliminated by design, heater area has a strong influence on the energy required to eject and the steady state fluid temperature. Typically, halving the heater area (keeping the heater resistance constant) will reduce the energy required to nucleate the bubble by ~60%.

The heater areas of printers currently on the market are around 400 $\mu m^2$. These heaters are covered with ~1 μm of protective coatings. If the protective coatings on prior art heaters could be removed to eliminate the energy wasted in heating them, it would be possible to create self cooling inkjets with heater areas as large as 400 $\mu m^2$, but the drop volume would need to be at least 5 pl to take the required amount of heat away. It is generally understood by people experienced in the art that drop volumes smaller than 5 pl are desirable, to:

1. enhance the resolution of the printed image and
2. reduce the amount of fluid the paper has to absorb, thereby facilitating faster printing without exacerbating paper cockle.

Drop sizes of 1-2 pl are preferable, as they allow ~1600 dpi printing. The Applicant has fabricated nozzles that eject ~1.2 pl water based ink drops with ~200 nJ ejection energy using ~150 $\mu m^2$ heaters. The corresponding temperature rise of the chip with an arbitrary number of nozzles is predicted to be 40° C., since a 1.2 pl water based ink drop 40° C. above ambient can take away 200 nJ of heat. In reality, the rise in chip temperature from the ambient will be somewhat less than this, as heat conduction out of the back of the chip is not taken into account in this calculation. In any case, these nozzles meet the definition of self cooling, as they require no cooling mechanisms other than heat removal by the droplets to keep the ink below its boiling point in the expected range of ambient temperatures. If the ambient is 20° C., the steady state chip and ink temperature will be less than 60° C., no matter how densely the nozzles are packed or how quickly they are fired. 60° C. is a good upper temperature limit to aim for, since ink can quickly dehydrate and clog the nozzles or outgas air bubbles above that temperature. Therefore, when the heater area is less than 150 $\mu m^2$, the steady state ink temperature can be <60° C. when ejecting 1.2 pl drops with 20 ° C. ambient. Likewise, if the heater area is less than 225 $\mu m^2$, the steady state ink temperature can be <80° C. when ejecting 1.2 pl drops without any conductive cooling.

Figure 49:
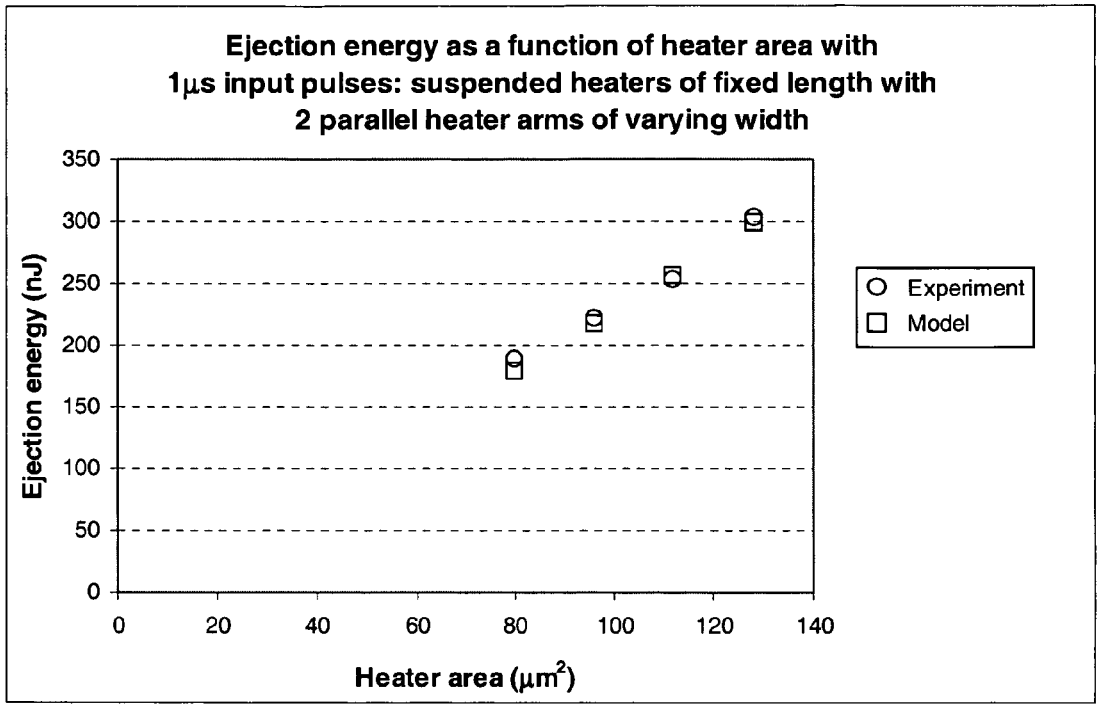
FIG. 49 shows experimental and theoretical data for the energy required for bubble formation as a function of heater area.

FIG. 49 shows experimental and theoretical data for the energy required for bubble formation, shown as discussed to be a strongly decreasing function of heater area. The experimental data was taken from some of the Applicant's early devices which suffered from contact problems and consequently had large series loss. To estimate the series resistance extraneous to the heaters in these devices, the sheet resistance of the heater material was measured using a 4 terminal structure located on the semiconductor wafer close to the devices in question. The sheet resistance and the heater geometry were used to predict the 2 terminal resistances of the heaters. When the predictions were compared with 2 terminal measurements of the heater resistances, an additional 22 Ohms of series resistance was found to be contributed by resistances extraneous to the heaters. When this 22 Ohm series resistance was put into a model based on Equation 3, the theoretical energy prediction (shown in FIG. 49) closely matched the experiment. If the series resistance were reduced from 22 Ohms to 5 Ohms, the same model predicts the energy required to nucleate with a pulse of the same width would go down by ~30%. The low resistance shunt layer described below in the section on minimizing series loss was not used in these devices: these results emphasise its benefit.

The limit to which the heater area can be reduced is determined by the evaporation of volatile ink components from the ink meniscus in the nozzle. In the case of a water based ink, evaporation of water from the ink will decrease the concentration of water in the region between the heater and the nozzle, increasing the concentration of other ink components such as the humectant glycerol. This increases the viscosity of the ink and also reduces the amount of vapour generated, so as the evaporation proceeds:

it becomes harder to push the ink through the nozzle and the bubble impulse (force integrated over time) available to push the ink reduces.

When eventually the water concentration between the heater and the nozzle drops below a certain level, the impulse of the bubble explosion will be insufficient to eject the ink. To ensure continuous firing of the nozzles, the interval between successive firings must be less than the time taken for the water concentration to drop below this critical level, after which the nozzle is effectively clogged.

This time period is influenced by many factors, including ambient humidity, the ink composition, the heater-nozzle separation and the heater area. The heater area is tied into this phenomenon through the ink viscosity. Smaller heaters have a smaller bubble, are less able to force viscous fluid out the nozzle and consequently have a lower viscosity limit for ejection. They are thus more susceptible to evaporation. Heaters that are too small will have clogging times that are impractically short, requiring that nozzles be fired at a rate that would adversely affect print quality. One would expect the 150 $\mu m^2$ heater of the present invention to have a significantly shorter clogging time than printers currently on the market, which have heater areas around 400 $\mu m^2$. In the present invention, however, there is the option of suspending the heater so that it is fully immersed in the fluid, with both the top side and underside contributing to bubble formation. In that case the effective surface area is 300 $\mu m^2$, only a 25% reduction from printers currently on the market.

Thin or Non-existent Protective Coatings

To protect against the effects of oxidation, corrosion and cavitation on the heater material, inkjet manufacturers use protective layers, typically made from $Si_3N_4$, SiC and Ta. These layers are thick in comparison to the heater. U.S. Pat. No. 6,786,575, to Anderson et al (assigned to Lexmark), is an example of this structure. The heater is ~0.1 μm thick while the total thickness of the protective layers is at least 0.7 μm. With reference to equation 3, this means there will be a $\Delta TA\rho_c C_c t_c$ term that is ~7 times larger than the $\Delta TA\rho_h C_h t_h$ term. Removing the protective layers eliminates the $\Delta TA\rho_c C_c t_c$ term. Removing the protective layers also significantly reduces the diffusive loss terms $\Delta TA(\rho_u C_u k_u)^{1/2}\tau^{1/2}$ and $\Delta TA(\rho_i C_i k_i)^{1/2}\tau^{1/2}$, since a smaller volume is being heated and smaller volumes will reach the film boiling point more quickly with a given power input. Models based on equation 3 show that removing the 0.7 μm thick protective coatings can reduce the energy required to eject by as much as a factor of 6. Thus in the preferred embodiment, there are no protective coatings deposited onto the heater material. Removing or greatly thinning the protective coatings (while maintaining a practical heater longevity) is possible, provided:

1. heater materials with improved oxidation resistance are selected
2. alternate strategies for avoiding cavitation damage are adopted.

With respect to the option of thinning the coating rather than removing it entirely, models based on equation 3 show that ~0.7 μm is the thickness limit for self cooling operation with water based inks, assuming 20° C. ambient and 1.2 pl drops: even with a relatively small 120 $\mu m^2$ heater the ink will be close to boiling using this thickness (neglecting the conductive heat sinking mechanism, on the assumption it will be inadequate for high density nozzle packing and high firing frequencies). In preferred embodiments, the total thickness of protective coating layers is less than 0.1 μm and the heater can be pulsed more than 1 billion times (i.e. eject more than 1 billion drops) before the heater burns out. Assuming the ambient temperature is 20° C., heater area is 120 $\mu m^2$ and the droplet size is 1.2 pl, the steady state ink temperature will be below 60° C. thus avoiding problems discussed above in relation to heater area.

Reduced Heater Thickness

Since the $\Delta TA\rho_c C_c t_c$ term associated with heating the protective layers is generally much larger than the $\Delta TA\rho_h C_h t_h$ term associated with heating the heater, reducing the heater thickness $t_h$ will be of little benefit unless the coating is eliminated or made thin compared to the heater. Presuming that has been done, reducing $t_h$ will further reduce the volume to be heated, thereby reducing not only the $\Delta TA\rho_h C_h t_h$ term, but also the diffusive terms, as nucleation will occur more quickly. Models based on equation 3 show that a 0.1 μm thick uncoated heater will typically require less than half of the energy required by a 0.5 μm thick heater. However, attempting to reduce thickness below 0.1 μm is likely to cause problems with deposition thickness control and possibly electromigration. To avoid the risk of electromigration failure with such thin heaters, the heater resistivity needs to be at least 2 μOhm·m, to ensure the current density is not too high (<1 $MA \cdot cm^{-2}$).

Minimizing $\rho_h C_h$ and $\rho_c C_c$

The densities and specific heats of the heater and protective coating materials are generally of secondary concern to an inkjet designer, since properties such as resistivity, oxidation resistance, corrosion resistance and cavitation resistance are of greater importance. However, if these considerations are put to one side, materials with a lower density-specific heat product are desirable. Reducing $\rho_h C_h$ and $\rho_c C_c$ and in equation 3 has the same effects as reducing $t_h$ and $t_c$.

Generally the ρC product does not vary by more than a factor of 2 in the class of materials available to the inkjet designer: considering the case of an uncoated heater, models based on equation 3 indicate the heater material selection will therefore affect the energy required to eject by at most 30%.

Minimizing Nucleation Time (Minimizing Diffusive Loss)

It is important to minimize τ, as it governs the diffusive loss into the ink and underlayer. The first step in minimizing τ is to reduce the volume to be heated, which is done by minimizing A, $t_h$, $t_c$ and in the case of a heater bonded to a solid underlayer, $(\rho_u C_u k_u)^{1/2}$. Minimizing τ then becomes a matter of selecting the right heater resistance and drive voltage, to set the heater power. Lower resistance or higher voltage will increase the power, causing a reduction in nucleation time τ. Lower resistance can be provided by either lowering the heater resistivity or making the heater wider (and shorter to avoid affecting A). Lowering the resistance is not the preferred option however, as elevating the current could cause problems with electromigration, increased FET loss FL and increased series loss SL. Higher voltage, on the other hand, could cause problems with electrolytic destruction of the heater or ink components, so a compromise is appropriate: in the preferred embodiment, FET drive voltages between 5V and 12V are considered optimum. Typical numbers derived from equation 3 for an uncoated 0.3 μm thick 120 $\mu m^2$ heater are: 175 nJ required to eject with a 5V, 1.5 μs pulse, or 110 nJ with a 7V, 0.5 μs pulse i.e. a 37% reduction in ejection energy obtained by simply changing the drive voltage. Thus, in one preferred embodiment, the voltage and resistance should be chosen to make τ<1.5 μs. In a particularly preferred embodiment, the voltage and resistance should be chosen to make τ<1 μs.

Figure 50:
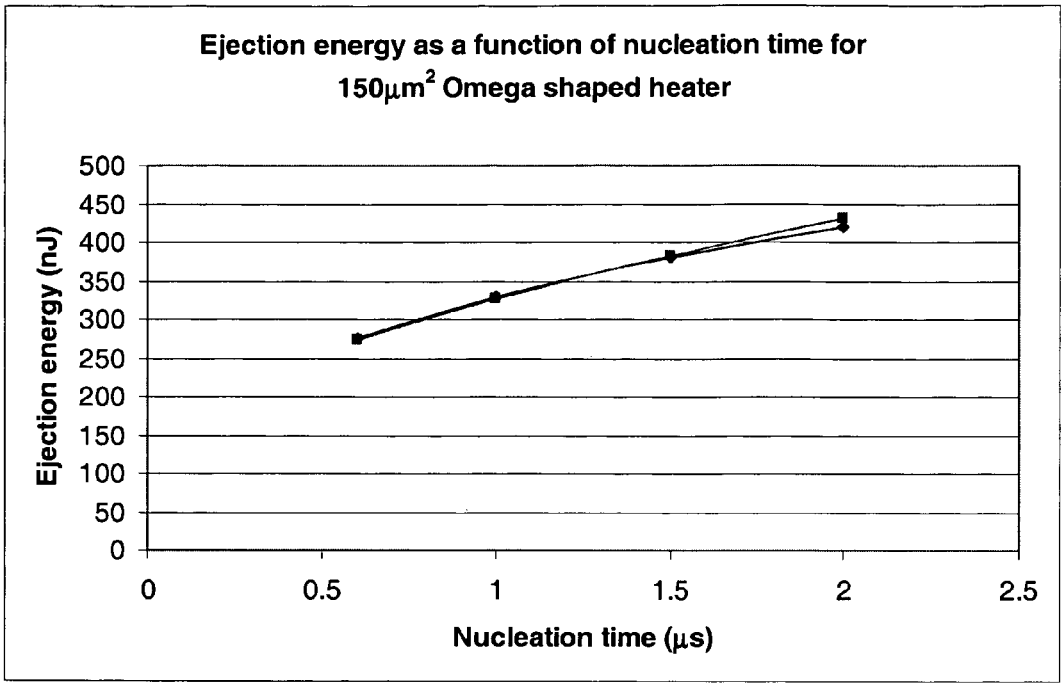
FIG. 50 shows experimental and theoretical data for the energy required for bubble formation as a function of nucleation time.
Figure 50:
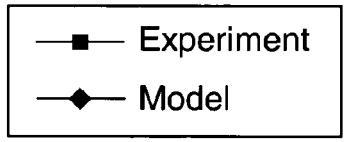

FIG. 50 shows experimental and theoretical data for the energy required for bubble formation. As discussed above, it is a strongly decreasing function of nucleation time or input pulse width (the drive voltage is adjusted to make the input pulse width equal to the nucleation time). The experimental data was taken from some of the Applicant's early devices which suffered from contact problems and consequently had large series loss. To estimate the series resistance extraneous to the heaters in these devices, the sheet resistance of the heater material was measured using a 4 terminal structure located on the semiconductor wafer close to the devices in question. The sheet resistance and the heater geometry were used to predict the 2 terminal resistances of the heaters. When the predictions were compared with 2 terminal measurements of the heater resistances, an additional 40 Ohms of series resistance was found to be contributed by resistances extraneous to the heaters. When this 40 Ohm series resistance was put into a model based on Equation 3, the theoretical energy prediction (shown in the figure) closely matched the experiment. If the series resistance were reduced from 40 Ohms to 5 Ohms, the same model predicts the energy required to nucleate with a pulse of the same width would go down by ~30%. The low resistance shunt layer described in the section on minimizing series loss was not used in these devices: these results emphasise its benefit.

It should be noted that without a shunt layer, some heater shapes will have more extraneous series resistance than others. The Omega shape, for example, has two arms which attach the heater loop to the contacts. If those arms are wider in the attachment section than the loop section, the arms will not contribute to the bubble formation, but they will contribute to the extraneous series resistance. This explains why the extraneous series resistance of these devices with an Omega shaped heater is higher than the parallel bar designs discussed in the reduced heater area section: the parallel bars run straight between the two contacts without resistive attachment sections. Without a shunt layer, heater shapes without resistive attachment sections are preferable.

Side Effects of Reduced Nucleation Time

It should be noted that the heat that diffuses into the ink and the underlayer prior to nucleation has an effect on the volume of fluid that vaporizes once nucleation has occurred and consequently the impulse of the vapor explosion (impulse=force integrated over time). Tests have shown that nozzles run with shorter, higher voltage heater pulses have shorter ink clogging times (discussed above in relation to Reduced Heater Area). This is explained by the reduced impulse of the vapor explosion, which is less able to push ink made viscous by evaporation through the nozzle.

The Applicant has additionally noted that shorter, higher voltage heater pulses reduce the extent of "microflooding". Microflooding is a phenomenon whereby the stalk dragged behind the ejecting droplet attaches itself to one side of the nozzle and drags across the surface of the nozzle plate 2. When droplet break-off occurs part of the stalk remains attached to the nozzle plate, depositing liquid onto the nozzle plate. Liquid pooling asymmetrically on one side of the nozzle can cause printing problems, because the stalks of subsequent droplets can attach themselves to the pooled liquid, causing misdirection of those droplets. The attachment of droplet stalks to liquid already on the nozzle plate encourages further accumulation of liquid, so the phenomenon of microflooding and misdirection is self-perpetuating, depending on a balance of firing rate, evaporation rate and the rate at which fluid is re-imbibed back into the nozzles. The traditional method by which the droplet stalks are discouraged from attaching themselves to the nozzle plate involves reducing the surface energy of the nozzle plate with an appropriate surface treatment or coating. This also encourages re-imbibing of fluid on the nozzle plate. However, the Applicant has found that microflooding can be dramatically reduced without surface treatment by reducing the time taken to nucleate below 1 μs. High magnification stroboscopic imaging indicates this is most likely due to the effect of reduced bubble impulse, which reduces the length of the droplet stalk and the likelihood of the stalk attaching itself to one side of the nozzle.

Minimizing $(\rho_i C_i k_i)^{1/2}$

Aside from minimizing τ, not much can be done about reducing heat lost into the ink prior to the onset of film boiling, since the so-called thermal product $(\rho_i C_i k_i)^{1/2}$ is a material property intrinsic to the ink base, be it water or alcohol. For example, ethanol has a much lower thermal product than water (570 $Jm^{-2}K^{-1}s^{-1/2}$ versus 1586 $Jm^{-2}K^{-1}s^{-1/2}$). While this would greatly reduce heat lost into the ink, the inkjet designer does not generally have the freedom to change ink base, since the ink base strongly affects the interaction of the ink with the print medium. In addition, ethanol and other similar solvents are less suitable to self-cooling printheads: despite having reduced ejection energies, the lower densities and specific heats mean less heat is able to be taken away in the droplets, and the reduced boiling points mean there is less margin for operating without boiling the ink continuously.

Improved Thermal Isolation: Minimizing $(\rho_u C_u k_u)^{1/2}$

Generally the inkjet designer has considerable freedom to tailor the thermal properties of the underlayer, by selecting a material with a low thermal product $(\rho_u C_u k_u)^{1/2}$. Low thermal conductivity k is a good initial screening criterion for material selection, since k can vary up to 2 orders of magnitude in the class of available materials, while the product ρC varies less than 1 order of magnitude. In determining whether a particular material is suitable, it is instructive to compare the thermal products of $H_2O$ (TP=1579 $Jm^{-2}K^{-1}s^{-1/2}$) and $SiO_2$ (TP=1495 $Jm^{-2}K^{-1}s^{-1/2}$). Since the thermal products of the two materials are very close, it is possible to conclude:

1. the heat energy lost into the ink is roughly equal to the heat energy lost into the underlayer if the heater is bonded to a $SiO_2$ underlayer,
2. there is little difference in dissipative loss between a heater bonded to a $SiO_2$ underlayer and a heater suspended at each end, fully immersed in ink.

Thus there are at least 2 configurations in which the heat loss into the underlayer is no worse than the heat loss into the ink (underlayer=$SiO_2$ and underlayer=ink). To improve on this situation: underlayers should be selected on the basis that the thermal product of the underlayer is less than or equal to the thermal product of the ink.

Other candidates for underlayers with lower thermal products than water or $SiO_2$ come from the new class of low-k dielectrics, such as Applied Material's Black Diamond™ and Novellus' Coral™, both of which are CVD deposited SiOC films, used in copper damascene processing. These films have lower density than $SiO_2$ (~1340 $kgm^{-3}$ vs ~2200 $kgm^{-3}$) and lower thermal conductivity (~0.4 $Wm^{-1}K^{-1}$ vs ~1.46 $Wm^{-1}K^{-1}$). Consequently, their thermal product is around 600 $Jm^{-2}K^{-1}s^{-1/2}$ i.e. a 60% reduction in thermal product compared to $SiO_2$. To calculate the benefit that may be derived by replacing $SiO_2$ underlayers with these materials, models using equation 3 can be used to show that ~35% of the energy required for ejection is lost by diffusion into the underlayer when $SiO_2$ underlayers are used. The benefit of the replacement is therefore 60% of 35% i.e. a 21% reduction in energy of ejection. Thus in another preferred embodiment, the underlayer is made from carbon doped silicon oxide (SiOC) or hydrogenated carbon doped silicon oxide (SiOCH). In a further preferred embodiment, the silica's thermal product is reduced by introducing porosity to reduce the density and thermal conductivity.

Minimizing FET Loss

The resistance of the FET depends on:

a) the area of the FET
b) the type of FET (p-channel or n-channel)
c) the load (heater) resistance driven by the FET
d) the CMOS process e.g. 5V or 12V drive The area of the FET is determined by the packing density of the nozzles and the size of each nozzle's unit cell: increasing the packing density will reduce the FET size and increase the FET resistance. N-channel FETs have lower resistance than P-channel FETs because their carrier mobility is higher. However a PFET may be preferable as it is able to pull one side of the heater up to the rail voltage. NFETs cannot do this easily: they are typically used to pull one side of the heater down to ground, implying the heater is normally held high. Holding the heater at a positive DC bias may subject the heater to electrochemical attack.

As a rule of thumb, the heater resistance should be at least 4 times higher than the FET on resistance, so that by the voltage divider equation, no more than 20% of the circuit power is dissipated in the FET. The heater resistance should not be too high though, as this reduces the power delivered to the heater, increases the nucleation time and increases the amount of heat lost by diffusion into the ink and underlayer prior to nucleation. The ideal heater resistance depends on the CMOS process chosen, and the type of FET (N or P). SPICE models of the FET can be used in conjunction with equation 3 to determine the heater resistance which minimizes FET loss without compromising diffusive loss. Typical resistance ranges for an uncoated 120 $\mu m^2$ heater are 50-200 Ohms for a 5V process and 300-800 Ohms for a 12V process. Designers with the freedom to choose should target the upper end of these ranges, to minimize device current: high currents can cause problems in the circuit external to the heater, including electromigration, series loss, power supply droop and ground bounce. Preferably, the higher resistances would be obtained with higher heater resistivity rather than modifications of the heater geometry, since higher resistivity will reduce the beater current density, reducing the likelihood of heater electromigration failure. The resistivity range suited to a 5V process is ~2.5 μOhm·m to 12 μOhm·m. The resistivity range suited to a 12V process is ~8 μOhm·m to ~100 μOhm·m. Thus in the preferred embodiment, the heater resistance is between 50 Ohms and 800 Ohms, while the heater resistivity is between 8 μOhm·m and 100 μOhm·m.

Minimizing Series Resistance Loss (SL)

Referring back to FIGS. 10 to 44, any portion of the heater layer 14 that is resistive but does not contribute to bubble formation will contribute to the series loss SL. The contributions to SL include the contact resistance of the electrodes 15 and the portions of the heater layer 14 that connect the electrodes 15 to the heater element 10: these portions will generate heat but will not get hot enough to contribute to the bubble formation. SL should be minimized as much as possible. Otherwise it can raise the steady state temperature of the ink and compromise efforts to achieve self cooling.

Minimizing contact resistance involves rigid standards of cleanliness and careful preparation of the metal surface onto which the heater electrodes 15 will be deposited. Consideration must be given to the possibility of insulating layers forming at the contact interface as a result of the formation of undesirable phases or species: in some cases a thin barrier layer may be inserted between the CMOS metal and the heater electrode 15 to avoid undesirable reactions.

The resistance of the sections connecting the electrode to the heater can be minimized by 1. minimizing the distance between the ends of the heater element 10 and the CMOS contact metal, or
2. shunting this resistance with a separately deposited and patterned layer of low resistivity material.

FIG. 23 then shows a second layer 40 that can be used to shunt the series resistance. It is also possible to put the shunt layer underneath the heater layer.

In the preferred embodiment, the series resistance contribution from the contacts and non-nucleating sections of the heater layer is less than 10 Ohms.

Bubble Formation on Opposite Sides of Heater Element

Figure 51:
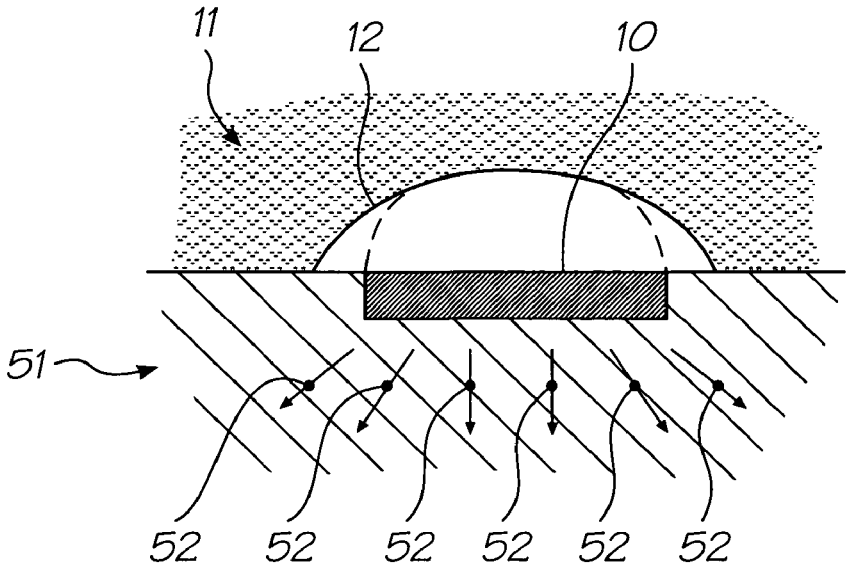
FIG. 51 is a diagrammatic section through a nozzle chamber with a heater element embedded in a substrate.
Figure 52:
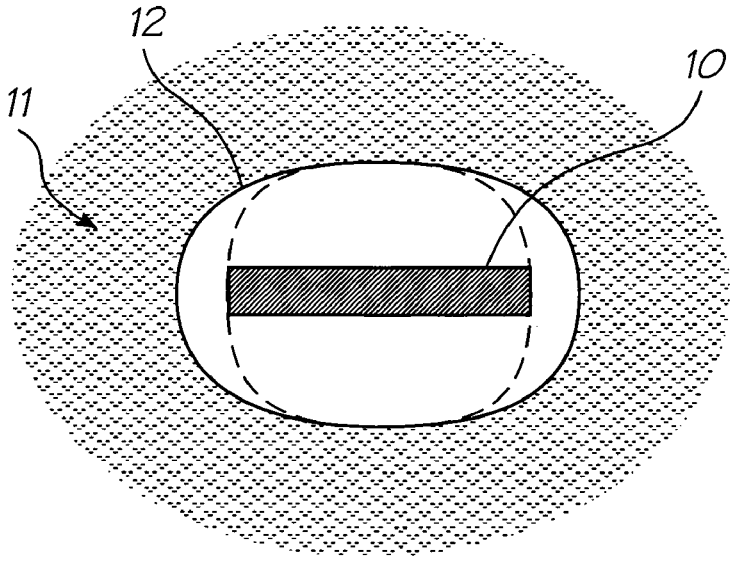
FIG. 52 is a diagrammatic section through a nozzle chamber with a heater element in the form of a suspended beam.

Referring to FIGS. 51 and 52, the heater 14 can be configured so that when a bubble 12 forms in the ink 11

(bubble forming liquid), it forms on both sides of the heater element 10. Preferably, it forms so as to surround the heater element 10 where the element is in the form of a suspended beam.

FIG. 51 shows the heater element 10 adapted for the bubble 12 to be formed only on one side, while in FIG. 52 the element is adapted for the bubble 12 to be formed on both sides, as shown.

In a configuration such as that of FIG. 51, the bubble 12 forms on only one side of the heater element 10 because the element is embedded in a substrate 51. By contrast, the bubble 12 can form on both sides in the configuration of FIG. 52 as the heater element 10 here is suspended.

Of course where the heater element 10 is in the form of a suspended beam as described above in relation to FIG. 1, the bubble 12 is allowed to form so as to surround the suspended beam element.

The advantage of the bubble 12 forming on both sides is the higher efficiency that is achievable. This is due to a reduction in heat that is wasted in heating solid materials in the vicinity of the heater element 10, which do not contribute to formation of a bubble 12. This is illustrated in FIG. 51, where the arrows 52 indicate the movements of heat into the solid substrate 51. The amount of heat lost to the substrate 51 depends on the thermal product of the solid underlayer, as discussed earlier with reference to equation 3. If the underlayer is $SiO_2$, as is typical, approximately half of the heat lost from the heater prior to nucleation will go into the substrate 51, without contributing to bubble formation.

Other Aspects of Self Cooling Design and Bubble Formation

Although equation 3 is very useful, it does not embody all the requirements of a self cooling nozzle design, as it only describes the energy required to form a bubble: it does not predict the force of the bubble, the likelihood of ejection or the impact of removing the protective overcoats on heater lifetime.

As discussed in relation to equation 3, a key step in lowering the energy required to form a bubble is the reduction of heater area. This has an undesirable side effect of reducing the force of the bubble explosion. To compensate for the reduced force, the designer must:

1. reduce the heater-nozzle separation to reduce the mass of ink that needs to be displaced
2. reduce the nozzle plate thickness to reduce viscous drag of fluid passing through the nozzle
3. implement an ink warming/nozzle declog scheme to overcome the increased susceptibility of the nozzles to evaporatively induced increases in ink viscosity.

Furthermore, with the oxidation prevention coatings removed, the designer must replace the conventional heater material with one less susceptible to oxidation. With the tantalum cavitation protection coating removed, the designer must find an alternate means of preventing cavitation damage.

These additional requirements are discussed below.

Heater-nozzle Separation

The ink chamber volumes of ink jet printers currently on the market are typically greater than 10 pl. The heaters are around 400 $\mu m^2$ and are placed at the bottom of the ink chamber, about 12 μm below the nozzle. In the present invention, 1-2 pl is chosen as preferred drop size to facilitate 1600 dpi resolution and 150 $\mu m^2$ is chosen as the preferred heater area to facilitate self cooling operation with that drop size.

The reduction in the heater area of the present invention reduces the bubble impulse (pressure integrated over area and time), so the likelihood of ejecting a particular ejectable liquid is reduced. It is possible to mitigate this effect by reducing the forces acting against the drop ejection, so that ejection with reduced bubble impulse remains possible.

The forces acting against drop ejection are associated with:

1. ink inertia,
2. surface tension and
3. viscosity.

With a particular heater area and bubble impulse, the inertia of the ink will determine the acceleration of the body of liquid between the heater and the nozzle. The inertia depends on the liquid density and the volume of liquid between the heater and the nozzle. It is possible to reduce the ink inertia by reducing the volume of liquid between the heater and the nozzle i.e. by moving the heater closer to the nozzle. With reference to FIGS. 10 to 44, this is achieved by using a thickness of the sacrificial layer 42 less than 10 μm. If the inertia is reduced in this fashion, the liquid acceleration and momentum produced by the bubble will increase.

In choosing to move the heater closer to the nozzle, one must take into account nozzle clogging from increased ink viscosity because of water evaporation.

If the heater is moved closer to the ink-air interface, the concentration of the volatile ink component (typically water) at the level of the heater will decrease (a diffusion gradient of the volatile component results from the loss of that component by evaporation at the ink-air interface). This decreases the volume of vapour generated and the impulse of the bubble and makes the clogging time shorter.

It should be noted that the heater to nozzle aperture separation, and therefore the inertia of the ink displaced are the important design considerations and not the chamber volume. In light of this, the heater need not be attached to the bottom of the ink chamber: it may also be suspended or attached to the roof of the chamber.

It is important to realize that in addition to inertia, successful ejection requires that the bubble impart sufficient momentum to overcome the other forces acting against ejection i.e. those associated with surface tension and viscosity.

Surface Tension and Viscosity

Surface tension decelerates the emerging liquid from the moment the meniscus in the nozzle begins to bulge to the moment of drop break-off. If the bubble impulse is sufficient to push the meniscus out far enough, a droplet will form, but this droplet will drag a stalk of liquid behind it that will attach the droplet to the liquid remaining in the ink chamber. The action of surface tension in the stalk acts like a stretching rubber band that decelerates the droplet, but if the drop momentum is high enough, the stalk will stretch to a sufficient length for drop break-off to occur (a necessary condition for successful ejection). The length to which the stalk must be stretched is largely governed by the critical wavelength of the Rayleigh-Taylor instability, which is a strongly increasing function of liquid viscosity. The stalks of higher viscosity liquids will stretch out further before break-off occurs, giving surface tension more time to decelerate the droplet. Thus drop break-off is harder to achieve with higher viscosity fluids: if the bubble impulse is too low or the viscosity is high enough, the drop will not break off; the stalk will instead pull the droplet back into the ink chamber.

Nozzle Plate Thicknesses

Viscosity plays an additional role in reducing the likelihood of drop break-off: viscous drag in the nozzle reduces the momentum of fluid flowing through the nozzle. The viscous drag increases as the nozzle length in the direction of fluid flow increases, so devices with thinner nozzle plates are more likely to eject if the bubble impulse is low. As addressed below in relation to the formation of the nozzle plate 2 by CVD, and with the advantages described in that regard, the nozzle plates in the present invention are thinner than in the prior art. More particularly, the nozzle plates 2 are less than 10 μm thick and typically about 2 μm thick.

The likelihood of ejection can be determined with a particular heater area, heater-nozzle separation, nozzle diameter and length, liquid viscosity and surface tension using finite-element solutions to the Navier-Stokes equations together with the volume-of-fluid (VOF) method to simulate the free surface motion. These computations can be used to examine the optimal actuator geometry for low energy ejection (<500 nJ) for a range of liquids of interest. In particular, the following limits have been determined for successful ejection:

1. the heater-nozzle separation must be less than 5 μm at its closest point; and
2. the nozzle length must be less than 5 μm; and
3. the ejectable liquid must have a viscosity less than 5 cP.

The Applicant's devices satisfy these constraints, along with a number of others described in the above referenced co-pending applications. In doing so, the Applicant has successfully fabricated self-cooling devices, with drop sizes of 1 pl to 2 pl and ejection energies of ~200 nJ for water based inks. In comparison, printheads on the market typically have heat-nozzle separations and nozzle lengths of 10 μm or more and typically have ejection energies of ~4000 nJ.

It will be appreciated by those experienced in the art that any reduction in ejection energy is highly desirable for any thermal inkjet design, regardless of whether that reduction is sufficient to achieve self cooling. The energy of ejection will be significantly reduced by adopting the measures discussed above. This will lower the chip temperature and allow increases in nozzle density and firing rate, even if it is not to the degree permitted by self-cooling designs.

Chemical Vapour Deposited Nozzle Plate, and Thin Nozzle Plates

The nozzle ejection aperture 5 of each unit cell 1 extends through the nozzle plate 2, the nozzle plate thus constituting a structure which is formed by chemical vapor deposition (CVD). In various preferred embodiments, the CVD is of silicon nitride, silicon dioxide or silicon oxy-nitride.

The advantage of the nozzle plate 2 being formed by CVD is that it is formed in place without the requirement for assembling the nozzle plate to other components such as the walls 6 of the unit cell 1. This is an important advantage because the assembly of the nozzle plate 2 that would otherwise be required can be difficult to effect and can involve potentially complex issues. Such issues include the potential mismatch of thermal expansion between the nozzle plate 2 and the parts to which it would be assembled, the difficulty of successfully keeping components aligned to each other, keeping them planar, and so on, during the curing process of the adhesive which bonds the nozzle plate 2 to the other parts.

The issue of thermal expansion is a significant factor in the prior art, which limits the size of ink jets that can be manufactured. This is because the difference in the coefficient of thermal expansion between, for example, a nickel nozzle plate and a substrate to which the nozzle plate is connected, where this substrate is of silicon, is quite substantial. Consequently, over as small a distance as that occupied by, say, 1000 nozzles, the relative thermal expansion that occurs between the respective parts, in being heated from the ambient temperature to the curing temperature required for bonding the parts together, can cause a dimension mismatch of significantly greater than a whole nozzle length. This would be significantly detrimental for such devices.

Another problem addressed by the features of the invention presently under discussion, at least in embodiments thereof, is that, in prior art devices, nozzle plates that need to be assembled are generally laminated onto the remainder of the printhead under conditions of relatively high stress. This can result in breakages or undesirable deformations of the devices. The deposition of the nozzle plate layer 2 by CVD in the embodiments of the present invention avoids this.

A further advantage of the present features of the invention, at least in embodiments thereof, is their compatibility with existing semiconductor manufacturing processes. Depositing a nozzle plate 2 by CVD allows the nozzle plate to be included in the printhead at the scale of normal silicon wafer production, using processes normally used for semiconductor manufacture.

Existing bubble jet systems experience pressure transients, during the bubble generation phase, of up to 100 atmospheres. If the nozzle plates 2 in such devices were applied by CVD, then to withstand such pressure transients, a substantial thickness of CVD nozzle plate would be required. As would be understood by those skilled in the art, such thicknesses of deposited nozzle plates would give rise to certain problems as discussed below.

Figure 53:
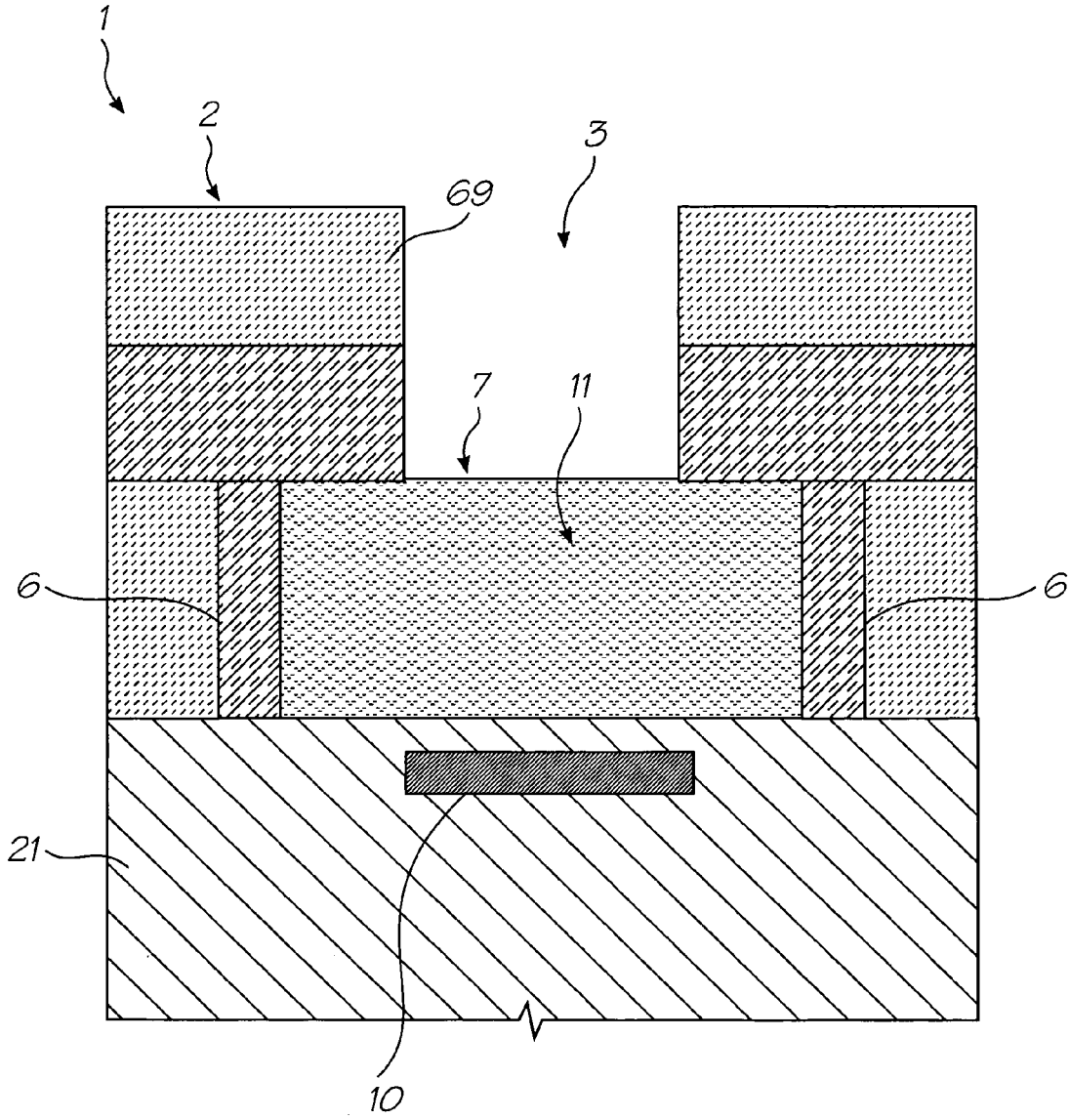
FIG. 53 is a diagrammatic section through a nozzle chamber showing a thick nozzle plate.

For example, the thickness of nitride sufficient to withstand a 100 atmosphere pressure in the nozzle chamber 7 may be, say, 10 microns. With reference to FIG. 53, which shows a unit cell 1 that is not in accordance with the present invention, and which has such a thick nozzle plate 2, it will be appreciated that such a thickness can result in problems relating to drop ejection. Increasing the thickness of nozzle plate 2, increases the fluidic drag exerted by the nozzle 3 as the ink 11 is ejected through the nozzle. This can significantly reduce the efficiency of the device.

Another problem that would exist in the case of such a thick nozzle plate 2, relates to the actual etching process. This is assuming that the nozzle 3 is etched, as shown, perpendicular to the wafer 8 of the substrate portion, for example using standard plasma etching. This would typically require more than 10 microns of resist 69 to be applied. The level of resolution required to expose that thickness of resist 69 becomes difficult to achieve, as the focal depth of the stepper that is used to expose the resist is relatively small. Although it would be possible to expose this relevant depth of resist 69 using x-rays, this would be a relatively costly process.

A further problem that would exist with such a thick nozzle plate 2 in a case where a 10 micron thick layer of nitride were CVD deposited on a silicon substrate wafer, is that, because of the difference in thermal expansion between the CVD layer and the substrate, as well as the inherent stress of within thick deposited layer, the wafer could be caused to bow to such a degree that further steps in the lithographic process would become impractical. Thus, a 10 micron thick nozzle plate 2 is possible but (unlike in the present invention), disadvantageous.

Figure 54:
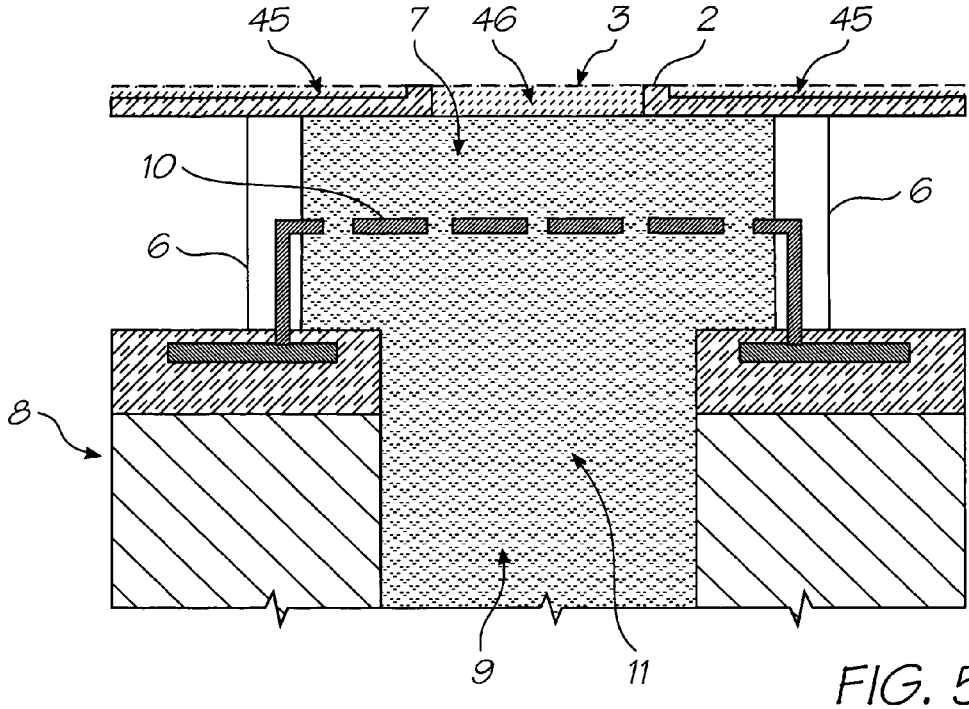
FIG. 54 is a diagrammatic section through a nozzle chamber in accordance with an embodiment of the invention showing a thin nozzle plate.

With reference to FIG. 54, in a Memjet™ thermal ink ejection device according to an embodiment of the present invention, the CVD nitride nozzle plate layer 2 is only 2 microns thick. Therefore the fluidic drag through the nozzle 3 is not particularly significant and is therefore not a major cause of loss.

Furthermore, the etch time, and the resist thickness required to etch nozzles 3 in such a nozzle plate 2, and the stress on the substrate wafer 8, will not be excessive.

Embodiments of the present invention are able to use a relatively thin nozzle plate 2 because the forces exerted on it are smaller, due to a reduction in heater surface area and input pulse length: both of these factors will as previously mentioned influence the amount of ejectable fluid that is vaporized and consequently the impulse of the bubble. However, a reduced bubble impulse can still eject drops because:

1. the small heater-nozzle separation reduces the ink inertia;
2. the fluidic drag through thin nozzle 3 is reduced;
3. the pressure loss due to ink back-flow through the inlet 9 is reduced;
4. accurate fabrication of nozzle 3 and chamber 7 reduces drop velocity variance between devices;
5. the nozzle sizes have been optimized for the bubble volumes used in the invention;
6. there is very low fluidic and thermal crosstalk between nozzles 3
7. the drop ejection is stable at low drop velocities.

As previously described with reference to FIGS. 10 to 44, the etching of the 2-micron thick nozzle plate layer 2 involves two relevant stages. One such stage involves the etching of the region designated 45 in FIGS. 28 and 54, to form a recess outside of what will become the nozzle rim 4. The other such stage involves a further etch, in the region designated 46 in FIGS. 30 and 54, which actually forms the ejection aperture 5 and finishes the rim 4.

De-Clogging Pre-Heat Cycles and Humidity

During periods of inactivity, evaporation at the ink-air interface in the nozzle will cause the concentration of the volatile ink component in the ink chamber to decrease as a function of time. Regions of the fluid closer to the ink-air interface will dry out more quickly, so a concentration gradient or depleted region of the volatile component is established near the ink-air interface. As time progresses, the depleted region will extend further towards the heater and the concentration of the volatile component in the fluid immediately in contact with the heater will decrease. The evaporation has two deleterious effects: the viscosity of the ink between the heater and the nozzle will increase, making it harder to push ink through the nozzle, and the volume of vapor generated will decrease, reducing the impulse of the bubble. Eventually, if the nozzle is left too long without firing, the impulse of the bubble explosion will be insufficient to force the fluid through the nozzle and the nozzle will become unable to fire ink. Therefore, the maximum interval between successive firings, before the nozzle becomes clogged, can be determined and monitored by the print engine controller.

A short maximum interval before clogging is undesirable when printing images with a high density nozzle array, as individual nozzles may be used irregularly. Every nozzle should be fired at a frequency less than the maximum interval before clogging. The print engine controller can do this by firing so called "keep wet" drops, i.e. drops fired at a frequency high enough to avoid clogging. However, the dots from keep wet drops can cause printing defects. Ideally, if keep-wet drops are required, they are fired between pages into a spittoon to avoid them appearing on the page. However, with small chamber volumes the viscosity of the ink increases quickly and the maximum time before clogging is typically less than the time to print a page. In this case, the keep-wet drops need to be fired onto the page. The Applicant's work in this area has found that if the density of dots from keep-wet drops is low enough, they are not visible to the human eye. To achieve this, the print engine controller (PEC) monitors the keep-wet times of every nozzle and ensures that the density keep-wet dots on the page is less than 1 in 250, and that these dots are not clustered. This effectively avoids any artifacts that can be detected by the eye. However, if the keep-wet times of the nozzles permit, the PEC will keep the density of keep-wet times below 1 in every 1000 drops.

In addition to having a keep-wet strategy to avoid clogging during operation, it is helpful to have a strategy to recover clogged nozzles: this may be useful when the printer is turned on after an idle period. The Applicant has found two recovery strategies that are particularly effective:

1. start firing the nozzles at the keep-wet frequency while running a low level DC warming current through the heater (the fire pulses add to the DC level)
2. apply a ~17 kHz burst of ~30 warm-up pulses before dropping back to the keep-wet frequency.

These strategies can generally recover nozzles that have been left for up to a day uncapped in a dry environment. The explanation behind their success lies in the strong viscosity vs temperature profile of the ink components. For example, the viscosity of water is halved by heating from 20° C. to 50° C. The heating compensates for the increase in viscosity caused by evaporation. In the case of the first strategy the ink is gently warmed with a low DC current. In the second strategy (which is more compatible with the CMOS drive circuitry) the fire pulses themselves provide the warming: with each unsuccessful firing of a clogged nozzle, the small amount of heat retained in the heater after firing will dissipate into the volume of fluid which failed to eject from the ink chamber, raising its temperature a small amount with each firing until eventually its viscosity drops below the limit for successful ejection. Thus after a number of attempted firings (typically less than 30) the clogged nozzle may successfully fire, restoring the nozzle to operation: from this point onwards the nozzle can be fired at the minimum keep-wet frequency to prevent clogging from occurring again.

The 17 kHz frequency of the warming pulses was empirically determined to be optimum for the devices, which have a chamber diameter of 30 μm. This frequency corresponds to a 1/17 kHz=59 μs pulse period. The length scale for heat diffusion in water in this time is $(4*59\times10^{-6}\ s*k_i/\rho_i C_i)^{1/2}=58$ μm, while the length scale for heat diffusion in the glycerol humectant (which remains behind after the water has evaporated) is 48 μm. Thus it appears the ideal warming pulse interval should exceed the time scale for heat diffusion across the ink chamber, to ensure the entire volume of fluid to be ejected is heated. The warming pulse interval should not significantly exceed the time scale for heat diffusion, as that will allow the heat to dissipate away from the chamber, in which case the fluid temperature will not build up to the optimum point at the required rate and may even have a negative effect in causing increased evaporation. The optimum temperature for a water based ink is considered to be 50° C.-60° C.: high enough to lower the viscosity significantly from the room temperature value, but low enough to avoid increasing the evaporation rate significantly and low enough to avoid outgassing of dissolved air in the ink.

Note that as soon as ejection is restored with the 17 kHz pulse train, the temperature of the ink in the nozzle will settle at the value determined by self cooling: it does not matter that the heaters are being fired particularly quickly, as an advantage of self cooling is that the steady state fluid temperature is largely independent of the firing rate. As long as the time taken to refill the nozzles after firing is low enough, firing the nozzles at 17 kHz once they have declogged will not cause a problem. The Applicant's nozzles typically refill within 20 μs, so 17 kHz ejection is well within their capability.

The number of pulses in the pulse train is a compromise between the effectiveness of the declog cycle and ink wastage: too few pulses and the ink may not increase in temperature enough to declog; too many pulses and a lot of ink will be wasted if ejection is restored early in the declog cycle. Thirty pulses give the nozzles ample opportunity to declog, given the total amount of energy involved: if the nozzles are not declogged after 30 pulses, more pulses are unlikely to help.

A nozzle which has been left for a very long time may not be successfully restored to operation by the above strategies, as the reduction in viscosity provided by the warming cycle may not be sufficient to compensate for the increase in viscosity caused by evaporation. In this case a third strategy is required. The Applicant's nozzles have been shown to be recoverable in these circumstances when the ambient relative humidity is raised above 60%. At this level of humidity, the humectant in the ink takes up enough water from the atmosphere to reduce the viscosity of the ink in the chamber to an ejectable level. A humid environment may be supplied by two methods:

1. humid air blowing across the nozzles, or
2. a capping mechanism, providing a sealed or mostly sealed chamber covering the printhead, with a source of moisture within the chamber.

The first method could be used continuously to prevent clogging from occurring during operation, as the humid environment will reduce the evaporation rate, decreasing or eliminating the need for keep-wet drops. Alternatively, it could be used sparingly as a remedial measure, in conjunction with one of the warm-and-fire declog cycles, to recover clogged nozzles. Either way, the method has the advantage of not requiring the application of a capping mechanism, so it would not interrupt printing.

The second method could not be used to prevent clogging during printing, but could be used to prevent clogging during idle periods. It could also be used as a remedial measure to recover clogged nozzles: the capping mechanism could be applied, then a warm-and-fire declog cycle could be used. This would require that printing be stopped however, so printers without the humid air will generally require the keep-wet drops to prevent clogging.

As discussed above, the PEC can guarantee that during operation, each nozzle will be fired at an interval not more than the keep-wet time of the ink in the nozzles, where the keep-wet time is measured at what is considered the worst-case ambient humidity for the printer's operation. The PEC may also try to fire any, keep-wet drops between pages if possible, thereby reducing the density of the keep-wet drops that get printed to the page.

Humid air may be blown across the nozzles to prevent clogging or increase the keep-wet time, thereby avoiding or reducing the need for keep-wet drops.

Furthermore a capping mechanism can provide a humid environment for storage of the print head during idle times, with a humidity that is high enough to allow recovery of the nozzles prior to printing using one of the warm and fire declog methods.

In the preferred embodiment, the warm and fire cycle used to declog the nozzles prior to printing is a ~17 kHz burst of ~30 pulses.

A DC offset may also be applied to the firing pulses, to provide a steady warming current, along with a set of firing pulses that will eject the ink as soon as the warming current reduces the ink viscosity to an ejectable level.

Prevention of Cavitation Using Heater Shape

As described above, after a bubble 12 has been formed in a printhead according to an embodiment of the present invention, the bubble collapses towards a point of collapse 17. According to the feature presently being addressed, the heater elements 10 are configured to form the bubbles 12 so that the points of collapse 17 towards which the bubbles collapse are at positions spaced from the heater elements. Preferably, the printhead is configured so that there is no solid material at such points of collapse 17. In this way cavitation, being a major problem in prior art thermal inkjet devices, is largely eliminated.

Figure 58:
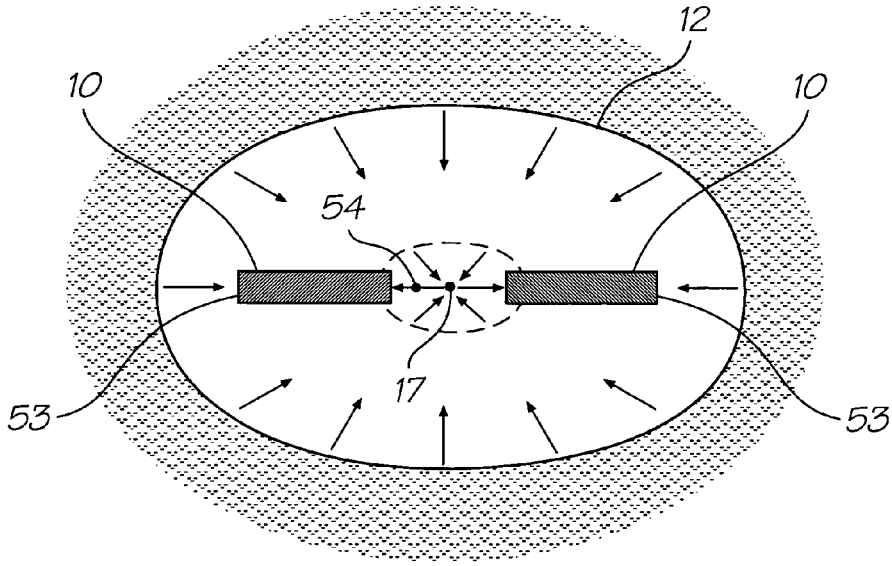
FIG. 58 is a diagrammatic section through a nozzle chamber in accordance with an embodiment of the invention showing a heater element defining a gap between parts of the element.

Referring to FIG. 58, in a preferred embodiment, the heater elements 10 are configured to have parts 53 which define gaps (represented by the arrow 54), and to form the bubbles 12 so that the points of collapse 17 to which the bubbles collapse are located at such gaps. The advantage of this feature is that it substantially avoids cavitation damage to the heater elements 10 and other solid material.

Figure 57:
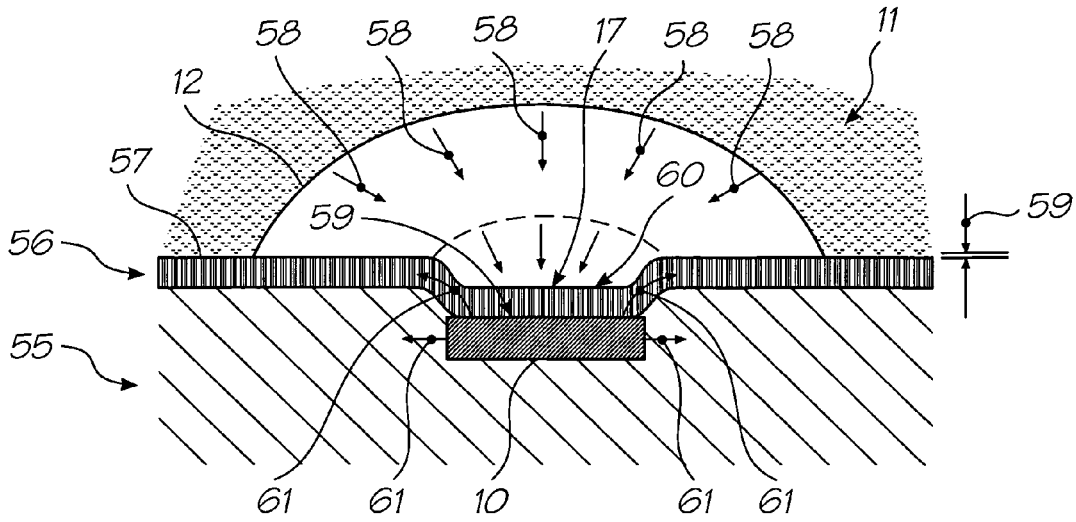
FIG. 57 (PRIOR ART)
FIG. 57 is a diagrammatic section through a nozzle chamber of a prior art printhead showing a coated heater element embedded in the substrate.

In a standard prior art system as shown schematically in FIG. 57, the heater element 10 is embedded in a substrate 55, with an insulating layer 56 over the element, and a protective layer 57 over the insulating layer. When a bubble 12 is formed by the element 10, it is formed on top of the element. When the bubble 12 collapses, as shown by the arrows 58, all of the energy of the bubble collapse is focused onto a very small point of collapse 17. If the protective layer 57 were absent, then the mechanical forces due to the cavitation that would result from the focusing of this energy to the point of collapse 17, could chip away or erode the heater element 10. However, this is prevented by the protective layer 57.

Typically, such a protective layer 57 is of tantalum, which oxidizes to form a very hard layer of tantalum pentoxide ($Ta_2O_5$). Although no known materials can fully resist the effects of cavitation, if the tantalum pentoxide should be chipped away due to the cavitation, then oxidation will again occur at the underlying tantalum metal, so as to effectively repair the tantalum pentoxide layer.

Although the tantalum pentoxide functions relatively well in this regard in known thermal ink jet systems, it has certain disadvantages. One significant disadvantage is that, in effect, virtually the whole protective layer 57 (having a thickness indicated by the reference numeral 59) must be heated in order to transfer the required energy into the ink 11, to heat it so as to form a bubble 12. Not only does this increase the amount of heat which is required at the level designated 59 to raise the temperature at the level designated 60 sufficiently to heat the ink 11, but it also results in a substantial thermal loss to take place in the directions indicated by the arrows 61. As discussed earlier with reference to equation 3, this disadvantage would not be present if the heater element 10 was merely supported on a surface and was not covered by the protective layer 57.

According to the feature presently under discussion, the need for a protective layer 57, as described above, is avoided by generating the bubble 12 so that it collapses, as illustrated in FIG. 58, towards a point of collapse 17 at which there is no solid material, and more particularly where there is the gap 54 between parts 53 of the heater element 10. As there is merely the ink 11 itself in this location (prior to bubble generation), there is no material that can be eroded here by the effects of cavitation. The temperature at the point of collapse 17 may reach many thousands of degrees C., as is demonstrated by the phenomenon of sonoluminesence. This will break down the ink components at that point. However, the volume of extreme temperature at the point of collapse 17 is so small that the destruction of ink components in this volume is not significant.

Figure 38:
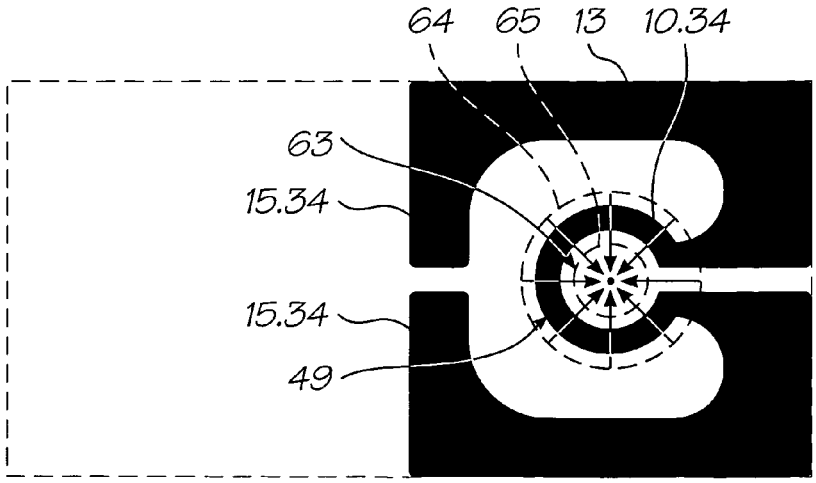
FIG. 38 is a schematic plan view of a mask suitable for use in performing the production stage for the printhead of FIG. 37 for forming the heater element thereof.

The generation of the bubble 12 so that it collapses towards a point of collapse 17 where there is no solid material can be achieved using heater elements 10 corresponding to that represented by the part 10.34 of the mask shown in FIG. 38. The element represented is symmetrical, and has a hole represented by the reference numeral 63 at its center. When the element is heated, the bubble forms around the element (as indicated by the dashed line 64) and then grows so that, instead of being of annular (doughnut) shape as illustrated by the dashed lines 64 and 65) it spans the element including the hole 63, the hole then being filled with the vapor that forms the bubble. The bubble 12 is thus substantially disc-shaped. When it collapses, the collapse is directed so as to minimize the surface tension surrounding the bubble 12. This involves the bubble shape moving towards a spherical shape as far as is permitted by the dynamics that are involved. This, in turn, results in the point of collapse being in the region of the hole 63 at the center of the heater element 10, where there is no solid material.

Figure 35:
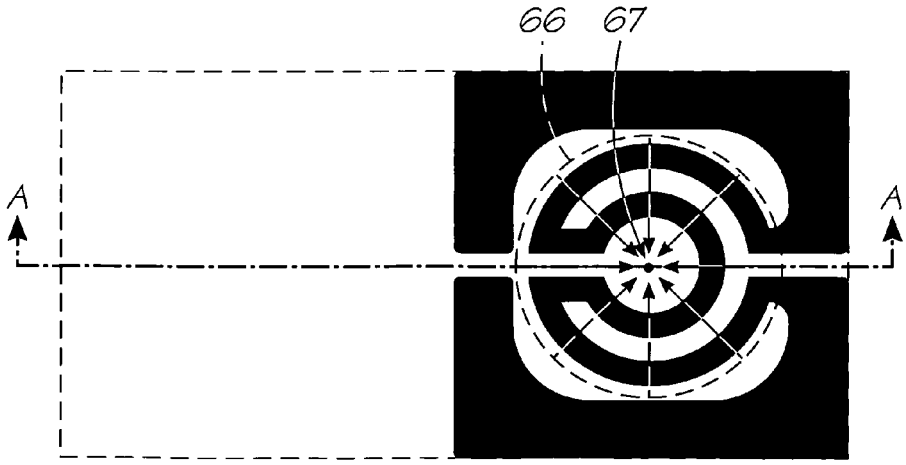

The heater element 10 represented by the part 10.31 of the mask shown in FIG. 35 is configured to achieve a similar result, with the bubble generating as indicated by the dashed line 66, and the point of collapse to which the bubble collapses being in the hole 67 at the center of the element.

The heater element 10 represented as the part 10.36 of the mask shown in FIG. 40 is also configured to achieve a similar result. Where the element 10.36 is dimensioned such that the hole 68 is small, manufacturing inaccuracies of the heater element may affect the extent to which a bubble can be formed such that its point of collapse is in the region defined by the hole. For example, the hole may be as little as a few microns across. Where high levels of accuracy in the element 10.36 cannot be achieved, this may result in bubbles represented as 12.36 that are somewhat lopsided, so that they cannot be directed towards a point of collapse within such a small region. In such a case, with regard to the heater element represented in FIG. 40, the central loop 49 of the element can simply be omitted, thereby increasing the size of the region in which the point of collapse of the bubble is to fall.

Transition Metal Nitride Heater Materials

The metal nitride bonds of transition metal nitrides have a high degree of covalency that provides thermal stability, hardness, wear resistance, chemical inertness and corrosion resistance. The metallic bonding in some transition metal nitrides such as TiN and TaN can in addition result in low resistivity, making these nitrides suitable for use as CMOS driven resistive heaters.

In U.S. Ser. No. 10/728,804 to the present Applicant (one of the cross referenced documents listed above) the heater material described was TiN, a columnar crystalline nitride used in CMOS fabs as a barrier layer for aluminium metallization, and as a tool coating. TiN has the following advantages as a heater material:

- it is readily available in CMOS fabs, deposited using reactive sputtering from a Ti target in a nitrogen plasma
- its ~2 μOhm·m resistivity is well suited for heaters driven with typical CMOS voltages (3.3V to 12V)
- it is very hard and therefore more cavitation resistant than traditional heater alloys
- the atomic bonding is stronger than that present in an alloy, so the electromigration resistance is likely to be higher.

However, without some form of oxidation protection, an uncoated TiN heater will only eject a few tens of thousands of droplets before going 'open circuit' (fracturing due to oxidative failure). Likewise, uncoated TaN heaters have inadequate oxidation resistance.

Transition Metal Nitride Heater Materials with a Self Passivating Component

The Applicant resolved the oxidation problem by introducing an additive that allows the transition metal nitride to self passivate. As previously discussed 'self passivation' refers to the formation of a surface oxide layer, where the oxide has a low diffusion coefficient for oxygen so as to provide a barrier to further oxidation.

Figure 60:
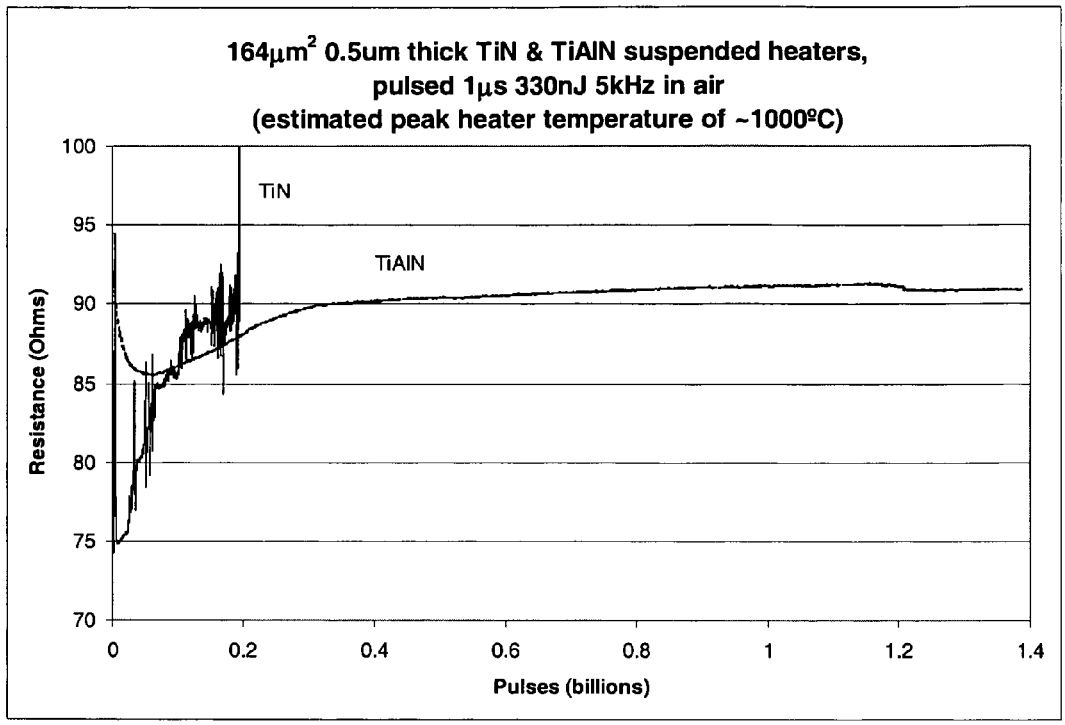
FIG. 60 are experimental results comparing the oxidation resistance of TiN and TiAlN elements.

FIG. 60 shows experimental results comparing the oxidation resistance of TiN and TiAlN heater elements. The TiAlN heater is made replacing the Ti target (used to make TiN heaters) with a TiAl target (50% Ti, 50% Al by atomic composition). The resulting TiAlN heater material is "self passivating", in the sense that it forms a thin $Al_2O_3$ layer on its surface. This oxide layer acts as a diffusion barrier for oxygen. Since the diffusion coefficient for oxygen in $Al_2O_3$ is much lower than that of $TiO_2$, the oxidation resistance of TiAlN is vastly better than TiN, to the extent that an oxidation prevention coating is unnecessary.

The heater elements used in this test were suspended beams: these would normally be fully immersed in ink, but in this case, the ink chambers were deliberately left unfilled so that the heaters could be pulsed in air. This was done to isolate the oxidative failure mechanism. Each heater was pulsed at 5 kHz with 1 μs 330 nJ pulses. This amount of energy would normally be delivered mostly to the ink. Without the ink there was no diffusive loss and most of the input energy contributed to raising the heater temperature. The time scale for cooling due to conduction out the ends of the heater was measured to be ~30 μs: fast enough to cool the heater to the background printhead IC (chip) temperature between pulses, but not fast enough to significantly reduce the peak heater temperature reached with each pulse. With a heater area of 164 $\mu m^2$ and heater thickness of 0.5 μm, the 330 nJ input energy of each pulse was sufficient to raise the heater elements to ~1000° C.

FIG. 60 shows a rapid rise in resistance of the TiN heater, with open circuit burn-out occurring within 0.2 billion pulses. In comparison, the TiAlN heater lasted for 1.4 billion pulses before the experiment was halted (with the heater still intact). The resistance of the TiN heater was very unstable. This was thought to be intrinsic to the heater rather than a measurement artifact such as noise, since each resistance spike typically consisted of ~50 samples over 8 minutes. In comparison, the TiAlN heater resistance was relatively stable, but did show an initial dip then rise. Several effects could explain this, but only two have been proven to occur: with Auger depth profiling, aluminium has been shown to migrate from the bulk of the heater to the surface, then form $Al_2O_3$ on the surface. The oxidation will increase the heater resistance while the removal of aluminium from the bulk of the material will decrease the heater resistance, since TiN is less resistive than TiAlN. This instability in the resistance of the TiAlN is not of great concern, since the peak operating temperature of the heater in ink is around 300° C., well below the temperature required for the effect to manifest itself: further tests in an oven showed only small changes in the resistance of TiAlN heaters after heating in air to 400° C. for various lengths of time up to one hour (0.4% change for 1 hour at 400° C.).

To further prove than the difference in heater lifetime in air was due to different oxidation rates and not a difference in mechanical properties, the above tests were repeated with DC current, to avoid the repeated expansion and contraction caused by pulsing the current. Again, the TiAlN heaters had vastly improved lifetime compared to TiN heaters supplied the same amount of power. When the TiN heaters were coated with a 300 A layer of $Si_3N_4$, the lifetimes with DC current became comparable, indicating $Si_3N_4$ provides effective oxidation protection. This $Si_3N_4$ layer quickly cracked and peeled when the heater were pulsed however, due to a difference in coefficient of thermal expansion (CTE).

In terms of ejection performance, the TiAlN heaters again had vastly improved longevity. Uncoated 120 $\mu m^2$*0.5 μm TiAlN heaters suspended in ink 4 μm directly beneath the ejection nozzle typically eject several hundreds of millions of ink drops compared to several tens of thousands of drops for uncoated TiN heaters or TiN heaters coated in 300 A of $Si_3N_4$. In the light of the above experiments discussing oxidation, the improved longevity over TiN results from the improved oxidation resistance of TiAlN, which arises from a self passivating $Al_2O_3$ layer.

The cavitation resistance of TiAlN has been investigated with extensive open pool testing of non-suspended heaters bonded to $SiO_2$ substrates. In these tests the heater was not shaped to avoid the collapse of the bubble on the heater: stroboscopic imaging indicated that the bubble was in fact collapsing on the heater. Despite this, none of the pitting traditionally associated with cavitation damage was observed, even after 1 billion nucleating pulses in water. The high ~25 GPa hardness of TiAlN provides excellent cavitation resistance on TiAlN. Thus the use of TiAlN heaters (in addition to removing the oxidation protection layers) allow removal of the cavitation protection layer, even without a mechanism designed to avoid bubble collapse, such as shaped heaters. As a result, use of this material facilitates a dramatic increase in ejection efficiency.

In the long term ejection and open pool testing, the ultimate failure mechanism of the TiAlN heaters was cracking across the heater, causing an open circuit. On one device, this occurred after 7 billion pulses. The standard deviation in lifetime was quite large, however, so it would be misleading to quote just that figure. In statistical analysis of cracking, it is common to derive reliability figures by plotting lifetime results on the so called Weibull distribution. When this was done, it was determined that 0.5 μm thick, 32 μm long, 4 μm wide TiAlN heaters could reach 80 million bubble nucleations in water in an open pool configuration with 99% reliability.

Exposing the TiAlN heaters to acidic (pH<4) or alkaline (pH>9) environments, or chlorine or fluorine ions, can destabilize the $Al_2O_3$ passivating layer. This can lead to stress corrosion cracking and ultimately failure of the element. However, the crack limited lifetime of open pool heaters can be improved by several means:

- A 300 A Ta or TaN coating (which also oxidizes readily to form Ta2O5). This layer is sufficiently thin that it increases the ejection energy by less than 10%.
- A 300 A TiAl coating. The corrosion resistance of TiAlN was found to be a decreasing function of increasing nitrogen content and TiAl was found to have better corrosion resistance than TiAlN, justifying the use of a TiAl coating to improve corrosion resistance. A TiAl coating is easier to fabricate than a Ta or TaN coating, as the TiAl sputter target used for the TiAlN deposition can also be used for the TiAl coating. TiAl also sticks to the TiAlN heater better than Ta or TaN and is less likely to flake off during operation.
- The addition of ~5% (atomic) Cr to the TiAl target to improve the heater's pitting corrosion resistance (see "Chromium ion implantation for inhibition of corrosion of aluminium", *Surface and Coatings Technology*, Volume: 83, Issue: 1-3, September, 1996).
- The addition of ~5-15% (atomic) Si to the TiAl target to form a nanocomposite structure that is more resistant to crack propagation.

Several other aspects of TiAlN require discussion to replicate this work. Firstly the aluminium content of the TiAl target impacts the oxidation resistance and resistivity, both of which increase monotonically up to ~60% aluminium content. Beyond this point the phase of the deposited material changes to a form with reduced oxidation resistance. A 50% composition was chosen in the Applicant's work to provide a margin of safety in avoiding this phase change. Secondly, the resistivity increases monotonically as a function of increasing nitrogen flow in the reactive deposition. At a particular nitrogen flow, the resistivity increases sharply as a result of another phase change. The exact nitrogen flow at which this occurs depends on other parameters such as argon flow and sputtering power, so it is best to characterize this effect in a new deposition chamber by running a set of depositions with increasing nitrogen flow or decreasing sputtering power, plotting the sheet resistance of the resulting layers as a function of nitrogen flow or sputtering power. In the Applicant's work, films were deposited on both sides of the phase change associated with nitrogen flow. The resistivity of the low nitrogen material was 2.5 μOhm·m, while the resistivity of the high nitrogen material was 8 μOhm·m. The higher resistivity is preferable for inkjet heaters, as the current density and current will be lower. Therefore, electromigration is less likely to be a problem. Unfortunately, the oxidation resistance of the high nitrogen material was worse: with 1 hour treatments at 400° C., heaters made from the high nitrogen material increased in resistance 5%, compared to 0.4% for heaters made from the low nitrogen material. As a result, all of the Applicant's work has focused on the low nitrogen material.

Two final aspects of TiAlN are of interest. Firstly, if the material is deposited onto aluminium metallization using reactive sputtering in a nitrogen atmosphere, care must be taken to avoid the formation of an insulating aluminium nitride layer, which will greatly increase the contact resistance. The formation of this interlayer can be avoided by sputtering a thin TiAl layer a few hundred angstroms thick as a barrier layer prior to the introduction of nitrogen into the chamber. Secondly, as with TiN, TiAlN forms columnar crystals. Both of these materials suffer from a growth defect when deposited over non-planar geometry: in the corners of trenches, the columnar crystals on the bottom of the trench grow vertically, while the crystals on the side wall grow horizontally. In this situation, regardless of the deposition thickness, it is possible for the layers on the bottom and side wall to not merge at all, but instead be electrically isolated by a crack that grows at the interface. This can make it difficult to connect the heater material to the CMOS metallization, as it must be deposited into a trench etched in the passivation covering the CMOS metallization. This problem can be overcome by electrically shorting the bottom of the trench to the top of the trench with a metal layer, deposited before or after the heater layer. The metal layer needs to be thick enough to ensure electrical continuity over the step and to ensure its current carrying capacity is high enough to avoid electromigration.

Readers experienced in the art will appreciate that sputtering a composite TiAl target in a nitrogen atmosphere is not the only means by which TiAlN films may be formed. Variations such as the use of CVD deposition, replacing the composite target with co-sputtered Ti and Al targets or using a method other than argon sputtering to sputter the targets do not affect the ability of TiAlN to self-passivate.

Readers experienced in the art will also appreciate that the transition metal of the "transition metal nitride heater materials with a self passivating component" need not be titanium, as other transition metals such as tantalum form conductive nitrides. Also, the self passivating component need not be aluminium: any other additive whose oxidation is thermodynamically favored over the other components will form an oxide on the heater surface. Provided this oxide has a low oxygen diffusion rate (comparable to aluminium oxide), the additive will be a suitable alternative to aluminium.

Nanocrystalline Composite Heater Material

Nanocrystalline composite films are made from two or more phases, one nanocrystalline, the other amorphous, or both nanocrystalline. By incorporating the self passivating transition metal nitrides into a nanocrystalline composite structure, it is possible to further improve hardness, thermal stability, oxidation resistance and in particular crack resistance. For example, it is possible to improve the properties of TiAlN by adding Si to form a TiAlSiN nanocomposite, in which TiAlN nanocrystals are embedded in an amorphous $Si_3N_4$ matrix. TiAlSiN has the following advantages over TiAlN:

1. The columnar crystalline grain boundaries that act as fast diffusion paths for the transport of oxygen into TiAlN are removed. Diffusion of oxygen into TiAlSiN is limited by the low diffusion coefficient for oxygen of the $Si_3N_4$ phase encasing the TiAlN nanocrystals.
2. The $Si_3N_4$ phase encasing the TiAlN nanocrystals provides enhanced corrosion resistance.
3. The $Si_3N_4$ phase separating the TiAlSiN crystals improves the stability against recrystallisation (Oswald ripening). TiAlSiN is thermally stable up to 1100° C., compared to 800° C. for TiAlN, so the material is more able to withstand the high temperatures that result when a suspended heater is pulsed in deprimed chamber.
4. The hardness of the material can significantly exceed that of its constituent phases, improving the cavitation resistance (~50 GPa for TiAlSiN, compared to ~25 GPa for TiAlN and ~19 GPa for $Si_3N_4$).
5. The resistivity can be increased from 2.5 μOhm·m to 5 μOhm·m (for similar nitrogen contents). This allows a reduction in current and current density, reducing the likelihood of problems such as ground bounce and electromigration.
6. A crack-like defect caused by the change in direction of crystal growth in TiAlN deposited at the bottom of trenches in eliminated.
7. The structure is less brittle and far less prone to crack propagation, thereby improving the lifetime of the heaters.

As with TiAlN, increased nitrogen content can be used to increase the resistivity of TiAlSiN: films in the range 5 μOhm·m to 50 μOhm·m have been tested by the Applicant. As with TiAlN however, the corrosion resistance of the high nitrogen films (>10 μOhm·m in this case) is relatively poor, so again the Applicant has concentrated on the low nitrogen films.

The hardness of TiAlSiN films exhibit a maximum that depends on the grain size of the crystals embedded in the amorphous $Si_3N_4$ matrix, which in turn depends on the percentage of silicon incorporated into the film. As the silicon percentage increases from zero, the crystal grain size becomes smaller and the film hardness increases because dislocation movement is hindered, as described by the Hall Petch relationship. As it approaches ~5 nm, the hardness peaks. If the silicon percentage is increased further, the grain size will reduce further, and the hardness will decrease towards that of the amorphous $Si_3N_4$ phase as grain boundary sliding becomes dominant (the reverse Hall Petch effect).

Although high hardness is ideal for cavitation resistance, high fracture toughness is perhaps more relevant to the heater material given the cracking failure mechanism of TiAlN. The fracture toughness of nanocrystalline composite TiAlSiN is higher than the toughness of the constituent phases, because the crystals can terminate cracks propagating in the amorphous phase. Like the hardness, the fracture toughness exhibits a maximum as a function of silicon concentration: too little silicon and the crystal phase will dominate cracking; too much silicon and the crystals will be too sparse or small to terminate cracks, so the amorphous phase will dominate cracking.

It is estimated that the peaks in hardness and toughness lie between atomic Si concentrations of 5% to 20%. Targets made with that concentration of Si, with the balance composed of equal proportions of Ti and Al, can be sputtered in a reactive nitrogen atmosphere to produce the nanocrystalline composite films. As with the TiAlN, the presence of Al is intended to improve the oxidation resistance of the material.

It will be understood by those experienced in the art that the amorphous phase of the nanocrystalline composite does not have to be silicon nitride: any hard, thermally stable alternative with a low oxygen diffusivity (such as boron nitride, aluminium oxide or silicon carbide) will suffice. Also, the nanocrystalline phase need not be a transition metal nitride, as silicides, borides and carbides can also be very hard with low resistivity. Similarly, the transition metal need not be titanium, as other transition metals such as tantalum and tungsten form conductive nitrides. Finally, the self passivating component added to the nanocrystalline composite material need not be aluminium: any other additive whose oxidation is thermodynamically favored over the other components will form an oxide on the heater surface. Provided this oxide has a low oxygen diffusion rate (comparable to aluminium oxide), the additive will be a suitable alternative to aluminium.

Using the Heater as a MEMS Fluid Sensor

The heater can be used as a fluid sensor, using the heater's thermal coefficient of resistance (TCR) to determine temperature and the temperature to determine whether the heater is surrounded by air or immersed in liquid. There are 2 key enabling aspects that allow the heaters of self cooling nozzles to be used in this fashion:

1. the removal of all, or at least the vast majority of, the protective overcoat layers
2. suspension of the heaters to thermally isolate the heaters from the substrate.

Considering firstly the protective layers: these are typically about 1 μm thick in existing printhead heaters. These layers must be heated to the film boiling temperature to eject a drop, together with a ~1 μm layer of ink. While the protective layers and the ink are being heated, heat will diffuse about the same distance into the underlayer. The heater thickness is typically ~0.2 μm so in total, ~3.2 μm of solid and ~1 μm of liquid must be heated to the film boiling temperature. The large amount of solid that must be heated makes existing devices inefficient, but it also means the heater cannot easily be used as a fluid sensor, as the portion of heat lost to the fluid is relatively small. The drop in peak heater temperature is at most 1.5% when the ink chamber goes from an unfilled to a filled state (~25% of the total heat is taken away from the 3.2 μm of solid, of which the heater comprises only 6% by thickness).

Figure 61:
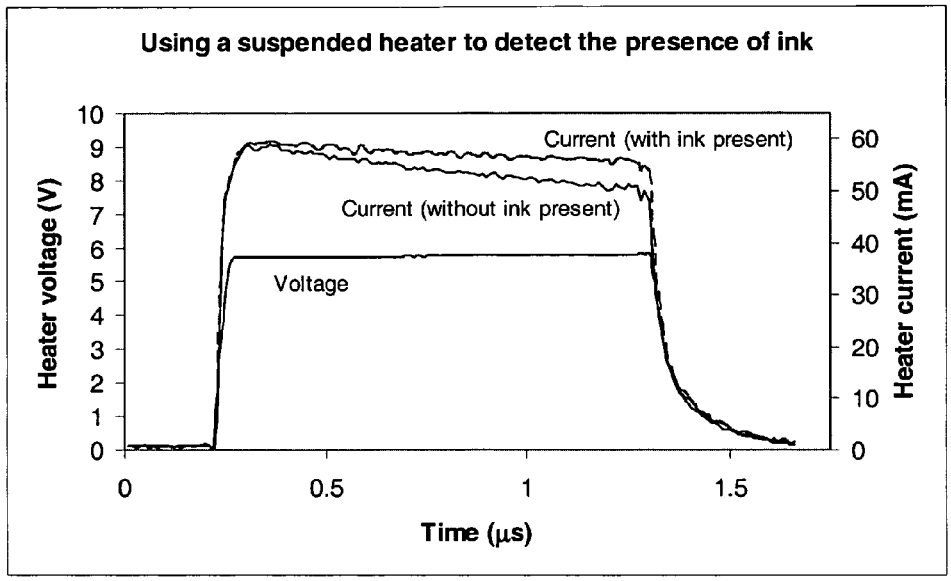
FIG. 61 are experimental results showing the current as a function of time for heater elements in a primed and unprimed chamber of a unit cell of a printhead according to an embodiment of the invention.

Considering now the devices of the present invention, with heaters that have either no coatings or coatings that are thin with respect to the heater (<20% of heater thickness). These heaters have good thermal isolation, being fully suspended or with underlayers that have thermal products $(\rho_u C_u k_u)^{1/2}$ less than that of water. If the heater is fully suspended with no protective coatings, there is no solid outside of the heater to heat. If there is no ink present, almost all of the heater will be retained by the heater on the time scale of the input pulse. If there is water based ink present, modelling with equation 3 indicates that ~30% of the heat will be retained the heater with the remaining ~70% diffusing into the ink. As a result, the peak heater temperature will drop 70% when the ink chamber goes from an unfilled to a filled state. If the heater has an appreciable TCR, this difference in peak temperature will show up as a difference in heater resistance at the end of the input pulse. If the input voltage is kept constant with a low output impedance drive, this will show up as a difference in current at the end of the input pulse. The change in current can be used to detect the transition of the ink chambers from an unfilled to a filled state. FIG. 61 shows an example of this phenomenon.

One point of concern regarding suspended heaters is the temperature they reach when pulsed without ink present. The temperature the heaters must reach to eject water based ink when it is present is ~300° C. If there is no ink present when an input pulse of the same magnitude is applied, the peak temperature will be 100%/30% higher i.e. ~1000° C. At this temperature the stability of the heaters becomes a concern: TiN readily oxidises at this temperature, as demonstrated by FIG. 61. TiAlN with an equal proportion of Ti and Al has much better stability at this temperature, but unfortunately its TCR is practically zero and cannot be used to detect the presence of ink.

The fact that suspended heaters reach 1000° C. when pulsed in air is of some concern: the heaters must be robust against depriming of the ink chambers. One way to address this concern is to use a non-suspended heater with a solid underlayer. In that case, the heater will always be in contact with a solid, regardless of the presence of ink, so the peak temperature will be lower. If the thermal product of the underlayer is comparable to that of water, modelling using equation 3 with a 0.2 μm thick heater predicts ~35% of the heat would diffuse into the ink if ink were present. Without ink, this 35% would be shared between the heater and the underlayer, which has a thermal length scale of ~0.7 μm. This would result in a drop in peak heater temperature of only ~8% when the ink chamber goes from an unfilled to a filled state (~35% of the total heat is taken away from the 0.9 μm of solid, of which the heater comprises 22% by thickness). With a film boiling temperature of ~300° C., this implies a peak heater temperature of ~326° C. if the heater is pulsed with the same energy when ink is not present. The difference in temperature is more difficult to detect given the presence of noise in the measured pulses. Thus, using the heaters to detect the presence of ink is far more practical if the heater is suspended.

This sensor could be applied to any MEMS fluidic device where an electrical means of determining the presence of fluid is desired. This may be required in some devices where automation of filling is required or where visual observation of filling is made impossible by obstruction. The is the case for thermal inkjet printheads and the detection of subsequent de-priming is also very useful.

Of course, it is particularly convenient to use the heaters in a printhead for the dual purpose of droplet ejection and fluid sensing. However, as discussed above, traditional inkjet heater elements are not suitable as fluid sensors because of their thick protective coatings and non-suspended configurations.

Figure 62:
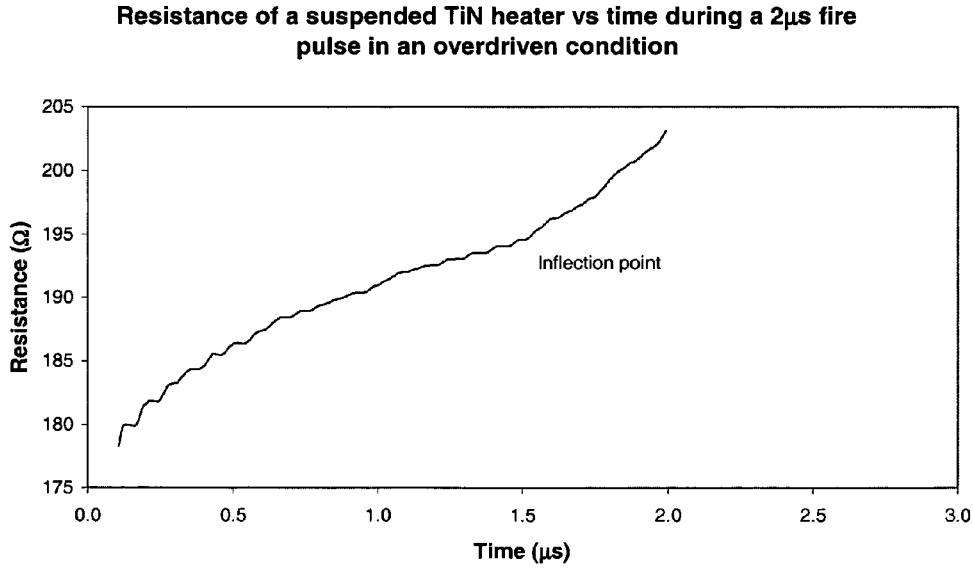
FIG. 62 shows the resistance of a suspended TiN heater vs time during a 2 μs firing pulse in an overdriven condition.

An additional benefit of using the heater as a fluid sensor is that the phase change associated with bubble nucleation can be detected: as soon a film boiling occurs, the suspended heater becomes thermally isolated from the fluid it is immersed in, so further input of energy causes the temperature and resistance of the heater to rise more quickly as a function of time. By detecting this inflection point in the resistance vs time curve, the time at which nucleation occurs can be determined for a given input power. This is useful for studying the physics of the device and also useful for systems where visual inspection of the ejected drops is not possible. Experiments with the Applicant's devices show that the inflection point in the resistance vs time curve corresponds to a "saturation point", where further increases in voltage or pulse length do not increase the droplet velocity any further. This is because the bubble completely envelops the heater when it is formed, preventing the heater from delivering any more energy to the fluid. With a given input voltage, tuning the pulse length so that the inflection point is occurs at the very end of the input pulse allows the pulse length, input energy and peak heater temperature to be electrically minimized. FIG. 62 shows the resistance of a suspended TiN heater as a function of time. In this case the pulse length is longer than it need be: the heater is being overdriven so that the inflection point can be clearly seen.

Suspended vs Bonded Heaters

Suspending the heater is not an essential ingredient in producing a self cooling inkjet: as long as the underlayer has a thermal product $(\rho_u C_u k_u)^{1/2}$ that is less than or equal to that of the ink, the energy required to nucleate a bubble will be less than or equal to that of a suspended heater. As discussed above, one advantage of depositing the heater on a solid underlayer is the peak temperature of the heater will be very much lower if the heater is fired without ink in the chamber, so the requirements on the thermal stability and oxidation resistance of the heater are less stringent. Other advantages are ease of manufacturing and the fact that the heater can be made thinner because it is supported by a solid underlayer. This reduces the energy required to heat the heater, which makes the nucleation time faster, which also reduces the diffusive loss terms in equation 3. Thus a heater of the same top surface area bonded to a solid underlayer can actually take less energy to nucleate a bubble than a suspended one, especially if the thermal product of the underlayer is significantly less than that of water. The big disadvantage of unsuspended heaters with respect to self cooling inkjets is the loss of half the bubble volume, which will decrease the bubble impulse (force integrated over time) and reduce the keep-wet time.

Heater Elements Formed in Different Layers

In some embodiments, it is useful to have a plurality of heater elements 10 disposed within the chamber 7 of each unit cell 1. The elements 10, which are formed by the lithographic process as described above in relation to FIG. 10 to 35, are formed in respective layers.

Figure 44:
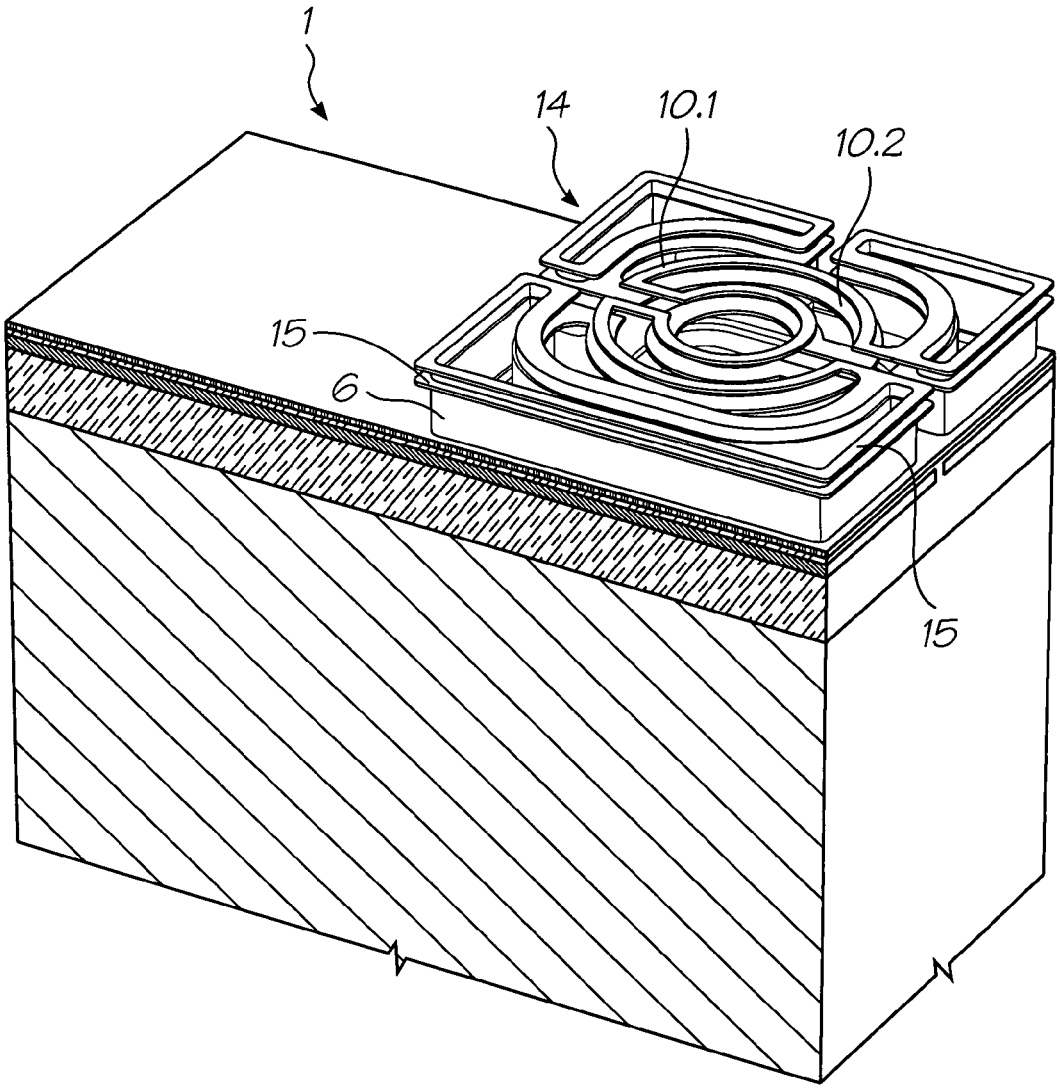
FIG. 44 is a further schematic perspective view of the unit cell of FIG. 42 shown with the nozzle plate omitted.
Figure 45:
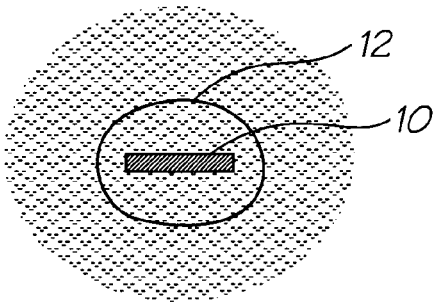
FIG. 45 is a schematic section through a nozzle chamber of a printhead according to an embodiment of the invention showing a suspended beam heater element immersed in a bubble forming liquid.
Figure 46:
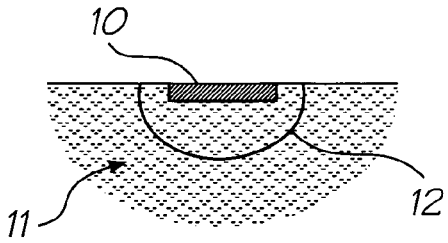
FIG. 46 is schematic section through a nozzle chamber of a printhead according to an embodiment of the invention showing a suspended beam heater element suspended at the top of a body of a bubble forming liquid.
Figure 55:
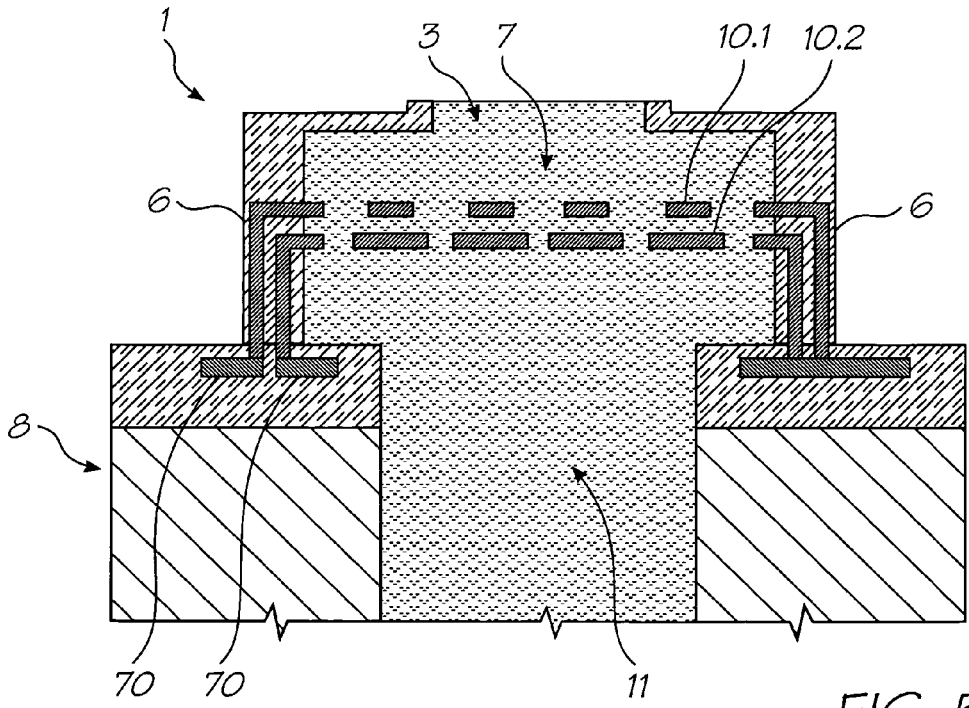
FIG. 55 is a diagrammatic section through a nozzle chamber in accordance with an embodiment of the invention showing two heater elements.

As shown in FIGS. 42, 44 and 55, the heater elements 10.1 and 10.2 in the chamber 7, may have different sizes relative to each other.

Also as will be appreciated with reference to the above description of the lithographic process, each heater element 10.1, 10.2 is formed by at least one step of that process, the lithographic steps relating to each one of the elements 10.1 being distinct from those relating to the other element 10.2.

The elements 10.1, 10.2 are preferably sized relative to each other, as reflected schematically in the diagram of FIG. 55, such that they can achieve binary weighted ink drop volumes, that is, so that they can cause ink drops 16 having different, binary weighted volumes to be ejected through the nozzle 3 of the particular unit cell 1. The achievement of the binary weighting of the volumes of the ink drops 16 is determined by the relative sizes of the elements 10.1 and 10.2. In FIG. 55, the area of the bottom heater element 10.2 in contact with the ink 11 is twice that of top heater element 10.1.

Figure 59:
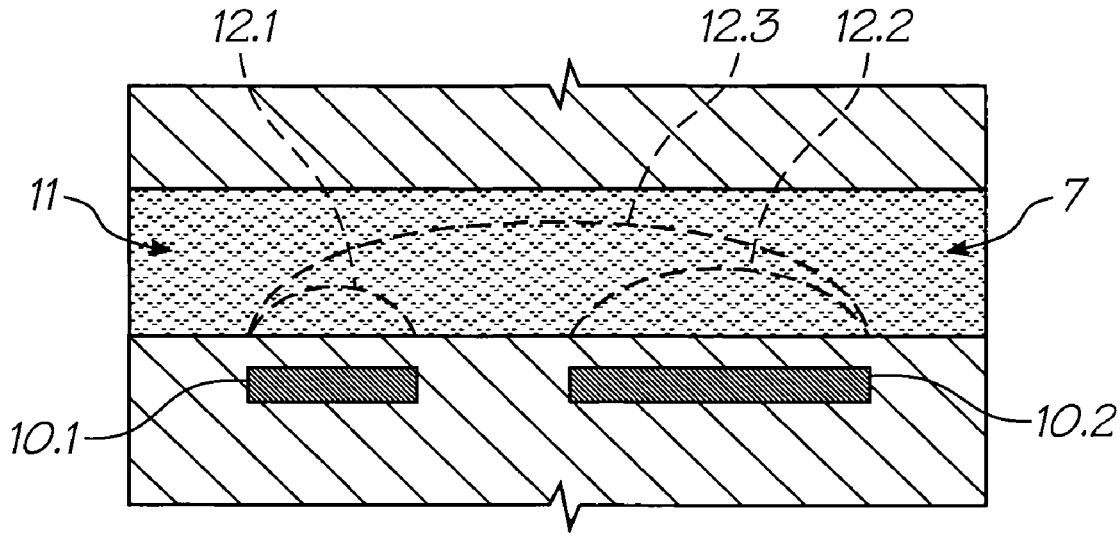
FIG. 59 (PRIOR ART)
FIG. 59 is a diagrammatic section through a nozzle chamber of a prior art printhead showing two heater elements.

One known prior art device, patented by Canon, and illustrated schematically in FIG. 59, also has two heater elements 10.1 and 10.2 for each nozzle, and these are also sized on a binary basis (i.e. to produce drops 16 with binary weighted volumes). These elements 10.1, 10.2 are formed in a single layer, adjacent to each other in the nozzle chamber 7. It will be appreciated that the bubble 12.1 formed by the small element 10.1 alone, is relatively small, while that 12.2 formed by the large element 10.2 alone, is relatively large. The bubble generated by both elements actuated simultaneously, is designated 12.3. Three differently sized ink drops 16 will be caused to be ejected by the three respective bubbles 12.1, 12.2 and 12.3.

It will be appreciated that the size of the elements 10.1 and 10.2 themselves are not required to be binary weighted to cause the ejection of drops 16 having different sizes or the ejection of useful combinations of drops. Indeed, the binary weighting may well not be represented precisely by the area of the elements 10.1, 10.2 themselves. In sizing the elements 10.1, 10.2 to achieve binary weighted drop volumes, the fluidic characteristics surrounding the generation of bubbles 12, the drop dynamics characteristics, the quantity of liquid that is drawing back into the chamber 7 from the nozzle 3 once a drop 16 has broken off, and so forth, must be considered. Accordingly, the actual ratio of the surface areas of the elements 10.1, 10.2, or the performance of the two heaters, needs to be adjusted in practice to achieve the desired binary weighted drop volumes.

Where the size of the heater elements 10.1, 10.2 is fixed and where the ratio of their surface areas is therefore fixed, the relative sizes of ejected drops 16 may be adjusted by adjusting the supply voltages to the two elements. This can also be achieved by adjusting the duration of the operation pulses of the elements 10.1, 10.2—i.e. their pulse widths. However, the pulse widths cannot exceed a certain amount of time, because once a bubble 12 has nucleated on the surface of an element 10.1, 10.2, then any duration of pulse width after that time will be of little or no effect.

On the other hand, the low thermal mass of the heater elements 10.1, 10.2 allows them to be heated to reach, very quickly, the temperature at which bubbles 12 are formed and at which drops 16 are ejected. While the maximum effective pulse width is limited, by the onset of bubble nucleation, typically to around 0.5 microseconds, the minimum pulse width is limited only by the available current drive and the current density that can be tolerated by the heater elements 10.1, 10.2.

As shown in FIG. 55, the two heaters elements 10.1, 10.2 are connected to two respective drive circuits 70. Although these circuits 70 may be identical to each other, a further adjustment can be effected by way of these circuits, for example by sizing the drive transistor (not shown) connected to the lower element 10.2, which is the high current element, larger than that connected to the upper element 10.1. If, for example, the relative currents provided to the respective elements 10.1, 10.2 are in the ratio 2:1, the drive transistor of the circuit 70 connected to the lower element 10.2 would typically be twice the width of the drive transistor (also not shown) of the circuit 70 connected to the other element 10.1.

In the prior art described in relation to FIG. 59, the heater elements 10.1, 10.2, which are in the same layer, are produced simultaneously in the same step of the lithographic manufacturing process. In the embodiment of the present invention illustrated in FIG. 55, the two heaters elements 10.1, 10.2, as mentioned above, are formed one after the other. Indeed, as described in the process illustrated with reference to FIGS. 10 to 35, the material to form the element 10.2 is deposited and is then etched in the lithographic process, whereafter a sacrificial layer 39 is deposited on top of that element, and then the material for the other element 10.1 is deposited so that the sacrificial layer is between the two heater element layers. The layer of the second element 10.1 is etched by a second lithographic step, and the sacrificial layer 39 is removed.

Referring once again to the different sizes of the heater elements 10.1 and 10.2, as mentioned above, this has the advantage that it enables the elements to be sized so as to achieve multiple, binary weighted drop volumes from one nozzle 3.

It will be appreciated that, where multiple drop volumes can be achieved, and especially if they are binary weighted, then photographic quality can be obtained while using fewer printed dots, and at a lower print resolution.

Furthermore, under the same circumstances, higher speed printing can be achieved. That is, instead of just ejecting one drop 14 and then waiting for the nozzle 3 to refill, the equivalent of one, two, or three drops might be ejected. Assuming that the available refill speed of the nozzle 3 is not a limiting factor, ink ejection, and hence printing, up to three times faster, may be achieved. In practice, however, the nozzle refill time will typically be a limiting factor. In this case, the nozzle 3 will take slightly longer to refill when a triple volume of drop 16 (relative to the minimum size drop) has been ejected than when only a minimum volume drop has been ejected. However, in practice it will not take as much as three times as long to refill. This is due to the inertial dynamics and the surface tension of the ink 11.

Figure 56:
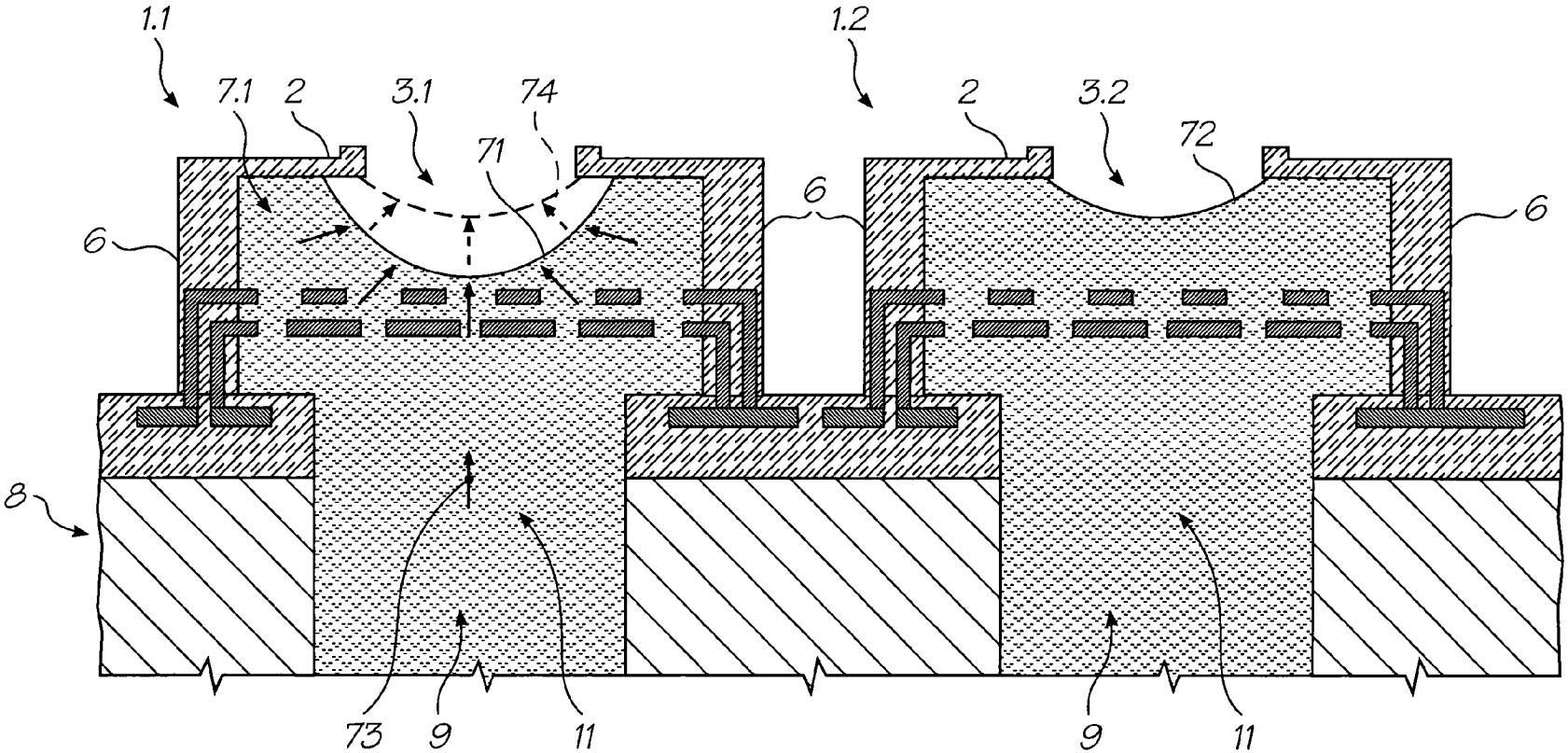
FIG. 56 is a diagrammatic section through a pair of adjacent unit cells of a printhead according to an embodiment of the invention, showing two different nozzles after drops having different volumes have been ejected therethrough.

Referring to FIG. 56, there is shown, schematically, a pair of adjacent unit cells 1.1 and 1.2, the cell on the left 1.1 representing the nozzle 3 after a larger volume of drop 16 has been ejected, and that on the right 1.2, after a drop of smaller volume has been ejected. In the case of the larger drop 16, the curvature of the air bubble 71 that has formed inside the partially emptied nozzle 3.1 is larger than in the case of air bubble 72 that has formed after the smaller volume drop has been ejected from the nozzle 3.2 of the other unit cell 1.2.

The higher curvature of the air bubble 71 in the unit cell 1.1 results in a greater surface tension force which tends to draw the ink 11, from the refill passage 9 towards the nozzle 3 and into the chamber 7.1, as indicated by the arrow 73. This gives rise to a shorter refilling time. As the chamber 7.1 refills, it reaches a stage, designated 74, where the condition is similar to that in the adjacent unit cell 1.2. In this condition, the chamber 7.1 of the unit cell 1.1 is partially refilled and the surface tension force has therefore reduced. This results in the refill speed slowing down even though, at this stage, when this condition is reached in that unit cell 1.1, a flow of liquid into the chamber 7.1, with its associated momentum, has been established. The overall effect of this is that, although it takes longer to completely fill the chamber 7.1 and nozzle 3.1 from a time when the air bubble 71 is present than from when the condition 74 is present, even if the volume to be refilled is three times larger, it does not take as much as three times longer to refill the chamber 7.1 and nozzle 3.1.

Example Printer in which the Printhead is Used

The components described above form part of a printhead assembly shown in FIG. 67 to 74. The printhead assembly 19 is used in a printer system 140 shown in FIG. 75. The printhead assembly 19 includes a number of printhead modules 80 shown in detail in FIGS. 63 to 66. These aspects are described below.

Figure 48:
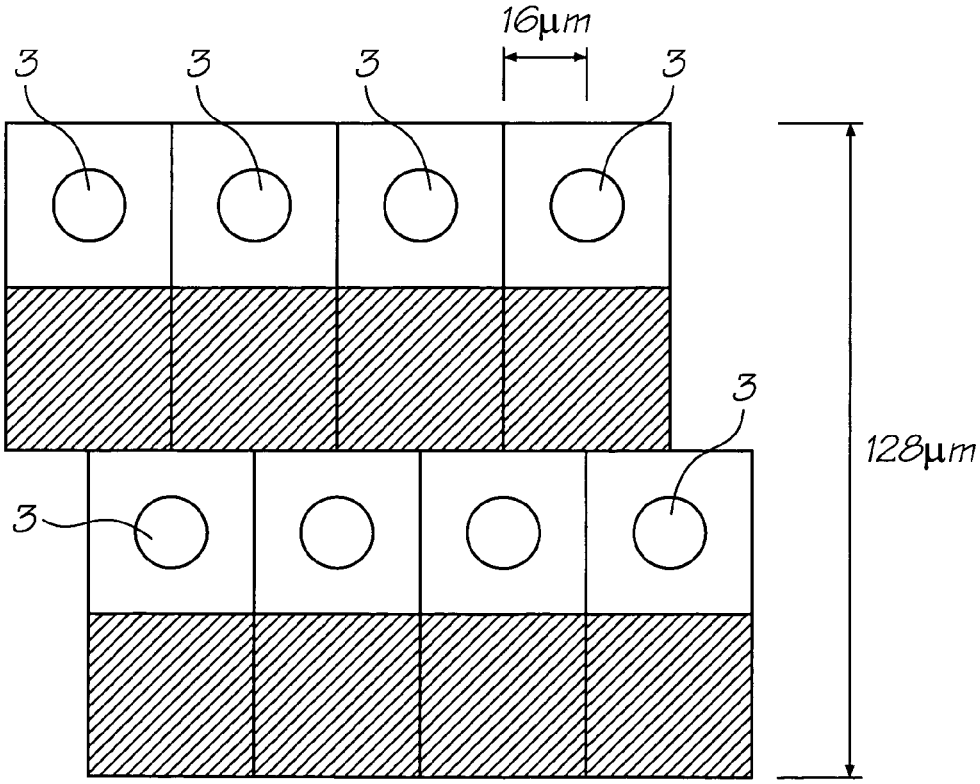
FIG. 48 is a diagrammatic plan view of a plurality of unit cells of a printhead according to an embodiment of the invention showing a plurality of nozzles.

Referring briefly to FIG. 48, the array of nozzles 3 shown is disposed on the printhead chip (not shown), with drive transistors, drive shift registers, and so on (not shown), included on the same chip, which reduces the number of connections required on the chip.

Figure 63:
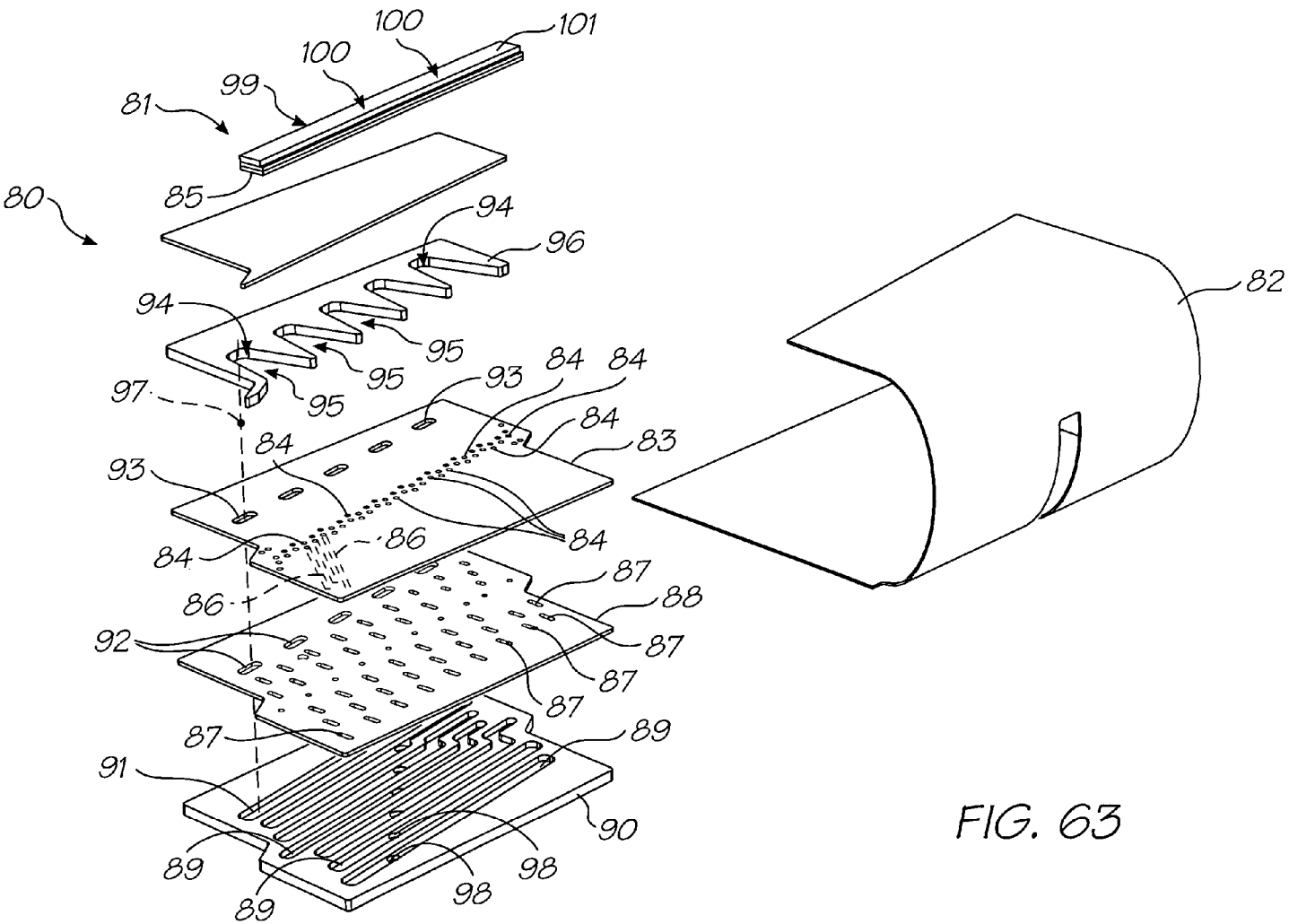
FIG. 63 is a schematic exploded perspective view of a printhead module of a printhead according to an embodiment of the invention.
Figure 64:
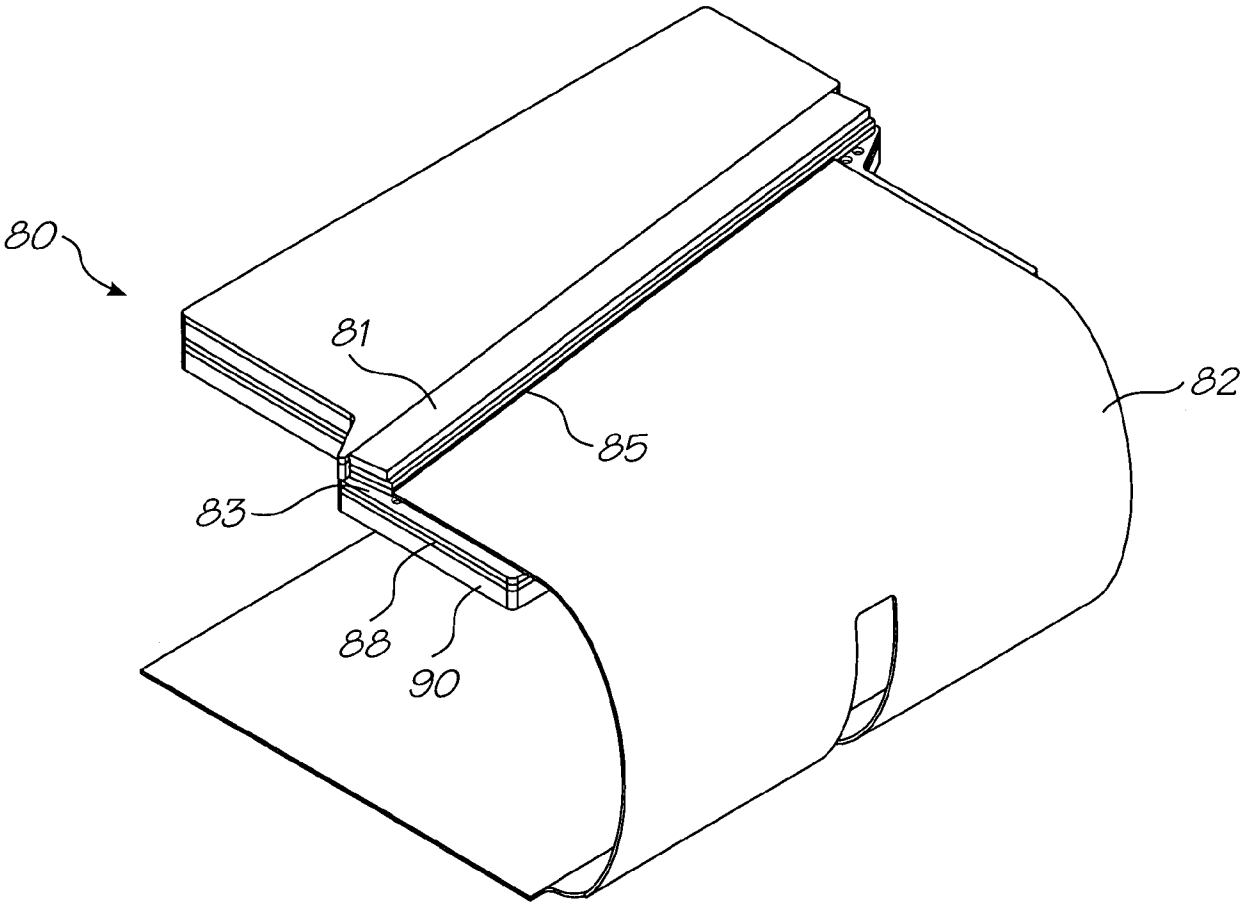
FIG. 64 is a schematic perspective view the printhead module of FIG. 58 shown unexploded.

FIGS. 63 and 64 show an exploded view and a non-exploded view, respectively, a printhead module assembly 80 which includes a MEMS printhead chip assembly 81 (also referred to below as a chip). On a typical chip assembly 81 such as that shown, there are 7680 nozzles, which are spaced so as to be capable of printing with a resolution of 1600 dots per inch. The chip 81 is also configured to eject 6 different colors or types of ink 11.

A flexible printed circuit board (PCB) 82 is electrically connected to the chip 81, for supplying both power and data to the chip. The chip 81 is bonded onto a stainless-steel upper layer sheet 83, so as to overlie an array of holes 84 etched in this sheet. The chip 81 itself is a multi-layer stack of silicon which has ink channels (not shown) in the bottom layer of silicon 85, these channels being aligned with the holes 84.

The chip 81 is approximately 1 mm in width and 21 mm in length. This length is determined by the width of the field of the stepper that is used to fabricate the chip 81. The sheet 83 has channels 86 (only some of which are shown as hidden detail) which are etched on the underside of the sheet as shown in FIG. 63. The channels 86 extend as shown so that their ends align with holes 87 in a mid-layer 88. The channels 86 align with respective holes 87. The holes 87, in turn, align with channels 89 in a lower layer 90. Each channel 89 carries a different respective color of ink, except for the last channel, designated 91. This last channel 91 is an air channel and is aligned with further holes 92 in the mid-layer 88, which in turn are aligned with further holes 93 in the upper layer sheet 83. These holes 93 are aligned with the inner parts 94 of slots 95 in a top channel layer 96, so that these inner parts are aligned with, and therefore in fluid-flow communication with, the air channel 91, as indicated by the dashed line 97.

The lower layer 90 has holes 98 opening into the channels 89 and channel 91. Compressed filtered air from an air source (not shown) enters the channel 91 through the relevant hole 98, and then passes through the holes 92 and 93 and slots 95, in the mid layer 88, the sheet 83 and the top channel layer 96, respectively, and is then blown into the side 99 of the chip assembly 81, from where it is forced out, at 100, through a nozzle guard 101 which covers the nozzles, to keep the nozzles clear of paper dust. Differently colored inks 11 (not shown) pass through the holes 98 of the lower layer 90, into the channels 89, and then through respective holes 87, then along respective channels 86 in the underside of the upper layer sheet 83, through respective holes 84 of that sheet, and then through the slots 95, to the chip 81. It will be noted that there are just seven of the holes 98 in the lower layer 90 (one for each color of ink and one for the compressed air) via which the ink and air is passed to the chip 81, the ink being directed to the 7680 nozzles on the chip.

Figure 65:
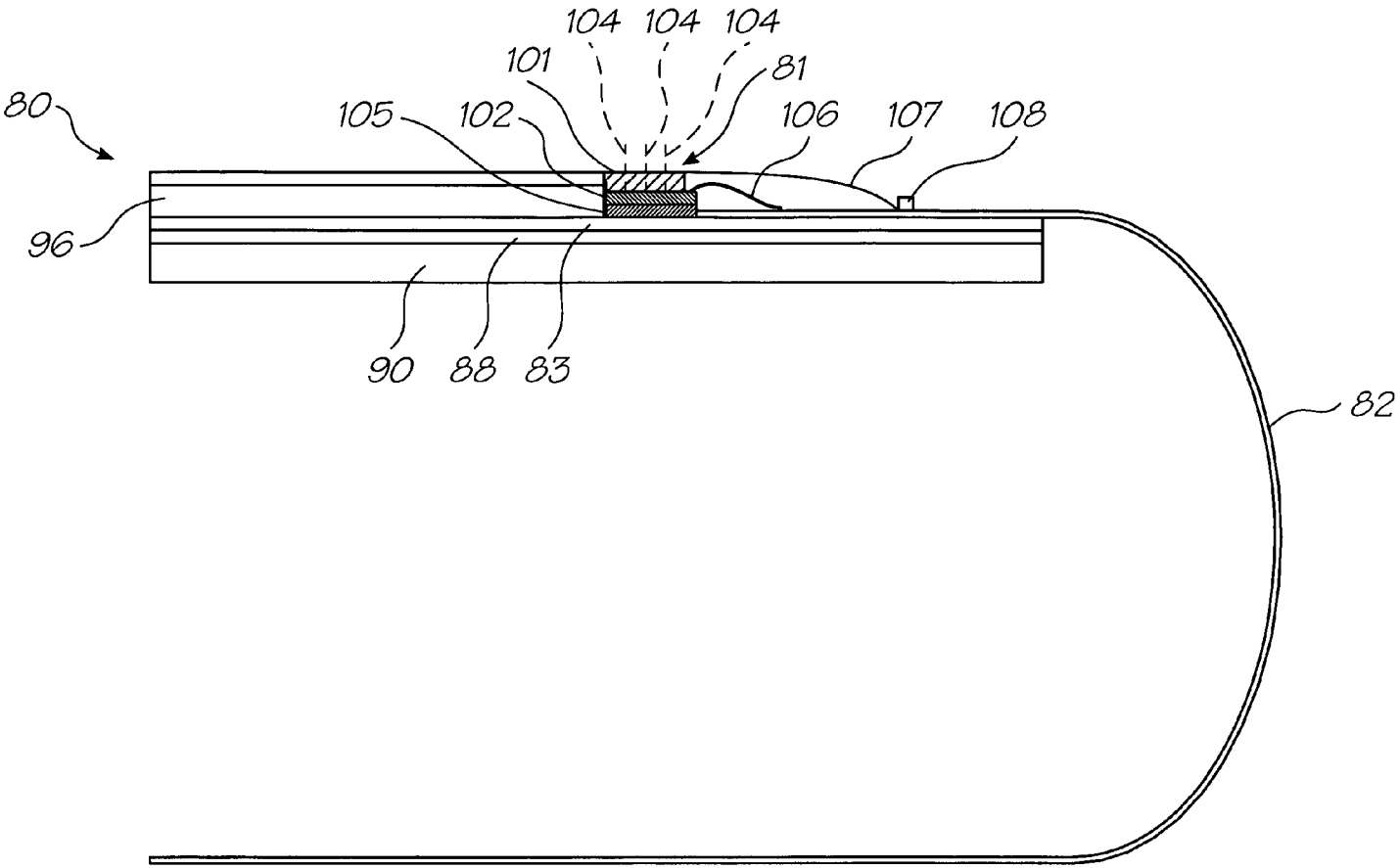
FIG. 65 is a schematic side view, shown partly in section, of the printhead module of FIG. 63.
Figure 66:
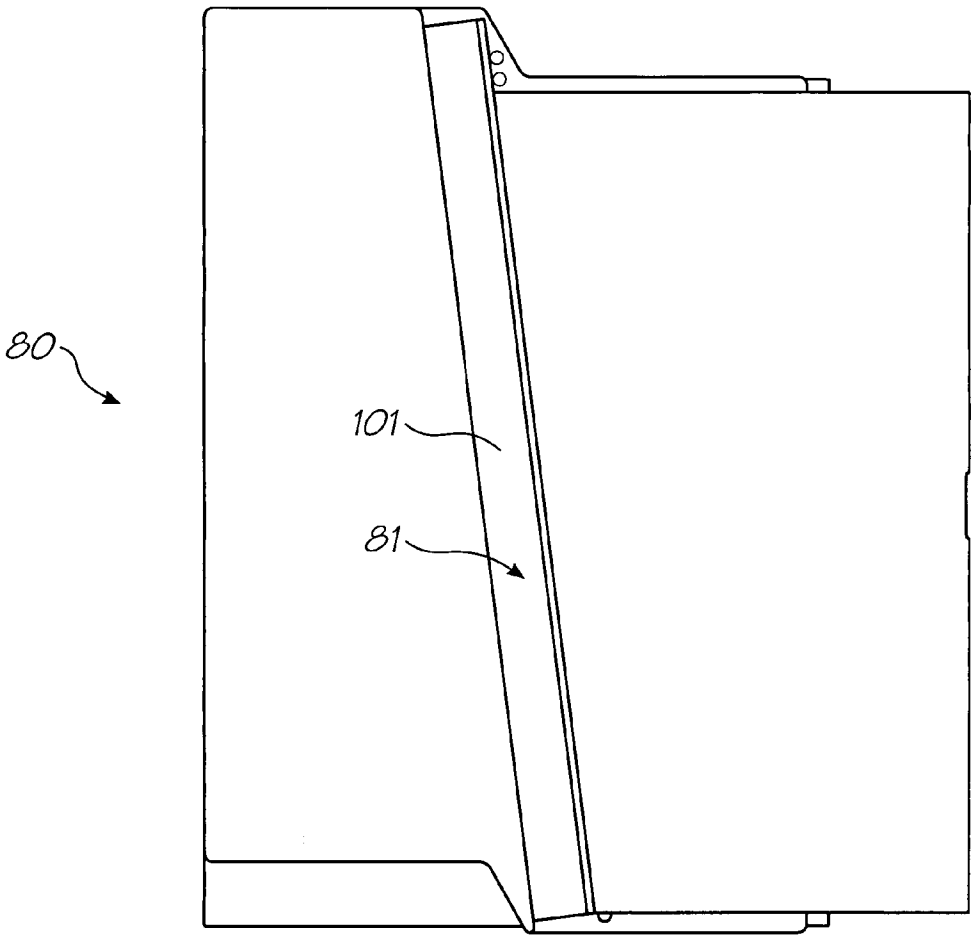
FIG. 66 is a schematic plan view of the printhead module of FIG. 63.

FIG. 65, in which a side view of the printhead module assembly 80 of FIGS. 58 and 59 is schematically shown, is now referred to. The center layer 102 of the chip assembly is the layer where the 7680 nozzles and their associated drive circuitry are disposed. The top layer of the chip assembly, which constitutes the nozzle guard 101, enables the filtered compressed air to be directed so as to keep the nozzle guard holes 104 (which are represented schematically by dashed lines) clear of paper dust.

The lower layer 105 is of silicon and has ink channels etched in it. These ink channels are aligned with the holes 84 in the stainless steel upper layer sheet 83. The sheet 83 receives ink and compressed air from the lower layer 90 as described above, and then directs the ink and air to the chip 81. The need to funnel the ink and air from where it is received by the lower layer 90, via the mid-layer 88 and upper layer 83 to the chip assembly 81, is because it would otherwise be impractical to align the large number (7680) of very small nozzles 3 with the larger, less accurate holes 98 in the lower layer 90.

The flex PCB 82 is connected to the shift registers and other circuitry (not shown) located on the layer 102 of chip assembly 81. The chip assembly 81 is bonded by wires 106 onto the PCB flex and these wires are then encapsulated in an epoxy 107. To effect this encapsulating, a dam 108 is provided. This allows the epoxy 107 to be applied to fill the space between the dam 108 and the chip assembly 81 so that the wires 106 are embedded in the epoxy. Once the epoxy 107 has hardened, it protects the wire bonding structure from contamination by paper and dust, and from mechanical contact.

Figure 67:
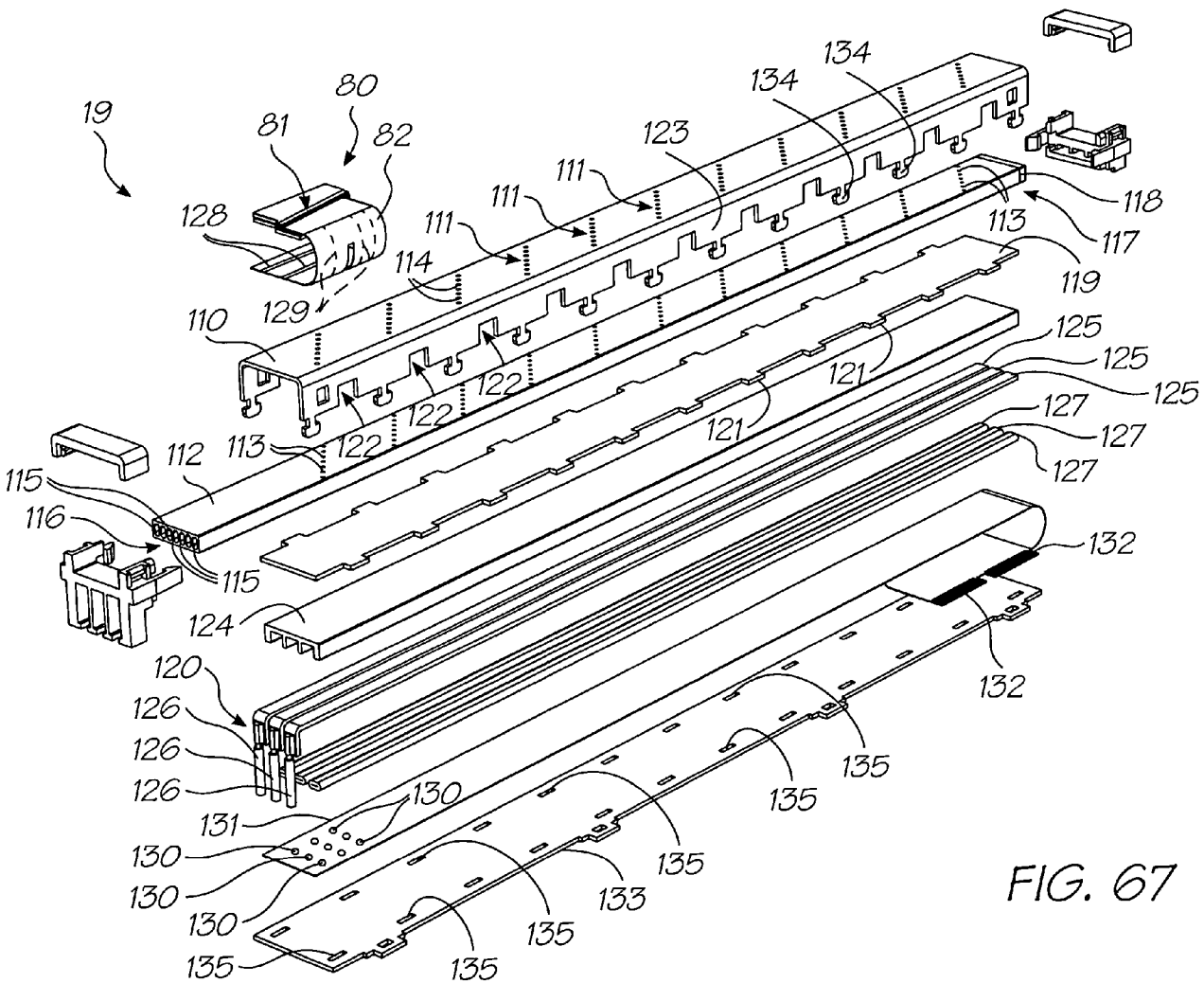
FIG. 67 is a schematic exploded perspective view of a printhead according to an embodiment of the invention.
Figure 68:
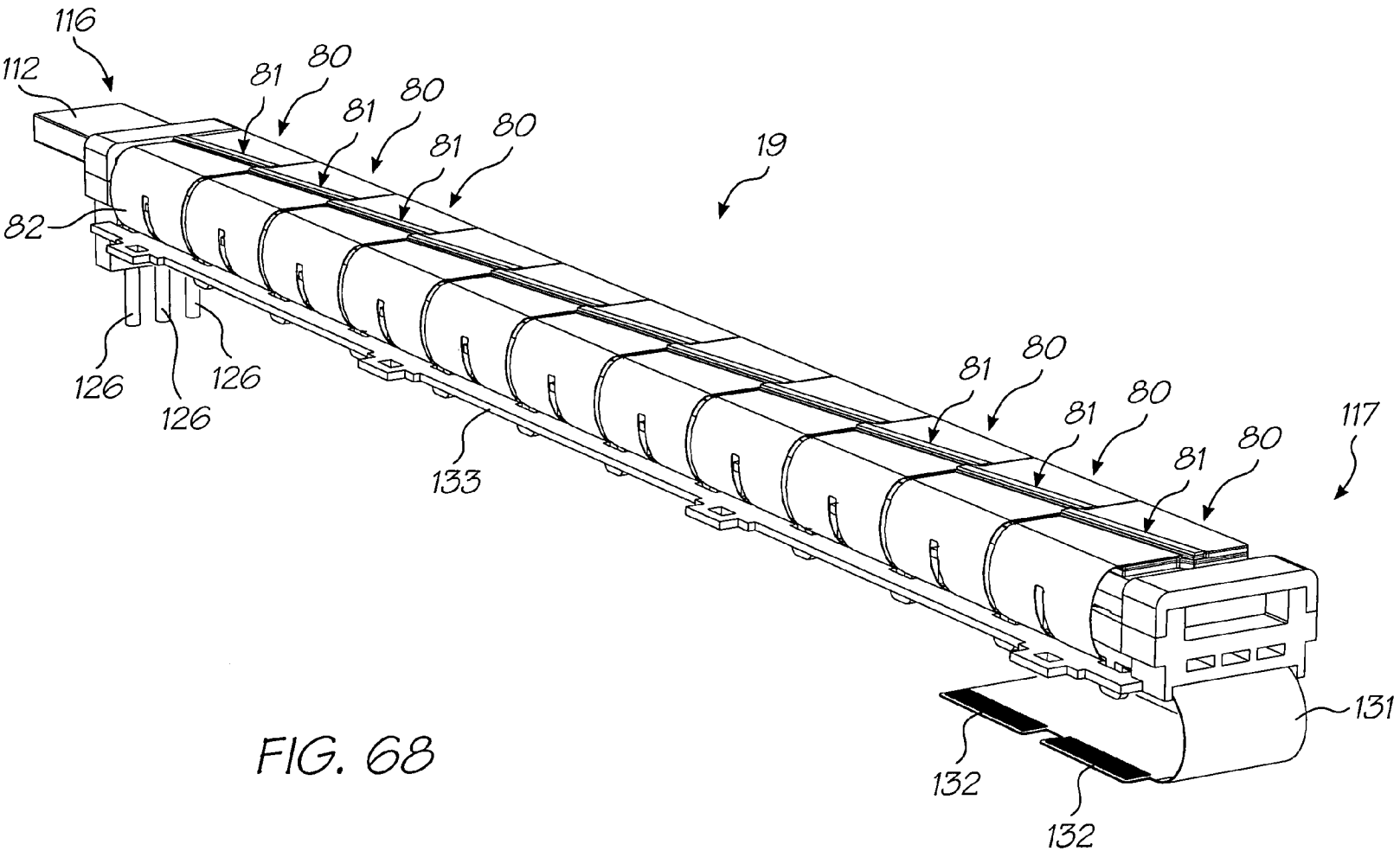
FIG. 68 is a schematic further perspective view of the printhead of FIG. 67 shown unexploded.
Figure 69:
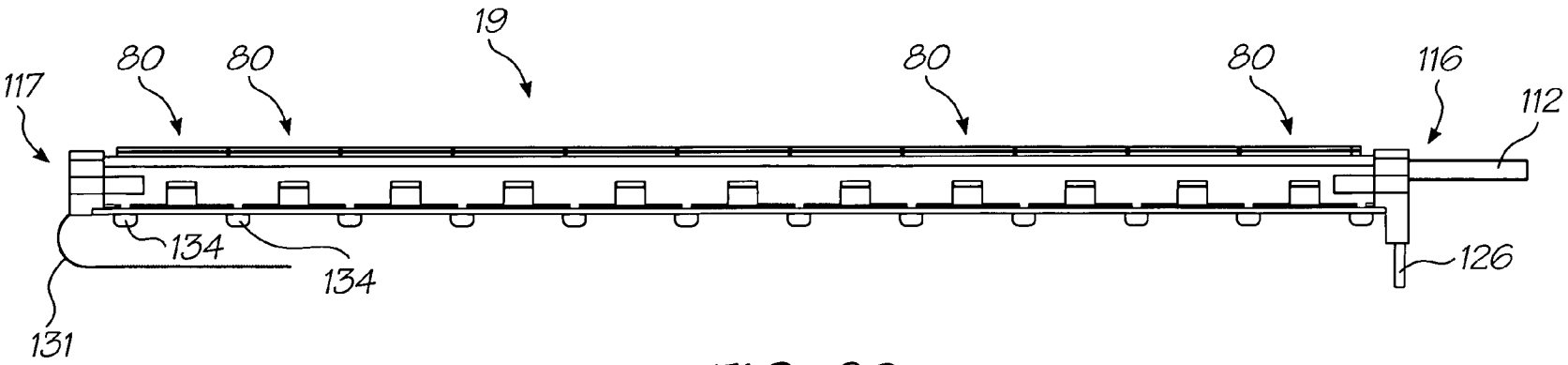
FIG. 69 is a schematic front view of the printhead of FIG. 67.
Figure 70:
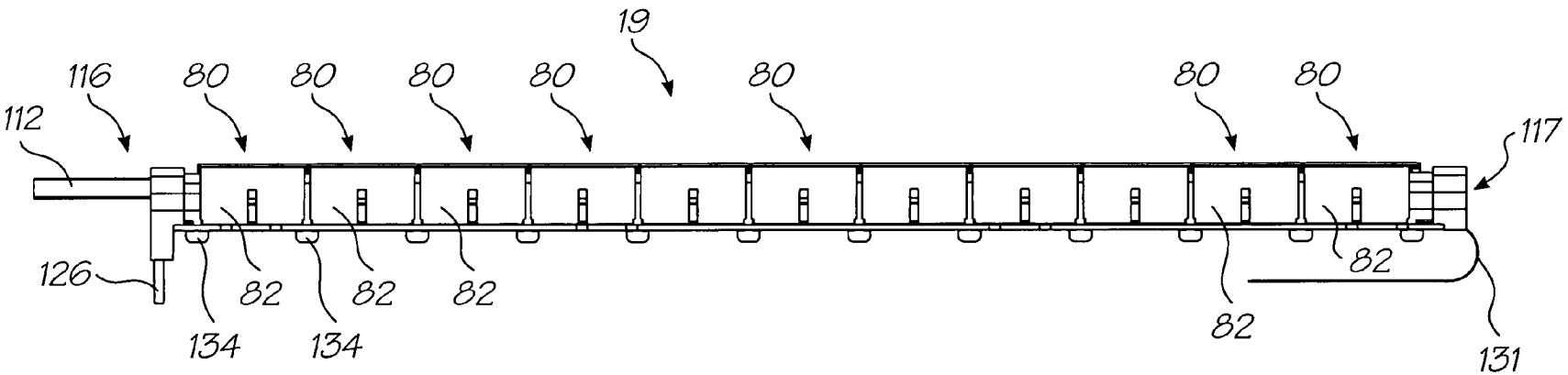
FIG. 70 is a schematic rear view of the printhead of FIG. 67.
Figure 71:
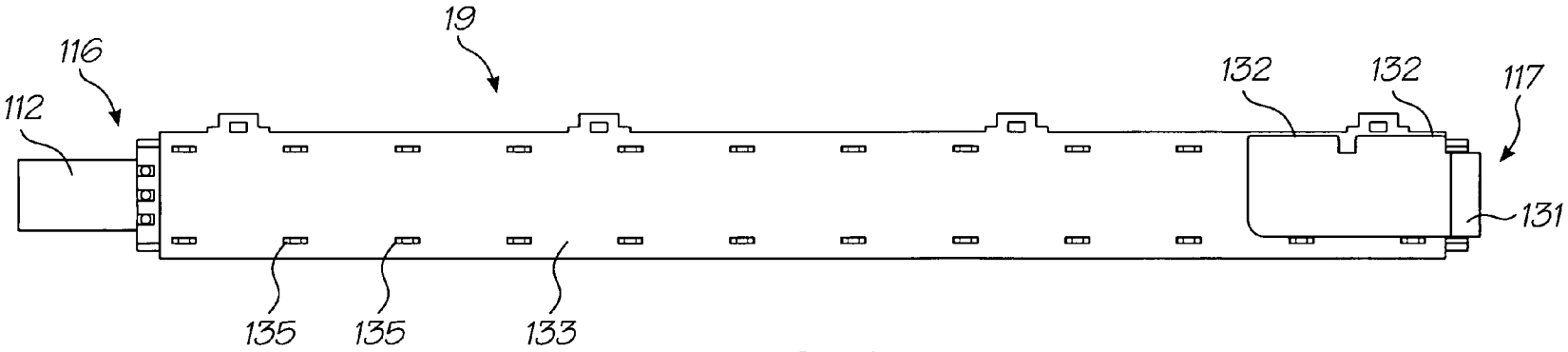
FIG. 71 is a schematic bottom view of the printhead of FIG. 67.
Figure 72:
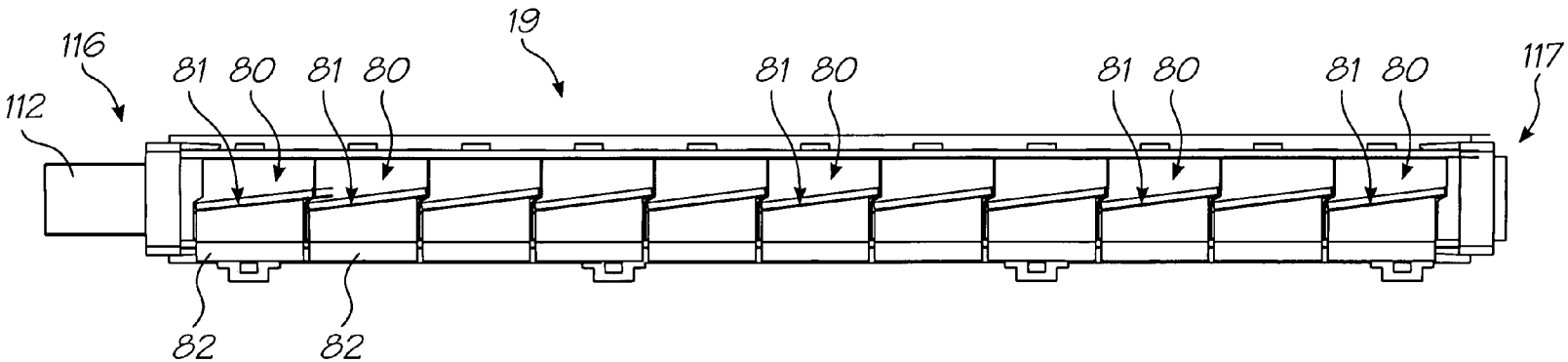
FIG. 72 is a schematic plan view of the printhead of FIG. 67.
Figure 73:
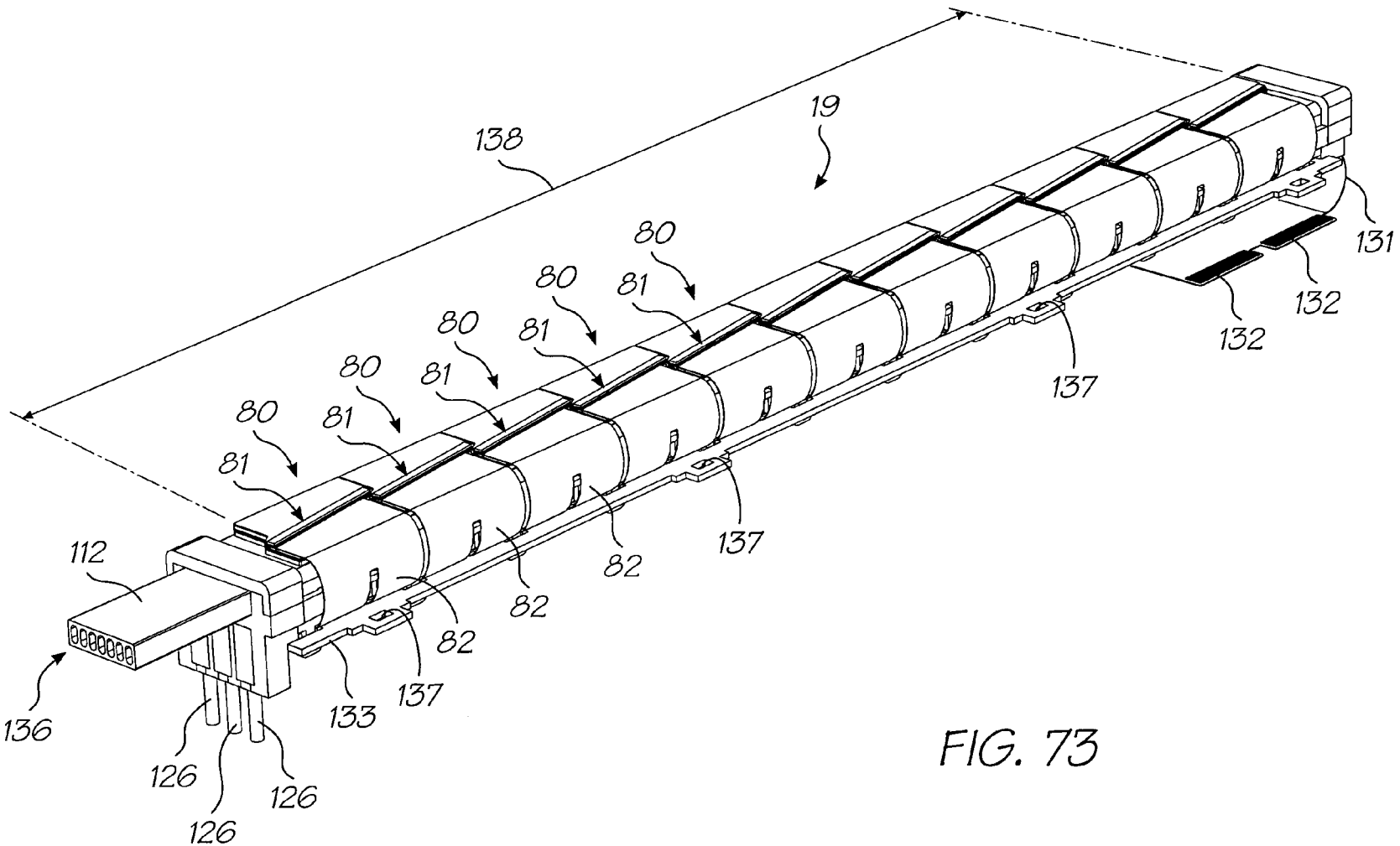
FIG. 73 is a schematic perspective view of the printhead as shown in FIG. 67, but shown unexploded.

Referring to FIG. 67, there is shown schematically, in an exploded view, a printhead assembly 19, which includes, among other components, printhead module assemblies 80 as described above. The printhead assembly 19 is configured for a page-width printer, suitable for A4 or US letter type paper.

The printhead assembly 19 includes eleven of the printhead modules assemblies 80, which are glued onto a substrate channel 110 in the form of a bent metal plate. A series of groups of seven holes each, designated by the reference numerals 111, supply the 6 different colors of ink and the compressed air to the chip assemblies 81. An extruded flexible ink hose 112 is glued into place in the channel 110. It will be noted that the hose 112 includes holes 113 therein.

These holes 113 are not present when the hose 112 is first connected to the channel 110, but are formed thereafter by way of melting, by forcing a hot wire structure (not shown) through the holes 111, which holes then serve as guides to fix the positions at which the holes 113 are melted. When the printhead assembly 19 is assembled, the holes 113 are in fluid-flow communication with the holes 98 in the lower layer 90 of each printhead module assembly 80, via holes 114 (which make up the groups 111 in the channel 110).

The hose 112 defines parallel channels 115 which extend the length of the hose. At one end 116, the hose 112 is connected to ink containers (not shown), and at the opposite end 117, there is provided a channel extrusion cap 118, which serves to plug, and thereby close, that end of the hose.

A metal top support plate 119 supports and locates the channel 110 and hose 112, and serves as a back plate for these. The channel 110 and hose 112, in turn, exert pressure onto an assembly 120 which includes flex printed circuits. The plate 119 has tabs 121 which extend through notches 122 in the downwardly extending wall 123 of the channel 110, to locate the channel and plate with respect to each other.

An extrusion 124 is provided to locate copper bus bars 125. Although the energy required to operate a printhead according to the present invention is an order of magnitude lower than that of known thermal ink jet printers, there are a total of about 88,000 nozzles in the printhead array, and this is approximately 160 times the number of nozzles that are typically found in typical printheads. As the nozzles in the present invention may be operational (i.e. may fire) on a continuous basis during operation, the total power consumption will be an order of magnitude higher than that in such known printheads, and the current requirements will, accordingly, be high, even though the power consumption per nozzle will be an order of magnitude lower than that in the known printheads. The busbars 125 are suitable for providing for such power requirements, and have power leads 126 soldered to them.

Compressible conductive strips 127 are provided to abut with contacts 128 on the upperside, as shown, of the lower parts of the flex PCBs 82 of the printhead module assemblies 80. The PCBs 82 extend from the chip assemblies 81, around the channel 110, the support plate 119, the extrusion 124 and busbars 126, to a position below the strips 127 so that the contacts 128 are positioned below, and in contact with, the strips 127.

Each PCB 82 is double-sided and plated-through. Data connections 129 (indicated schematically by dashed lines), which are located on the outer surface of the PCB 82 abut with contact spots 130 (only some of which are shown schematically) on a flex PCB 131 which, in turn, includes a data bus and edge connectors 132 which are formed as part of the flex itself. Data is fed to the PCBs 131 via the edge connectors 132.

A metal plate 133 is provided so that it, together with the channel 110, can keep all of the components of the printhead assembly 19 together. In this regard, the channel 110 includes twist tabs 134 which extend through slots 135 in the plate 133 when the assembly 19 is put together, and are then twisted through approximately 45 degrees to prevent them from being withdrawn through the slots.

Figure 91:
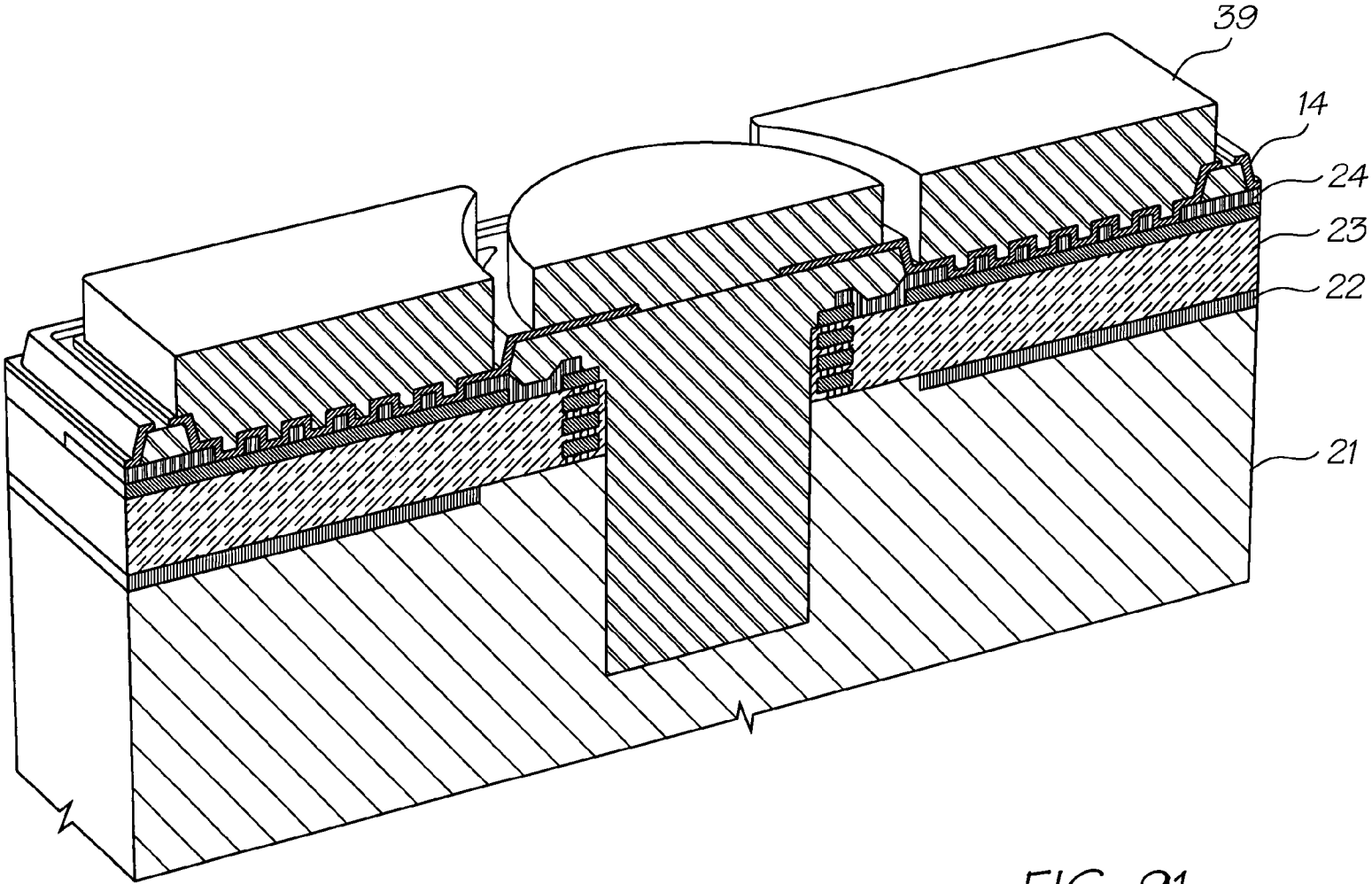
Figure 92:
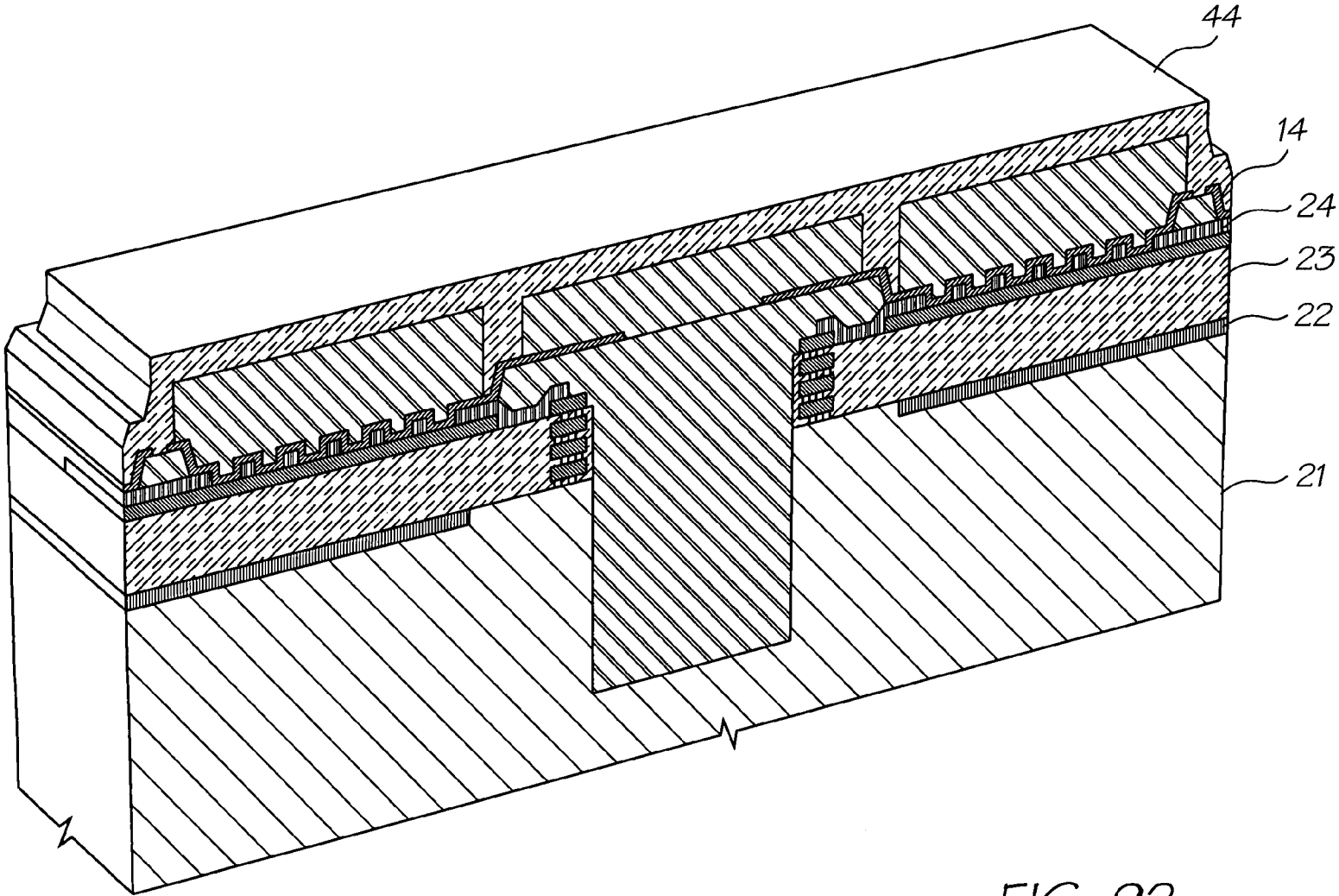
Figure 93:
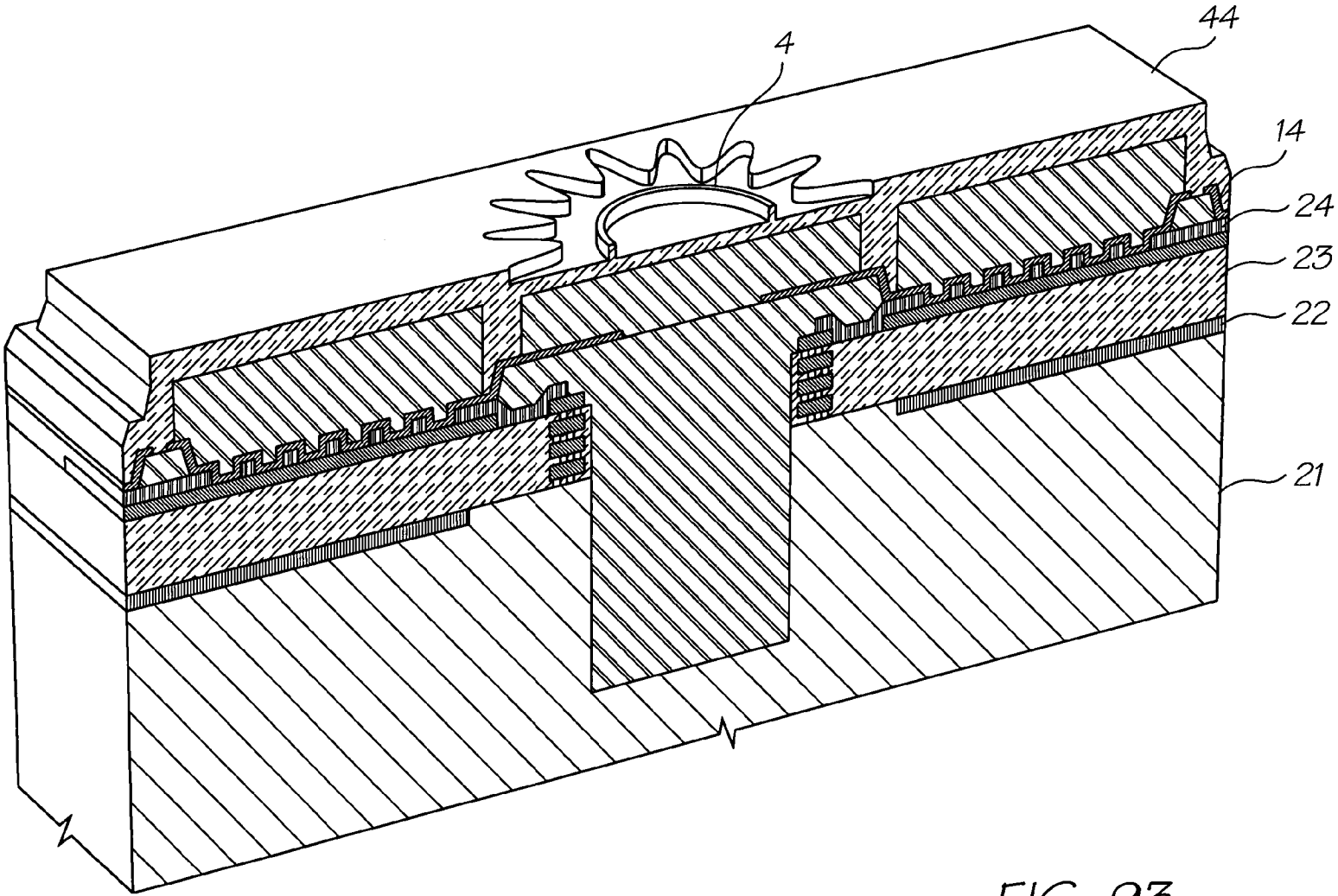
Figure 94:
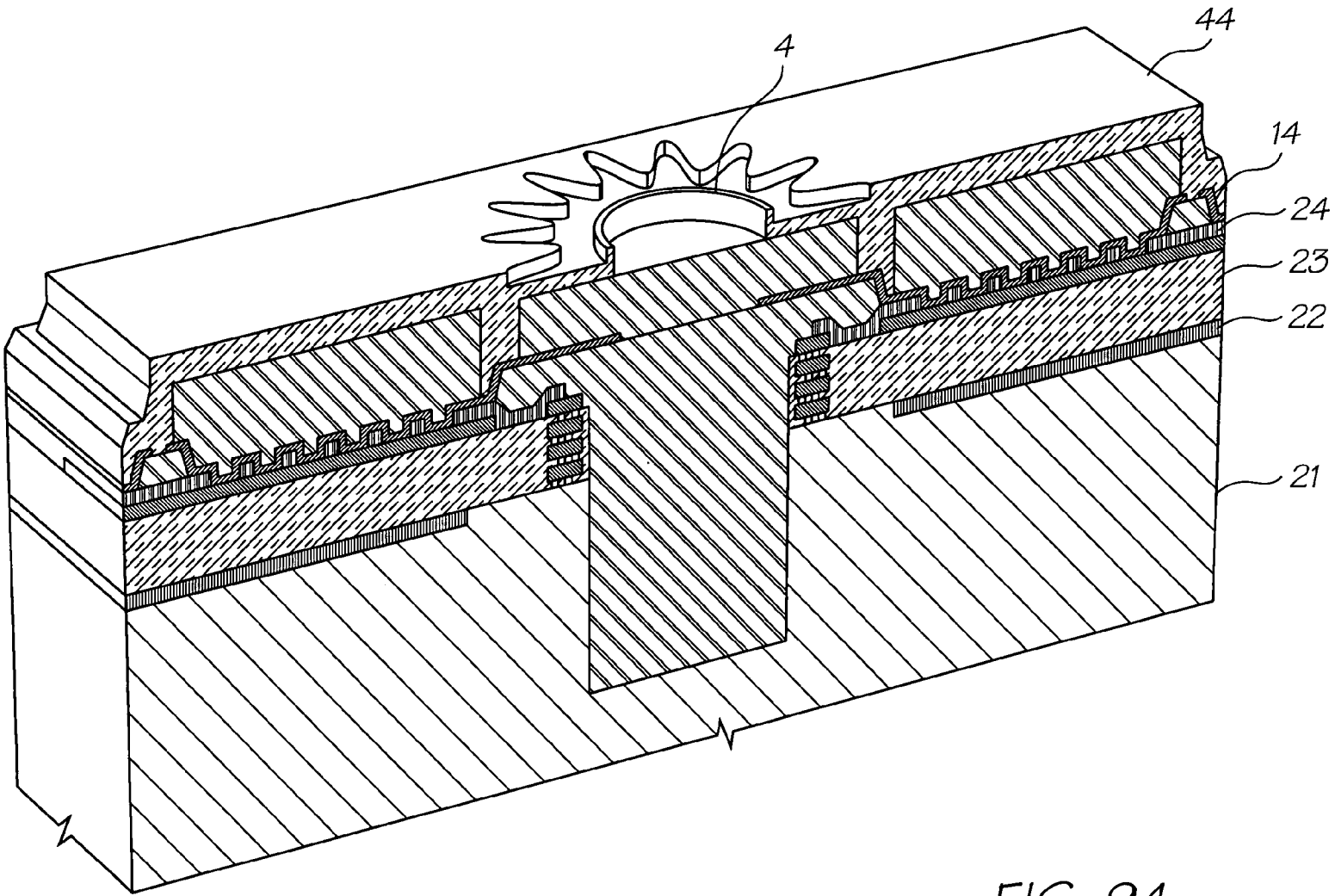
Figure 95:
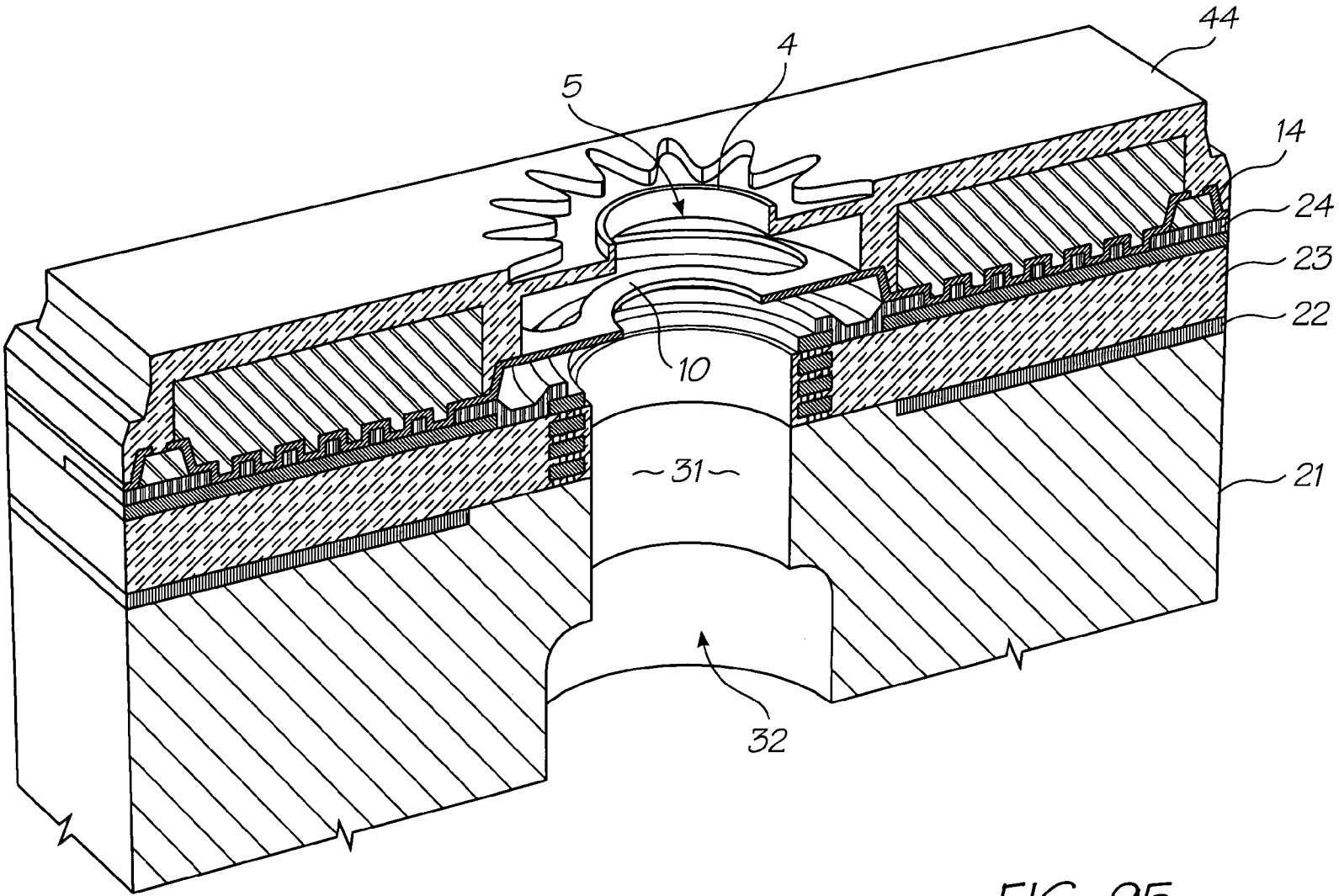
Figure 96:
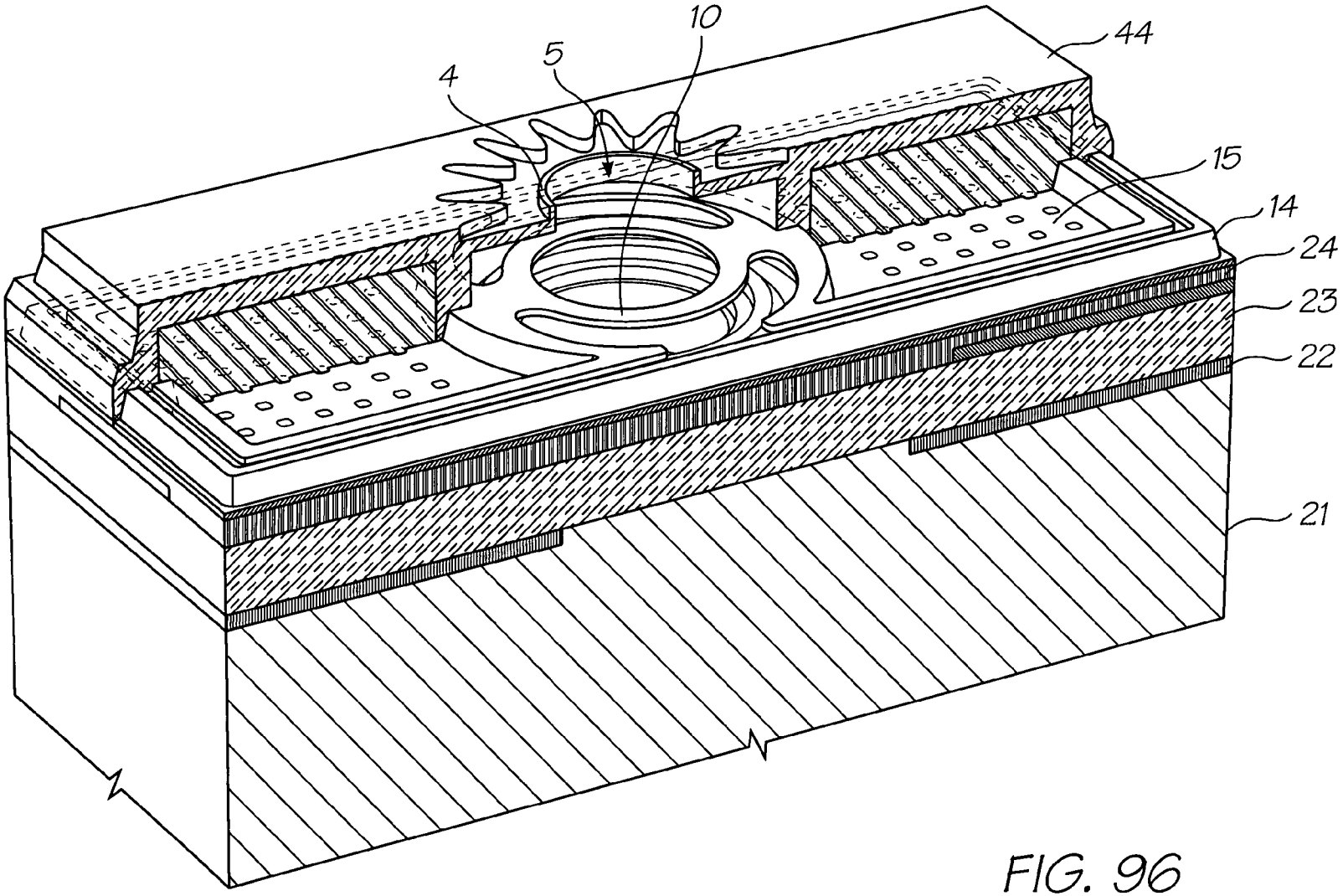
FIGS. 96 and 97 show schematic, partially cut away, schematic perspective views of two variations of the unit cell of FIGS. 83 to 95.

By way of summary, with reference to FIG. 91, the printhead assembly 19 is shown in an assembled state. Ink and compressed air are supplied via the hose 112 at 136, power is supplied via the leads 126, and data is provided to the printhead chip assemblies 81 via the edge connectors 132. The printhead chip assemblies 81 are located on the eleven printhead module assemblies 80, which include the PCBs 82.

Mounting holes 137 are provided for mounting the printhead assembly 19 in place in a printer (not shown). The effective length of the printhead assembly 19, represented by the distance 138, is just over the width of an A4 page (that is, about 8.5 inches).

Figure 74:
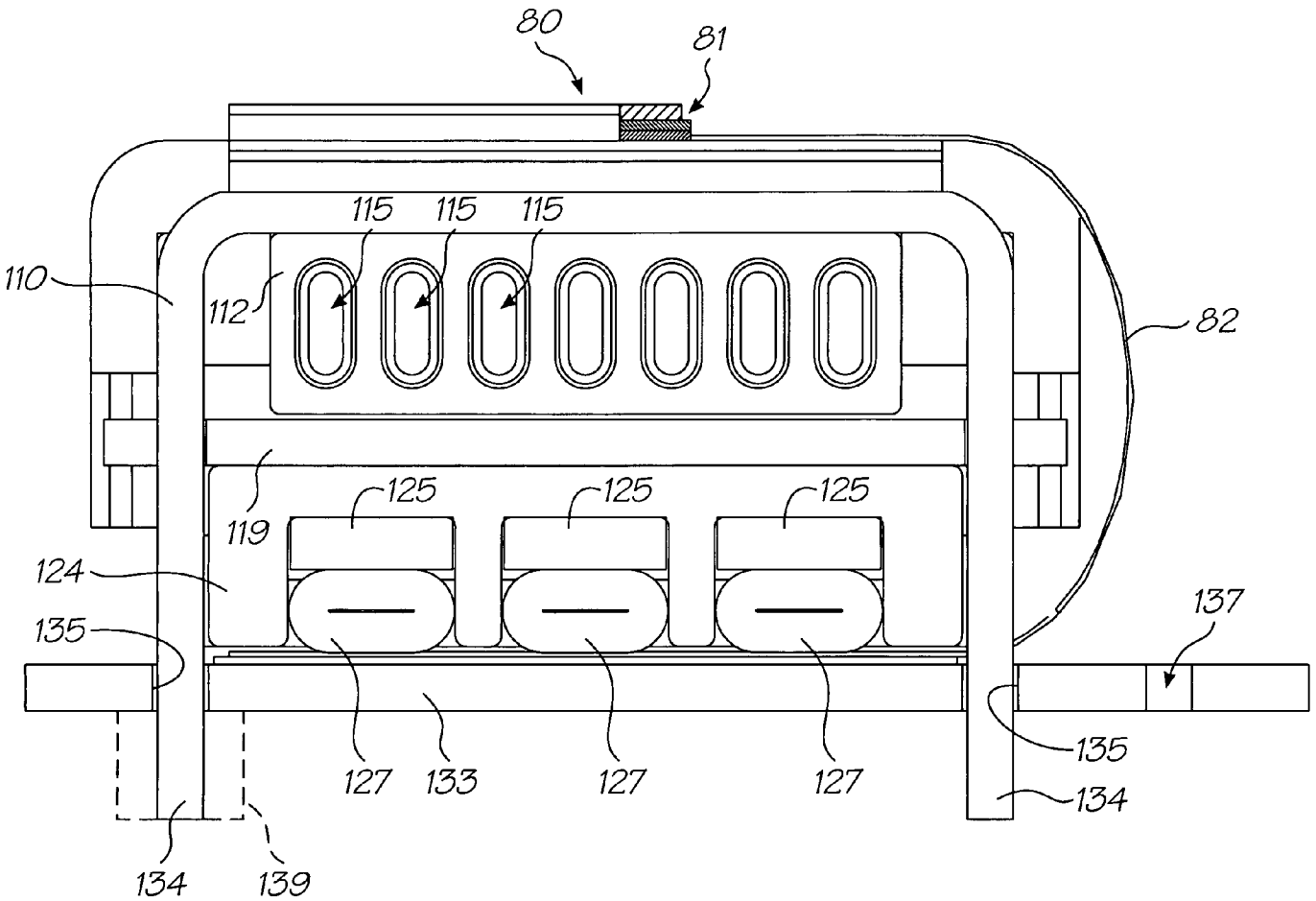
FIG. 74 is a schematic longitudinal section through the printhead of FIG. 67.

Referring to FIG. 74, there is shown, schematically, a cross-section through the assembled printhead 19. From this, the position of a silicon stack forming a chip assembly 81 can clearly be seen, as can a longitudinal section through the ink and air supply hose 112. Also clear to see is the abutment of the compressible strip 127 which makes contact above with the busbars 125, and below with the lower part of a flex PCB 82 extending from a the chip assembly 81. The twist tabs 134 which extend through the slots 135 in the metal plate 133 can also be seen, including their twisted configuration, represented by the dashed line 139.

Printer System

Figure 75:
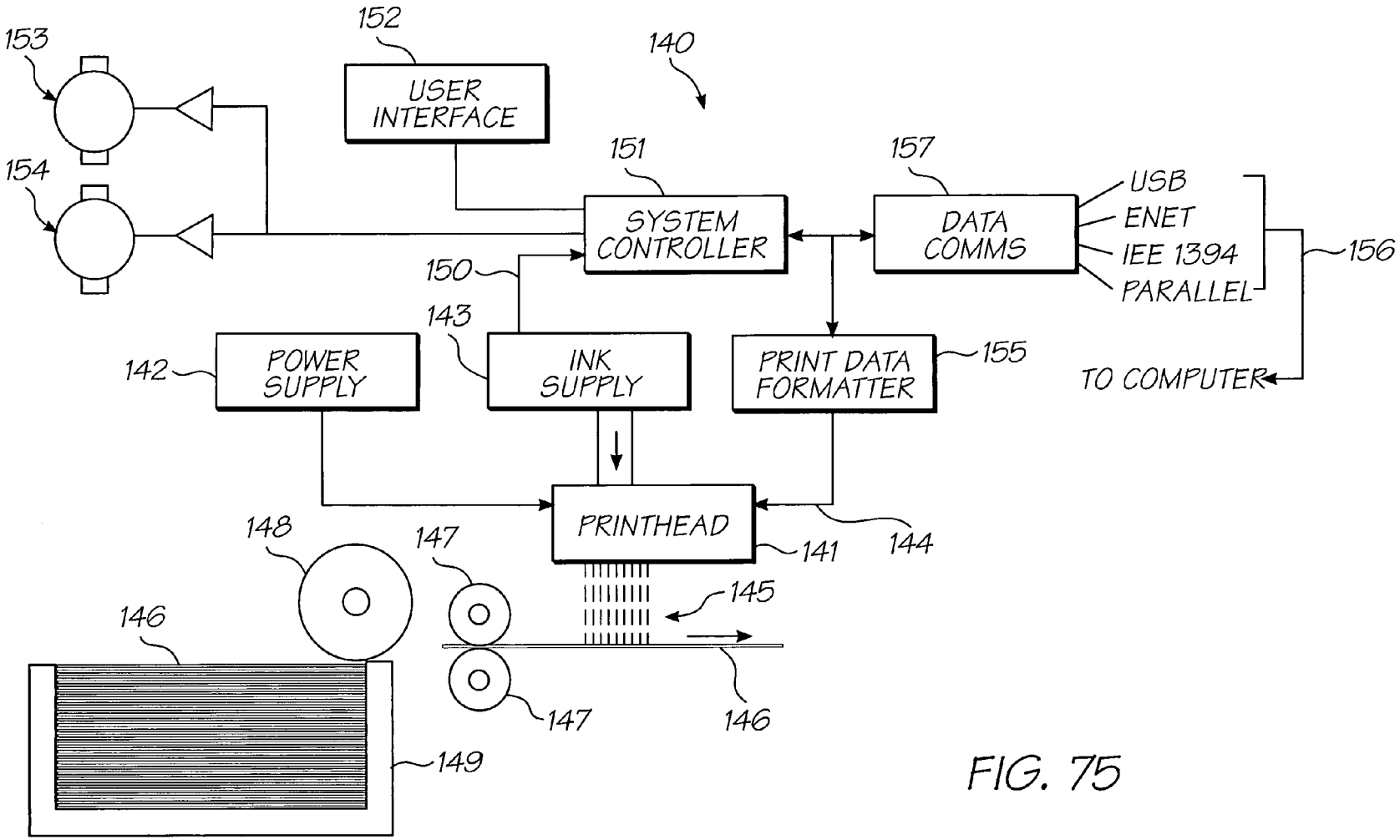
FIG. 75 is a block diagram of a printer system according to an embodiment of the invention.

Referring to FIG. 75, there is shown a block diagram illustrating a printhead system 140 according to an embodiment of the invention.

Shown in the block diagram is the printhead 141, a power supply 142 to the printhead, an ink supply 143, and print data 144 (represented by the arrow) which is fed to the printhead as it ejects ink, at 145, onto print media in the form, for example, of paper 146.

Media transport rollers 147 are provided to transport the paper 146 past the printhead 141. A media pick up mechanism 148 is configured to withdraw a sheet of paper 146 from a media tray 149.

The power supply 142 is for providing DC voltage which is a standard type of supply in printer devices.

The ink supply 143 is from ink cartridges (not shown) and, typically various types of information will be provided, at 150, about the ink supply, such as the amount of ink remaining. This information is provided via a system controller 151 which is connected to a user interface 152. The interface 152 typically consists of a number of buttons (not shown), such as a "print" button, "page advance" button, and so on. The system controller 151 also controls a motor 153 that is provided for driving the media pick up mechanism 148 and a motor 154 for driving the media transport rollers 147.

It is necessary for the system controller 151 to identify when a sheet of paper 146 is moving past the printhead 141, so that printing can be effected at the correct time. This time can be related to a specific time that has elapsed after the media pick up mechanism 148 has picked up the sheet of paper 146. Preferably, however, a paper sensor (not shown) is provided, which is connected to the system controller 151 so that when the sheet of paper 146 reaches a certain position relative to the printhead 141, the system controller can effect printing. Printing is effected by triggering a print data formatter 155 which provides the print data 144 to the printhead 141. It will therefore be appreciated that the system controller 151 must also interact with the print data formatter 155.

The print data 144 emanates from an external computer (not shown) connected at 156, and may be transmitted via any of a number of different connection means, such as a USB connection, an ETHERNET connection, a IEEE 1394 connection otherwise known as firewire, or a parallel connection. A data communications module 157 provides this data to the print data formatter 155 and provides control information to the system controller 151.

Features and Advantages of Further Embodiments

FIGS. 76 to 99 show further embodiments of unit cells 1 for thermal inkjet printheads, each embodiment having its own particular functional advantages. These advantages will be discussed in detail below, with reference to each individual embodiment. However, the basic construction of each embodiment is best shown in FIGS. 77, 79, 81 and 84. The manufacturing process is substantially the same as that described above in relation to FIGS. 10 to 35 and for consistency, the same reference numerals are used in FIGS. 76 to 99 to indicate corresponding components. In the interests of brevity, the fabrication stages have been shown for the unit cell of FIG. 83 only (see FIGS. 85 to 99). It will be appreciated that the other unit cells will use the same fabrication stages with different masking. Again, the deposition of successive layers shown in FIGS. 85 to 99 need not be described in detail below given that the lithographic process largely corresponds to that shown in FIGS. 10 to 35.

Figure 76:
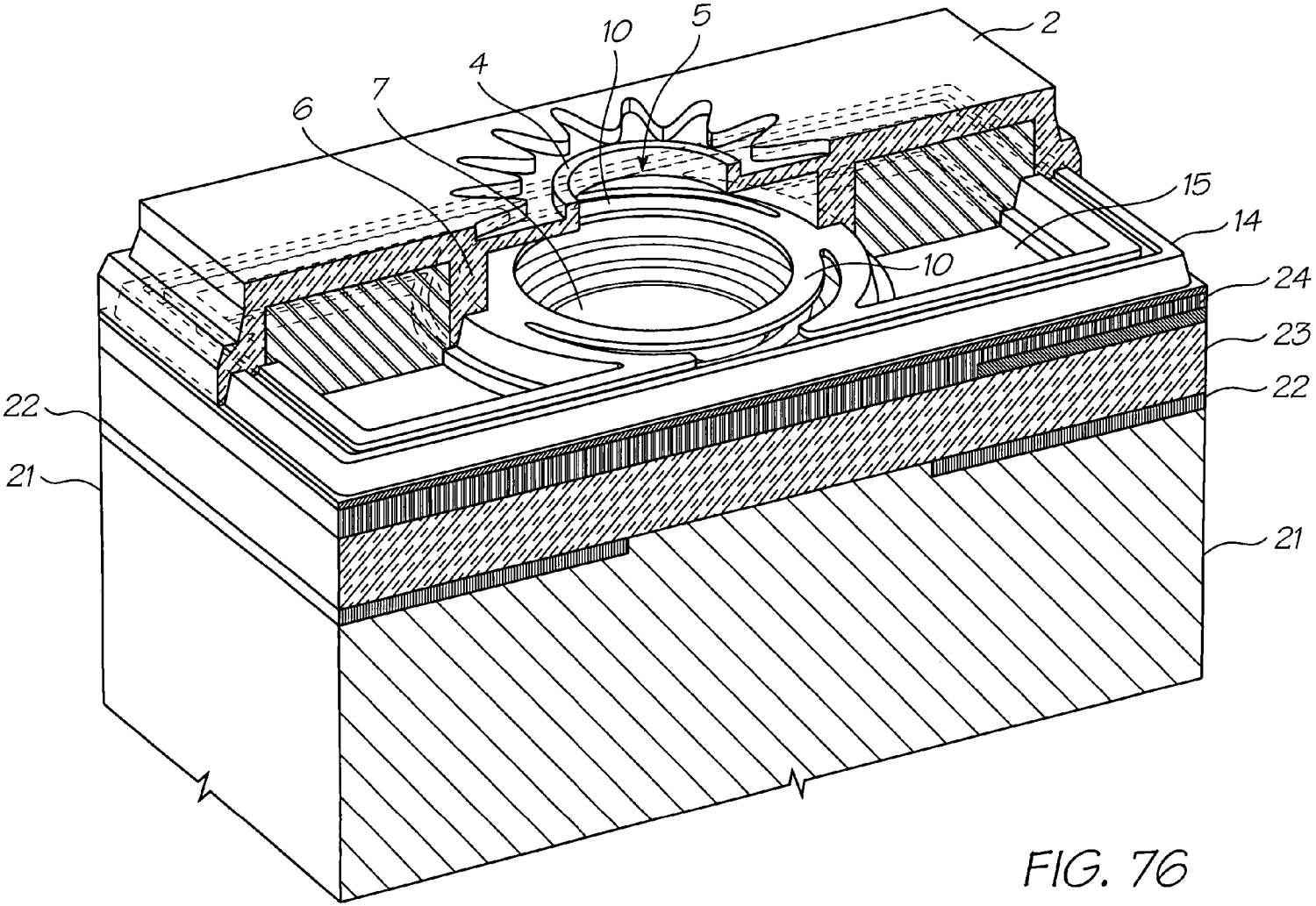
FIG. 76 is a schematic, partially cut away, perspective view of a further embodiment of a unit cell of a printhead.
Figure 77:
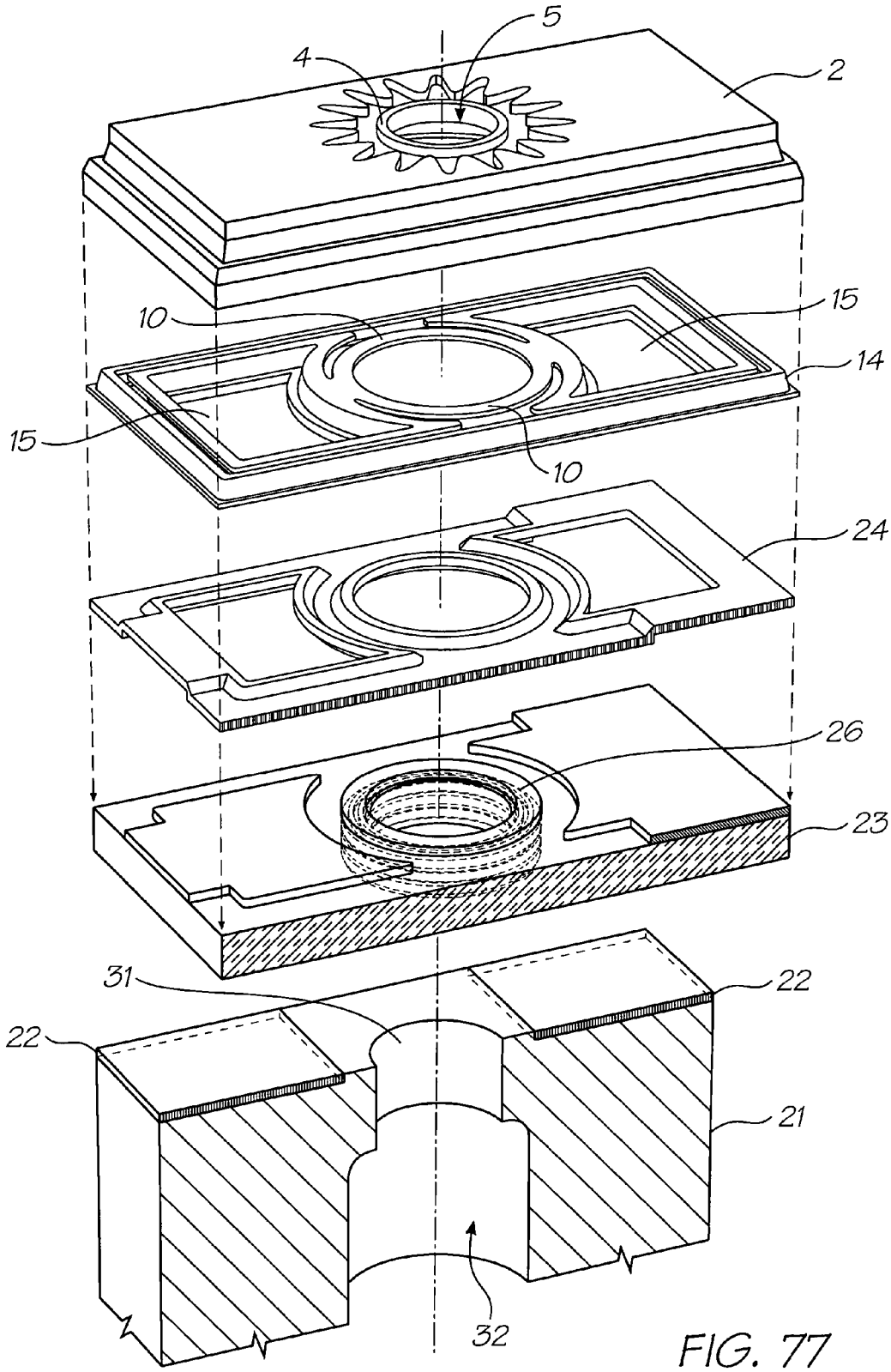
FIG. 77 is a schematic, partially cut away, exploded perspective view of the unit cell of FIG. 76.
Figure 87:
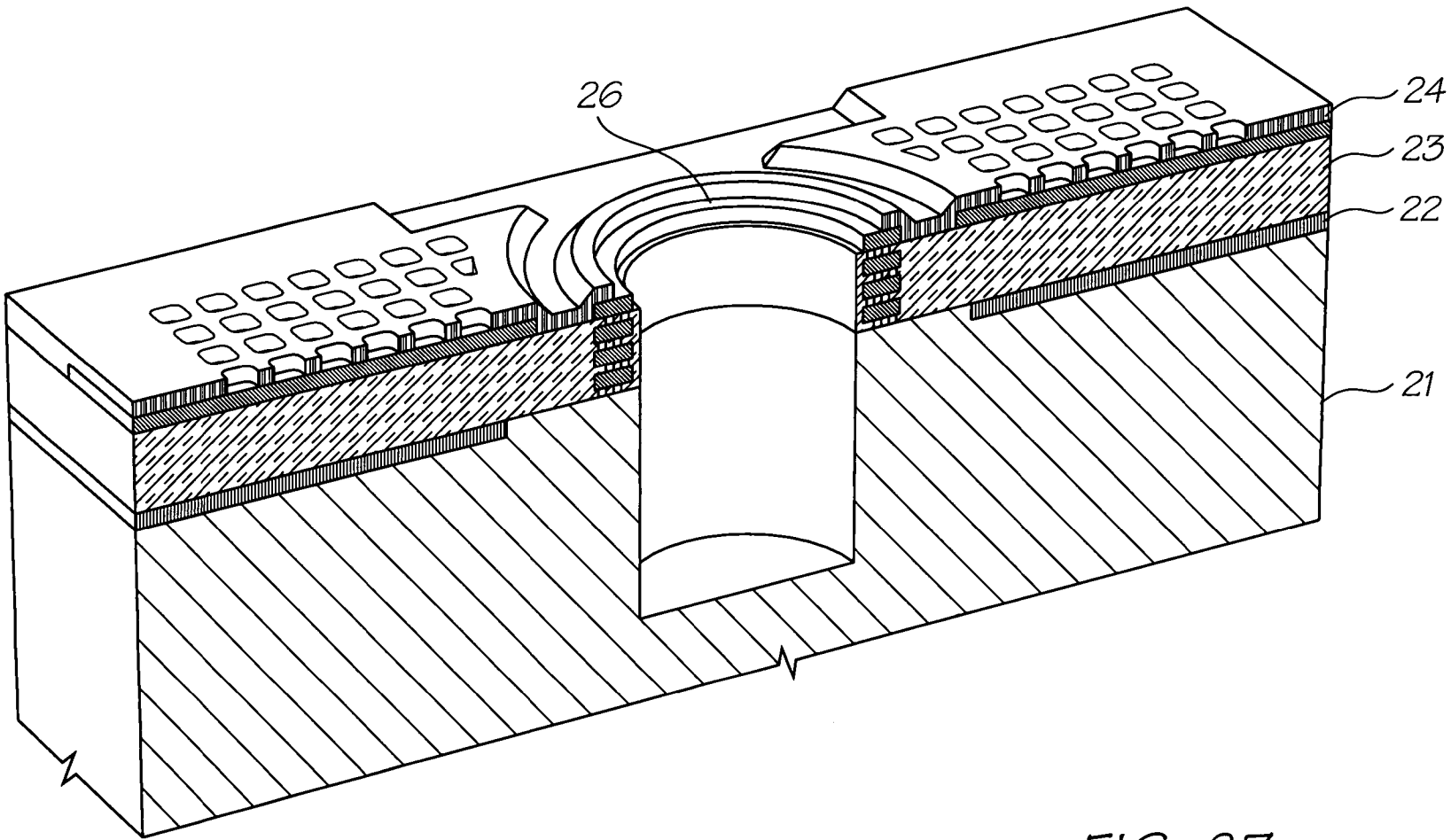
Figure 88:
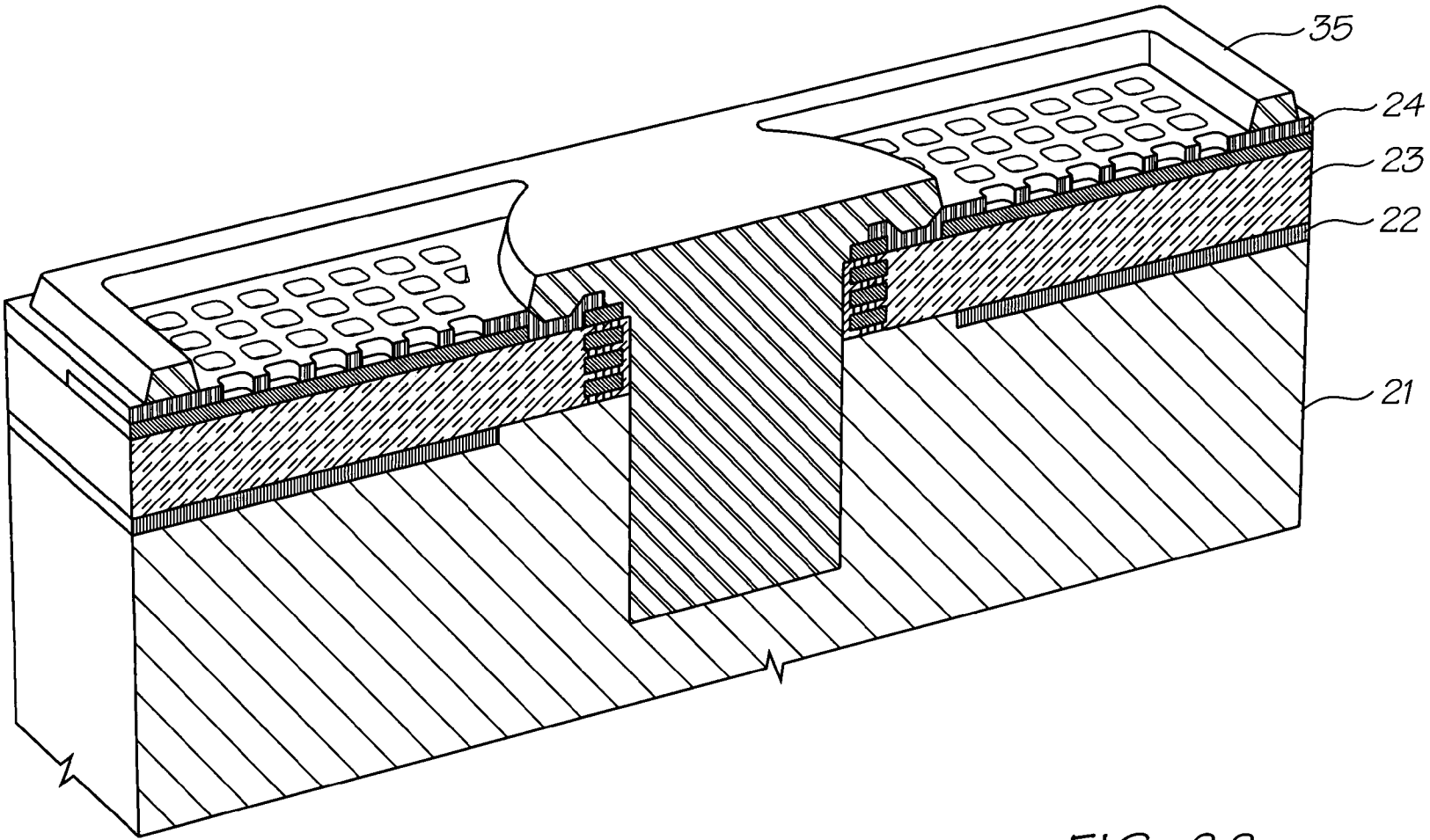
Figure 89:
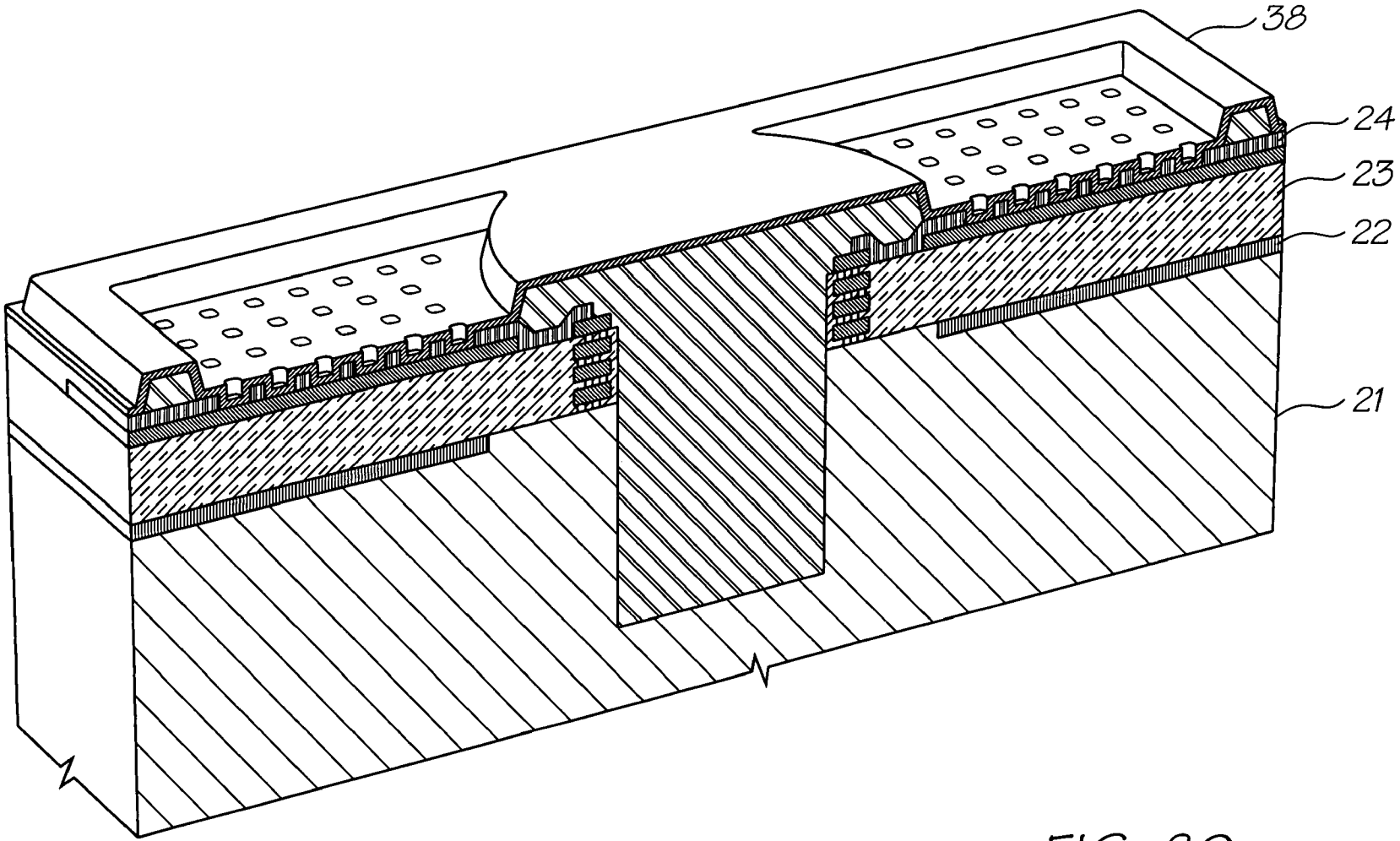
Figure 90:
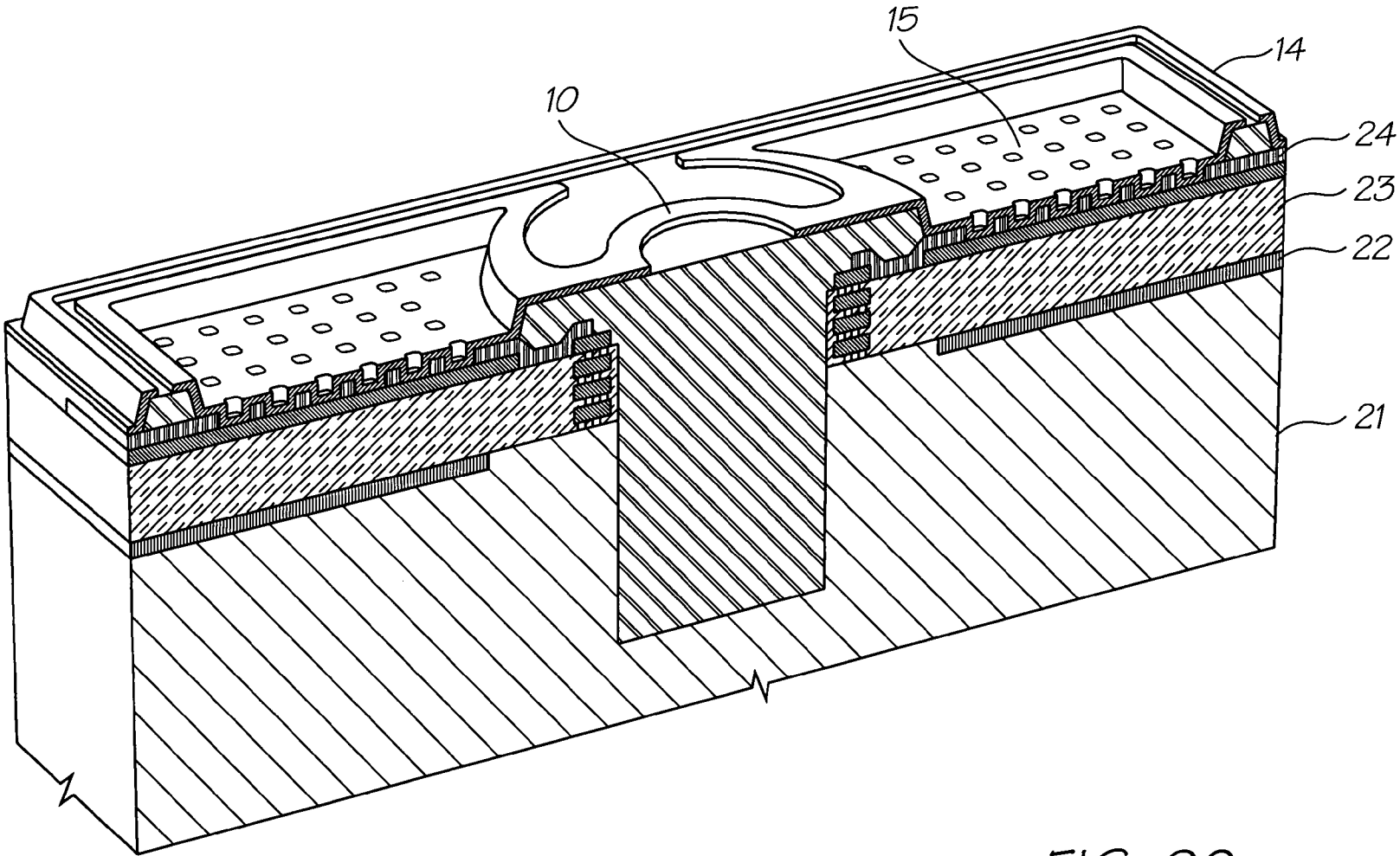

Referring to FIGS. 76 and 87, the unit cell 1 shown has the chamber 7, ink supply passage 32 and the nozzle rim 4 positioned mid way along the length of the unit cell 1. As best seen in FIG. 77, the drive circuitry is partially on one side of the chamber 7 with the remainder on the opposing side of the chamber. The drive circuitry 22 controls the operation of the heater 14 through vias in the integrated circuit metallisation layers of the interconnect 23. The interconnect 23 has a raised metal layer on its top surface. Passivation layer 24 is formed in top of the interconnect 23 but leaves areas of the raised metal layer exposed. Electrodes 15 of the heater 14 contact the exposed metal areas to supply power to the element 10.

Alternatively, the drive circuitry 22 for one unit cell is not on opposing sides of the heater element that it controls. All the drive circuitry 22 for the heater 14 of one unit cell is in a single, undivided area that is offset from the heater. That is, the drive circuitry 22 is partially overlaid by one of the electrodes 15 of the heater 14 that it is controlling, and partially overlaid by one or more of the heater electrodes 15 from adjacent unit cells. In this situation, the center of the drive circuitry 22 is less than 200 microns from the center of the associate nozzle aperture 5. In most Memjet printheads of this type, the offset is less than 100 microns and in many cases less than 50 microns, preferably less than 30 microns.

Configuring the nozzle components so that there is significant overlap between the electrodes and the drive circuitry provides a compact design with high nozzle density (nozzles per unit area of the nozzle plate 2). This also improves the efficiency of the printhead by shortening the length of the conductors from the circuitry to the electrodes. The shorter conductors have less resistance and therefore dissipate less energy.

Figure 84:
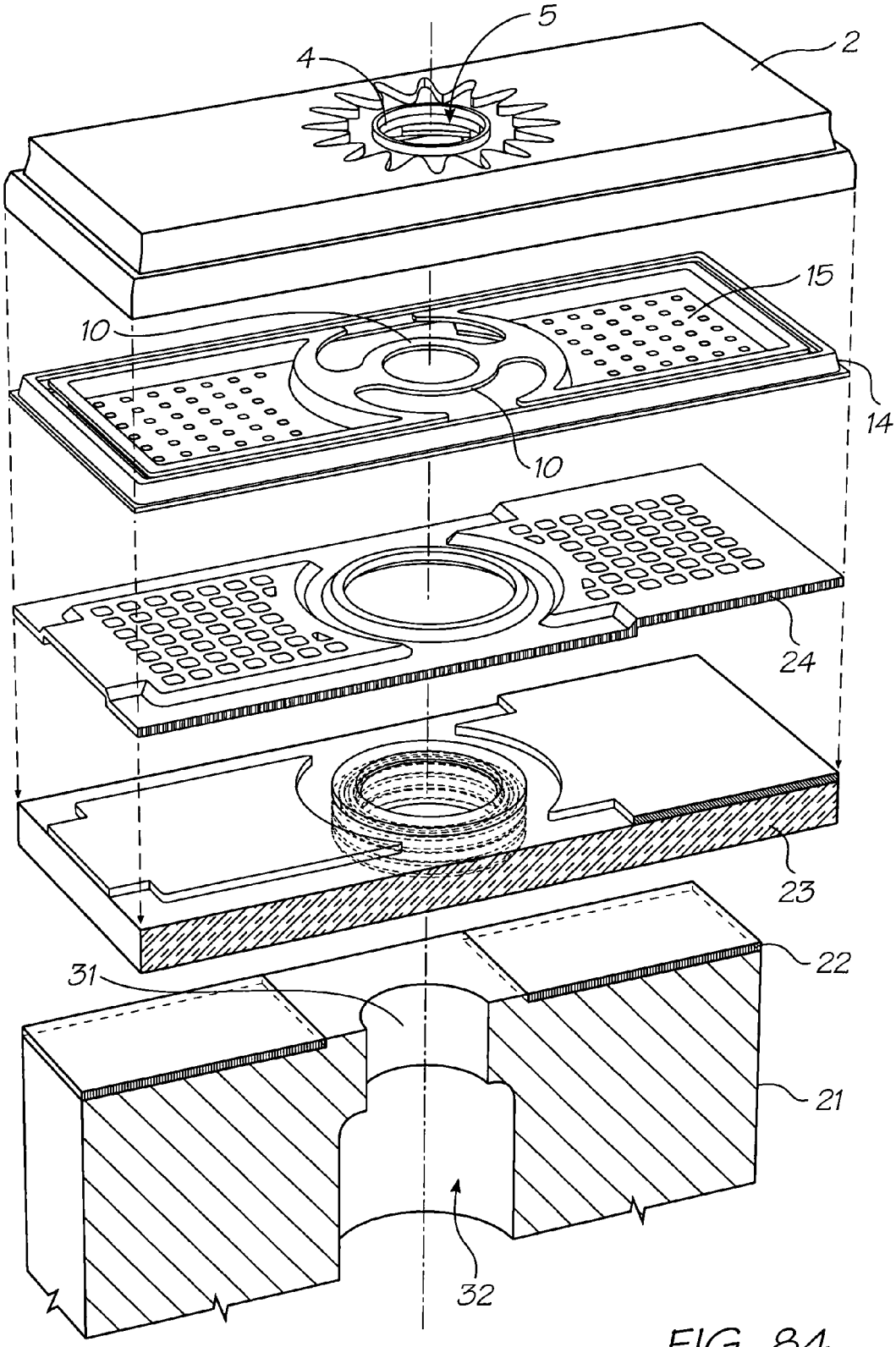
FIG. 84 is a schematic, partially cut away, exploded perspective view of the unit cell of FIG. 83.
Figure 85:
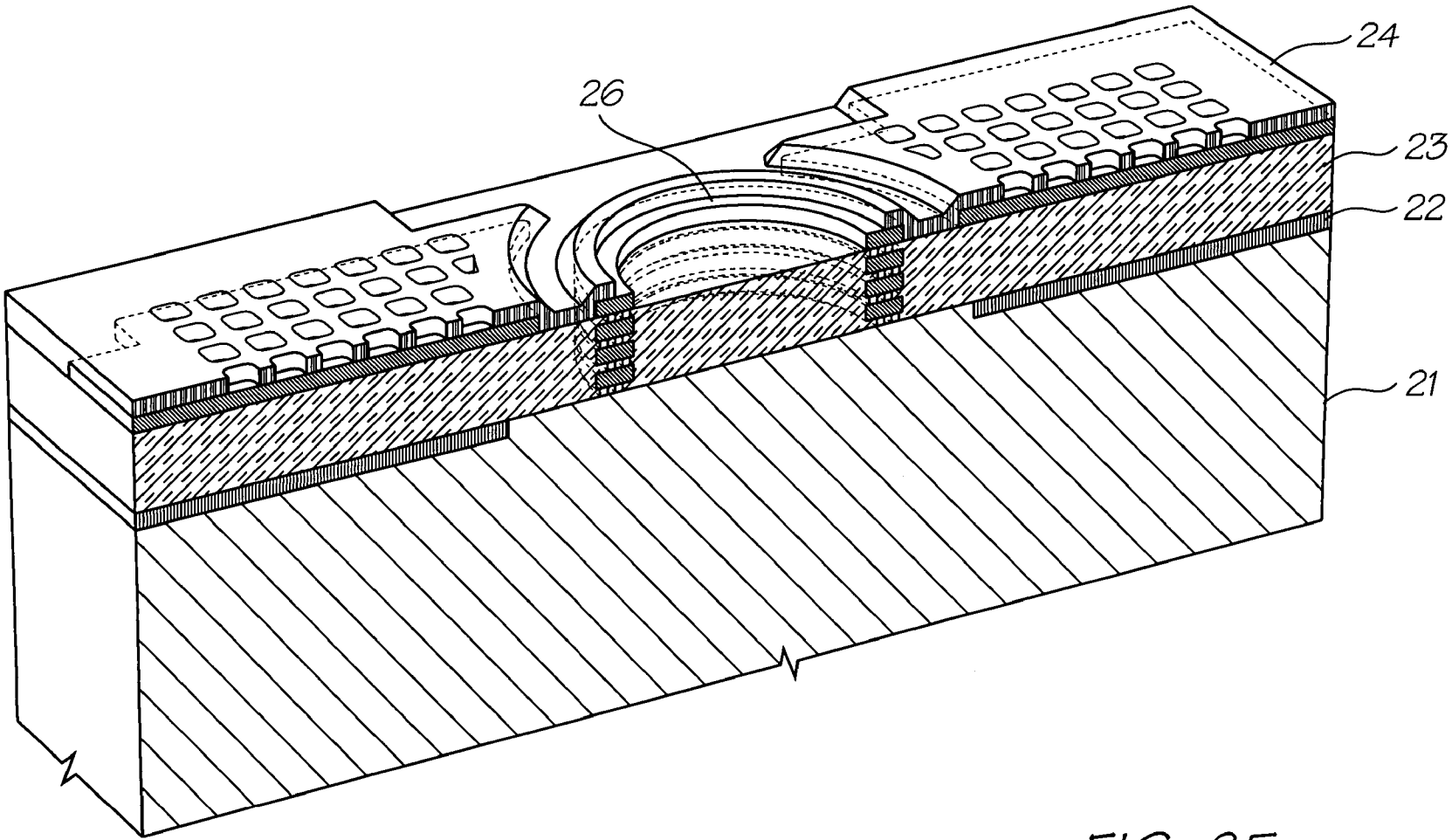
FIGS. 85 to 95 are schematic perspective views of the unit cell shown in FIGS. 83 and 84, at various successive stages in the production process of the printhead.
Figure 86:
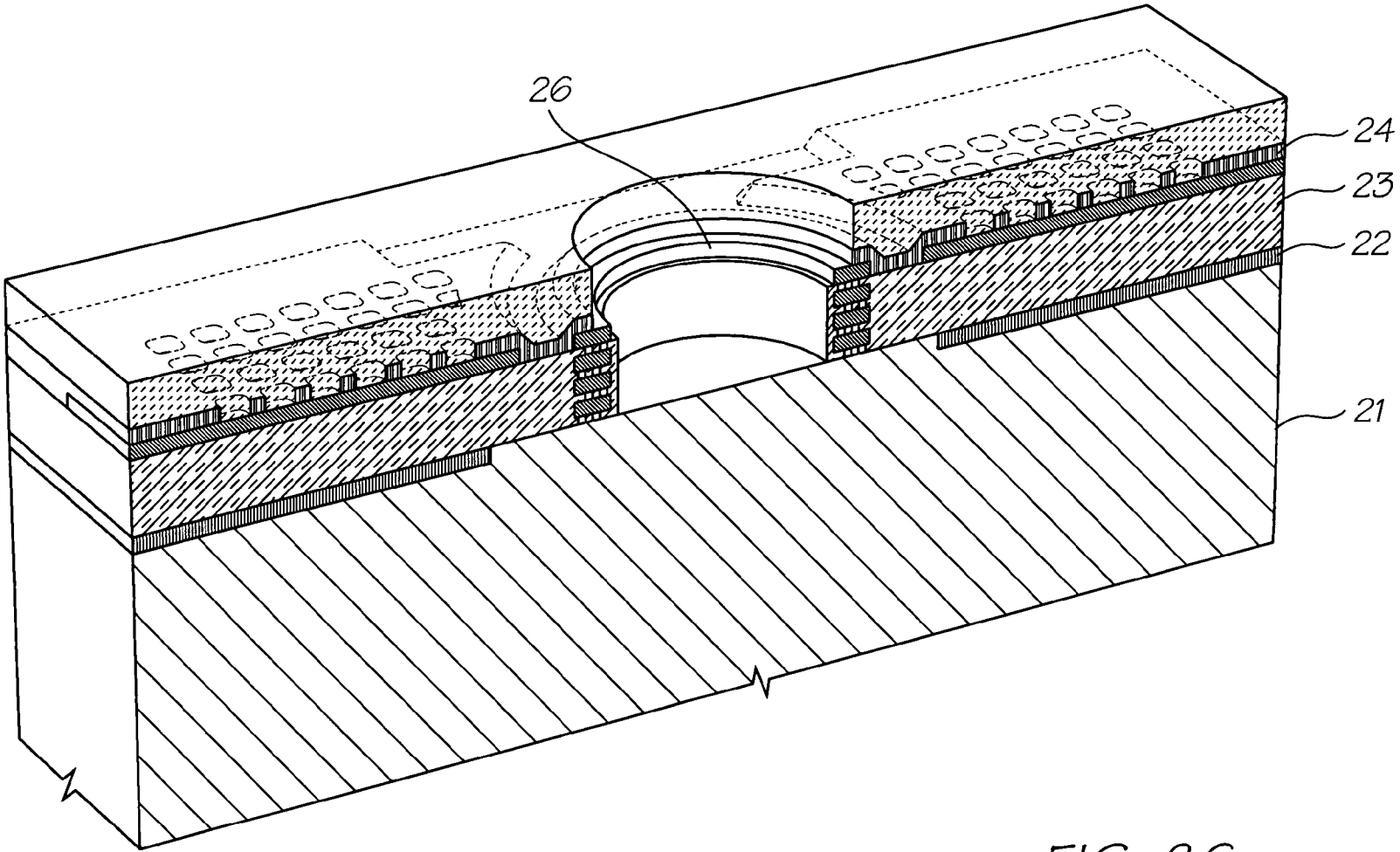

The high degree of overlap between the electrodes 15 and the drive circuitry 22 also allows more vias between the heater material and the CMOS metalization layers of the interconnect 23. As best shown in FIGS. 84 and 85, the passivation layer 24 has an array of vias to establish an electrical connection with the heater 14. More vias lowers the resistance between the heater electrodes 15 and the interconnect layer 23 which reduces power losses.

Figure 79:
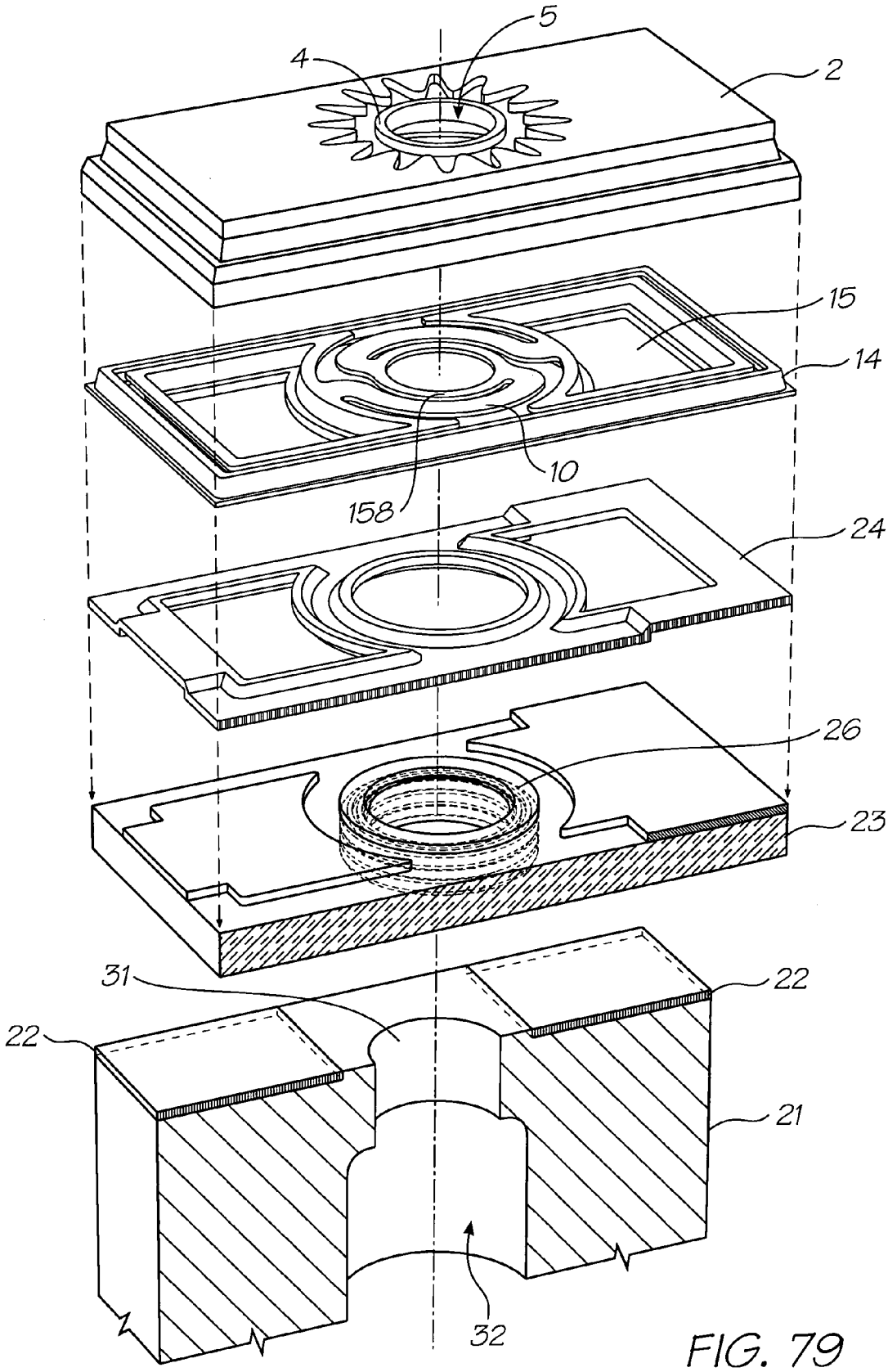
FIG. 79 is a schematic, partially cut away, exploded perspective view of the unit cell of FIG. 78.

In FIGS. 76 and 79, the unit cell 1 is the same as that of FIGS. 76 and 77 apart from the heater element 10. The heater element 10 has a bubble nucleation section 158 with a smaller cross section than the remainder of the element. The bubble nucleation section 158 has a greater resistance and heats to a temperature above the boiling point of the ink before the remainder of the element 10. The gas bubble nucleates at this region and subsequently grows to surround the rest of the element 10. By controlling the bubble nucleation and growth, the trajectory of the ejected drop is more predictable.

Figure 78:
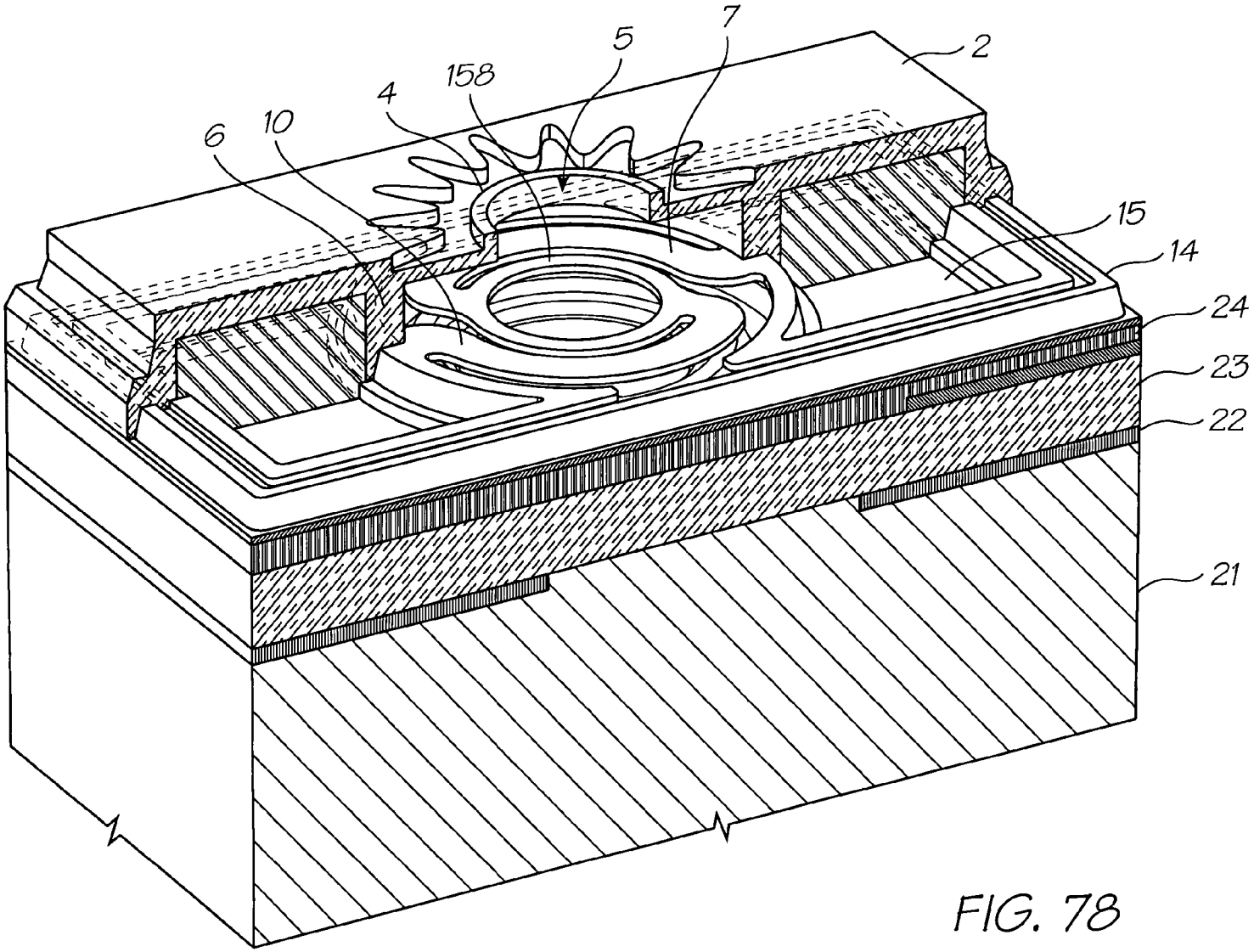
FIG. 78 is a schematic, partially cut away, perspective view of a further embodiment of a unit cell of a printhead.

The heater element 10 is configured to accommodate thermal expansion in a specific manner. As heater elements expand, they will deform to relieve the strain. Elements such as that shown in FIGS. 76 and 77 will bow out of the plane of lamination because its thickness is the thinnest cross sectional dimension and therefore has the least bending resistance. Repeated bending of the element can lead to the formation of cracks, especially at sharp corners, which can ultimately lead to failure. The heater element 10 shown in FIGS. 78 and 79 is configured so that the thermal expansion is relieved by rotation of the bubble nucleation section 158, and slightly splaying the sections leading to the electrodes 15, in preference to bowing out of the plane of lamination. The geometry of the element is such that miniscule bending within the plane of lamination is sufficient to relieve the strain of thermal expansion, and such bending occurs in preference to bowing. This gives the heater element greater longevity and reliability by minimizing bend regions, which are prone to oxidation and cracking.

Figure 80:
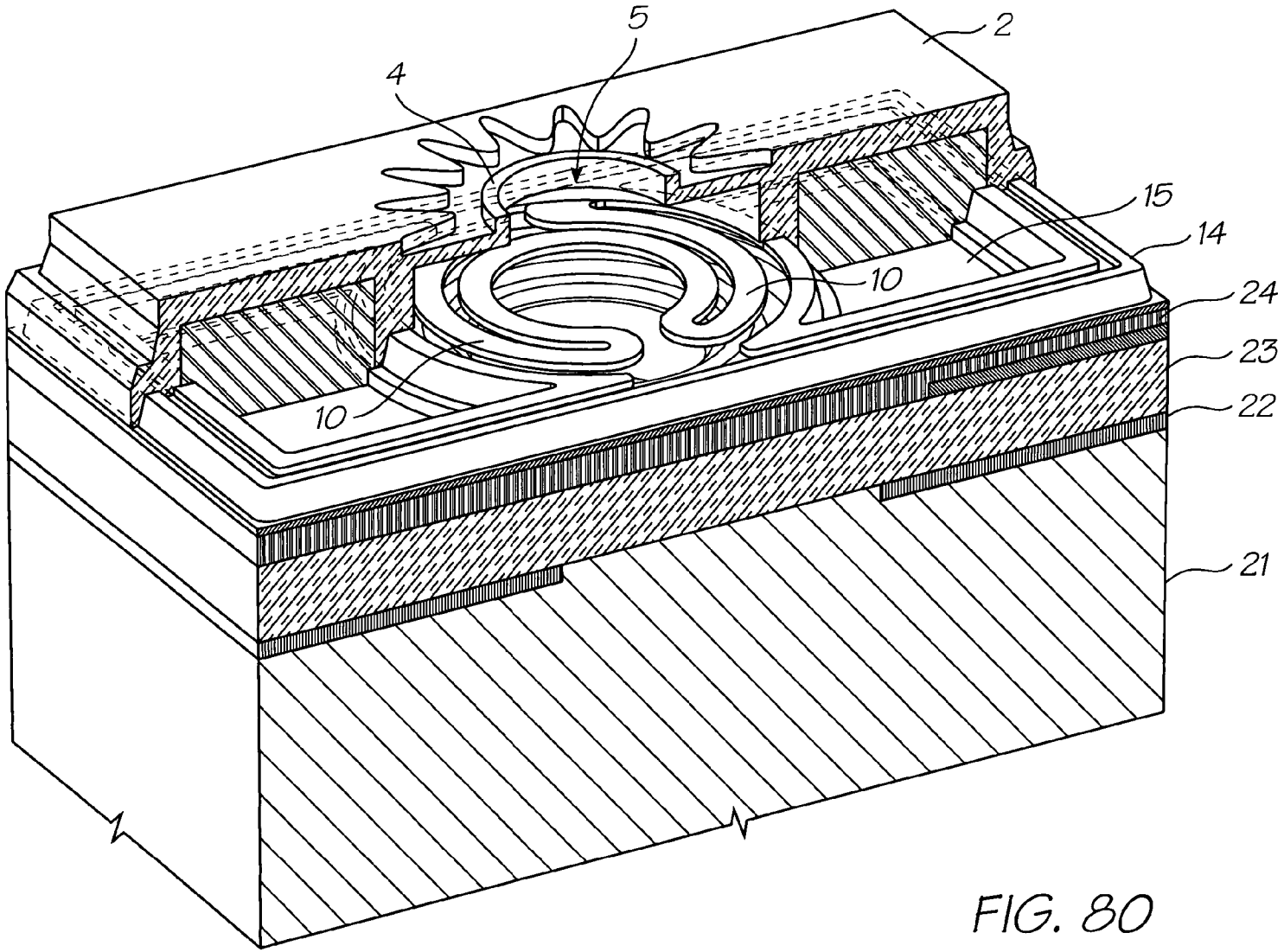
FIG. 80 is a schematic, partially cut away, perspective view of a further embodiment of a unit cell of a printhead.
Figure 81:
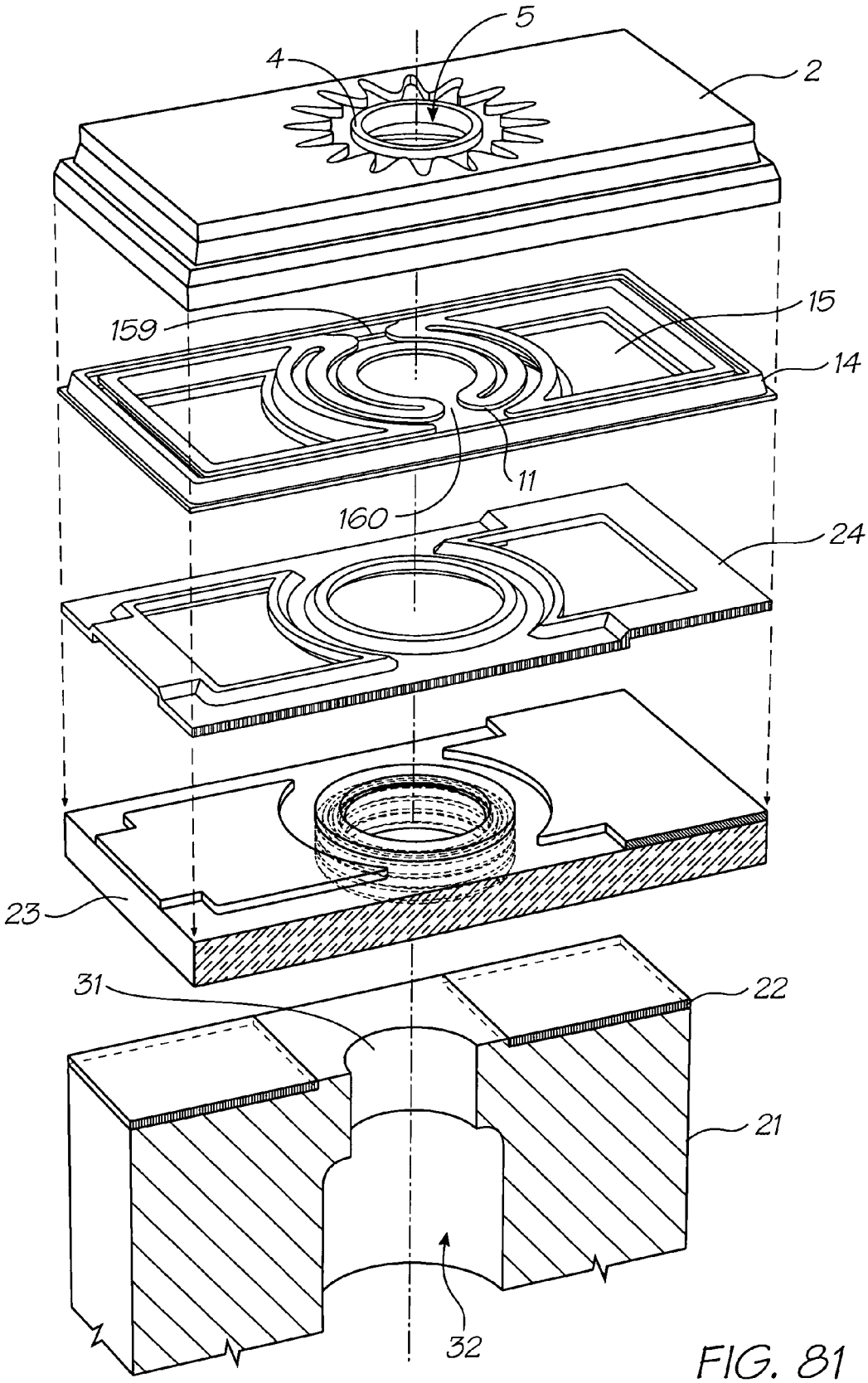
FIG. 81 is a schematic, partially cut away, exploded perspective view of the unit cell of FIG. 80.

Referring to FIGS. 80 and 81, the heater element 10 used in this unit cell 1 has a serpentine or 'double omega' shape. This configuration keeps the gas bubble centered on the axis of the nozzle. A single omega is a simple geometric shape which is beneficial from a fabrication perspective. However the gap 159 between the ends of the heater element means that the heating of the ink in the chamber is slightly asymmetrical. As a result, the gas bubble is slightly skewed to the side opposite the gap 159. This can in turn affect the trajectory of the ejected drop. The double omega shape provides the heater element with the gap 160 to compensate for the gap 159 so that the symmetry and position of the bubble within the chamber is better controlled and the ejected drop trajectory is more reliable.

Figure 82:
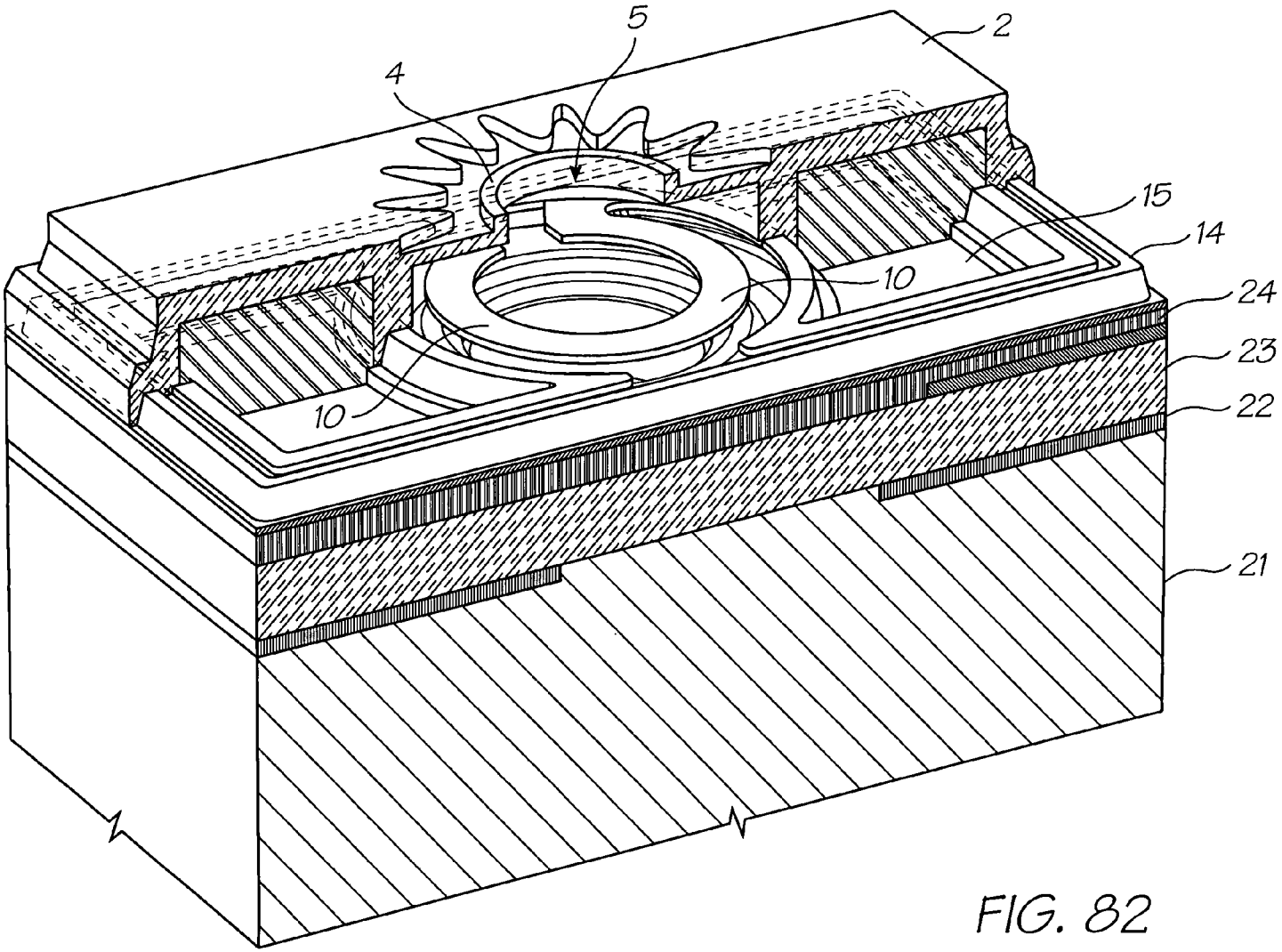
FIG. 82 is a schematic, partially cut away, perspective view of a further embodiment of a unit cell of a printhead.
Figure 83:
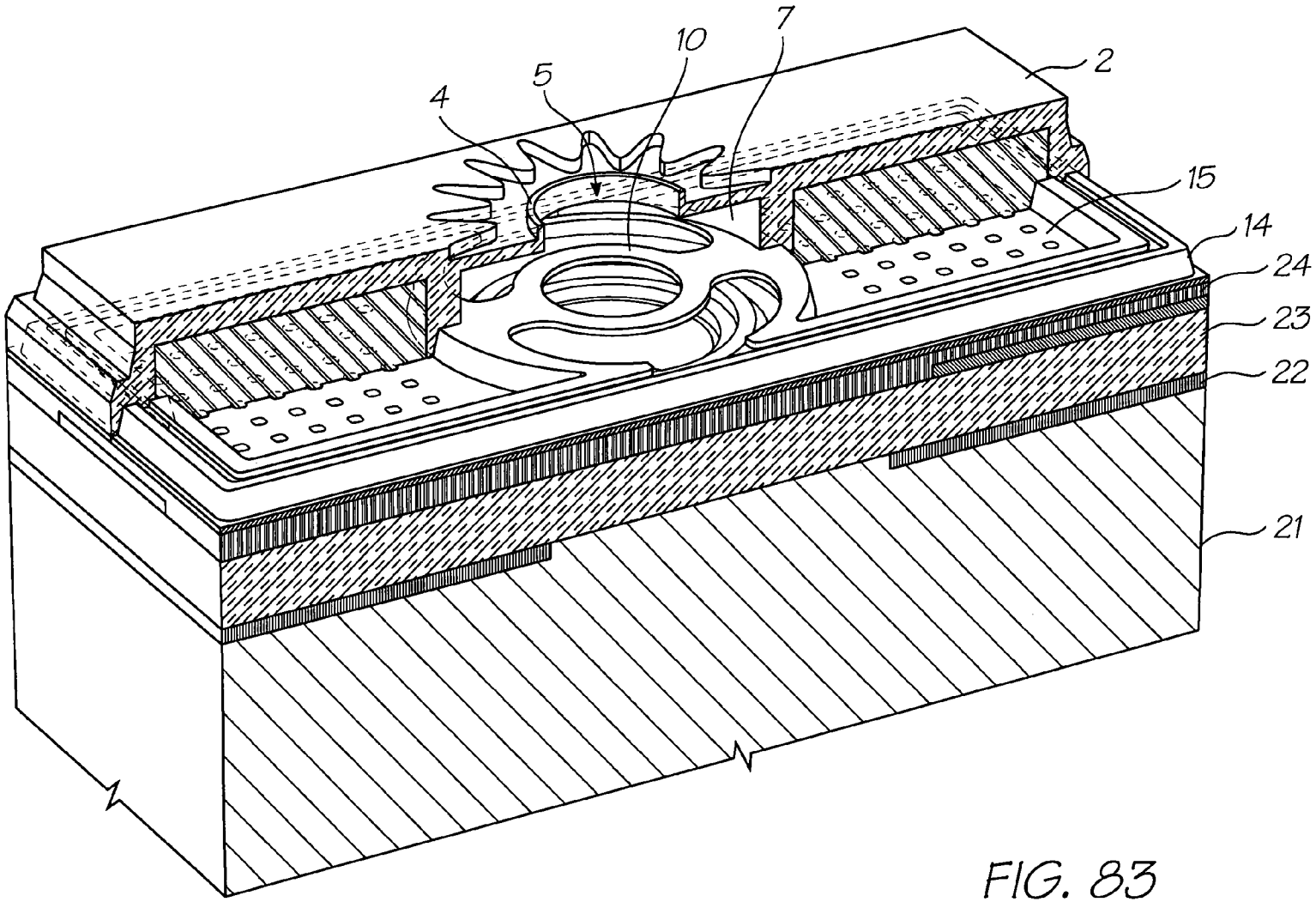
FIG. 83 is a schematic, partially cut away, perspective view of a further embodiment of a unit cell of a printhead.

FIG. 82 shows a heater element 10 with a single omega shape. As discussed above, the simplicity of this shape has significant advantages during lithographic fabrication. It can be a single current path that is relatively wide and therefore less affected by any inherent inaccuracies in the deposition of the heater material. The inherent inaccuracies of the equipment used to deposit the heater material result in variations in the dimensions of the element. However, these tolerances are fixed values so the resulting variations in the dimensions of a relatively wide component are proportionally less than the variations for a thinner component. It will be appreciated that proportionally large changes of components dimensions will have a greater effect on their intended function. Therefore the performance characteristics of a relatively wide heater element are more reliable than a thinner one.

The omega shape directs current flow around the axis of the nozzle aperture 5. This gives good bubble alignment with the aperture for better ejection of drops while ensuring that the bubble collapse point is not on the heater element 10. As discussed above, this avoids problems caused by cavitation.

Figure 97:
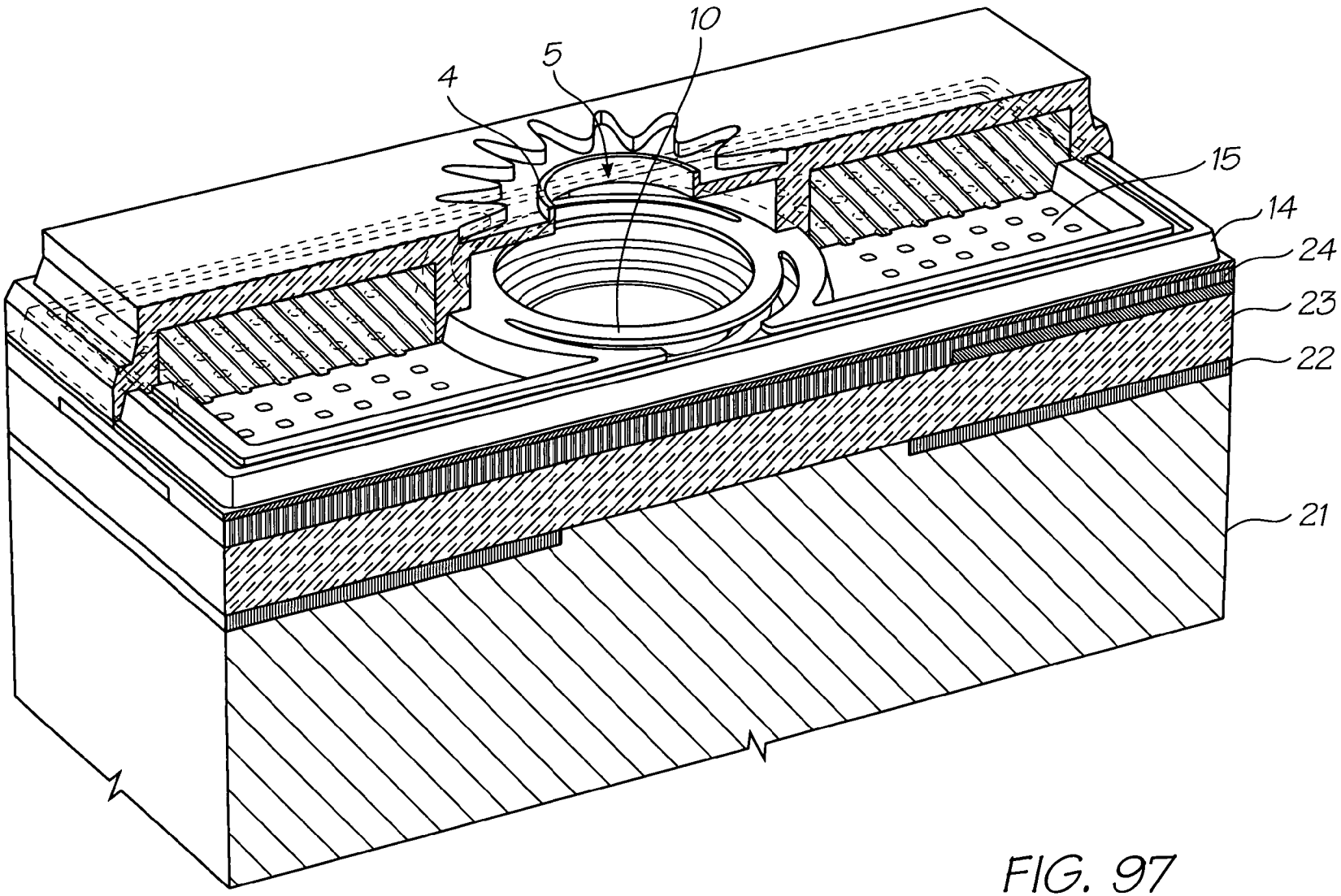
Figure 98:
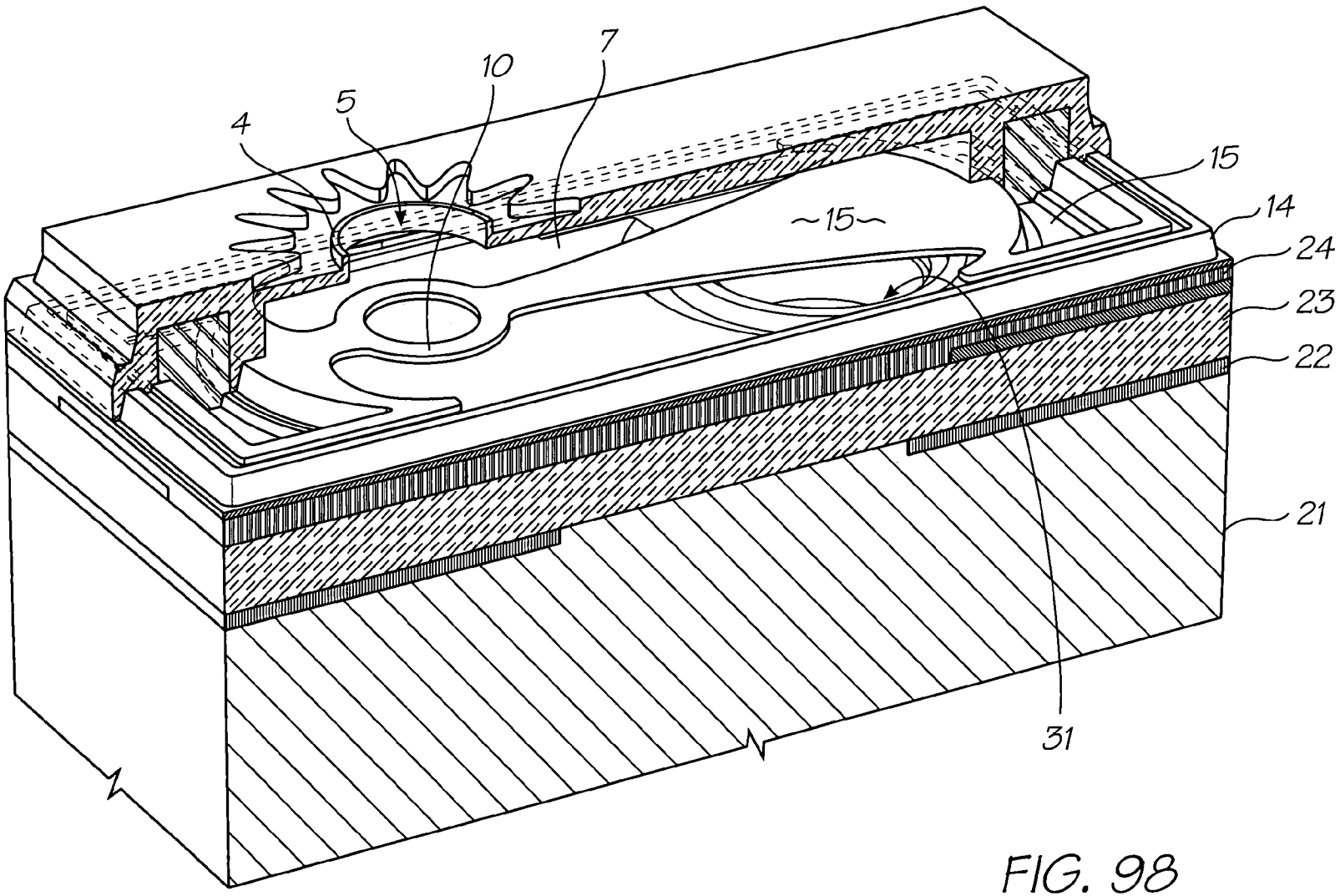
FIG. 98 is a schematic, partially cut away, perspective view of a further embodiment of a unit cell of a printhead.

Referring to FIGS. 83 to 96, another embodiment of the unit cell 1 is shown together with several stages of the etching and deposition fabrication process. In this embodiment, the heater element 10 is suspended from opposing sides of the chamber. This allows it to be symmetrical about two planes that intersect along the axis of the nozzle aperture 5. This configuration provides a drop trajectory along the axis of the nozzle aperture 5 while avoiding the cavitation problems discussed above. FIGS. 97 and 98 show other variations of this type of heater element 10.

FIG. 98 shows a unit cell 1 that has the nozzle aperture 5 and the heater element 10 offset from the centre of the nozzle chamber 7. Consequently, the nozzle chamber 7 is larger than the previous embodiments. The heater 14 has two different electrodes 15 with the right hand electrode 15 extending well into the nozzle chamber 7 to support one side of the heater element 10. This reduces the area of the vias contacting the electrodes which can increase the electrode resistance and therefore the power losses. However, laterally offsetting the heater element from the ink inlet 31 increases the fluidic drag retarding flow back through the inlet 31 and ink supply passage 32. The fluidic drag through the nozzle aperture 5 comparatively much smaller so little energy is lost to a reverse flow of ink through the inlet when a gas bubble form on the element 10.

Figure 99:
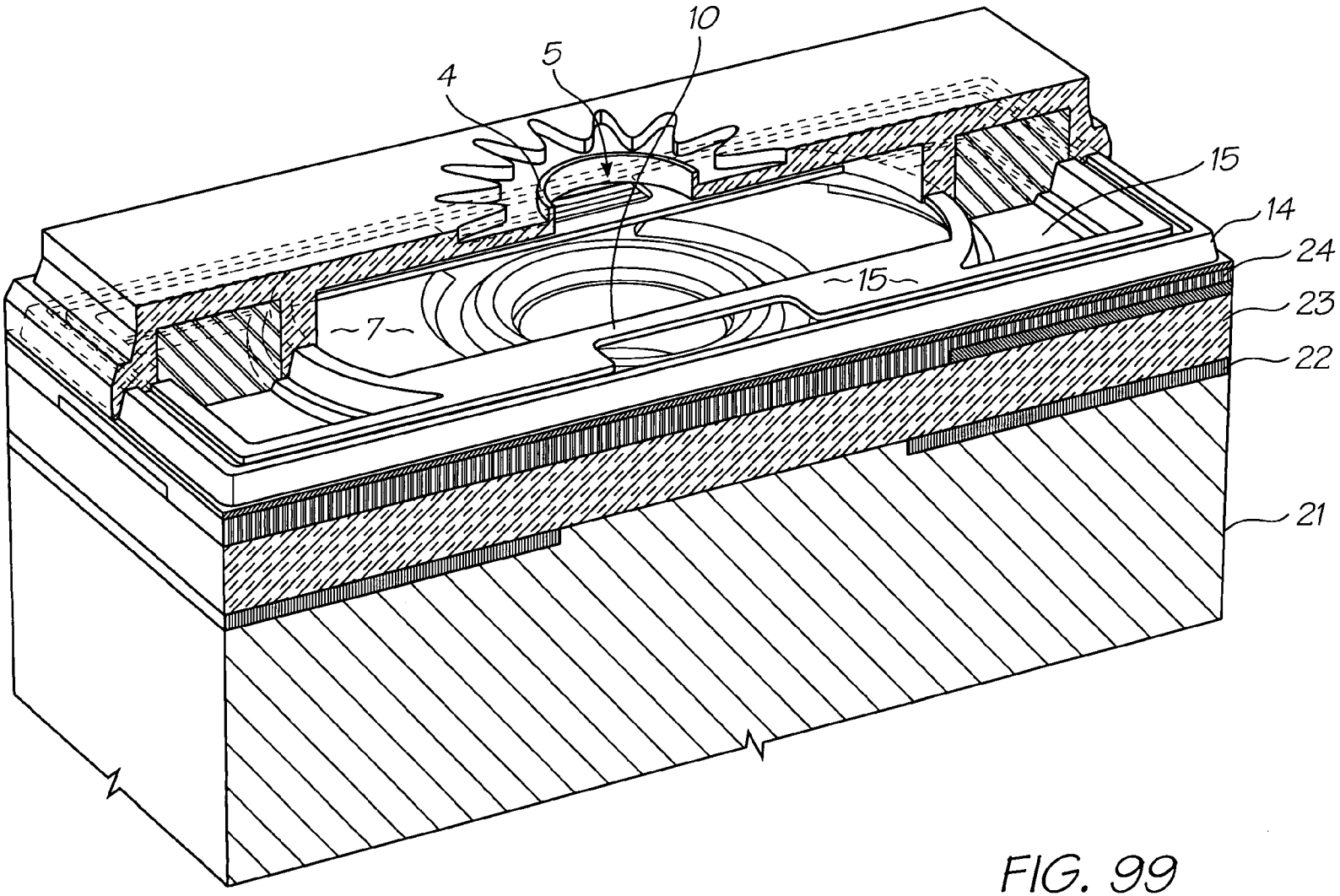
FIG. 99 is a schematic, partially cut away, perspective view of a further embodiment of a unit cell of a printhead.

The unit cell 1 shown in FIG. 99 also has a relatively large chamber 7 which again reduces the surface area of the electrodes in contact with the vias leading to the interconnect layer 23. However, the larger chamber 7 allows several heater elements 11 offset from the nozzle aperture 5. The arrangement shown uses two heater elements 10; one on either side of the chamber 7. Other designs use three or more elements in the chamber. Gas bubbles nucleate from opposing sides of the nozzle aperture and converge to form a single bubble. The bubble formed is symmetrical about at least one plane extending along the nozzle axis. This enhances the control of the symmetry and position of the bubble within the chamber 7 and therefore the ejected drop trajectory is more reliable.

Although the invention is described above with reference to specific embodiments, it will be understood by those skilled in the art that the invention may be embodied in many other forms. For example, although the above embodiments refer to the heater elements being electrically actuated, non-electrically actuated elements may also be used in embodiments, where appropriate.

The invention claimed is:

1. An inkjet printhead comprising:

a plurality of nozzles;

a bubble forming chamber corresponding to each of the nozzles respectively, the bubble forming chambers adapted to contain ejectable liquid; and, a heater element disposed in each of the bubble forming chambers respectively, the heater element configured for direct contact with the ejectable liquid to heat some of the ejectable liquid above its boiling point to form a gas bubble that causes the ejection of a drop of the ejectable liquid from the nozzle; wherein, the heater element is formed from a material with a nanocrystalline composite structure, wherein said material comprises silicon in an atomic concentration of from 5% to 20%.

2. An inkjet printhead according to claim 1 wherein the nanocrystalline composite has one or more nanocrystalline phases embedded in an amorphous phase.

3. An inkjet printhead according to claim 2 wherein at least one of the nanocrystalline phases is a transition metal nitride or a transition metal silicide.

4. An inkjet printhead according to claim 2 wherein the amorphous phase is non-metallic.

5. An inkjet printhead according to claim 2 wherein the amorphous phase is a nitride, a carbide, carbon or an oxide.

6. An inkjet printhead according to claim 5 wherein the nitride is:

silicon nitride; or aluminium nitride;

the carbide is:

silicon carbide; and, the oxide is;

silicon oxide; or aluminium oxide.

7. An inkjet printhead according to claim 1 wherein the transition metal is one of Ti, Ta, W, Ni, Zr, Cr, Hf, V, Nb, or Mo.

8. An inkjet printhead according to claim 1 wherein the heater element is formed from TiAlSiN.

9. An inkjet printhead according to claim 8, wherein said heater element comprise substantially equal proportions of Ti and Al.

10. An inkjet printhead according to claim 1 further comprising a MEMS fluid sensor for detecting the presence or otherwise of the ejectable liquid in the chamber, the MEMS fluid sensor having a MEMS sensing element formed of conductive material having a resistance that is a function of temperature, the MEMS sensing element having electrical contacts for connection to an electrical power source for heating the sensing element with an electrical signal; and control circuitry for measuring the current passing through the sensing element during heating of the sensing element; such that, the control circuitry is configured to determine the temperature of the sensing element from the known applied voltage, the measured current and the known relationship between the current, resistance and temperature.

11. An inkjet printhead according to claim 1 further comprising a print engine controller to control the ejection of drops from each of the nozzles such that it actuates any one of the heaters to eject a keep-wet drop if the interval between successive actuations of that heater reaches a predetermined maximum; wherein during use, the density of dots on the media substrate from the keep-wet drops, is less than 1:250 and not clustered so as to produce any artifacts visible to the eye.

12. An inkjet printhead according to claim 1 wherein the heater element is formed from a self passivating transition metal nitride.

13. An inkjet printhead according to claim 1 wherein the heater element is bonded on one side to the chamber so that the gas bubble forms on the other side which faces into the chamber, and the chamber has a dielectric layer proximate the side of the heater element bonded to the chamber; wherein the dielectric layer has a thermal product less than 1495 Jm−2K−1s−½, the thermal product being (ρCk)½, where ρ is the density of the layer, C is specific heat of the layer and k is thermal conductivity of the layer.

14. An inkjet printhead according to claim 1 wherein the heater element configured for receiving an energizing pulse to form the gas bubble that causes the ejection of a drop of the ejectable liquid from the nozzle; wherein during use, the energizing pulse has a duration less than 1.5 micro-seconds (μs) and the energy required to generate the drop is less than the capacity of the drop to remove energy from the printhead.

15. An inkjet printhead according to claim 1 wherein the planar surface area of the heater element is less than 300 $\mu m^2$.

16. An inkjet printhead according to claim 1 wherein the heater element is separated from the nozzle by less than 5 μm at their closest points;

the nozzle length is less than 5 μm; and the ejectable liquid has a viscosity less than 5 cP.

* * * * *